US008993826B2

(12) United States Patent
Assenov

(10) Patent No.: US 8,993,826 B2
(45) Date of Patent: Mar. 31, 2015

(54) NANO FLEX HLW/SPENT FUEL RODS RECYCLING AND PERMANENT DISPOSAL

(71) Applicant: Dimitre S. Assenov, Salt Lake City, UT (US)

(72) Inventor: Dimitre S. Assenov, Salt Lake City, UT (US)

( * ) Notice: Subject to any disclaimer, the term of this patent is extended or adjusted under 35 U.S.C. 154(b) by 288 days.

(21) Appl. No.: 13/646,365

(22) Filed: Oct. 5, 2012

(65) Prior Publication Data

US 2013/0197293 A1 Aug. 1, 2013

Related U.S. Application Data

(60) Provisional application No. 61/632,865, filed on Feb. 1, 2012.

(51) Int. Cl.
*G21F 9/34* (2006.01)
*G21F 9/30* (2006.01)
*G21F 9/16* (2006.01)

(52) U.S. Cl.
CPC ..... *G21F 9/302* (2013.01); *G21F 9/162* (2013.01); *G21F 9/34* (2013.01)
USPC ..... 588/14; 588/12

(58) Field of Classification Search
USPC ..... 588/14, 10, 11, 12
See application file for complete search history.

(56) References Cited

U.S. PATENT DOCUMENTS

| | | | | |
|---|---|---|---|---|
| 5,667,339 | A | 9/1997 | Dash | |
| 6,258,994 | B1 | 7/2001 | Jantzen et al. | |
| 6,342,650 | B1 | 1/2002 | Valfells | |
| 6,734,334 | B2 | 5/2004 | Chekhmir et al. | |
| 7,663,014 | B2 * | 2/2010 | Krekeler et al. | 588/13 |
| 7,825,288 | B2 * | 11/2010 | Chekhmir et al. | 588/11 |

FOREIGN PATENT DOCUMENTS

WO 86/02770 5/1986

OTHER PUBLICATIONS

United States Patent and Trademark Office, "International Search Report and Written Opinion," mailed Nov. 5, 2013, in related PCT application No. PCT/US2013/024232.

* cited by examiner

*Primary Examiner* — Edward Johnson
(74) *Attorney, Agent, or Firm* — Durham Jones & Pinegar Intellectual Property Law Group

(57) ABSTRACT

Methods for converting toxic waste, including nuclear waste, to quasi-natural or artificial feldspar minerals are disclosed. The disclosed methods may include converting, chemically binding, sequestering and incorporating the toxic waste into quasi-natural or artificial Feldspar minerals. The quasi-natural or artificial feldspar minerals may be configured to match naturally occurring materials at a selected disposal site. Methods for the immediate, long term, quasi-permanent disposal or storage of quasi natural or artificial feldspar materials are also disclosed.

20 Claims, 36 Drawing Sheets

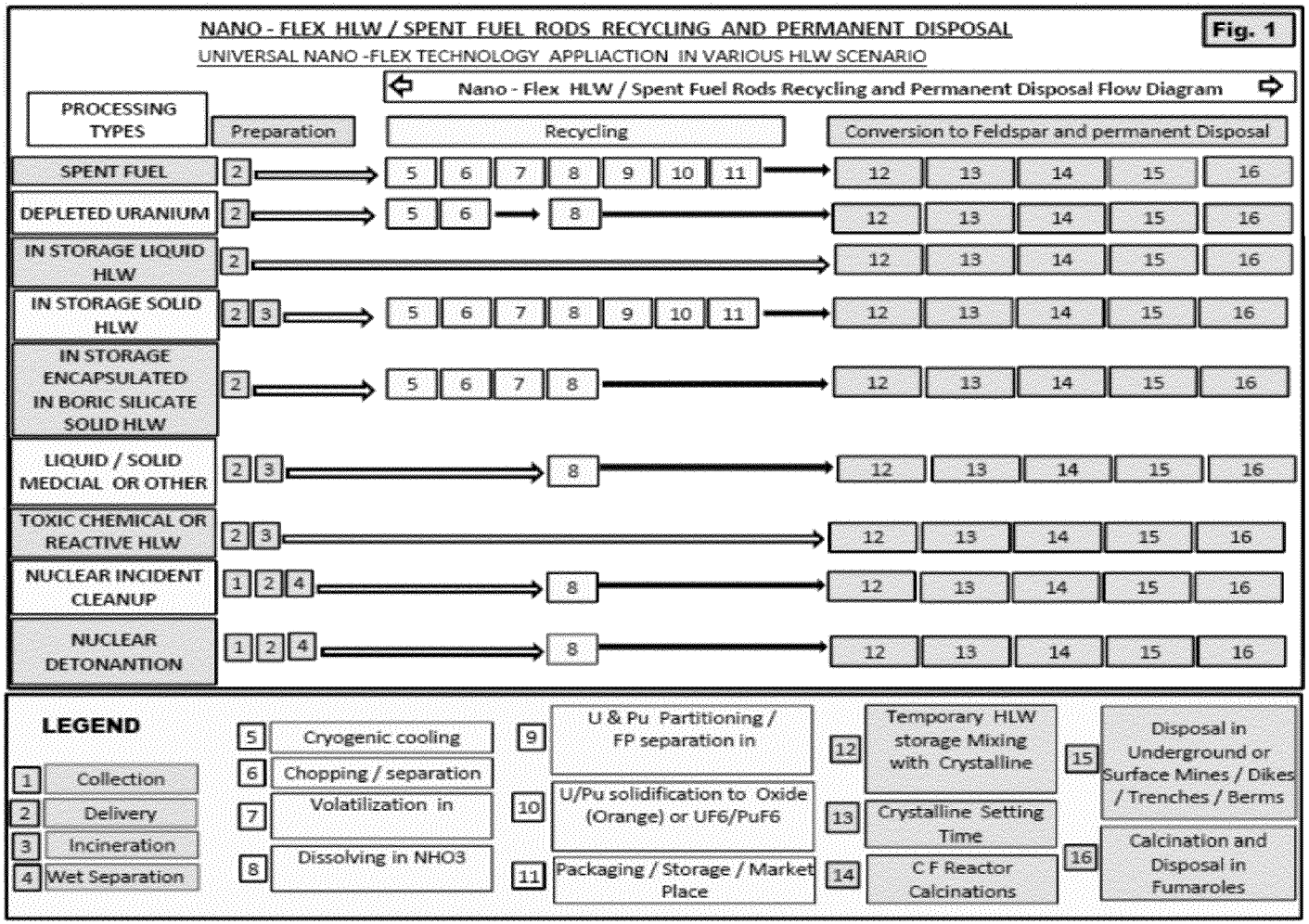
Fig. 1
NANO - FLEX HLW / SPENT FUEL RODS RECYCLING AND PERMANENT DISPOSAL
UNIVERSAL NANO-FLEX TECHNOLOGY APPLIACTION IN VARIOUS HLW SCENARIO
Nano - Flex HLW / Spent Fuel Rods Recycling and Permanent Disposal Flow Diagram
PROCESSING TYPES
Preparation
Recycling
Conversion to Feldspar and permanent Disposal
SPENT FUEL
DEPLETED URANIUM
IN STORAGE LIQUID HLW
IN STORAGE SOLID HLW
IN STORAGE ENCAPSULATED IN BORIC SILICATE SOLID HLW
LIQUID / SOLID MEDCIAL OR OTHER
TOXIC CHEMICAL OR REACTIVE HLW
NUCLEAR INCIDENT CLEANUP
NUCLEAR DETONANTION
LEGEND
1 Collection
2 Delivery
3 Incineration
4 Wet Separation
5 Cryogenic cooling
6 Chopping / separation
7 Volatilization in
8 Dissolving in NHO3
9 U & Pu Partitioning / FP separation in
10 U/Pu solidification to Oxide (Orange) or UF6/PuF6
11 Packaging / Storage / Market Place
12 Temporary HLW storage Mixing with Crystalline
13 Crystalline Setting Time
14 C F Reactor Calcinations
15 Disposal in Underground or Surface Mines / Dikes / Trenches / Berms
16 Calcination and Disposal in Fumaroles

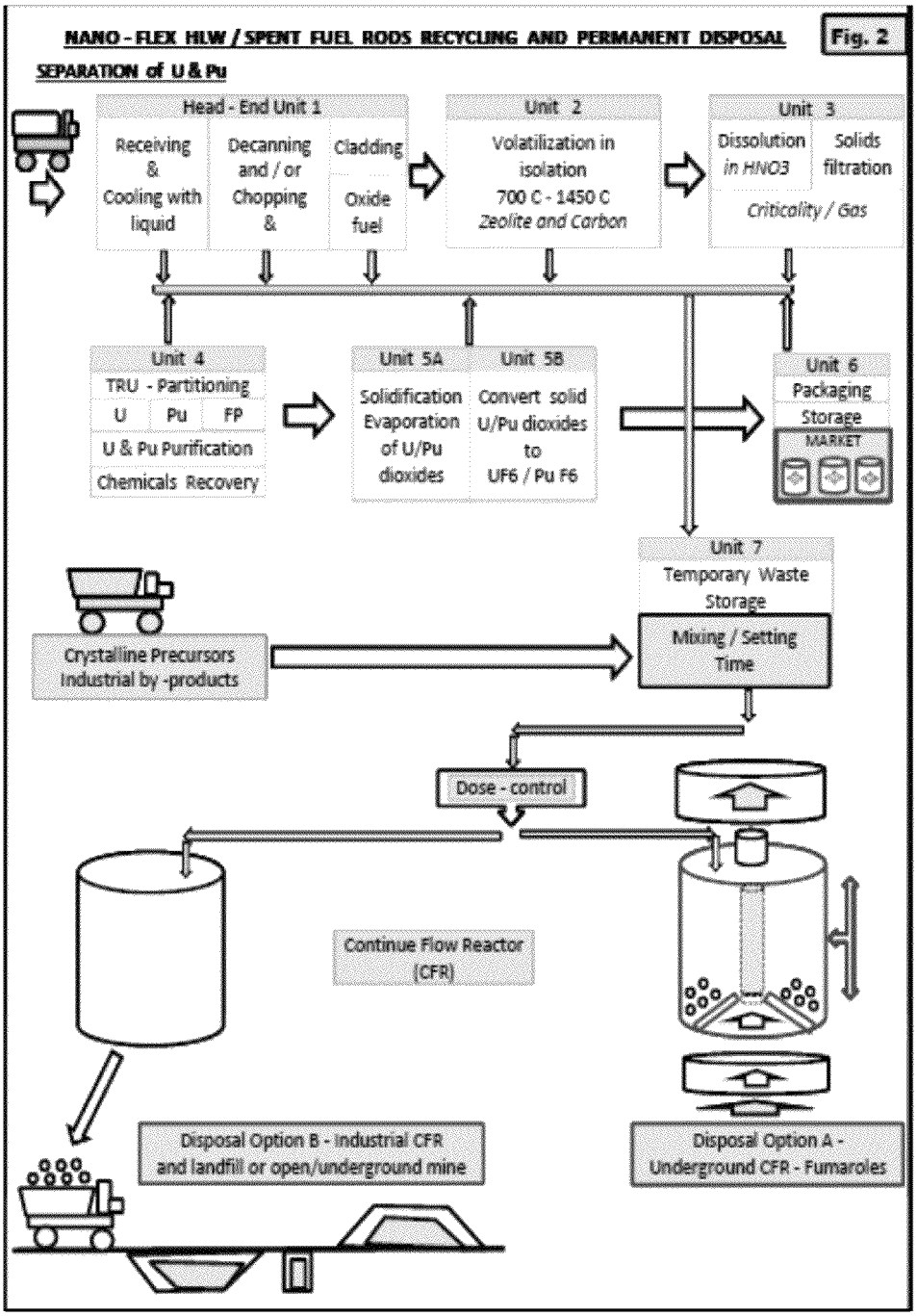
NANO - FLEX HLW / SPENT FUEL RODS RECYCLING AND PERMANENT DISPOSAL
Fig. 2
SEPARATION of U & Pu
Head - End Unit 1
Receiving & Cooling with liquid
Decanning and / or Chopping &
Cladding
Oxide fuel
Unit 2
Volatilization in isolation
700 C - 1450 C
Zeolite and Carbon
Unit 3
Dissolution in HNO3
Solids filtration
Criticality / Gas
Unit 4
TRU - Partitioning
U
Pu
FP
U & Pu Purification
Chemicals Recovery
Unit 5A
Solidification Evaporation of U/Pu dioxides
Unit 5B
Convert solid U/Pu dioxides to UF6 / Pu F6
Unit 6
Packaging
Storage
MARKET
Unit 7
Temporary Waste Storage
Mixing / Setting Time
Crystalline Precursors Industrial by -products
Dose - control
Continue Flow Reactor (CFR)
Disposal Option B - Industrial CFR and landfill or open/underground mine
Disposal Option A - Underground CFR - Fumaroles

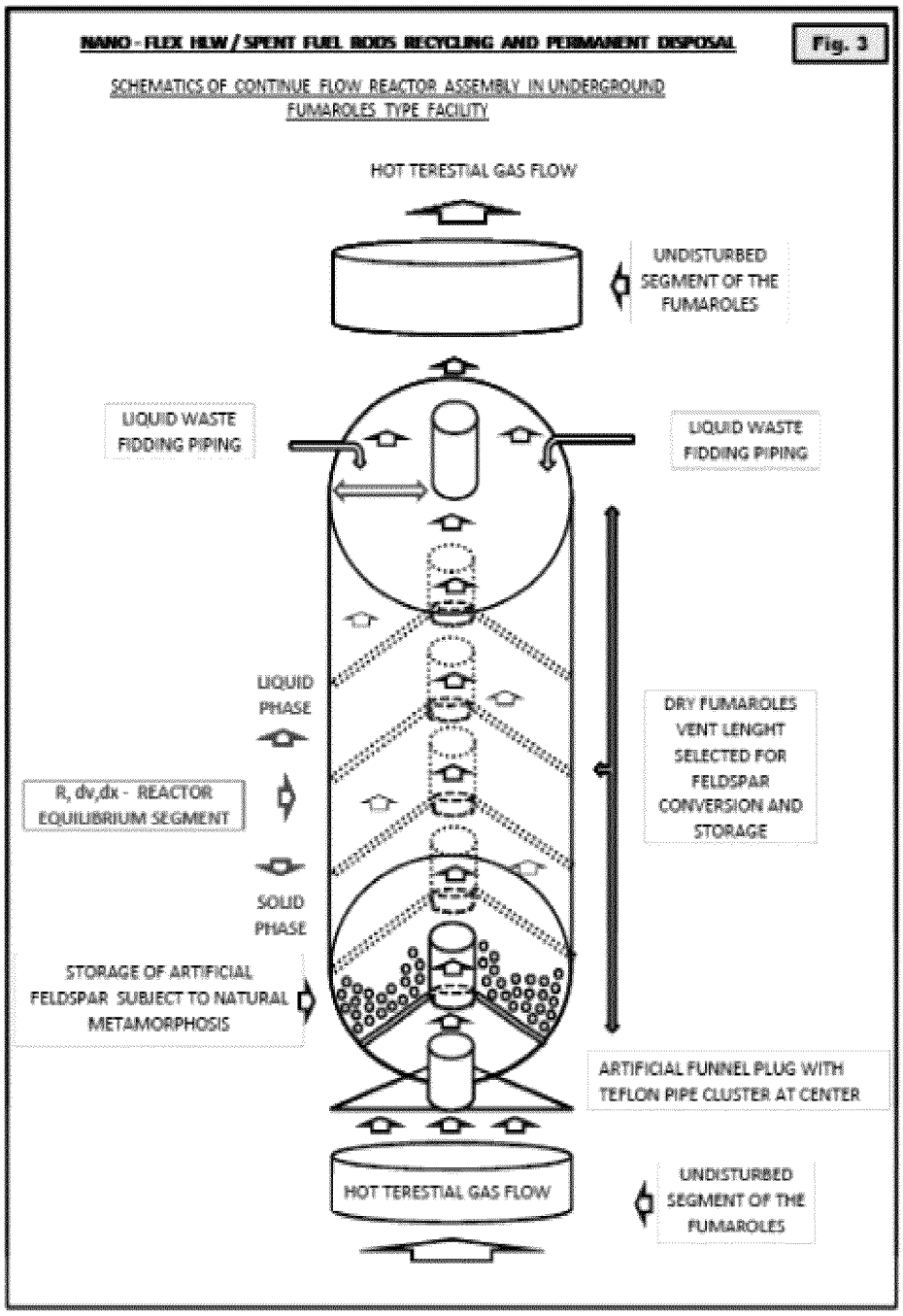
NANO - FLEX HLW / SPENT FUEL RODS RECYCLING AND PERMANENT DESPOSAL
Fig. 3
SCHEMATICS OF CONTINUE FLOW REACTOR ASSEMBLY IN UNDERGROUND FUMAROLES TYPE FACILITY
HOT TERESTIAL GAS FLOW
UNDISTURBED SEGMENT OF THE FUMAROLES
LIQUID WASTE FIDDING PIPING
LIQUID WASTE FIDDING PIPING
LIQUID PHASE
R, dv,dx - REACTOR EQUILIBRIUM SEGMENT
SOLID PHASE
DRY FUMAROLES VENT LENGHT SELECTED FOR FELDSPAR CONVERSION AND STORAGE
STORAGE OF ARTIFICIAL FELDSPAR SUBJECT TO NATURAL METAMORPHOSIS
ARTIFICIAL FUNNEL PLUG WITH TEFLON PIPE CLUSTER AT CENTER
HOT TERESTIAL GAS FLOW
UNDISTURBED SEGMENT OF THE FUMAROLES

NANO - FLEX HLW / SPENT FUEL RODS RECYCLING AND PERMANENT DISPOSAL

Fig. 4.1

SCHEMATICS OF GRAVITY SEPARATOR / SOLIDS FILTRATION APPARATUS

VERTICAL CROSS - SECTION

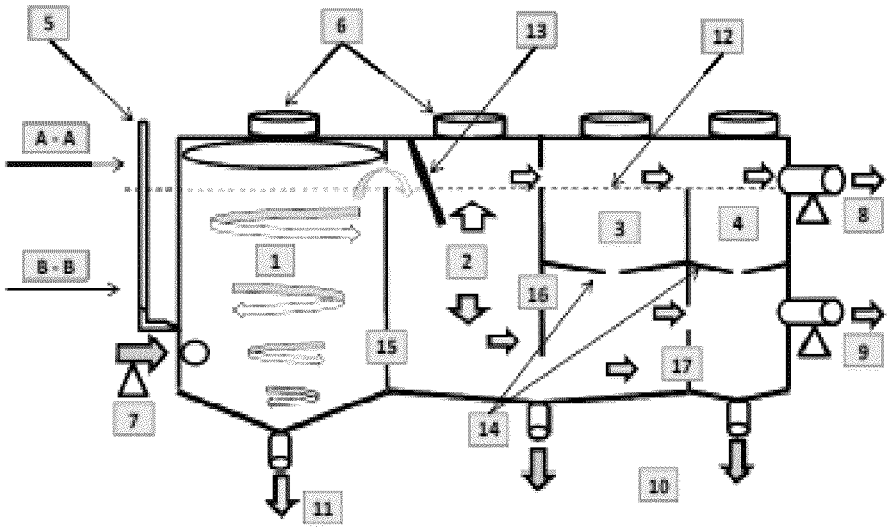

LEGEND

| | | |
|---|---|---|
| 1 | > | Swirl Chamber |
| 2 | > | Gravity Separation Chamber |
| 3 and 4 | > | screen chambers |
| 5 | > | Piezometer |
| 6 | > | Access lids |
| 7 | > | Inlet pipe with Flow Valve |
| 8 | > | Organic solution outlet pipe with Flow Valve |
| 9 | > | Aqueous solution outlet pipe with Flow Valve |
| 10 | > | Back to inlet pipes - maintain the hydraulic High Flow Control (12) |
| 11 | > | Un dissolved solids outlet |
| 12 | > | Hydraulic High Flow Control level |
| 13 | > | Circular geometry screen shell |
| 14 | > | Conical screen with opening at the lowest central point |
| | > | Organic / Aqueous mix phase |
| | > | Aqueous phase |
| | > | Organic phase |
| 15 | > | Separation wall between Swill and Gravity Separation Chamber with opening for free overflowing |
| 16 | > | Separation wall between Gravity Separation and first Screen Chambers with 2 openings - upper for organic phase overflow; large low for aqueous phase flow |
| 17 | > | Separation wall between long Screen chamber (3) and short Screen Chamber with 2 opening - upper for organic phase overflow; lower for aqueous phase flow |
| A - A | > | Horizontal cross sections |

Fig. 4.2
NANO - FLEX HLW / SPENT FUEL RODS RECYCLING AND PERMANENT DISPOSAL
SCHEMATICS OF GRAVITY SEPARATOR / SOLIDS FILTRATION APPARATUS
HORIZONTAL CROSS - SECTIONS
HORIZONTAL CROSS - SECTION A - A
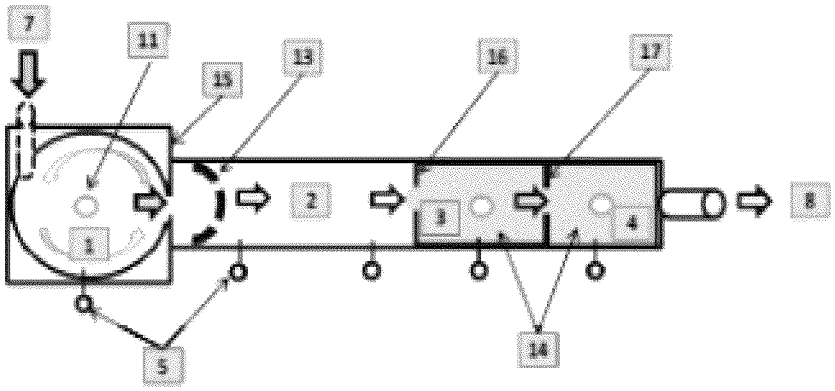
HORIZONTAL CROSS - SECTION B - B
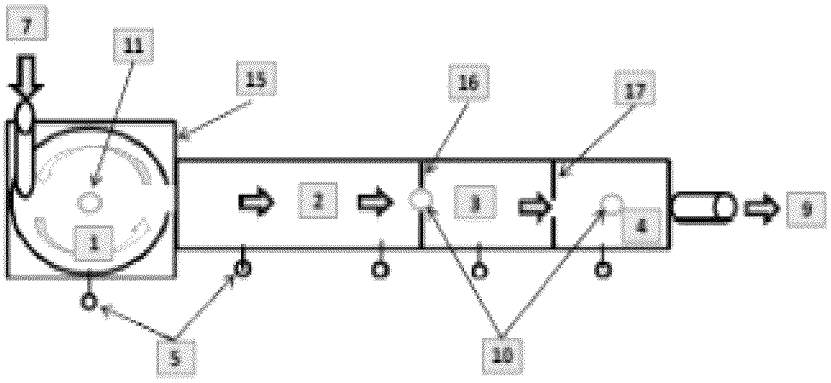

Reference - Aquatic Chemistry - An introduction Emphasizing Chemical Equilibria in Natural Waters - Werner Stumm & James J. Morgan - 1981 Canada Represent solubility and saturation relationship at concentration ranges versus pH for supersaturated, metastable, saturated and undersaturated solutions

Reference - Chemical Reactor Kinetics
Principle of Continue Flow Reactor

Reference - Rock & MInerals of the World - Charles A. Sorrel, George F. Sandstrom - St. James's place, London

Reference - Chemistry of Elements (2nd ed) - Oxford - Norman Greenwood, Alan Earshaw - 1997

Reference - Processing of Used Nuclear Fuel - World Nuclear Association

Reference - Nuclear Chemical Engineering - Manson Benedict, Thomas Pigford, McGraw - Hill

Reference - Rock & MInerals of the World - Charles A. Sorrel, George F. Sandstrom - St. James's place, London

Reference - Rock & MInerals of the World - Charles A. Sorrel, George F. Sandstrom - St. James's place, London

Reference - Rock & MInerals of the World - Charles A. Sorrel, George F. Sandstrom - St. James's place, London

Reference - Rock & MInerals of the World - Charles A. Sorrel, George F. Sandstrom - St. James's place, London

Reference - Rock & Minerals of the World - Charles A. Sorrel, George F. Sandstrom - St. James's place,

Reference - Feldspars - phase relations, optical properties, geologic distribution - Moskow 1962

Reference - Rock & MInerals of the World - Charles A. Sorrel, George F. Sandstrom - St. James's place,

Reference - Encyclopedia Britannica Inc. 1968 London

Reference - Rock & MInerals of the World - Charles A. Sorrel, George F. Sandstrom - St. James's place,

Reference - Rock & MInerals of the World - Charles A. Sorrel, George F. Sandstrom - St. James's place, London

Reference - Aquatic Chemistry - An introduction Emphasizing Chemical Equilibria in Natural Waters - Werner Stumm & James J. Morgan - 1981 Canada Represent solubility and saturation relationship at concentration ranges versus pH for supersaturated, metastable, saturated and undersaturated solutions

Reference - Aquatic Chemistry - An introduction Emphasizing Chemical Equilibria in Natural Waters - Werner Stumm & James J. Morgan - 1981 Canada Represent solubility correlation of various chemical elements, including heavy ones in combination with Potassium (in case of Potasium Feldspar)

Reference - Aquatic Chemistry - An introduction Emphasizing Chemical Equilibria in Natural Waters - Werner Stumm & James J. Morgan - 1981 Canada Represent hydrolisis of metal ions related to pH of the medium in relation to ion size(diameter) and the distance from the Oxygen atom

Reference - Aquatic Chemistry - An introduction Emphasizing Chemical Equilibria in Natural Waters - Werner Stumm & James J Morgan 0 1981 Canada Represent solubility of metal carbonates in a closed system

Reference - Aquatic Chemistry - An introduction Emphasizing Chemical Equilibria in Natural Waters - Werner Stumm & James J. Morgan - 1981 Canada Represent solubiluty from formed in the atmosphere conditions hydrocarbonates form CO2 in the air

Reference - Aquatic Chemistry - An introduction Emphasizing Chemical Equilibria in Natural Waters - Werner Stumm & James J. Morgan - 1981 Canada - Represent solubility of axydes and hydroxides

Reference - Aquatic Chemistry - An introduction Emphasizing Chemical Equilibria in Natural Waters - Werner Stumm & James J. Morgan - 1981 Canada - Represent solubility of simple salts as function of concentration

Reference - Aquatic Chemistry - An introduction Emphasizing Chemical Equilibria in Natural Waters - Werner Stumm & James J. Morgan - 1981 Canada - Represent cumulative frequency distribution in terrestrial water

Reference - Aquatic Chemistry - An Introduction Emphasizing Chemical Equilibria in Natural Waters - Werner Stumm & James J. Morgan - 1981 Canada - Represent importatnt element in natural waters, occurence and concentration

FIG. 31

| | 1 | 2 | 3 | 4 | 5 | 6 | 7 | 8 | 9 | 10 | 11 |
|---|---|---|---|---|---|---|---|---|---|---|---|
| | Stream | Stream | Stream | Lake Erie | Ground-water | Ground-water | Ground-water | Ground-water | Ground-water | Ground-water | Closed-Basin Lake |
| | | | | | Gabbro | | | | | | |
| | Granite | Quartzite | Sandstone[b] | | Granite | Plagioclase | Sandstone | Shale | Limestone | Dolomite | Soda Lake |
| pH | 7.0 | 6.6 | 8.0 | 7.7 | 7.0 | 6.8 | 8.0 | 7.3 | 7.0 | 7.9 | 9.6 |
| pNa | 4.0 | 4.6 | 4.3 | 3.4 | 3.4 | 3.0 | 3.3 | 2.6 | 3.0 | 3.5 | 0.0 |
| pK | 4.7 | 5.1 | 4.8 | 4.3 | 4.0 | 4.5 | 4.0 | 4.2 | 3.7 | — | 1.7 |
| pCa | 4.0 | 4.3 | 3.1 | 3.0 | 3.5 | 3.1 | 3.0 | 2.5 | 2.7 | 2.8 | 4.5 |
| pMg | 4.6 | 5.1 | 4.0 | 3.4 | 3.8 | 3.2 | 3.5 | 2.5 | 3.4 | 2.8 | 4.6 |
| $pH_4SiO_4$ | 3.8 | 4.2 | 4.1 | 4.7 | 3.2 | 3.0 | 3.9 | 3.5 | 3.7 | 3.4 | 2.8 |
| $pHCO_3$ | 3.6 | 4.0 | 2.9 | 2.7 | 2.9 | 2.5 | 2.6 | 2.1 | 2.3 | 2.2 | 0.4 |
| pCl | 5.3 | 5.8 | 5.3 | 3.6 | 4.0 | 3.5 | 3.7 | 4.0 | 3.2 | 3.3 | 0.3 |
| $pSO_4$ | 4.5 | 4.7 | 3.7 | 3.6 | 4.2 | 4.0 | 3.2 | 2.2 | 3.4 | 4.7 | 2.0 |
| −log (ionic strength) | 3.5 | 3.8 | 2.7 | 2.5 | 2.8 | 2.4 | 2.4 | 1.7 | 2.2 | 2.2 | 0.0 |

Reference - Aquatic Chemistry - An introduction Emphasizing Chemical Equilibria in Natural Waters - Werner Stumm & James J. Morgan - 1981 Canada - Represnet water properties of continental USA streans

Reference -Rapid Decay in Single Radionuclide for Atomic Nucleus

Reference -Rapid Decay in Single Radionuclide for Atomic Nucleus Represent "packing" in solids

Reference -Rapid Decay in Single Radionuclide for Atomic Nucleus
Represent molecular motion related to temperature

Reference -Rock & MInerals of the World - Charles A. Sorrel, George F. Sandstrom - St. James's place, London
Represent crystalization transition from solid solutions to aqueous solution related to temperature

NANO FLEX HLW/SPENT FUEL RODS RECYCLING AND PERMANENT DISPOSAL

CROSS-REFERENCE TO RELATED APPLICATION

This application claims the benefit of priority, under 35 U.S.C. §119(e), to U.S. Provisional Patent Application No. 61/632,865, titled NANO FLEX HLW/SPENT FUEL RODS RECYCLING AND PERMANENT DISPOSAL, which was filed on Feb. 1, 2012 ("the '865 Provisional Application"). The entire disclosure of the '865 Provisional Application is, by this reference, hereby incorporated herein.

TECHNICAL FIELD

This disclosure resolves all issues related to produced liquid waste, in storage consolidated HLW, depleted uranium, isotope byproducts, nuclear disasters and cleanup after nuclear detonation, toxic chemical or reactive HLW, via converting, in a controlled environment, all of the above to a very low radiation level quasi-natural or artificial Feldspar minerals, and immediately and permanently disposing of the latter. The radiation level of the product is controlled so as to achieve a level matching or below the selected disposal location. This disclosure achieves an efficient flow of the technological process, and includes simplified liquid to liquid separation of U and Pu in the Vortex apparatus, enhanced with cryogenic cooling and Volatilization in isolation gas isotope separation. The Vortex apparatus is very simple and safe to operate; the disclosure is used for the separation of Uranium & Plutonium from other TRU isotopes, including all undissolved metal particles; it requires no power and has no moving parts. Upon separation, all collected dry and liquid HLW are converted into a very low radiation level quasi-natural or artificial Feldspar minerals. It is recommended that the separation process be performed at the same site where the Feldspar will be disposed, avoiding all issues and concerns of waste transportation and handling. The Production flow diagram includes the use of mobile detachable interconnected production units placed under soil berms temporary burial, thereby replacing the entire existing reprocessing flow schematics of building very heavy and expensive for deployment, use and decommissioning industrial facilities—permitting use at multiple sites and almost no-cost decommissioning—only 9% of parts are highly irradiated and will be converted to very low radiation level quasi-natural or artificial Feldspar minerals, and permanently disposed on the same site.

BIBLIOGRAPHY

Nuclear Chemical Engineering—Manson Benedict, Thomas Pig ford, McGraw-Hill.

Nuclides and isotopes—Chart of nuclides—GE 14th edition.

The Rocks & Minerals of the World—Charles A. Sorrel, George F. Sandstrom, St James's place, London.

Aquatic Chemistry—An introduction Emphasizing Chemical Equilibria in Natural Waters—Warner Srumn—Professor EAWAG Swiss Institute of Technology, James J. Morgan—professor California Institute of Technology; Second Edition 1981—John Wiley & Sons Inc.

Waste Classification—10 CFR 61.55.

Rapid Decay in Single Radionuclide for Atomic Nucleus.

Nuclear Reactor Physics.

Processing of Used Nuclear Fuel—World Nuclear Association.

Purex Process, European Nuclear Society.

Nuclear Wastes—Technologies for Separation and Transmutation—1996, National Cacademy of Science.

Chemistry of the Elements ($2^{nd}$ ed)—Oxford—Norman Greeenwood, Alan Earnshaw—1997.

Overwiew of the Hydrometallurgical and pyro-metallurgical Process Srudied Worldwide for the Partitioning of Hygh Active Nuclear Waste—Charles Madic—Spain, Madrid 2000.

Feldspar dissolution at 25 C and low pH (American Journal of Science—February 1996, Vol. 296, p 101-127).

Natural Mineral Degradation—Deer, W. A, Howie R. A. and Zussman J—Moskow 1966.

Feldspars—phase relations, optical properties, geologic distribution—Moskow 1962.

Army Corps of Engineers—Properties of Fly Ash.

NISTIR 5598—Compositional Analysis of Beneficiated Fly Ash.

Definition of mineral and chemical composition of Fly Ash—2007 WOCA, May 2007 Northern Kentucky.

Conversion of Fly Ash into Mesophorous Aluminosilicate 1999 American Chemical Society.

Geochemical Evolution of Fly Ash Leachate pH—November 2010, White Paper, Urbana, Ill.

Chemical Reaction of Fly Ash—Department of Civil engineering, University of Twente, the Netherlands.

Correlation between Chemical composition of Fly Ash Stockpiles and their Suitability for Geopolymer related Construction products—Louisiana Tech University.

Mining and Fortification—Institute of Mining and Geology, Sofia, 1970—Patronev collapsing cone—ref. to sealing cone collapsing determination in mining shafts.

Chemical reactor kinetics—reactor schematics.

Chemical Kinetics—Richard M Noyes, University of Oregon.

Nuclear energy—Advance Reactor Schematics—www-.nuclear.energy.gov.

BACKGROUND OF THIS INVENTION

Reprocessing of either spent nuclear fuel, weapon material, entire Uranium (U) or Plutonium (Pu) enrichment, or other variety of isotope production results in liquid waste production. Existing technology requires, that these liquid wastes must be reduced in volume, and consolidated to permit presumably "safe disposal"—storage and safeguarding for an unknown, infinite period of time "until new sustainable technical invention resolve all safety and biohazard issues." The current practice is to dehydrate the liquid waste by heating, then to consolidate the residue by either calcinations or vitrification.

SUMMARY OF THE INVENTION

The disclosure facilitates conversion of all existing and future liquid/solid HLW to very low radiation level quasi-natural or artificial Feldspar minerals, which will be deposited in natural formations, where they will be processed and broken down by natural metamorphosis processes. In other way explained this disclosure end the needs of building and maintaining HLW deep underground repository facilities. Feldspar minerals consist of over 50% of the Earth crust (Lunar crust and also found in meteorites), and geologically were, and currently are, the natural carriers of a very wide range of natural isotopes (Ref. to Technical Report). All existing technologies in use today are creating more environmental issues and are not able to resolve permanently any of the HLW problems, by repeating the common mistake of producing new product, which cannot be absorbed in nature—major requirement for building very expensive deep underground HLW repository facilities. It is important to point out that during 4.5 billion years, planet Earth is a closed system that does not gain or lose any components in the matrix. All materials including isotopes are transitioned from one form to other, via a well-known process of natural mineral metamorphosis. Utilizing this natural process is the only solution to all existing safety and biohazard HLW issues.

The principle objectives in this disclosure is immobilizing by chemical binding, sequestering and incorporating the nuclear waste in trace amounts, into very low radiation level quasi-natural or artificially produced Feldspar minerals, and dispose them in natural formations. The disposed very low radiation level quasi-natural or artificial Feldspar minerals are matching, or are below the selected disposal sites' natural radiation level, and combined with specific targeted properties, are preventing the hazard of isotope transport. Once deposited these Feldspar minerals will naturally mutate as the host minerals, via natural mineral metamorphosis. Compared to the uranium ore extraction process, the disclosed process is 25,000 times more efficient (example: the biggest Brazilian uranium mine in Caetite at 0.252% randeman (metal to virgin ore), requires to process 125,000 kg ore for 1 kg of uranium (U208)). This disclosure converts the remaining HLW of each kg of processed (recycled) spent fuel/any type HLW into 5 kg or less, very low radiation level quasi-natural or artificial Feldspar minerals.

BRIEF DESCRIPTION OF THE DRAWINGS

In the drawings, which depict various aspects of the disclosed subject matter in several figures and views:

FIG. 1 is a diagram depicted various aspects of the disclosed subject matter used in various scenarios for disposing of nuclear waste and other types of toxic waste.

FIG. 2 is a flow diagram depicting an embodiment of a process for separating uranium and plutonium from remaining waste materials, conversion of the remaining waste materials into artificial feldspar minerals and disposing of the artificial feldspar minerals.

FIG. 3 is a schematic representation of apparatus for enabling continuous flow reactions in a natural, underground fumerole.

FIG. 4.1 is a front view of a separation apparatus that includes a vortex and other elements for separating undissolved solids in a liquid waste material, an organic phase (uranium and plutonium) of the liquid waste material and an aqueous phase of the liquid waste material.

FIG. 4.2 depicts two cross sections through the separation apparatus of FIG. 4.1.

FIGS. 29-31 are charts showing properties of various elements and the forms (e.g., in molecules, as ions, etc.) in which they are present in natural waters.

BRIEF DESCRIPTION OF THE TABLES

Figure 5:
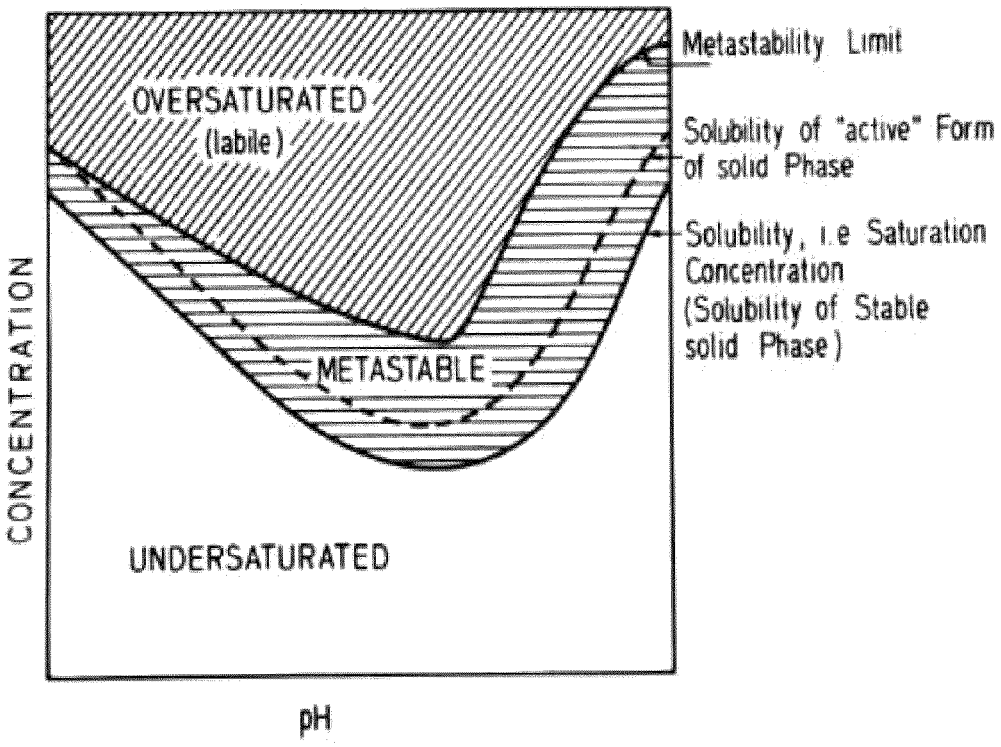
FIGS. 5 and 22 are solubility and saturation charts from Aquatic Chemistry, Sec. 2.18—Equilibria and Rates.

TABLE 1 Isotopes constituents in Uranium Fuel discharged form PWR.

TABLE 2 Isotopes constituents in HLW after reprocessing of Uranium Fuel discharged form PWR.

TABLE 3 Long-lived Isotopes constituents in HLW after reprocessing of Uranium Fuel discharged from PWR.

TABLE 4 Calculated Isotopes amount and radiation for quasi-natural or artificial very low radiation Level Feldspar for 5 kg-10 kg-50 kg-100 kg mix.

TABLE 5 Natural Isotope minerals.

TABLE 6 Nano-Flex Experimental Protocol for disposal after 10 years decay.

TABLE 7 Chemical properties of Isotopes.

TABLE 8 Radiation value/Isotopes content in 5 kg of quasi-natural or artificial Feldspar.

DETAILED DESCRIPTION

FIG. 1—Universal Nano-Flex Technology Application in Various HLW Scenario.

The diagram presents the universal application of the Nano-Flex process in all possible HLW applications.

SPENT FUEL—the process applies for recycling and conversion to quasi-natural or artificial very low radiation level Feldspar and its quazi-permanent disposal and long term storage of any type of spent reactor fuel. Detailed explanation for particular segment of the process is provided in other sections and enclosures of this disclosure and the enclosed Technical Report. The process consists of the following steps:

Delivery

Cryogenic cooling of fuel assembly

Chopping/Separation of fuel from cladding

Volatilization in isolation at 1450 C—gas/heat emission isotopes separation

Dissolution in nitric acid

Undissolved solids separation (Vortex apparatus)

U & Pu Partitioning and Fission Products (FP) separation (Vortex apparatus)

Separation of U from Pu, when required

U/Pu solidification (orange salt)

U/Pu conversion to UF6/PuF6 (Green salt)

Temporary storage of remaining HLW sludge

Mixing with crystalline precursors

Crystalline setting time
Calcification in Continuous Flow Reactor (CFR)
Conversion of artificial Feldspar to pellets/other solid form
Disposal—possible at any location. Cost effective recommended locations:
a) Fumaroles vents
b) Underground old mine facilities
c) Open mine pit
d) Dikes, Berms, Trenches DEPLETED URANIUM—process for conversion of depleted uranium metal to quasi-natural or artificial very low radiation level Feldspar and its quazi-permanent disposal and long term storage. Detailed explanation for the particular segment of the process is provided in other sections/enclosures of this disclosure. The process consists of the following steps:
Delivery
Cryogenic cooling
Chopping
Dissolution in nitric acid
Undissolved solids separation (Vortex apparatus)
Temporary storage of remained HLW sludge
Mixing with crystalline precursors
Crystalline setting time
Calcification in CFR
Conversion of artificial Feldspar to pellets/other solid form
Disposal
a) Fumaroles vents
b) Underground old mine facilities
c) Open mine pit
d) Dikes, Berms, Trenches IN STORAGE LIQUID HLW—process for conversion of any stored liquid HLW into quasi-natural or artificial very low radiation level Feldspar and its quazi-permanent disposal and long-term storage. Detailed explanation for the particular segment of the process is provided in other sections/enclosures of this disclosure. The processes consists of the following steps:
Delivery
Temporary storage of remaining HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles vents
b) Underground old mine facilities
c) Open mine pit
d) Dikes, Berms, Trenches INSTORAGE SOLID HLW—process for conversion of any in storage solid HLW into quasi-natural or artificial very low radiation level Feldspar and its quazi-permanent disposal and long term storage. Detailed explanation for the particular segment of the process is provided in other sections/enclosures of this disclosure. The processes consists of the following steps:
Delivery
Cryogenic cooling
Chopping/Separation if requires
Volatilization in isolation at 1450 C—gas/heat emission isotopes separation
Dissolution in nitric acid
Undissolved solids separation (Vortex apparatus)
U & Pu Partitioning and FP separation (Vortex apparatus)
Separation of U from Pu, if required
U/Pu solidification (orange salt)
U/Pu conversion to UF6/PuF6 (Green salt)
Temporary storage of remaining HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches IN STORAGE ENCAPSULATED IN BORIC SILICATE SOLID HLW OR OTHER FORM OF ENCAPSULATION—process for conversion of any encapsulated in boric silicate HLW in storage, or other form of encapsulation, into quasi-natural or artificial very low radiation level Feldspar and its quazi-permanent disposal and long term storage. Detailed explanation for the particular segment of the process is provided in other sections/enclosures of this disclosure. The processes consists of the following steps:
Delivery
Cryogenic cooling
Chopping/Separation if requires
Volatilization in isolation at 1450 C—gas/heat emission isotopes separation
Dissolution in nitric acid
Undissolved solids separation (Vortex apparatus)
Temporary storage of remained HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches LIQUID MEDICAL OR OTHER CLASSIFIED HLW—process for conversion of any medical or other classified HLW into quasi-natural or artificial very low radiation level Feldspar and its quazi-permanent disposal and long term storage. Detailed explanation for particular segment of the process is provided in other sections/enclosures of this disclosure. The processes consists of the following steps:
Delivery
Incineration
Dissolution in nitric acid
Undissolved solids separation (Vortex apparatus)
Temporary storage of remained HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches TOXIC CHEMICAL OR REACTIVE HLW—process for conversion of any toxic chemical or reactive HLW into quasi-natural or artificial very low radiation level Feldspar and its quazi-permanent disposal and long term storage. Detailed explanation for particular segment of the process is provided in other sections/enclosures of this disclosure. The processes consists of the following steps:

Delivery
Temporary storage of remained HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches NUCLEAR INCIDENT CLEANUPS—process for conversion of any collected from nuclear incident cleanups HLW into quasi-natural or artificial very low radiation level Feldspar and its quazi-permanent disposal and long term storage. Detailed explanation for particular segment of the process is provided in other sections/enclosures of this disclosure. The processes consists of the following steps:

Collection
Delivery
Soil wet separation/blending
Dissolution in nitric acid
Undissolved solids separation (Vortex apparatus)
Temporary storage of remained HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches NUCLEAR DETONATION—process for conversion of any collected from nuclear detonation cleanups HLW into quasi-natural or artificial very low radiation level Feldspar and its quazi-permanent disposal and long term storage. Detailed explanation for particular segment of the process is provided in other sections/enclosures of this disclosure. The processes consists of the following steps:

Collection
Delivery
Soil wet separation/blending
Dissolution in nitric acid
Undissolved solids separation (Vortex apparatus)
Temporary storage of remained HLW sludge
Mixing with crystalline precursors
Crystalline setting time
Calcification in CFR
Conversion of artificial Feldspar to pellets/other solid form
Disposal—possible at any location. Cost effective recommended locations:
a) Fumaroles
b) Underground old mine facilities
c) Open mine pit
d) Dikes, Berms, Trenches FIG. 2—Flow Diagram for Uranium and Plutonium Separation, Conversion of Remaining HLW into Very Low Radiation Level Artificial Feldspar Minerals, and Immediate Permanent Disposal of the Latest.

The inscription in the different boxes of the block diagrams, each box representing a process step, have the following meanings:

Unit 1

Receiving dock for canisters, carrying spent fuel rod assemblies, depleted uranium, solid or liquid HLW—spent fuel requires transfer jackets.

Liquid Nitrogen Cooling chamber.

Decanning and/or chopping fuel assembly with transfer cutting.

Separation of cladding from fuel—vertical shakers (assembly/cladding) and reverse direction shakers (fuel).

Chopping the fuel to size not greater than 4 mm.

Unit 2

Volatilization in isolation chamber—heating in inert atmosphere at 1450 C—separation of all volatile gas isotopes and 50% of heat emitting isotopes—requires Zeolite and Carbon multi level filtering.

Unit 3

Dissolution of oxide fuel in nitric acid ($HNO_3$) in concentration of ca.7 mol. dm-3. Active filtering and criticality control required. All vapors are subject to active condensation before final filtering. Use of hot nitric acid speeds the process.

Solid separation—separation of all undisclosed solids from the aqueous phase.

Unit 4

TRU partitioning—rapid vigorous mixing of aqueous phase with organic solvent—33% TBP and kerosene, and 67% aqueous solution.

Separation of U and Pu from FP—shortly after discontinuing mixing the solution separated by gravity into two phases—lighter upper (organic) containing TBP, kerosene and nitrates of U and Pu, and—heavy lower (aqueous) with nitrates of Trans uranium isotopes (TRU). The process is accomplished by letting the solution rest for 45 minutes.

Extraction of U and Pu by gravity extraction into organic phase (U and Pu) and aqueous phase (TRU). If required, the cycle of Separation and Extraction could be repeated, which will extract all of U and Pu. The remaining aqueous phase containing Trans Uranic (TRU) undergoes nitric acid recovery (for reuse). The process of U/Pu gravity extraction, combined with solids separation is performing in a self-controlled, specifically designed, free of power or moving parts, Vortex apparatus.

Separation of U and Pu from TBP/kerosene—back extraction by striping of U and Pu from TBP/kerosene into nitric acid at concentration ca.02 mol. dm-3 (solvent extraction). TBP and kerosene undergo recovery process (for re-use).

Separation of U from Pu (if required)—treating kerosene solution with ferrous sulphamate, reduces the Pu to the +3 oxidation state. As result the Pu passes into an aqueous phase and U remains in the kerosene phase. U is extracted from kerosene with nitric acid at ca.0.2 mol·dm-3 following reduction to uranium dioxide.

Unit 5A

Solidification of the U/Pu mixture or U and Pu separately into a dry orange salt—dehydration by gradual heating to avoid air pollution.

Unit 5B (in Case of Fumaroles or as Additional Industrial Process).

Convert U and Pu dioxides to UF6 and PUF6 (green salt). In case of U/Pu mixture the process separates U from Pu, due to reaction temperature differences. In case of Fumaroles the Fluorine gas is supplied at no cost. In case of industrial process additional investment for Fluorine gas production/supply is required.

Unit 6

Packaging/temporary storage of all products from UNIT 5A and UNIT 5B for transporting to market place.

Unit 7

All collected from UNIT 1 to UNIT 6 liquid and solid HLW is stored temporary in containers. Criticality control is required.

Pre mixing as per Job Mix Formula (JMF) of liquid and solid HLW with selected industrial byproduct (crystalline precursor). Maturing (Setting) time is requires. Dose control for introducing the mix into Continuous Flow batch reactor (CFR) is required.

CFR

Baking the mixture at determined (d)T and (dP) at equilibrium (dx) and R, for time (dt). Determination of d(T) relates to type and melting temperature of used crystalline precursor. Reactor equilibrium phase transition at time d(t) requires—Liquid>Gas>Solid phase. Formed quasi-natural or artificial Feldspar mineral is cooled. The freshly formed very low radiation level quasi-natural or artificial Feldspar is similar to the natural one, lacking up to 4 molecules of water per unit volume (reference to Bowen Reaction Series).

Disposal Option (A)

In case of Fumaroles vent—bilateral depositing of formed quasi-natural or artificial Feldspars.

Disposal Option B

Cooled quasi-natural or artificial Feldspar minerals are transformed into small pellets/other solid form, for preventing air pollution during disposal.

On site disposal is done in selected underground mine facilities that are currently closed for operation, or open pit mine facilities that are also closed for operation, or Low Level Waste (LLW) landfills such as dikes, trenches and berms. (Since the very low radiation level, quasi-natural or artificial Feldspars can be disposed anywhere, the selection of such facilities as burial site is to avoid excavation cost).

FIG. 3—Schematics of Continuous Flow Reactor Assembly in Underground Fumaroles Type Facility.

Fumaroles vents are very rear, unique natural phenomenon, formed long ago in geological time. With length of several miles, directly connected to solidified magma deep in Earth crust, they breathe hot terrestrial and in most cases radioactive gas. Geometrically well formed, geodynamically stable the Fumaroles vents never appeared on the surface. The schematics represent conversion of selected length of Fumaroles vent into "climbing" type CFR with bilateral disposal of formed quasi-natural or artificial Feldspars. The inventor already has outlined the location of such Fumaroles vent. The following modules are remotely assembled, in ascending order.

Bottom Funnel

This is a simple funnel type, not less than octahedral shape, metal, self-locking, wall climbing structure allowing access to the Fumaroles vent (moving downward is free, mowing upward self locks the legs against the vent walls). At the vent center a cluster of 2" or bigger diameter Teflon made piping duct is installed. The duct's purpose is to keep the vent circulation, and create bilateral storage space for Feldspars.

Each following reactor segment have same type and structure Teflon made central piping duct cluster. Each piping end is equipped with simple self-locking fascia.

First Reactor Cluster

The end of each cluster is self-locking; the upper cluster will lock to the one below. The length of each piping cluster is in the range of 5 meters or less (for easy installation). Since the installation will be done remotely (under video camera surveillance), the only permissible movement will be downward. Each cluster length will be assumed as reactor equilibrium segment (R,dV,dx). Once the space is 75% filled bilaterally, the next piping cluster will be installed. Each cluster will have the same, not less than an octahedral supporting self-locking structure to the wall's metal legs system. The top of each Teflon piping crown will be protected with simple metal folding "shell" type reflective shielding, preventing pipe clogging from accidently falling from above rocs (very rear—details provided in the Technical Report). During installation of the following segment, the shells shall unfold at pressure from down moving next segment (simple "Lego"—open/close operation).

Second to "n−1" Reactor Cluster

According to the production schematics the CFR will be climbing upwards, filling bilateral vent space with low radiation level Feldspars, and simultaneously keeping the vent circulation unchanged and open in the center. Since there is a naturally ascending, naturally established decrease in temperature gradient (vent thermodynamics), all deposited Feldspars will be subject, in upward direction to thermal metamorphosis. Immediately following this process the Feldspars will become solidified slowly, and by gravity increasing the pressure against the walls, respectfully decreasing the gravity friction (Patronev collapsing—cone ref. to Mining and Fortification—sealing cone collapsing determination in mining shafts). Assuming arching/circle geometry, the pressure decreases toward the center of the vent keeping very low pressure to the air circulating Teflon piping in the center (Civil engineering—arch static force diagram distribution). Such production schematics allow the use of one Fumaroles facility, for up to several miles in length. The climbing segment structure is self-sustaining closed system providing excellent conditions of production and depositing of very low radiation level quasi-natural or artificial Feldspars.

"n" Reactor Cluster

The last production CFR cluster will end with 3 to 5 meters piping cluster, not filled with Feldspars. This is to guarantee that after production closure the vent cluster will continue normal terrestrial gas circulation—Teflon piping will provide unlimited lifetime of gas circulation. The top surface of deposited Feldspars will be impregnated with tar or silicon self leveling gel. On the top of the piping cluster a self-locking armored metal funnel will be installed, preventing clogging of the piping from falling rocks (very rare scenario because the continuous process of natural crystallization makes such occurrence very rare—reference to technical report).

FIG. 4—Apparatus for Vortex Gravity Separation of Organic Phase (U and Pu) from Aqueous Pase (TRU) & Separation of Undissolved Solids from the Liquid.

All of the existing equipment used for separation of Uranium and Plutonium (organic phase) from TRU (aqueous phase), has two unresolved deficiencies: a) reliance on forceful separation of the phases, and b) requirement of power supply, maintenance and staff for continuous operation and monitoring. All of the existing processes of forceful separation are not proficient and require repetition to achieve purity of the product. Additionally, there is a high probability of equipment failure. It is imperative to note that this phase of separation has the highest level of liquid radioactivity, gas pollution, is an explosion hazard and has a criticality issue. A new, simple apparatus has been designed to resolve the abovementioned challenges; it requires no power supply and it is self-controlled via an unusual combination of several hydraulic independent processes described below.

Design

Reference the Accompanying Schematics of the Gravity Separator/Solids Filtration Apparatus.

The apparatus consist of 4 inter connected chambers representing 5 different operations. Each chamber is equipped with independent lid/seal type of access for inspections, observations, cleanup and maintenance.

Swirl Chamber (1)

Cylindrical geometry (easy for criticality control) with a sealed-type lid on the top and conical bottom for collecting of all undissolved metal particles in liquid. At the bottom ¼ of the cylinder height, as a tangent is located an inlet pipe for delivering the solution. Since the solution is entering under very low pressure, it will naturally form a vortex, which serves the following purposes: a) centrifugal force of gravity below turbulence, following Stokes law, will split the phases in the solution, and b) the same forces will pull all undissolved metal particles toward the periphery of the cylinder, and precipitate at the bottom of the cylinder. The Vortex at the bottom will aggregate the particles at the lowest point of the cone, into a small, capped chamber, from where they will exit the apparatus. Since the solution is split quickly by the Vortex into two phases, the organic one quickly will rise to the point of high flow control window and overflow into the second chamber.

Note: Before Using, the Apparatus Need to be Filled Initially with Liquid not Less than 75 Percent of the Volume.

Attached outside the wall piezometer will serve as an automatic measuring gauge for the solution level in the cylinder. Once all chambers are filled to the High flow control level, the process of phase separation/solid filtration will continue automatically (via self-regulated hydraulic mechanism) without outside interruption.

Gravity Separation Chamber (2)

Around the overflowing High flow control window, a circular segment geometry screen shell helps with the following: a) to downgrade the flow of the solution, b) separation of the phases, and c) prevention of direct solution flowing toward chamber #3. Since the solution is overflowing slowly (total time of approximately 45 minutes), the phases entering the chamber will continue gravity separation at 100% proficiency. This process is accelerating via width chamber reduction to 50% of the swirl chamber, preventing any turbulent motions in the solution. The wall connecting chamber #3 has two windows, lower one—below the bottom elevation of inlet pipe (chamber #1) for transfer of TRU aqueous solution; and an upper window with matching High Flow control elevation—for transferring the Uranium & Plutonium organic phase.

Screen Chamber (3 and 4)

Chambers 3 and 4 are identical except for one difference—chamber #3 is twice as long as chamber #4. The reason for that is to achieve complete phase separation following Stokes Law hydraulic horizontal and vertical density distribution. At volume distribution of 30/70% are installed conical screens with opening at the lowest central point, serving as an easy downgrade transition of any aqueous phase from the upper section (the screen openings size should not resist upward organic solution passage). Since the disclosure solution design is in the ratio of 33/67%, (organic to aqueous) the chamber volume distribution will serve as a phase splitting point somewhere in the middle of the screens. Each phase will move to chamber #4 via; a) low opening (at the middle of the 70% volume) and b) overflowing at high flow control. The process is repeating in the smaller chamber #4 to achieve 100% phase separation. Each phase exits the apparatus, via outlet pipes. The bottoms of Chamber #2 and #3 are connected into a combined cone. Chamber #4 has a separate conical bottom. Each cone ends with a pipe that reverts any solution back to the inlet pipe serving as hydraulic auto control. Such configuration aids with the following: a) cleaning the apparatus without any liquid leaving the system and b) preventing any possibility of overflowing the High flow controls. It is important to note that gravity separation speed relates to the solution temperature. The apparatus' reverting ability helps in case a temperature adjustment is needed. The apparatus is very simple, easy to operate, without any power supply, moving parts or process controls. Outside each chamber will be installed multiple transparent piezometer, providing automatic measurement of levels of organic and aqueous phases (for precision one piezometer is needed for every 20% fluid volume). The unique design provides an easy and safe operation in any conditions. Overflow is prevented by automatic hydraulic solution level control, connected to double circuit shut-off valves on the inlet pipe (the floatable shut-off is installed inside the piezometer serving the Swirl chamber). Periodic clean up (washing the interior) will be done with drainage from the bottom of Chamber #1, 2-3, and 4 separately. The waste will go directly to the final waste collector storage, for processing in CFR.

Geologic Future of the Fumaroles after Closure

Once the production and disposal of quasi-natural or artificial Feldspars is suspended, the vent access will be sealed. This will reverse the Fumaroles vent to the original natural process, which is as follows:

During hundreds of thousands of years the Fumaroles vent walls are covered with new natural crystalline formations that slowly seal all cracks. Once this is done, the Fumaroles start accelerated (tens of thousands of years geologic time frame) crystalline formation in descending direction. As a result deep in the crust the Fumaroles will be subject to excessive pressure, which causes; a) accelerated internal vent crystalline metamorphosis, and b) new geotectonic fracturing of the host rock following change in rock pressure dynamic equilibrium. This releases the pressure, during the next ten of thousands of years, when the cracks are naturally seal again with new-formed crystals. This process is being repeated for millions of years until the solidified magma deep in the crust is cooled off. Since the magma is already solidified, no volcanic eruption is expected. Such volcanic eruption is expected only after global gravitational change (moving the planet poles to new location, or orbital change), which will reconfigure all tectonic plates—a process that appears every hundreds of millions of years related to change of the galactic position of the Solar system.

A) HLW/Fuel Rods Recycling

This disclosure includes several additional unique processes of liquid-to-liquid separation of Uranium and Plutonium (Ref. to Flow Diagram, FIG. 2).

The first process is cryogenic cooling with liquid nitrogen, or equivalent cooling after the removal of the fuel assembly or HLW from the delivery canister. Cryogenic cooling provides 3 advantages to the existing process of recycling.

The first one is mechanical. It is known that during the irradiation the fuel tends to expand in volume from extreme heat in the reactor core. As a result the Uranium oxide pellets are compressed against the cladding. When added to the heat emission from spent fuel, this makes mechanical removal of the pellets from the assembly very challenging. Cryogenic cooling prior mechanical removal shrinks the assembly rapidly, creating extensive cracking of the cladding and loosening the fuel pellets. This effect increases with additional heat emission removal from the fuel pellets.

The second advantage is chemical. After removal from the delivery canister, the fuel assembly tends to release several gas components (including isotopes). Some of these pose an explosion danger during disassembling of the cladding. Cryogenic cooling with liquid nitrogen or equivalent cooling replaces instantaneously all released gas components, immobilizes the rest, providing a safe environment against possible explosion. Cutting the assembly/cladding in subfreezing environment also minimizes the normal release of fine metal particles in the air. All fine metal particles remain frozen, wet and stuck on the cladding or fuel pellets surface. Their removal via simple washing, during fuel dissolution is much easy and inexpensive, compared to than from air pollution.

The third advantage is a physical. Rapid cryogenic cooling provides significant change in the atomic behavior of the fuel. Initially, the rotation and vibration spin of the electrons/photons in the atom tends to delay and stop. As a result, the freeze in the electron orbit suspends high electromagnetic radiofrequency emission. The Thompson electron energy field in the outer atom orbits disappears. The electrons/photons continue to vibrate while they are in and on-hold orbit position at extreme low kinetic energy level, and low frequencies. Meanwhile, the energy emission of the nuclei affected by the cryogenic cooling continues, creating simple energy unbalance (99.5% of the atom mass is in nuclei). Since the splitting of the nuclei is not possible, the atom enters the only possible mode of so called energy self shielding. The process continues until shortly after the cryogenic cooling is suspended, when the heat level permits the electrons/photons to return to the normal rotation and vibration spin. As a result, the radiation emission energy level drops significantly during the freezing period (the type of radiation remain the same). This provides a much safer environment during assembly, handling and fuel separation (details provided in Technical Report).

The next unique process is Volatilization in isolation of the fuel. The process involves simple heating of the fuel in inert atmosphere at 1450 C. This process is more technically simple to achieve and control, compared to using a vacuum. During this process 100% of all gas isotopes and 50% of heat emission is easily removed—the remaining 50% emitted by Strontium-90 will be removed later during the liquid-to-liquid separation. The following isotopes are removed:

| | | |
|---|---|---|
| 50% of Palladium | (3112 C.) | (boiling temperature reference) |
| 50% of Tellurium | (1012 C.) | |
| 100% of Cesium | (682 C.) | (emits also 50% of total heat from the fuel) |
| 100% of Rubidium | (705 C.) | |
| 100% of Silver | (2163 C.) | |
| 100% of Iodine | (183 C.) | |
| 100% of Tritium | (100 C.) | |
| 100% of Krypton | (−153 C.) | |
| 100% of Xenon | (−108 C.) | |
| 100% of Carbon-14 | (100 C.) | converted to CO2-14 |

Small amounts also will be released from:

| | |
|---|---|
| Strontium | (1357 C.) |
| Cadmium | (770 C.) |
| Antimony | (1625 C.) |
| Barium | (1634 C.) |
| Samarium | (1670 C.) |
| Europium | (1430 C.) |

All released isotopes will be captured in salt-enriched Zeolite and Carbon multiple barrier air filters (Example is Silver salt to capture Iodine). All released isotopes will be in the form of oxides, to accommodate efficient capturing in the filters. Xenon and Krypton are immobilized via condensation.

Similar process applies for cleaning the cladding. Heating in inert atmosphere to levels of 3200 C to 3813 C removes all rare earth elements including Uranium and Plutonium. This process will be at discretion of the consumer of the disclosed subject matter. Considering the systematic flows of all existing recycling HLW technologies need to be noted that such process was never deployed.

All isotopes collected in the filtering system will be temporary stored in Unit 7 before their processing into low level radiation quasi-natural or artificial Feldspar minerals.

The next liquid-to-liquid HLW recycling separates Uranium and Plutonium. Here the disclosure incorporates a new unique design, very safe and simple to operate, requires no power or moving parts, hydraulic auto control apparatus that separates Uranium & Plutonium from TRU isotopes, including removal of all undissolved in the liquid metal particles. Once recovered (U & Pu), they will be reused either in fuel enrichment or as fuel in the new reactors. All collected liquid form HLW will be temporary stored in Unit 7 for processing into low-level radiation quasi-natural or artificial Feldspar minerals.

B) Conversion of all Collected Dry and Liquid Form HLW to Very Low Radiation Level Artificial Feldspars All liquid HLW and isotopes entrapped in filters left from the recycling process are collected and processed directly into very low level radioactive artificial Feldspar minerals. This unique process is very low cost and technically easy to achieve. HLW isotopes conversion to unique very low-level radioactive quasi-natural mineral matrix and metamorphosis transition is sustainable for a very long geological time without posing any biohazard. This process has passed nature's test for 4.5 billion years. This unique natural matrix is well known as Feldspars mineral family. The Feldspar minerals comprise over 50% of all minerals in the upper crust of the Earth. Detailed information about this process is provided in the enclosed Technical report. The simulation of artificial Feldspar is also provided in the Technical Report. This disclosure successfully resolves all issues related to produced and stored liquid waste including consolidated HLW, depleted uranium, industrial isotope byproducts, nuclear disasters and clean-up after nuclear detonation, and toxic chemical or reactive HLW. This is a controlled process that converts all of the above wastes to a very low radiation level quasi-natural or artificial Feldspar minerals, and immediate permanent disposal. This disclosure removes the needs for building, deploying and maintaining extremely expensive deep geologic HLW repositories.

The first step in the process is determining the isotope constituents in the remaining HLW. It should be noted that the type and amount of isotopes in the fuel deviate based on the different types of reactor fuel and irradiation time. This means that future use of this universal process will require predetermination of the actual isotopes constituents in the fuel/HLW. For purpose of the enclosed Job Mix Formula (JMF) protocol, a 10-year decay time (most of the stored in US spent fuel is 10 years or older) and LWR fuel type were selected. The enclosed table indicates the isotope content in percents.

Reference—Technical Report—Table 4—Property of Isotopes Nano-Flex Experimental Protocol and JMF, and Tables 1 to 3

Since the preliminary selection was that the isotope host (quasi-natural or artificial Feldspar) base would be 5000 grams, the actual isotope content will be 5 times lower per kg. This is done to achieve the first goal—isotope content equal or below the average natural content at one of the selected disposal locations. Future use of this process will require predetermination of natural isotope levels, and adjustment in the Artificial Feldspar JMF. This means that the natural isotope content at different sites will exceed the values in the enclosed protocol (JMF). Such adjustable JMF flexibility provides unlimited application of this process.

The following steps involve the selection of the type of artificial Feldspar that will host the isotopes.

The Feldspar family consists of 4 major groups:

Calcium Feldspar;

Potassium Feldspar;

Sodium Feldspar;

Barium Feldspar.

Extensive information of Feldspar properties is provided in the enclosed Technical report. Calcium Feldspar was selected for the purposes of this JMF. The reason of this decision was the selection of cheap, largely available industrial byproduct, as mineral precursor for Feldspar production. Since no significant blending was required, the decision was in favor of Fly ash. With additional blending, any industrial byproduct can be used to produce any of the above mentioned groups quasi-natural or artificial Feldspars. Extensive technical properties of Fly ash are provided in the Technical report. Based on these properties the Job Mix Formula was drafted—mixing of mineral precursors with liquid HLW. The Final setting time for formation of tri calcium aluminum silicates clusters was determined to be in the range of 16 hours (measured from the time of mixing with liquid to the end of the Final Setting time). For all other Feldspar types the required setting time will be experimentally determined. With this universal advantage this disclosure is an open end method and process for recycling and permanent disposing of any of above mentioned types and classes of HLW.

Reference—Nano-Flex JMF Protocol

Details are provided in enclosed JMF Protocol/Experimental Protocol.

This disclosure provides two embodiments of options for production of artificial Feldspars:

Fumaroles vent underground production facility;

Industrial build production facility.

Both of the above are resolving the production process challenges via chemical thermodynamic kinetics of Continuous Flow/Continuous Flow Batch Reactor phase equilibrium (liquid>gas>solid). Each of proposed facilities will have different technological schematics. The following provides details:

B.1) Continuous Flow Underground Fumaroles Vent Reactor

This is another unique future of this disclosure. As was noted above, Fumaroles vents are a unique natural phenomenon that in addition to an industrial advantage, provide excessive technical and investment advantages.

Fumaroles vents are rare unique geologic formations, several miles long, never appeared on the crust surface, connected to deep underground hot solidified magma, that breathe hot terrestrial gas with elevated natural radioactivity, but under no pressure. Naturally formed, tens of thousands of year ago, these vents have almost perfect cylindrical geometry, stable thermodynamic hot terrestrial gas flow, producing very slow natural crystallization. These vents are naturally occurring, very unique, stable thermodynamics with the surrounding host rock massive, preventing formation of any perched water, and voiding any dissolution, and drying or solute transport. Taking into account all of the above, from a technical point of view the Fumaroles vents are the perfect, low cost natural continuous flow reactor—providing a stable temperature gradient and gas composition.

The greatest difficulty is locating such Fumaroles vent, and accesses it (since they never appear on the surface). The inventor has already located such vent that also resolves the access issue. An additional benefit of the vent in question is that it provides a free supply of Fluorine gas, which can be used for low cost conversion, and separation of recycled Uranium/Plutonium dioxide to UF6 and PuF6. The unique nature of the Fumaroles demands a very specific Continuous Flow Reactor design schematic. The inventor develops design schematics that are technically easy and at very low cost to assemble. Such CFR will not require any production control or technical maintenance; intake flow and monitoring for JMF adjustments may be required. The added benefit is the developed design for immediate, bilateral and permanent disposal of produced artificial Feldspar.

Reference—Schematics of Continues Flow Reactor in Underground Fumaroles Facility.

The length of several miles combined with unique design schematics of the reactor, provide capacity to permanently and safely dispose all produced world wide HLW for several decades at one location. Details of the unique climbing design of this disclosure of Continue Flow Reactor were provided:

FIG. 3—Schematics of Continuous Flow Reactor Assembly in Underground Fumaroles Type Facility.

B.2.) Industrial Continuous Flow Batch Reactor

This disclosure offers the option to build a Continuous Flow Batch Reactor at any designated location for recycling and disposal. The technological schematics, thermodynamic kinetics except the production process is already established, and will not be discussing of this disclosure.

The production process consists of the following steps:

The first step is collection of all dry and liquid HLW products of the recycling process in Unit 7. This step will require criticality control. Methods of criticality control are already established in the literature and their utilization will be at the discretion of the industrial implementation. All collected and enriched with HLW Zeolite filters will undergo initial preparation—the particles must be processed (crushed) to a size no bigger than 4 mm (equal to ASTM coarse sand granular size). For air pollution prevention simple wetting process of solid filtering material with already collected liquid diluted HLW is included—moisture range of less than ½ of absorption value in order to prevent the wet sticking of particles. Once prepared the dry material will be mixed with the rest of liquid HLW waste (composition of both isotopes was established in Table 5—Isotopes Composition).

The second step is mixing of this sludge with selected industrial byproduct mineral precursor. Since no blending is required, the immediate preference is the use of Fly ash (widely available and very cheap industrial by product). At locations (worldwide) where Fly ash is not available, other suitable materials can be used (requires pre determination of chemical and mineral composition evaluation for JMF adjustment). Some of these by products were already named in the Technical Report.

The next step requires leaving the mixture for a period no longer than 16 hours, in order for it to completely set up Try Calcium Alumina Silicates clusters (completion of Final Setting Time for the case of Calcium Feldspar).

Controlled introduction of the mixture into Continuous Flow reactor follows, in order to achieve successful conversion to stable mineral Feldspar—equilibrium transition between liquid-gas-solid phases. The equilibrium should satisfy the Bowen Reaction Series material softening point. The time is adjusted in order to achieve the desired granular size (left to discretion of the future Owner—the size starts from course sand, pellet type aggregates—various size, to size of solid blocks). Please note that powder is undesirable as it relates to additional air pollution. In case of Fly ash the final product is Calcium Feldspar.

Following a short period of cooling, the produced Feldspar will undergo the well-known process of pellets production (from sand size to solid blocks). Other option is partially molten Feldspar to undergo immediate very low cost pellet formation via dropping over high speed rotating "hedgehog" cylinder and cooled in water basin (provide the pellets with immediate glacial surface, that lower the future water absorption—mimicking the formation of volcanic glass in nature). Feldspar in pellets provides for easy handling and disposal—for air pollution prevention the size of the pellets will be left to the discretion of the consumer. Consideration should be given to a smaller pellet size, as it will not form macro-pores in the fill and will prevent the accumulation of large amounts of ground water/if any at the disposal site.

C) Depositing Produced Very Low Radiation Level Artificial Feldspars

The disclosure provides three disposal options. Since the produced very low radiation level artificial Feldspar will match or be below the natural radiation level of the host matrix, selection of the disposal site is without any restrictions and purely a matter of convenience.

C.1) Disposal in Selected Closed for Exploration Underground Mine Facilities

This option offers a readily available, free-from-excavation underground space, otherwise subject to recovery and re mediation. In almost all cases closed for exploration underground mines are locked and left to the process of natural collapsing. Such facilities can stay open for very long time, and be places of accumulation of large volume of contaminated ground water—since water generally flows in a direction of low resistance. Considering that in most of the cases underground mines have high to excessive natural contamination, collection of such large water volumes during time creates contamination large volume plume, affecting the surrounding fresh water aquifer. Several decades after mine closure, EPA and other Federal and Local Agencies usually undertake very expensive remediation and recovery, which in most cases are not successful. One way of avoiding such consequences is filling the old mines with minerals that are similar to ones found freely in nature, have equal or lower radiation level, and do not need any care after disposal (including but not limited to safeguarding). Such minerals will continue the process of natural metamorphosis, without any negative effects to the biosphere. The artificial Feldspars were designed to match the original state of the natural Feldspars (through Bowen reaction series), which initially have less water in the molecule. With time all natural Feldspars acquire a total of 8 molecules of water per unit (in order to be electrically neutral). The artificial ones also have 4 water molecules (the number of water molecules relates to the processing temperature/time in the CFR). The reason for this is to gain two additional benefits—as natural feldspars. The first benefit is any excess amount of water that may reach the artificial Feldspars, will be completely absorbed. Thus preventing any leaching from the artificial Feldspars toward the host. The second benefit is during absorption, which will be done mostly by the Alumina atoms and will cause additional formation of Calcite. This will in turn increase the density—Ref to Technical Report; the cementation of Fly ash can reach up to 6000 PSI. A fill with a low pore content undergoing this process will take over 10 000 years' time to reach mass balance. Unlike most other clay atoms that can hold up to 3, the Alumina atom can hold up to 8 stable water shells for an infinite period of time (this is the reason for volume expansion of high Alumina containing soils—self-sealing phenomena of high plastic clay). This time window relates to the activation energy buildup after reaching mass balance equilibria between the host and the artificial Feldspars—reference to Aquatic Chemistry—section 2.18. Natural Water Systems and Models; Equilibrium and Rates—Chemical Reaction time—"activation energy of 150 kJ mol-1 correspond to a t½ of ~100,000 years." At such conditions the deposited artificial Feldspars, containing a very low radiation, will undergo natural metamorphosis, voiding any impact to the host and the surrounding aquifer. The process of filling is aided by simple air gunning, starting from the bottom of the mine. In case of very long horizontal shafts a high frequency hydraulically attached vibrating plates can be periodically applied (similar to the trench backfill compaction). When applied at vertical angle of 33 to 47 degrees, the placed fill will gain close to 85% of MDD (Maximum Dry Density) which resembles the one in nature.

C.2) Disposal in Selected Closed for Exploration Surface Open Pit Mines

This option provides an easily accessibly disposal facility, free from the need for excavation, containing a very large volume and generally subject to recovery and restoration. In most cases such facilities that are away from urban areas are subject to delayed recovery—they take decades and additional investment from the mining entity and the community (Federal, State and Local tax revenue is requires) to restore.

Ordinarily such facilities have significant pre-disposing environmental issues, related to land, aquifer and in some cases air pollution. Most of the pollution relates to natural issues of the ore—meaning natural elevated content of various heavy metals and isotopes. These locations are ideal for the permanent disposal of the artificial, low radiation Feldspar. Important key issue of this disclosure is that the radiation level of produced artificial Feldspars is equal or below the natural level of the host. Such matrix dynamic prevents dry or solute isotope transport for a long period of geologic time. This technology for disposal does not varies from any other engineering fill. Therefore the density level of placed very low-level artificial Feldspars should be in the range of above 85 to 87% of MDD, at Optimum Moisture Content (OMC), (ASTM determined).

Considering the pellet form of the product it will prevent any emission of air pollution during delivery in the pit, unloading, spreading and compaction. On the other hand the OMC level will provide the required of whatever was left from the Fly ash natural cementation sub process. Originally the Fly ash was formed at 1100 C, and the production of the artificial Feldspars following Bowen reaction series ranges between 1400 C and 800 C. From a physicochemical point of view this means the following: a) Thermal calcinations of Tri Calcium Alumina Silicate to obtain artificial Feldspars; with reduce water content, and b) the remnants from Fly ash minerals (also present in Feldspars) will to hold very high activity surface resulting to additional cementation on contact with water. This will accommodate solute transport from the host to the Feldspars and prevent the opposite for a very long period of geologic time. Achieving reverse solute transport on a large scale for the first time will void all biohazard issues, all existing HLW and LLW technologies, and guarantee for very long geologic time biosphere safety without any additional human interruption. Once completed, placed fill of artificial Feldspars will be covered with no less than 3 ft of high plastic index clay type soil (matching the grade of surrounding surface elevation) followed by 2 ft of large and medium size crushed rocks (for interlocking and preventing surface erosion). Simple edges protection may be required with cobble or boulders size rock berms. Such simple engineering barrier will serve several purposes such as preventing formation of surface standing water (via adjusting the surface drainage grading of clay type of soil), protecting the surface from natural or artificial erosion. Since the radiation level of placed fill will be equal or below the surround host, exhumation or intrusion will be meaningless—important issue all existing HLW and LLW have. Finally, planting of grass and trees vegetation will be advised for final introduction into the nature—it is also required by some local and municipal ordinances.

C.3) Disposal in Surface Trenches or Dikes

This option is well theoretically and practically developed and used all over the world and this disclosure will not modify it.

DETAILED DESCRIPTION OF CLAIMS

1. Methods for methods for processing, chemical binding, sequestering, and incorporating high level radioactive waste materials (including HLW with Actinides, Transuranics, Fission Products and other nuclear activated products) into quasi-natural or artificial Feldspar minerals for retention and long-term, quasi-permanent disposal or storage.

All existing HLW disposal technologies are based on two basic principles: a) direct storage of solid or liquid forms for an unknown period of time, and b) solidification and vitrification in boric silicate, concrete and other matrix, and storage for an unknown period of time. In all cases the HLW is isolated/stored in a form that differs significantly from any known natural matrix, creating and unknown risk to the biosphere. All modeling for the future, falls into uncertainties of unknown (no history record or experience for expected protection period from 1000 years to 10 000 years) and known (expected failure within few decades of artificial engineering barrier that are required to provide the safeguarding).

This disclosure follows the natural pathway that was proven in geological history as successful, and without any ungrounded assumption will continue to be successful in geologic future. Feldspars in nature are very well understood. Formed following the Bowen reaction series, this mineral group comprises over 50% of the Earth's crust. Feldspars were, are and will continue to be the major carrier of natural isotopes. This disclosure creates quasi-natural or artificial very low radiation level Feldspars that carry HLW isotopes in stable trace amounts simulating the ones found freely in nature. This was achieved by exploring several well know chemical binding properties using crystalline precursors. Once the crystallization process starts it transitions thru CFR in the thermal segment of Bowen Reaction series. The final product of this disclosure is quasi-natural or artificial Feldspars with reduced water content in the molecule (exactly reproducing the beginning process in nature—Ref. to Technical Report). This will prevent from the embodiment for extensive geologic time any dry or solute transport of HLW isotopes.

Before the process of irreversible dissolution starts, it will require extensive geologic time in the range of 100 K years or more, to expend the initial 4 molecules water per unit to 8 molecules per unit. The required activation reaction energy should be in the range of 150 KJ mol E-1 which corresponds to an irreversible chemical reaction time t½ of ~100,000 years. For example, rainwater has eH ~25 mV, which is equal to approximately 85 KJ mol E-1 for first order reactions. For second order reactions this time is extended to millions of years (Ref. Aquatic Chemistry. Sec. 2.18—Equilibria and Rates), as shown in the solubility and saturation diagram of FIG. 5.

Feldspars are so abundant, that no demand for industrial production exist—no patent claims were ever registered either.

From a technological point of view, this method consists of a simple, low cost process of production of low radiation level quasi-natural or artificial Feldspars, which are immediately, safely retained for a long-term in quasi-permanent disposal or storage sites. The method consists of the following steps:

- Including but not limited to liquid to liquid HLW recycling/spent fuel rods/solid or liquid form HLW industrial byproducts/depleted uranium/cleanups after disasters or nuclear detonations, toxic chemical or reactive HLW;
- Collection of liquid sludge and in solid form Actinides and Fission products as described above. The solid form requires preparation (as described);
- Mixing the latest with selected industrial byproducts as crystalline precursors to form quasi-natural or artificial Feldspar as per JMF (reference to enclosed Technical Report—JMF protocol);
- Waiting a designated time for successful initial crystalline formation (Final Setting Time) of Ca, N, K or Ba—Alumina Silicates (as basic constituent of quasi-natural or artificial Feldspar);
- Calcinations at thermal equilibrium in accordance with Bowen reaction series, in industrial or Fumaroles vent type Continuous Flow Reactor (liquid>gas>solid phase) for formation of stable quasi-natural or artificial Feldspar, chemically binding all HLW Actinides and Fission products in trace amounts, at reduced to approximately 4 molecules of water, per unit Feldspar;
- Upgrading the produced quasi-natural or artificial Feldspar to pellet or other solid form, to avoid any issue with air pollution;
- Immediate quasi-permanent disposal or storage of the latest in the form of engineering fill;
- Protection of the top of the fill with a dual cover consisting of: a) 3 to 5 ft of high plastic index clay type of soil at Optimum Moisture Content, covered with b) minimum 1 ft thick medium size crushed aggregates, separated from the clay with Geotextile layer (requires only for future event restoration). The aggregates can be reject fractions from a nearby crushing plant, quarry or hot asphalt mixing installations.

The selection of the disposal side is ruled by the cost, not by the restrictions. (Isotope content will be equal or below the natural isotope content in the host). Each production step in this disclosure is explained in detail in the enclosed documents, drawings, tables and Technical Report.

1.2. Method for processing, chemical binding, sequestering, and incorporating depleted uranium and related process materials into quasi-natural or artificial Feldspar minerals for retention and long-term, quasi-permanent disposal or storage.

Depleted Uranium constitutes a major volume segment of all produced HLW. Usually in metal form, lacking reactor activated Actinides and Fission product; Depleted Uranium contains fissile U-235 below 0.3%. Since no other use (except small amount for piercing munitions production) the metal is stored for infinity in a safe house storage facility (until new application for use is developed or new innovation that will permanently disposed it). This innovation provides the tool for quasi-permanent disposal or storage. Isotope inventory is required at time of receiving. The process consists of dissolving in acid, proportional pre-mixing with selected industrial by product (reference to JMF), pre-crystallization setting, and calcinations in CFR, converting to pellets/other solid for and quasi-permanent disposing or storage. The quasi-natural or artificial Feldspar matrix will have isotope content equal or below the host at any selected location (JMF requirement). The latest, following mass balance law will guarantee, for an extensive geologic time, that no dry or solute transport toward the host will occur. A detailed description of the process steps is provided in these documents, drawings and technical reports.

1.3 Method for processing, chemical binding, sequestering, and incorporating radioactive and toxic (chemical or reactive) materials into quasi-natural or artificial Feldspar minerals for retention and long-term, quasi-permanent disposal or storage Hazards to the planet's biosphere are radioactive and toxic (chemical or reactive) materials and by products. Since most of them are in large volume of liquid or solid forms, creates an unresolvable task, for their successful conversion and safe disposal. Such matrices are usually encapsulated after solidification, and stored for infinity. Unfortunately, these liquids or solids contradict the law of nature, where all matter naturally transition from one form to other. The same law of metamorphosis rules that at some point even manmade titanium containers will be dissolved and transmuted to other substances. When such substances contradict the same law of nature, they will become environmental hazard for extensive geologic time. All existing methods for conversion and disposal of radioactive and toxic (chemical or reactive) materials, as manmade cells, differ from nature. This disclosure provides a process for chemical binding, sequestering and incorporating radioactive and toxic (chemical or reactive) materials into quasi-natural or artificial Feldspar minerals and their safe and permanent disposal or storage, for long periods of time. In nature Feldspars carry a wide range of almost ¾ of all of the chemical elements in the entire Mendeleev periodic table. Controlling the content of these toxic (chemical or reactive) materials in acceptable trace amounts of the quasi-natural or artificial Feldspar minerals is provided in this disclosure (JMF control). All process steps for production are provided in the enclosed in this procedure, JMF, drawings and Technical report. For each individual case, the process steps are mirrored except the required JMF adjustments.

1.4. Method and process for chemical binding, sequestering and converting all captured gaseous volatile isotopes in the respective filters into quasi-natural or artificial very low radiation level Feldspar minerals.

All existing technologies are treating collected in the filters HLW isotopes separately, via expensive selected isotopes extraction (which produces additional waste) or vitrification (encapsulation for storage in repository). The existing technology does not permanently resolve any of the existing HLW issues.

This disclosure targets collection of isotopes in filters in a different way as follows:

- All filters before deployment are enriched with various selected components in order captured gas isotopes to be converted to stable or semi stable salts (an example is imbedded silver in order to convert the Iodine to salt);
- Once the filters complete their industrial life cycle, they are removed and temporary stored in Unit 7;
- There, all filtered materials are crushed to size of 4 mm or less, and mixed with collected liquid HLW (from the fuel recycling or other liquid HLW) and industrial byproduct in order to achieve the ratio presented in the JMF Protocol (Reference to Technical Report) as minimum of 5 kg/per each kg of fuel waste. The isotopes amount is ruled by the requirement to match or be below the isotope content in the natural host matrix;
- The mix is left for period of time to form alumina silicates crystalline packets of Ca, K, Na or Ba. In case of Calcium Alumina Silicate, the mix is left for 16 hours. (controls for the process are provided also in the Technical report);
- Introduce the mix into CFR at dT and dP for time dt to produce low radiation level quasi-natural or artificial Feldspars (Bowen Reaction Series) (and controlling the inlet flow to achieve liquid>gas>solid equilibrium);
- After short cooling the Feldspars are subject to additional processing and final disposal (as detail described in other sections of this disclosure.

1.5. Method and process for converting all produced quasi-natural or artificial Feldspar into pellets or other solid form, to eliminate possibility of any air pollution.

In order to avoid any air pollution from the Feldspar production and disposal, after the product immediately comes out from the CFR and is cooled, it goes thru a simple process of converting to pellets or other solid form.

In such form the artificial Feldspar will be very easy and clean to handle—load, transport to disposal site, un load and dispose. The process of pellets or other solid form production consists of following steps:

Option "A"

- Placing the Feldspar in portions in slow rotating cylindrical chamber, where in a controlled environment a pre-determined amount of water is added (The amount of water relates to the desire pallets size and not be greater than ½ of the absorption value);
- Rotating the wet material at designated speed and time forms the desire pellets size (slow rotation forms large pellet size and vice versa);
- Once the pellets are formed, they are rolled into the next slow rotating chamber, where during rolling the pellets are dried in inert temperature and time in order to form durable partially glacial surface;
- Once this process is complete, the pellets are rolled to the next rotating chamber where they are cooled in air or hot water bath.

Option "B"

- Partially molten Feldspar undergo immediate very low cost pellet formation via dropping over high speed rotating "hedgehog" cylinder. At the time the molten Feldspar reaches the rotating "Hedgehog" by gravity is disperses in various sizes almost perfect sphere pellets and continue dropping down. The slow cooling in the air promotes "quick crystallization" as described in Bowen reaction series. Once this is achieved the pellet dropping in hot water basin—providing much rapid cooling. This accommodating formation of dense glacial pellets surface—copy exactly magma cooling as happened in ocean volcanism—formation of volcanic glass. This is important to achieve extremely low surface absorption of the product. The process is low cost and very simple to deploy.

Option "C"

- If needed the molten Feldspars can be pre-mold in form of various size, brick & building blocks etc.;
- Short air and quick cooling in hot water bath will provide these bricks & block with glacial surface, as explained in Option "B";
- These blocks can be permanently disposed as dry masonry in any type of permanent disposal facility as provided in this disclosure.

This disclosure will leave the selection of the Option and pallets size to the discretion of the producer. Consideration should be given to the fact that the size relates to the future fill total pore volume. Formation of macro pores needs to be avoided to prevent possible interactions with large volume, gravitationally flowing water in the future. A simple method for void control is a gradation test; a steeper gradation indicates large void volume, and flatter gradation indicates low void volume. This is important to the artificial Feldspar predesign molecule water deficiency (approximately 4 water molecules less per unit of produced Feldspars). Drying temperature level requires to fulfill this design water deficiency—should be short in time and around or above the CFR calcinations temperature. Achieving partially glacial surface of the pallets decreases the possible surface absorption. Detailed information of this relation to the possible isotope dry or solute transport is provided in the Technical report and other parts of this disclosure.

1.6 Method and process for converting remaining from liquid to liquid separation waste sludge amounts of Actinides and Fission Products to a quasi-natural or artificial very low radiation level Feldspars minerals.

Once all HLW remaining after fuel recycling is collected in Unit 7, it will be subject to preparation (criticality control is required) as follows:

- In portions the HLW liquid waste will be mixed with selected industrial byproduct in proportions as provided in the JMF protocol. As a general rule the ratio is minimum of 5 kg industrial by product for each kg of recycled spent fuel sludge. It should be noted that this JMF is only recommended. The general rule of this disclosure is that the total amount of isotopes in Feldspars needs to match or be below the level of isotopes in the host rocks/soil. This is required to safeguard in future long geologic time, that no dry or solute isotope transport will be possible from the Artificial Feldspars to the host (transport from the host to the Feldspars is anticipated);
- Leave the mix for period of time to form stable alumina silicate crystalline packets—16 hours in order for complete formation of Try Calcium Alumina Silicates form fly ash;
- Introduce the mix into CFR at (dT) and (dP) for time (dt) to produce low radiation level artificial Feldspar (Bowen reaction Series), (by controlling the inlet flow to achieve liquid>gas>solid equilibrium);
- After short cooling the Feldspars are subject to additional processing (pellets, other solid form) and final disposal (as detail described in other sections of this disclosure).

1.7 Method and process for conversion to quasi-natural or artificial very low radiation level Feldspar minerals, of all existing liquid of stored HLW and waste byproducts.

Reference to FIG. 1—Universal Nano-Flex technology application in various HLW scenarios.

In present time very big amount of liquid form HLW is stored at various locations in US and around the world. Official DOE report indicates that only the US Navy has 5 locations with over 90 million gallons of HLW in storage. This is done simply because there is no permanent solution yet. The industry struggles to find new invention to resolve all liquid HLW issues. Unfortunately all efforts are going in a wrong direction of "single isotope separation, solidification and storage for infinite unknown time until new solution will come up").

This disclosure provides one time permanent solution of stored liquid HLW and all future produced liquid HLW, via converting to quasi-natural or artificial very low radiation level Feldspar and quasi-permanent disposal or long term storage.

The process is following:

- Designation of a permanent site for disposal as close as possible to the storage site—thus avoiding all issues and hazards for transportation. As provided in this disclosure, the production facility is design as "mobile from interconnected simple detachable modules";
- The HLW owner needs to provide certificate of the isotope inventory in the HLW sludge;
- Mix the liquid HLW sludge with industrial by product in proportion as provided in JMF Protocol;
- Leave the mix for period of time in order to be formed Alumina Silicate crystalline packets;
- Introduce the mix into CFR at dT and dP for time dt to produce quasi-natural or artificial very low radiation level Feldspar (Bowen reaction Series), (by controlling the inlet flow to achieve liquid>gas>solid equilibrium);
- After short cooling the Feldspars are subject to additional processing and final disposal (as described in detail in other sections of this disclosure).

As part of the site selection process is determination of natural isotopes content.

It should be noted that the conversion could be done with one mobile facility, moved from site to site, multiple facilities, or moving the sludge to one facility. In case of use of Fumaroles vent type facility the entire 90 million gallons will be disposed at one location.

1.8 Method and process for conversion to quasi-natural or artificial very low radiation level Feldspar minerals of all existing in storage encapsulated in boric silicate stored HLW and waste byproducts.

Reference to FIG. 1—Universal Nano-Flex Technology Application in Various HLW Scenarios.

The issue with HLW already encapsulated in boric silicate is more complicated. In general the HLW was dry (means concentrated) and placed in "suppose to be protected" boric silicate shell. This is partially true, taking in consideration the specific properties of Boron as shielding. The actual problem comes from the Silicon. It is a well known "secret" from the old glass producing factories in Bavaria and Bohemia, that amorphous silicate has one key negative property—aging. It is important to note that any Silicon dioxide that has been artificially produced has a chain crystalline structure making it easy to craft and produce any geometric form. During aging these chains are subject to very slow metamorphosis (100 years or more) when the Silicon atoms are reorganizing their position toward the Oxygen atoms. Since the mechanical movement of the Silicon atoms is very limited, it creates additional inter crystalline tensioning. As a result of this Pre-Crystallization, the Silicon Oxide experiences micro cracking to relieve the inter crystal stress. This effect was observed during centuries, when very old samples of produced glass in the factory show room suddenly breaks down without any outside force impact. Since the geometric forms of all boric silicate HLW encapsulations is close to brick forms, the linear tension along different sides will not be equal. Combined with the HLW heat emission, it is a matter of time when all encapsulated in boric silicate HLW bricks will experience the first signs of micro crack. These cracks are the future pathway for leaks and dry or solute transport. This disclosure provides resolution of all these issues, via one time converting these solid HLW to very low radiation level quasi-natural or artificial Feldspar minerals and immediate quasi-permanent disposal or long-term storage. The process is as follows:

- Delivery to production facility with certificate of the isotope inventory in the bricks;
- Cryogenic cooling of HLW encapsulated in boric silicate to achieve extensive cracking;

Cryogenic cooling provides all benefits explained in this disclosure—including but not limited to a drop in radiation energy emission level, preventing dust during chopping, gas removal and i.e.;

Chopping the bricks in pieces not larger than ½ inch (use of two way blade chopping waffles). Smaller size is desirable—speeds the next Volatilization in isolation and dissolving time;

Volatilization in isolation at 1450 C (process was explained in other part of the disclosure—Claim 4);

Dissolving in nitric acid;

Separation of undissolved metal particles;

Separation of remained U and Pu with mixing with 33% TBP/kerosene (organic phase) to 67% liquid phase;

Removal of U and Pu using the Vortex apparatus;

All collected HLW sludge is temporary stored in Unit 7;

Mix the liquid sludge with industrial by product in proportion as provided in JMF Protocol;

Leave the mix for period of time to form alumina silicate crystalline packets—in case of Calcium Feldspar from Fly ash—16 hours in order to be formed Try Calcium Alumina Silicate crystal packets;

Introduced the mix into CFR at dT and dP for time dt to produce very low radiation level quasi-natural or artificial Feldspar (Bowen Reaction Series), (by controlling the inlet flow to achieve liquid>gas>solid equilibrium).

After short cooling the Feldspars are subject to additional processing and final disposal (as detail described in other sections of this disclosure).

1.9 Method and process for conversion to very low radiation level quasi-natural or artificial Feldspar minerals of any HLW radioactive materials from hazard spills, accidents HLW and byproducts.

Reference to FIG. 1—Universal Nano-Flex Technology Application in Various HLW Scenarios.

This disclosure provides permanent solution for collected HLW after any hazard spills and accidents.

Contrary to all existing technologies which are collecting all spill/accident HLW and moved to designated storage facility where is treated as HLW—usually encapsulated in drums and stored for infinite time.

Such approach postpones all future risks of leakage, transportation, solute transport and contamination. This disclosure provides one time solution, via converting all collected HLW to a very low radiation level quasi-natural or artificial Feldspar minerals and quasi-permanent disposal or long term storage. The process is the following:

Collection of spills and contaminated soil after a nuclear accident;

Blending the contaminated soil with washing to remove as much non-contaminated soil as possible and collect the remaining amount contaminated with isotopes;

Dissolve the HLW, in portions, in acid to achieve partial separation;

Process the solution for removal of all undissolved material and wash out the latest;

Dry the separated material and measure the radiation level, for classification;

Collect all HLW liquid;

Mix the HLW liquid with industrial byproduct in proportions designated in the JMF Protocol;

Leave the mix for period of time in order for Alumina Silicate crystalline packets to be formed;

Introduced the mix into CFR at dT and dP for time dt to produce very low radiation level quasi-natural or artificial Feldspar minerals (Bowen reaction Series), (by controlling the inlet flow to achieve liquid>gas>solid equilibrium);

After short cooling the Feldspars are subject to additional processing and final disposal (described in detail in other sections of this disclosure.

In case the separated and dry undissolved material matches the radiation level, dispose it together with the produced Feldspars. In case the radiation is higher, reprocess it again as described above. Soil dry dilution via mixing with other materials to achieve low radiation level is not recommended, because such mechanical solution, do not resolve any of the possible solute transport (no chemical binding, sequestering and isotope incorporation).

1.10 Method and process for conversion to very low radiation level quasi-natural or artificial Feldspar minerals of any liquid radioactive medical by products and other classified as HLW liquid byproducts.

Reference to FIG. 1—Universal Nano-Flex Technology Application in Various HLW Scenarios.

Every year very large amounts of radioactive materials are produced from the medical industry and other classified HLW byproducts. Such materials after procedure for classification (A, B or C class) with or without solidification/incineration are transported to disposal sites, where they are buried in soil entrapments. Most of the materials due to their nature and composition will remain in the environment as non biodegradable for a long period of geologic time. The burials are protected with so called multiple engineering barriers. These barriers are expected to provide the assurance against any solid or solute isotope transport. From a civil engineering perspective all engineering barriers are not perfect and cannot provide the protection for the required minimum period of 300 to 1000 years (history indicates that these barriers fail within several decades after deployment). This means that at some point in time all buried materials will become a source of solid or solute transport isotope contamination.

This disclosure provides one time permanent resolution of all issues. After initial classification/incineration all remaining material will be dissolved in acid, converted to a very low radiation level quasi-natural or artificial Feldspar and permanently disposed as provided in this disclosure.

Since the liquid form matches the original format design of this disclosure, the process is as follows:

Collection and delivery of all HLW solutions to the facility, and transfer together with the certificate of the isotopes inventory;

Mix the solution as per the design proportions provided in the JMF Protocol with industrial byproduct;

Leave the mix for period of time to form Alumina Silicate crystalline packets;

Introduce the mixture into CFR at dT and dP for time dt to produce very low radiation level quasi-natural or artificial Feldspars (Bowen reaction Series), (by controlling the inlet flow to achieve liquid>gas>solid equilibrium);

After short cooling the Feldspars are subject to additional processing and final disposal (described in detail in other sections of this disclosure).

1.11 Method and process for conversion to very low radiation level quasi-natural or artificial Feldspar minerals of any solid radioactive solid medical by product and other classified as HLW solid by products.

Reference to FIG. 1—Universal Nano-Flex Technology Application in Various HLW Scenarios.

Every year, a very large amount of solid radioactive materials are produced from the medical industry and other classified HLW byproducts. Such materials after a procedure for classification (A, B or C class) with or without solidification/incineration are transported to disposal sites, where they are buried in soil entrapments. Due to their nature and composition, most of the materials will remain in the environment as non-biodegradable for long geologic time. The burials are protected with so called multiple engineering barriers. These barriers are expected to provide the assurance against any solid or solute isotope transport. From a civil engineering point of view, all engineering barrier are not perfect and cannot provide the protection for required minimum period of 300 to 1000 years (the history indicate that these barriers fail within several decades after deployment). This means that at some point in time all buried materials will become a source of solid or solute transport isotope contamination. This disclosure provides one time permanent resolution of all issues as follows:

- Delivery of all solid HLD waste to the production site (it is the responsibility of the owner to provide a certificate for isotopes composition);
- Some items may be subject to incineration;
- Chopping the solids to size less than 4 mm;
- Dissolution in nitric acid;
- Undissolved solids separation;
- Mix the solution according to the design proportions as provided in the JMF Protocol with industrial by product;
- Leave the mix for period of time to form Alumina Silicate crystalline packets;
- Introduce the mixture into CFR at dT and dP for time dt to produce very low radiation level quasi-natural or artificial Feldspars (Bowen Reaction Series), (by controlling the inlet flow to achieve liquid>gas>solid equilibrium).

After short cooling the Feldspars are subject to additional processing and final disposal (described in detail in other sections of this disclosure).

1.12 Method and process for conversion to very low radiation level quasi-natural or artificial Feldspar minerals of depleted Uranium.

Reference to FIG. 1—Universal Nano-Flex Technology Application in Various HLW Scenarios.

Every year a significant amount of depleted Uranium is produced in the US and worldwide. The metal usually is stored for an unknown period of time, or traded for production of piercing ammunition ordinances. Soon such production is expected to be outlawed by the UN. Since the amount of U235 is very low, any future use of this metal for fuel enrichment is void. Future use in new integrated reactors as fuel is also not expected soon—U238 already contains a great of amount of poisonous isotopes that will require additional purification. Disposal is the only available option. The challenge with existing technology is the expense for deep geological storage and safeguarding. Grinded depleted uranium is very useful in terrorism as a cheap source of material for dirty bombs (easy to obtain and produce in large amounts, supports flammability when mixed with lithium). This disclosure provides a permanent resolution of the problem with depleted uranium. After breaking it down/chopping into small pieces the depleted uranium will be dissolved in nitric acid, processed to very low radiation level quasi-natural or artificial Feldspars and permanently disposed as provided in the disclosure. The process is as follows:

- Delivery to production facility with certificate of the isotope inventory in the metal;
- Cryogenic cooling;
- Chopping in pieces not larger than ½ inch (use of two-way blade chopping waffles). Smaller size is desirable—speeds the dissolving time;
- Dissolution in nitric acid;
- Separation of undissolved metal particles;
- All collected HLW sludge is temporary stored in Unit 7;
- Mix the liquid sludge with industrial by product in the proportions provided in the JMF Protocol;
- Leave the mix for period of time to form Alumina Silicate crystalline packets;
- Introduce the mix into CFR at dT and dP for time dt to produce very low radiation level quasi-natural or artificial Feldspars (Bowen Reaction Series), (by controlling the inlet flow to achieve liquid>gas>solid equilibrium).

After short cooling the Feldspars are subject to additional processing and final disposal (described in detail in other sections of this disclosure).

1.13 Method and process for conversion to very low radiation level quasi-natural or artificial Feldspar of cleanups after nuclear disasters and nuclear detonations.

Reference to FIG. 1—Universal Nano-Flex Technology Application in Various HLW Scenarios.

Cleanup after a nuclear disaster, accidental spills or nuclear detonation, requires a different approach from HLW/spent fuel recycling. The existing technology deploys a very uncertain approach of burials in LLW waste sites, after mixing with additional soil, to dilute the isotope concentration. It is a proven fact that mechanical mixing resolves the radiation level problem only temporarily, but rapidly increases the issues with dry or solute transport of all isotopes. Furthermore, a long waiting period is required for dropping the radiation level (Ref to Technical report). This approach was replaced with a new vision after the Chernobyl disaster when very large areas of Eastern Europe were subject to extensive radiation fallout, and partial cleanup.

In a nuclear disaster, spills or nuclear detonation, the main issues come from cleanup of surface fallout contamination. Up until this moment the usual approach was to wait a prolonged period of time until isotope mutation drops the radiation level to acceptable thresholds, flip-flopping the soil surface to bury the isotopes, or scraping the surface and storing the collected stockpiles for an uncertain period of time. As a general rule the problem is just relocated from one place to another without a permanent resolution.

This disclosure provides a permanent solution for all of the above. The ground subject to nuclear disaster spills or nuclear detonation needs to be split in grids (GIS map), even when large in size. Each grid will be subject to immediate mobile air vacuum surface extraction of all isotopes as a result of fallout (the vacuum nozzle will be equipped with a radiation detector to trace the hot spots with elevated radiation level). All collected soil after that will be delivered to the production site (usually buffer zone to the event site), where it will be subject to wet screening to separate the isotopes from the soil (similar to processing ore). Collected fraction containing isotopes will be diluted in acid, and converted to very low radiation level quasi-natural or artificial Feldspars pallets. The latest after that will be permanently disposed as provided in the disclosure. The process is as follows:

- Preparation of GIS map of effected area—fly-over's, aerial designation of hot zones and buffer zones. PPSDP is required to find out probable erosion surface transport;
- Collect all fallout contaminated material—mobile vacuum units. The collected material will be delivered to the buffer zone and unloaded, for transportation to the process facility. All mobile units will be subject to daily decontamination procedure. Mobile units will have extensive shielding of the operator space. Personal protection gear is required;
- First stage—separation washing out the collected soil to separate as much soil as possible from isotopes. Separated, non-contaminated soil will be stockpiled and returned to the buffer zone for spreading. Provide isotope inventory;

Separated soil with elevated isotope content will be screened and dissolved in acid;

Separated undissolved part—provide isotope inventory/if any;

Mix the remaining acid solution with industrial byproduct in the proportions designated in the JMF Protocol. Adjust the JMF, if required, to match the existing isotope level in existence before the disaster/detonation;

Leave the mix for period of time for Alumina Silicate crystalline packets to be formed;

Introduced the mix into CFR at dT and dP for time dt to produce a very low radiation level quasi-natural or artificial Feldspars (Bowen reaction Series), (by controlling the inlet flow to achieve liquid>gas>solid equilibrium). After short cooling the Feldspars are subject to additional processing and final disposal (described in detail in other sections of this disclosure).

1.14 Method and process for adjusting the pre-mixed Job Mix Formula (JMF) for quasi-natural or artificial very low radiation level Feldspar minerals production.

The composition of produced quasi-natural or artificial very low radiation level Feldspar in this disclosure is subject to pre mix JMF adjustment to or below isotopes level at any selected for disposal location. The target of such flexibility is to equal to the existing natural isotope/s content in the host matrix. The reason for that is to avoid creation of artificial cell in the host matrix, as source of contamination during extensive geologic time. The established matrix equilibrium at any location in near surface crust, was done during very extensive geologic time, and theoretically is not subject to complete reversal (simply because in the modeling we will be not able to notice all components). To avoid any ungrounded assumption that will result in unexpected consequences (like Yuka Mountain deep repository), the only way is to equal the conditions at the specific location. The first requirement is the selection of Feldspar mineral type, second is the natural level of isotopes containing in the host. Since only few isotopes are produced artificially and are arguably if they do not exist in nature, we will match only these isotopes that are present in the host environment. (Reference to Technical report regarding recently discovered in nature traces of isotopes, believe to be create only artificially). This is a safe approach since the artificially produced ones are in equilibrium with the natural ones in the fuel and from there in the HLW. This way if we equal the content of the natural isotopes in the artificial Feldspars to the content in the host matrix, we achieve the equilibrium transfer to both.

Adjusting the pre-mix formula requires approach of:

Determine the isotope/s content in the host matrix;

Determine the level of same isotopes in the HLW sludge;

Calibrate isotope amounts of the pre-mixed proportions, as provided in the JMF Protocol in order to have equal or slightly below the content in the host, as warrant by equilibrium.

Reference to Tables 1 to 4 as Indicators for Isotopes Content and Proportions in Light Water Reactor (LWR) Spent Fuel after 10 Years Decay. It should be Considered that the Isotopes Type and Content Relates to the Type of Fuel, Irradiation Time in The Reactor, and Post Decay Time; i.e. Before Adjustments of JMF for Artificial Feldspar, Consideration should be Given to Isotope Content of the Fuel Type/HLW/Industrial Isotopes/Depleted Uranium/Hazard Spills/Other Nuclear Incident or Nuclear Detonation Cleanups.

This disclosure provides universal, flexible, permanent solution to all type of isotopes, related to any selected for disposal location on the planet.

1.15 Method and process for controlling the pre-crystallization Final Setting time of the quasi-natural or artificial very low radiation Feldspar mineral precursors.

Mineral precursors in this disclosure are responsible for adequate chemical binding, sequestering and incorporating all HLW trace isotopes. They play an important role in the matrix that successfully will host the isotopes for extensive geologic time (10K to 100K and more). The property of the precursor needs to comply with the genesis of the natural Feldspar minerals (extensive information was provided in Technical Report). Once the selection of Feldspar type is complete, the following step is selection of adequate industrial by product (extensive information provided in Technical report). To illustrate this as an example in this innovation was selected Fly ash, as crystalline precursor for Calcium Feldspar. One of the requirements the crystalline precursor needs to comply is the ability to form acceptably stable crystalline packages at room temperature. Another way of explaining this is to have crystalline Initial and Final Setting time. The inventor believes that the user of this disclosure will be familiar with these key properties, and will not provide detailed physical and chemical information at this time. As explained in the Technical Report in detail, Fly ash when mixed with water acts similarly to the cement hydration—there is an Initial and Final Setting time. The provided in the literature information related to Final Setting time, relates to value of obtained compressive strength, rather than actual crystallization. For complete formation of Try Calcium Alumina Silicates packages the inventor determined as Final Setting time the threshold of 16 hours after water introduction. The time was the result of the falling temperature gradient of the mix (measured with laser thermometer). This threshold also is pretty close to the cement final setting time of 18 to 19 hours, after water introduction. This scheme need to be consider when use any other type of crystalline precursor. In case of using discarded from open pit mines clay shavings, experimental protocol should be perform—Sodium alumina silicates are very weak, and almost do not indicate any strength changes. For such cases change in viscosity is the right indicator. Barium alumina silicate behaves similar as calcium alumina silicate.

1.16 Method and process for controlling the isotopes content in very low radiation level quasi-natural or artificial Feldspar minerals, via calibrating the natural isotope levels, at any selected location for permanent disposal.

This disclosure provides a universal solution for calibration of the isotopes content in the produced low radiation level artificial Feldspars. This means that the JMF is an open-ended equation, where all isotopes are in trace amounts. The actual calibration process consists of equalization of the isotopes content in the HLW sludge to the natural isotopes content in the host matrix. This is done as follows:

Determination of natural isotopes content at any selected for disposal location.

Calibrating the JMF for production of very low radiation level artificial Feldspars (Ref. to JMF Protocol) to have equal/or at least 5% below content of the same isotopes present in the host.

This flexibility was one of the targets in this disclosure, for permanently resolving all existing issues with disposal, something not possible for any of the existing technologies. In such format this disclosure is applicable at any location on the planet, avoiding any possibility of dry or solute isotope transport from the placed fill to the host matrix. Based on the mass balance law, the engineering design achieves a key target property of the product that guarantees for very extensive geologic time (10K to 100 K years) only one way of possible micro pore ground water transfusion—from the host to the fill. In such format the selection for permanent disposal is ruled not by restrictions but by the cost. An important rule needs to be observed—no disposal is recommended in areas with shallow ground water table, swamps, marshes or running surface water.

2. Method and Design for Continuous Flow reactor assembly in underground Fumaroles vent type facility References to Enclosed Schematics of Continue Flow Reactor Assembly in Underground Fumaroles Vent Type Facility—FIG. 2.

The origin, thermodynamic functioning of Fumaroles vent was explained in section B.1 of this disclosure.

Figure 6:
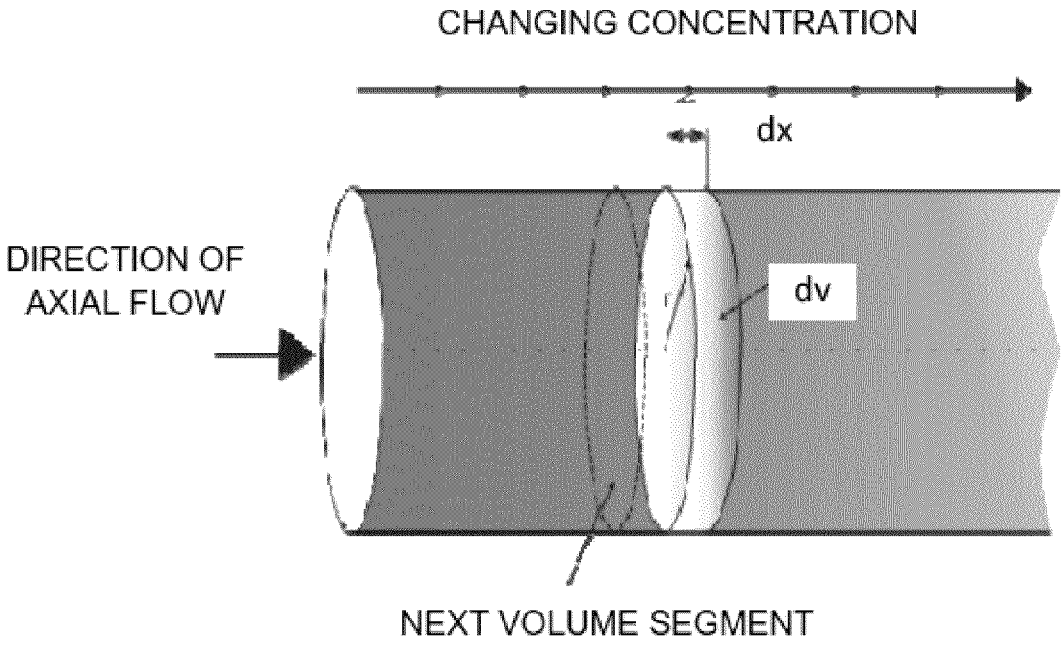
FIG. 6 is an orthogonal view of a portion of a continuous flow reactor.

FIG. 6 represents the theoretical thermodynamic of Continuous Flow Reactor. All thermo dynamic components of the CFR diagram are naturally established and stable for a very long geologic time in a Fumaroles type vent (natural phenomenon). Since it is a very long (several miles), and a geometrically well formed (continuous vertical gas flow) process, never appearing on the surface, the use this natural phenomenon requires several steps as follows:

Discovery—since they are very rare Fumaroles vents need to be intentionally (via seismic modeling) or accidently intercepted (usually in deep vein type underground mining facilities). The inventor has already located one.

Investigation—once located, the Fumaroles vent will be subject to collection of data that will be used for the final reactor design and Job Mix Formula adjustment for production of very low radiation level quasi-natural or artificial Feldspar. This will consist of GIS mapping of the entire vent length, containing the following information—gas composition and temperature gradient related to altitude. Collection of this information will be done via simple, remote station, which is attached to a cable containing symmetric rolling wheels (providing additional mobility and preventing jamming), panoramic lights and panoramic video cameras, continuous gas analysis module, radiation detector (all spectrum), thermocouple thermometer for temperature of the gas flow, and Laser thermometer for checking temperature of the vent walls. For thermal protection the entire station will be enclosed in a body of thick Teflon covered with a thermo reflective NASA-type, multiple-layer Alumina foil/carborund ceramic thermo insulation layer, and have simple interior cooling to prevent overheating of the components at deep altitude—close to solidified magma the air flow temperature is around or less than 500 C—Reference "Geo-Tectonic"). The station will check and record all components for every 5 meters change in the vent altitude. Combined with real time video all records will create a real time vent database. The database will be used to determine the active depth of future CFR. Need to be explained the difference between Fumaroles and Fumaroles vent. Fumaroles are cracks in the Earth crust emitting hot under pressure gas from liquid magma. At some altitude the crack intercepts ground water, which under very high pressure and temperature, changes to vapor—reason of observation fumes, geysers or other phenomena on the surface (Ref to Yellow Stone National Park). Fumaroles vents are rear, large size vents formed from quick reverse movement of lava—reason that they never appeared on the surface. Once formed, and the lava sucks down, they stay open until the magma solidifies. As result of magna solidification the air pressure disappeared, the temperature drops below Bowen reaction Series, and the process of slow vapor crystallization begins. The Fumaroles are pressurized water vapor reach. The Fumaroles vents are non pressurized and poor on water vapor—reason, they also are named "dry vents".

CFR Modules Prefabrication and installation—as presented in the enclosed schematics of CFR assembly in a Fumaroles vent type facility, the production modules will consist of detachable single modules with length no more than 5 meters—this relates to the size of the vent access at the point of interception. This means that the particular length of each module can vary from 2 to 5 meters, or longer, as per the deployment preference. For length greater than 5 meters additional design structural stability will be obtained as related to the CFR integrity. Each module consists of no less than octahedral self-locking walls attached to the vent walls, on a telescopic legs platform (the unfolding system is similar to the unfolding of space probe). At the center of the platform is installed a cluster of Teflon pipes, not less than 2"-3" diameter each. Both pipe ends will have self locking lips (fascia similar to the large size PVC/HDPE pipes), providing self locking of each module to the one located below.

The telescopic jack leg system provides free movement only in a downward direction. Once the module reaches the one located below, Teflon cluster will interlock to the structure below in a remote fashion. The locks will have a gap (free movement up or down) of few inches. This will provide the ability of the legs to lock to the vent wall. The bottom of the reactor will have a single funnel type short module—2 to 3 meters long, with the same octahedral leg configuration as the rest. The entire space between the vent walls and the Teflon pipe cluster at the center will be covered with a Japanese-type folding fan from thick metal shells. Once the desired vent depth is reached and the legs lock into the wall, the folding springs will be released, and the shells will cover the entire space between the vent walls and the pipe cluster in the center. The possibility the bottom funnel to sit on solidified magma stays open—mater of operational decision, but no any restrictions—the surface temperature of the solidified magma is in the range of 500 C or less. This is done to achieve continuous free upward gas flow and prevent clogging of the vent from downward free falling of Feldspar pellets. During modules installation, simple gyroscope will keep the assembly close to vertical (required for equal weight distribution). Based on recorded gas/temperature database the Feldspars JMF may require adjustments (not anticipated as the gas flow relates to the located deep in the crust frozen magma; such changes require geologic transitions in the time range of millions of years).

2.1 Design of permanent bi lateral disposal in underground Fumaroles vent type facility The unique features of Fumaroles vent afford the ability to set up permanent disposal of produced Feldspars, via incorporating the lateral space inside the vent as storage. As a closed thermodynamic system the Fumaroles vent void any possibility for formation of perched water (fresh water condensation) and any dry or solute contamination transport to fresh water aquifer (refer to the process of stable hot thermodynamics within host rock). This unique phenomenon was established during a very long geological interaction time between the host rocks and the vent, achieving a stable thermal equilibrium (continuous breathing of hot radioactive terrestrial non pressurized gas coming from deep in the ground frozen magma). Such equilibrium is not possible for all existing artificially created deep underground repository facilities—the thermal reduction gradient there is not stable and requires maintenance for an extensive period of geological time).

The space for disposal was formed from the unique parameters of climbing CFR (R,dx)—the reactor reaction equilibrium (dx) zone moves slowly from the vent bottom toward the top, leaving an empty space below. Once the transition from liquid/gas/solid equilibrium is achieved at (dx) elevation, all formed Feldspar pellets, will continue to move downward with the force of gravity, and settle at the bottom. This movement is facilitated by the unique design for transferring the hot terrestrial gas at the center of the vent (Teflon cluster). Once this is done the adjacent zone, free from ascending gas flow, is subject to the force of gravity—all precipitated Feldspars will have no effect on the vent thermodynamics. Such schematics repeat the process of any natural cavity filling (following the rule of gravity), and provide conditions for repeating the natural metamorphosis in the Planet's crust. Since the natural vent length is several miles this will provide a significant volume to be filled with Feldspars. Artificially constructing such size repository is exceeding human technological level of development, and financial ability even on a multinational level. Once the single CFR cluster is filled with Feldspars (up to 75% of the volume), the process will continue with installation of the next upper CFR cluster. The assembly's mechanical simplicity allows the CFR clusters installation to be done remotely—any installed upper cluster interlocks with the one below, keeping the CFR assembly continuous. All monitoring will be done remotely via video camera with gas/temperature gauges. Once the "box" is buried by the falling Feldspars, the temperature/gas analysis may continue via monitoring stations. It should be noted that such monitoring is not required however, as the vent thermodynamics remain unchanged for very extensive geologic time (100K years or more). A second option is retrieving the camera and gas/temperature analysis box—but this requires much more expensive lifting independent assembly in the vent. This decision will be left to the discretion of the entity that will deploy the facility. The deposited in the vent artificial very low radiation level feldspars will continue under the terms of natural rock metamorphosis transition, via first consolidation (refer to the mechanics of "cone of Patronev", followed by natural crystalline—chemical thermal transition (as metamorphic rocks)). Geologically the time frame of this process will exceed the required isotope's half-life, for a radiation reduction to safe levels for the biosphere. This process, was, and will continue to occur naturally in the Planet's crust. This disclosure resolves once and forever all existing complex issues of artificial geological repositories for HLW.

2.2 Method for conversion of all liquid and solid HLW (Actinides and Fission Products) to very low radiation level artificial Feldspar minerals and immediate bilateral permanent disposal in Fumaroles vents.

Reference to FIG. 1—Universal Nano-Flex Technology Application in Various HLW Scenarios.

Figure 7:
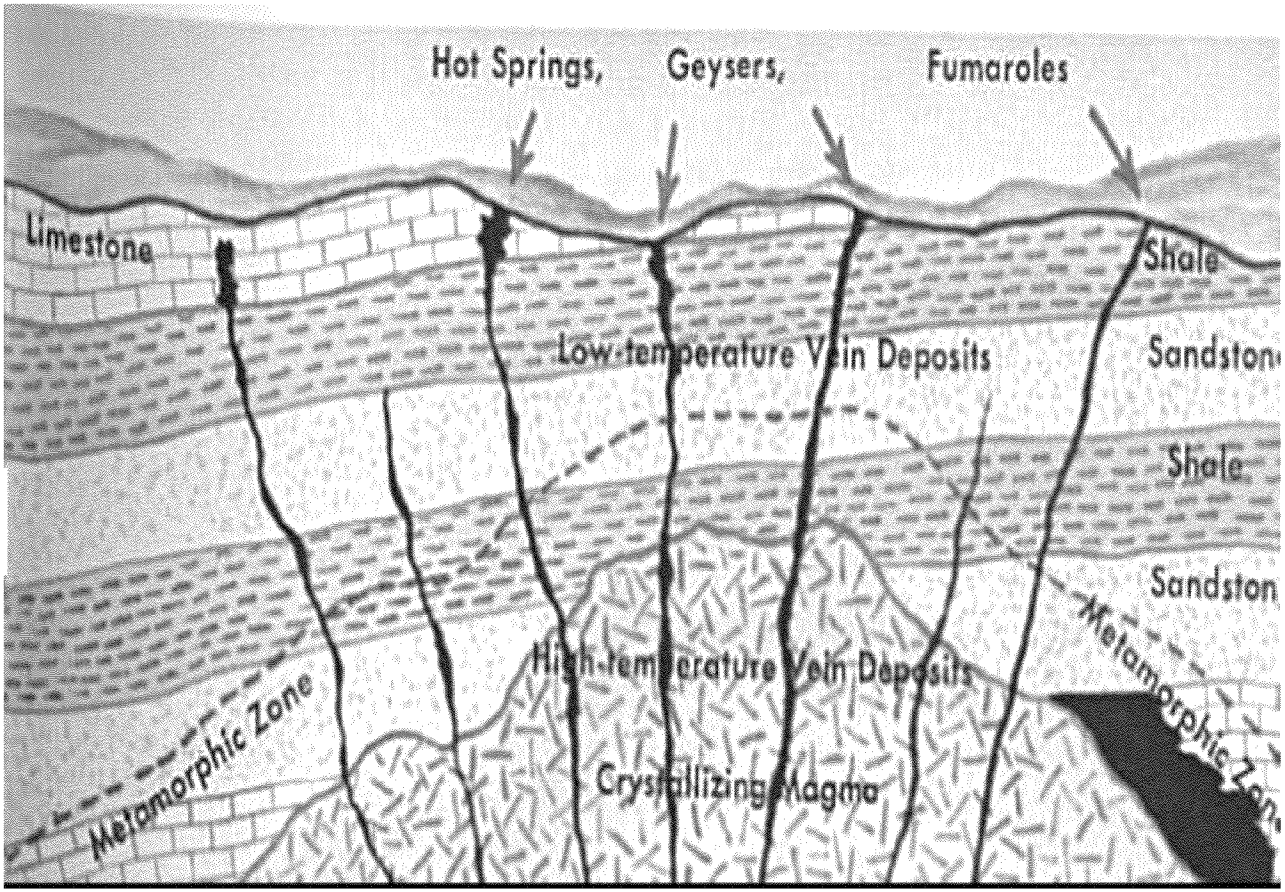
FIG. 7 is a geological illustration showing fumaroles vents.

This option is unique. This will be for first time a natural phenomena to be use as production/depositing facility. As was explained in detail, fumaroles vents, shown in FIG. 7, are very rare unique natural phenomena, formed long ago in geologic time (age from 10K to 35K or older). Long several miles, never appeared on the surface (top ends usually covered with at least Quaternary sediment deposits), these vents are connected to located deep in the crust frozen magma, and are breathing hot non pressurized terrestrial gas. Geometrically almost perfect, usually vertical, fumaroles have established long duration and stable thermodynamic equilibrium with the surrounding host matrix. These unique parameters prevent any formation of perched water (condensation) as preliminary source for water pollution transport. The terrestrial gas usually caries isotopes with elevated radioactivity.

The inventor already located such phenomena, resolving also the issue with access. Fumaroles vents are perfect candidates for establishing very low cost underground CFR. This disclosure provides unique design for establishing for first time in the world climbing type underground CFR, combined with bilateral space for depositing produced Feldspars.

Details of the deploying and operating Fumaroles facility were provided in the accompanying drawings and information. Need to be noted that the CFR (dx, dT, R, at time dt) segments locates above the segment for depositing produced artificial Feldspars, which in the previous climb was the CFR segment. Such unique schematics guarantee the climbing advantage of Fumaroles vents, which cannot be duplicate in any other natural or artificial conditions. All step of deployment and operations were provided in explanatory format in section—Description of the Drawings. FIG. 3, including process, discontinue production/disposal and vent sealing. The entire process in the Fumaroles vent is combination of reversal of natural processes and remote very simple and low cost operation. Considering that the length of Fumaroles vent is several miles long, one facility can take for several decades all worldwide HLW.

3. Methods for methods for spent fuel assembly preparation and processing, using liquid nitrogen cryogenic cooling or equivalent cryogenic cooling, that sequester or immobilized combustible gasses within and released from fuel assembly, reducing conditions for ignition or explosion.

One of the great hazards created by oxide fuels, when left in the open atmosphere, is rapid oxidation. During this process several gas components are rapidly released. The most dangerous is hydrogen. Concentration buildup produces spontaneous reaction with oxygen in the air resulting in a high power explosion. To avoid this, all existing technologies are using forced ventilation, to keep the concentrations below the threshold. A simple malfunction usually ends with an explosion. Use of a multiple circuit ventilation system, requires an additional financial investment, control and maintenance. On the other hand, forced ventilation produces additional HLW in the form of filtering solids—requires additional process for isotope separation and disposal. Using cryogenic cooling with liquid nitrogen or other cryogenic cooling provides the benefit of replacing all gas release from the oxide fuel. As cooling reaches freezing, further gas release stops. During the transition in and out of freezing, all released gas isotopes are captured in multi layer filters, enriched with selected salts to form stable compounds. No gas release occurs at good process transition timing temperature below −153 C. Concentrations between −153 C and −100 C are way below ignition or explosive concentrations.

3.1 Method for preparation and processing of spent fuel assembly, using liquid nitrogen cryogenic cooling or equivalent cryogenic cooling, that will induce fracturing of the assembly cladding, and internal materials and thereby releasing expanded fuel oxide from the cladding.

The method according to this claim consists of cryogenic cooling of the fuel assembly, using liquid nitrogen or other equivalent cryogenic cooling, immediately after removal from the cask. This method achieves the following advantages:

- Fracturing the fuel assembly following excessive linear shrinkage at most points of geometric change including but not limited to welds and bends;
- Release of the compressed uranium oxide pellets from the cladding as result of excessive heat in the reactor;
- Easy fuel oxide removal from the cladding (via vertical shakers and bottom transverse cutting).

Rapid cryogenic cooling creates significant linear shrinkage of the metal assembly and cladding—known as loss of elasticity. As a result of geometrical induced linear tension, all welding and bending points will crack, releasing the compressed oxide fuel pellets from thermal expansion. The assembly/cladding after transverse cutting is attached, positioned vertically and subjected to excessive shaking—fuel oxide pellets fall down on the top of reverse direction vibrating inclination surface plane transport tables and are collected into basket ducts connected to UNIT 2—Volatilization in isolation. Vertical assembly position combined with excessive vibratory shaking allows remote tamping operation/if necessary, in case some of the oxide pellets are stuck—remote tamping is technically very easy to install and operate. Vertical hooks/shakers are connected into a simple chain conveyor, moving on round double "I" beam—providing easy operation/access/removal of any failed segments from the unit for maintenance/repair, thus avoiding in house staff radiation exposure. All existing technologies are relying on horizontal shaking of Assembly chopping/cutting, or combining fuel oxide/assembly dissolving, which creates additional operational stages—requires more equipment, additional facilities, operation cost, staff and safety, and is subject to mechanical failure. Details for each steps is enclosed in this disclosure documents, drawings and tables.

3.2 Method for spent fuel assembly preparation and processing, using liquid nitrogen cryogenic cooling or equivalent cryogenic cooling, that provides rapid decrease in radiation energy level emission, for a period of time, caused by stopping of and delay of vibration and rotation wavelength spin of electrons/photons and converting nuclei radiation into energy self shielding. This decrease in radiation energy level emission allows for easier fuel handling at a decreased radiation rate.

Figure 8:
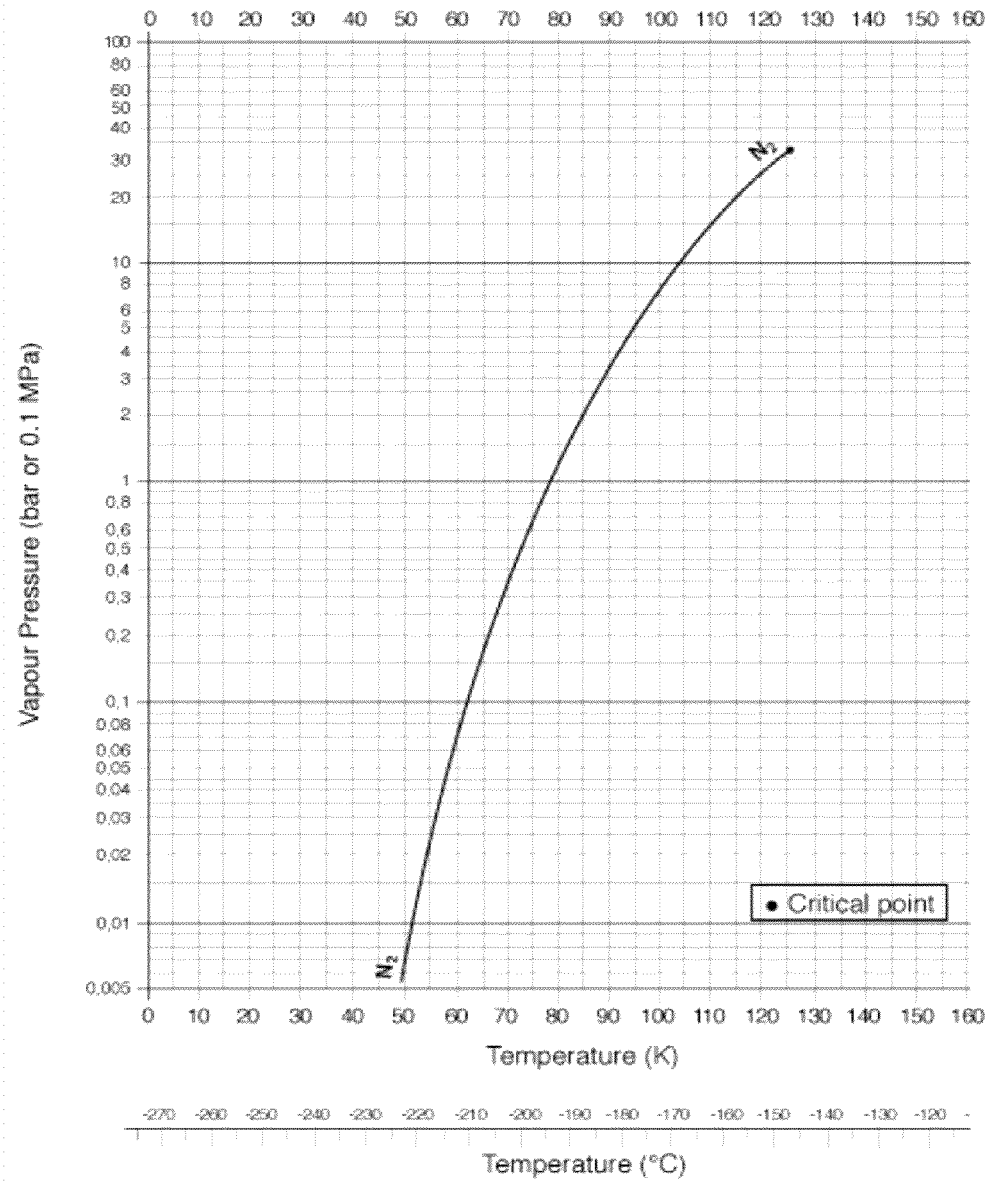
FIG. 8 is a temperature/pressure diagram.

Another benefit of cryogenic cooling with liquid nitrogen or equivalent cryogenic cooling is the behavior change of atomic particles in the phase of deep cold. The triple point of liquid Nitrogen is −210.1 C. The critical point for transition to a gas is −147 C—refer to FIG. 8, a temperature/pressure (T/P) diagram.

At such deep freeze the atom particles' behavior is changing—the electron and photon spin vibration and rotation wavelength frequency emissions rapidly decelerates. At temperature below −200 C all electrons and photons freeze at standby orbital positions with very low kinetic energy, and low vibration frequency. This condition affects the Thompson energy field below transmission levels. From the other side at that moment the radiation energy level emission (MeV) from the nuclei remains almost unchanged. Since the nuclei mass is 99.5% of the atom, at temperature below −200 C it will take longer for electromagnetic wavelength emitted from the nuclei to drop down. Once that happens, the energy levels of emitted $\alpha$, $\beta$ and $\gamma$-rays will also drop down—detailed explanation is provided in the Technical Report—Part 5.

This artificial energy field deficiency in the atoms reverse the nuclei energy level emission into "self energy shielding" in order to balance the energy—following the basic rule in physics—matter is equal to the ratio between the energy of the particles and the energy of the field. This process creates rapid drop in radiation energy level emission (not the radiation type) during temperature below the nitrogen boiling temperature of −195.8 C. This phenomenon is very useful for much safe and easy handling of all assembly components—oxide fuel, cladding and assembly.

3.3 Method for spent fuel assembly preparation and processing, using liquid nitrogen cryogenic cooling or equivalent cryogenic cooling, that prevent release of undesirable materials during assembly dismantling and cladding chopping.

Since all metal surfaces after freezing become very cold and wet (covered with ice sheeting), their surface attracts all metal particles released from the chopping process. This voids any metal particle air pollution. Collection of such particles is done with simple washing. The sludge is directed for acid dissolution, or in case of very low HLW contamination to Unit 7—temporary storage. Since during chopping some of the oxide fuel is affected, all metal particles collected from washing are subject to acid dilution and separation in the process, as described in the flow diagram. This accomplishes the goal of complete spent fuel recycling, and decreases the Actinides content in the waste—a process that all existing recycling is not able to accomplish.

4. Method and process for removal of gas isotopes and one half of all heat emitting isotopes from fuel oxide with heating in an inert atmosphere at 1450 C. 50% of—Tellurium (at 1012 C) and 100% of—Cesium (at 686 C), Rubidium (at 705 C), Iodine (at 183 C), Tritium (at 100 C), Krypton (at −153 C), Xenon (at −108 C), Carbon C-14 converted to 14-CO2 (at 100 C) and heat emission by Cesium (50%). The remaining 50% contributed by Strontium-90 will be removed later in the waste sludge. Small part of Strontium [at 1357 C] and Europium [at 1430 C] also will be removed during this process. All separated gas isotopes will be captured in multiple Carbon/Zeolite filters in form of selected salts.

An easy and simple way to remove all gas isotopes from the fuel is to heat the fuel in an inert atmosphere at or above the element's boiling temperature. The selected temperature threshold in this case is 1450 C. This process is more technically simple to achieve and control, compared to using a vacuum. The process removes all gas isotopes—affects the radiation level in the following recycling phase and removes one half (50%) of the heat emitting isotopes—this will be very important when recycling fuel that has a short decay time. The remaining 50% of the heat emitted by Strontium-90 will be removed during the liquid-to-liquid separation. A detailed description of this disclosure as well as the list of isotopes and their reference boiling temperature that will be removed from the spent fuel was provided previously—Refer to the Technical Report and Tables. Technically all released gases will be captured in a multi layer Zeolite and Carbon filters, enriched with selected salts for forming stable compounds (example: Silver to capture the Iodine). The filters disposal process follows with conversion to a very low radiation level quasi-natural or artificial Feldspar, and their immediate permanent disposal. It should be noted that all existing technologies struggle to resolve the filtering issues and they require the added process of isotope separation and purification, ending with their disposal in a secure underground repository. This disclosure immediately resolves all issues, at no additional cost, including permanent safe and unrestricted disposal. The captured Krypton and Xenon have no stable salts and will be disposed as per the existing standards—industrial use or control release in the atmosphere. Controlling the autoclave inert temperature, provide capability for separate isotope capturing/if needed—each isotope has different boiling temperature.

5. Methods for methods and process for slow motion, non turbulent Vortex gravity separation of organic phase from the liquid phase.

This disclosure incorporates in the liquid isotope separation a process of slow motion Vortex gravitational separation. By theory Vortex is a rotational liquid motion achieving no forced centrifugal gravitational force effect at turbulent or non turbulent velocity. This disclosure incorporates slow motion Vortex at a non-turbulent velocity, achieving important for the separation process goals. One of them is the separation of organic phase (TBP/kerosene) from the liquid (acid solution). This process is done in a special design apparatus. The dynamics of phase separation combines the effect of centrifugal gravitational rotation forces with the natural density separation between two different density phases:

Centric gravitational forces are known as centrifugal effect but in slow non turbulent motion. The gravity rotation centric forces separates the phases by their density, pushing the heavier at the peripheral and keeping the lighter organic in the center (following the well-known law of physics);

The density difference separation effect is also when the solution enters into a liquid phase at elevation ⅓ to ¼ of the cylinder height. Since the solution is mixed with lighter density than the one in the apparatus, after entering, the organic fraction tends to move rapidly upwards to achieve a point of density equilibrium. This process is delayed by the induced in the cylinder Vortex effect, keeping the liquid fraction down and against the periphery, and pushing the organic fraction up and towards the center.

Combination of both effects in this disclosure provides very high efficiency level of phase separation, which has not been achievable in any existing column type forced phase separation.

5.1 Method and process for 45 minutes gravity separation relaxation of organic phase from the liquid phase.

The forty five minute window gravity phase separation relaxation relates to the end of short duration aerometric Stokes law based liquid analysis (ASTM, ASHTO)—the logarithmic aerometric time scale is divided in two time bands a) SHORT—30 sec, 1 min, 2 min, 5 min, 10 min, 15 min, 30 min and b) LONG—1 hr, 2 hr, 3 hr, 6 hr, 12 hr and 24 hr. Since our solution does not have any particles above size #200 (0.005 mm), and it is in the molecule size range, the short time band gravity relaxation accomplishes separation of the organic (TBP/Kerosene) phase from the liquid one (acid liquid). The 45 minutes time frame combined with the slow motion Vortex application described in this disclosure, achieves the best-known single-step separation process.

It should be noted that all existing technologies were relying on forceful separation, using multi phase proportions (starting from 5% organic phase), achieving additional accommodation for selected isotope separation, but at a high equipment cost and complex process requirements. As a result the U/Pu separation is only partially successful the first time around, requiring multiple repetitions of the process. The final waste release has an elevated content of U and Pu, creating additional burden for the disposal.

5.2 Method and process for liquid to liquid separation of Uranium and Plutonium contained in organic phase of TBP/kerosene at volume of 33% and liquid phase of nitric acid containing Actinides and Fission product isotopes in volume of 67%.

For process simplification purpose, the disclosure sets the ration between the acid liquid phase and the organic phase at 67% (acid liquid) and 33% (TBP/kerosene) respectively. The reason for that is that this disclosure does not require any additional isotope separation, targeting a successful separation at the outset. The selection of the 33%/67% ratio was theoretically ruled by the rule of "2" related to Stokes law—for each organic molecule in the mix; two acid liquid molecules should be available. In this ratio, at vigorous turbulent mixing, the solution experiences an excessive level of surface activation energy (dynamic coagulation), facilitating the best conditions for separation of Uranium and Plutonium.

Once mixing is suspended and surface activation energy starts to fall, the U/Pu separation will continue, in accordance with Stokes' law gravitational phase separation. Such multi phase transition provides the best separation performance.

5.3 Method and process for separation of un dissolved metal fraction from liquid phase.

The liquid-to-liquid phase separation requires filtration of all undissolved in acid metal particles. All existing technologies rely on mechanical filtration (filtering system with certain allowable particle size passage) or use of centrifuges (turbulent) to extract it. They all require additional equipment and processing cost—such equipment has high level of wear and tear, and requires rigid maintenance. This disclosure incorporates a unique process of Vortex induced, slow motion, and non-turbulent separation. The benefits of this disclosure are that the process of solids separation is incorporated with other processes. As a result, the separation is easy to perform and does not require a costly operation/maintenance and staff.

The process of slow motion Vortex separation works by incorporating the unique properties of this phenomenon:

- Once the mixture enters the Swirl cylinder, the self inducing slow motion Vortex starts;
- The centric gravitational forces push the heavier metal particles toward the cylinder periphery;
- Since this happens at elevation below ½ of the Swirl cylinder, the same Vortex centric forces pull the heavier metal particles to the bottom (the Vortex velocity in the narrow segment along the cylinder walls is several times slower, due to the natural friction between the liquid and the walls, which allows the gravity to pull the particles down);
- From there the downgraded conic bottom geometry accelerates the Vortex toward the lowest point—all metal particles congregate at this point and naturally fall down into the installed cup and exit the Swirl cylinder.

The process is self-controlled and does not require any staff interruption. Generally the first to separate are the heaviest metal particles followed by the lighter weight. Absence of turbulent motion prevents formation of any uplifting forces effecting metal particles.

6. Methods for methods and process for quasi-permanent or long term disposal, of converted to quasi-natural or artificial very low radiation level Feldspar minerals, all remaining from liquid to liquid separation HLW sludge amounts of Actinides and Fission Products Once the low radiation level artificial Feldspar is produced and converted to pellets or other solid form, the product will undergo the following:

- Load, Transport to selected for permanent disposal nearby site and unload;
- In case of pellets—Place as engineering fill in lifts of 8" to 12" and compact it to 85% to 87% MDD at OMC when dispose in open mine pits, surface dikes or trenches; or air jetting in underground mine facilities. At long horizontal shafts, periodic compaction with vibratory plates at angle of 33 degree to 47 degree is recommended. In case of solid blocks—placed as dry masonry without open joints. Once blocks installation is completed, all joints will be seal with very dense clay sludge—deploying well know property of sealing with clay coagulation;
- Seal the final surface with minimum 3 ft of high plastic index (PI) clay at moisture content (MC) not less than ½ of the soil Plastic Index, and compacting to 87% to 90% of MDD. Prior placing of geo textile is recommended;
- Provide final surface grading to accommodate natural grade drainage, avoid paddling and surface erosion;
- Cover the surface with Geotextile using long double "I" non corrosive clips;
- Cover the surface with minimum 2 ft of crushed aggregate rejects from nearby quarry, construction/asphalt aggregate production facilities. Roll the surface in order to achieve interlocking of the rock aggregates. Around the periphery provide additional erosion support from large size continuous cobble/boulders made berm. The sealing process in underground mine facilities is provided in other claim.

6.1 Method and process for quasi-permanent or long-term disposal, of all converted gas isotopes into quasi-natural or artificial very low radiation level Feldspar minerals.

As explained in claim 1.4, once all isotopes captured in the filtering materials are converted to low radiation level quasi-natural or artificial Feldspars, they are processed for permanent disposal as follows:

Converting produced Feldspars to selected size pallets or other solid form;

Loading and transportation to nearby selected location for disposal;

Unloading and placement as: a) case of pellets—engineering fill, in underground closed for exploration mine facilities; or close for operation surface open mine pit; or surface burial, dikes and trenches, and b) solid blocks—as dry masonry without open joints;

Fill placing will be done in lifts of 8" to 12" and compacted to 85% to 87% of MDD at OMC. Due to the already present isotopes in the fill the density control is preferable to be done using radio frequency gauges or proof rolling test and avoid the use of nuclear gauges (nuclear gauges in this are applicable only when they work in "back scattering mode" because even in trace amounts the isotopes in the fill will interfere with the gauge calibrated emission of Americium/Strontium in the probe). Since the radiation level is very low matching the level of the host, use of sand cone test or water balloon test is permissible;

Capping the engineering fill top will be different and relates to the facility type—explained in other claims.

6.2 Method and process for quasi-permanent disposal or storage of quasi-natural or artificial very low radiation level Feldspar minerals, into closed for exploration underground mine facilities.

Reference to FIG. 1—Universal Nano-Flex Technology Application in Various HLW Scenarios.

Underground closed for operation mine facilities are another option for permanent deposit of produced very low radiation level artificial Feldspars. The reason this alternative is attractive is because there are not any restrictions, they are available at a low cost for a very large volume, and they are left for decades to self-collapse, or fill with ground water. After their closure these mine facilities create more environmental issues and soon become a point of public concern. In general, underground mine facilities are in an isolated location where nature accumulates one or complex of mineral resources which are a matter of industrial exploration. Additionally, these mine facilities have specific environmental issues with some time extremely elevated content of one or a group of chemical elements, which pose hazard to the biosphere. On a positive note, nature is capable of reaching mass equilibrium with the host matrix thereby isolating the hazard to a small transition zone in the region. Almost all underground mine facilities are related to pass hydrothermal activity that creates these rich on minerals veins. From geochemical point of view, these hydrotherms were a source of one or a group of isotopes that exist independently, or in a mixed matrix with other stable elements. The morphology of underground coal mines is different but they also can be attractive for permanent deposit—usually have elevated content of Strontium and in some case Uranium.

This phenomenon is used by this disclosure to convert HLW to quasi-natural or artificial Feldspar with equal or lower radiation level of the host matrix. This in turn means that this disclosure keeps the mass equilibrium equal to natural equilibrium in existence at these sites. The process is as follows:

Determine the natural isotopes content in the host (horizontal and vertical grid GIS map) form pre-exploration history. Pre-exploration and during exploration investigation, testing and modeling are sufficient to produce such GIS layer;

Deploy recycling facility from mobile detachable units (see the process flow diagram, and claim 7) at the mine site (avoiding any transportation issues, except initial delivery of subject to reprocess HLW). Mine facilities usually have a very large size yard, able to accommodate any size of recycling facility—requires by law to have operations and buffer zone;

Tune up the production isotope proportions for artificial Feldspars in order to match the existing natural isotope levels (Ref. to JMF Protocol and claims 1.14 and 1.16);

Production of quasi-natural or artificial very low radiation Feldspar (including, but not limited to recycling, production, pellet/solid blocks upgrading, etc., as provided in this disclosure);

Start filling the mine facility from the bottom up, following the following rule—first all horizontal shafts (cavities) at one mine elevation are filled then transition vertically to the next. Case of Pellets—An air jet, also called "gravel size blow up heads", performs the method of filling—multi level pressurized compressor-based duct with continuously connected large size flexible piping transporting the Feldspar pellets from the mine entrance to the depositing location. The high air pressure blowing the pellets achieves interlocking of the particles at the point of deposit. From other hand is recommended that after filling each 10 to 15 ft to be apply vibratory plate compaction at angle 33 to 47 degree as density proof (when the pellets are loose, the plate vibration noise is loud, but reaching the maximum density, the plate vibration noise diminishes). In case the bottom of the mine is already floated, temporary actions for dewatering will be required, until the fill comes up above the floating elevation. Since the empty volume will be significantly less, hydraulically the drainage of ground water will be less (ground water percolation relates to the value of pore pressure). The delivery of pellets could be done remotely or with limited staff equipped with required mine safety gear. The process is very simple and does not require any precision. Remote operation under surveillance is recommended. This will avoid specific requirements for forced ventilation, and surface filtering;

Case of solid blocks—place as dry masonry without open joints. After completion, seal the joints with high density clay sludge (coagulation to seal);

Once the mine is filled with quasi-natural or artificial Feldspar to the top entrance, standard measure for sealing of the mine will be undertaken. One of the most common methods is to demolish the last several hundred feet to the entrance with explosives. But other solutions are technically available;

After closure, all production detachable units will be disassembled, transported to new site, re-assembled, and the production process deployed.

Since the radiation level of produced quasi-natural or artificial Feldspar will match the level in the host, no action of isolation, decommissioning, or any safeguarding is required.

The mine site will be returned to the original conditions present prior to establishing the mine. The only difference—reduced contamination levels. Any required surface remediation will follow standard landscaping practices (grading, top soil, planting vegetation).

6.3 Method and process for quasi-permanent disposal or storage of quasi-natural or artificial very low radiation level Feldspar minerals into closed for exploration open pit mine facilities Reference to FIG. 1—Universal Nano-Flex Technology Application in Various HLW Scenarios.

Open mine pit facilities are location for selected mass mineral extraction from the crust's surface. As per the type of mineral source, these locations have naturally elevated content of contamination and isotopes, including a large buffer zone around. This is ruled by the erosion transport mechanics of forming such deposits. Once exploration is completed, these facilities are subject to reclamation—the process of partial restoration and grading. History indicates that reclamation is usually delayed due to financial, political and other burdens. Many decades later, with combine efforts from Federal, State, Local and municipal tax burden participation, such reclamation is accomplished. Open pit mine facilities are very good candidates for disposing quasi-natural or artificial very low radiation level artificial Feldspars, at a much more economical level—the produced artificial Feldspar will have isotopes content to match or be below the isotopes content in the host. The process consists of the following steps:

- Determine the natural isotopes content in the host (horizontal and vertical grid GIS map). Pre-exploration and during exploration investigations testing and modeling are sufficient to produce such detail GIS layer;
- Deploy recycling facility from mobile detachable units (see the process flow diagram) at the mine site (avoiding any transportation issues, except initial delivery of subject to reprocess HLW);
- Tune up the production proportions for quasi-natural or artificial very low radiation level Feldspar in order to match, or be at least 5% below the existing natural levels (Ref. to JMF Protocol and claim 1.14);
- Production of quasi-natural or artificial very low radiation Feldspar (including, but not limited to recycling, production, pellet or other solid form upgrading, etc., as provided in this disclosure);
- Case of pellets—Placing produced Feldspar as engineering fill—lifts from 8" to 12", compacted to 85-87% of MDD at OMC. Transfers vertical lift schematics to avoid "cold joints" vertical water infiltration. Case of sold blocks—place as dry masonry without joints. Seal the joints with clay sludge (well know clay coagulation);
- Final lift elevation—1 ft below the pit final grade at 90% MDD at OMC;
- Place minimum 3 ft of high Plastic Index clay at OMC ½ of the Plastic Index water content and density of 90% of MDD. Grade the final surface to have good drainage and prevent water paddling;
- Cover the surface with Geo textile for future needs as indicator of the fill beginning. Attach the Geo textile to the ground with double "I" form, long type, and non-corrosive landscaping clips;
- Place minimum 2 ft of crushed medium or large size rock rejects from a nearby quarry, construction material production site, or asphalt plant. Protect the edges from erosion with cobble/boulder size rock berms;
- If required by the local Authority provide additional landscaping—topsoil, planting permanent vegetation, etc.

6.4 Method and process for quasi-permanent disposal or storage of quasi-natural or artificial very low radiation level Feldspar minerals, into surface type burials including dikes, berms, trenches, large size burials and other disposal or storage arrangements.

Reference to FIG. 1—Universal Nano-Flex Technology Application in Various HLW Scenarios.

Surface burial is the most common and cheap way to dispose radioactive waste, but requires excavation and grading. Currently only LLW burial is permitted. These burial sites are subject to very comprehensive selection, approval, control by Government entities, but the major one is the requirement for safeguarding minimum of 300 years after closure (it a matter of time that the 1000 years will become mandatory). This means that the cost of the burials will be extended for the next minimum 300 years safe guarding, including any liability that may come from engineering barrier failure. This disclosure resolves all these concerns with a one-time action—the time of final disposing of the very low radiation level quasi-natural or artificial Feldspar. The first one is to consider that the disposal will be done in the form of an engineering fill (pellets or solid blocks). The rules of that are already established by the civil science. Any engineering fill, as an artificial product, needs to respond to several civil engineering requirements:

- Preparation of the natural ground, before placing;
- Technology of delivering, and deploying—placing, compaction, erosion control during operations, dust control, and protection (temporary the site needs to have a construction fence and Pollution Prevention Storm Drain Plan—PPSDP);
- Final preparation of the final fill grade (entombment);
- Establishing permanent erosion control and surface protection such as permanent vegetation, stone berms and filters and i.e. engineering measures;
- Closing activity and demobilization—means the site will be accessible to the public.

Since our fill will have specific properties equal to the soil/rock properties of the host, no requirements for radiation protection will be required—a major requirement of this disclosure is that the fill will have equal radiation level or at least 5% below the radiation level of the host. Taking in consideration of the targeted design of the artificial Feldspars—initial reduced amount of molecule water in the unit—requires simple additional preparation as follows:

- Selection of site for disposal (approval process is already established—local authority site approval, excavation permit, submittal of process, activity period, structural fill plan and property, final grading plan, closure and demobilization, safety and PPSDP);
- Site preparation—removal of top soil, minor excavation/grading if required, establishing temporary erosion controls, and air pollution controls, fence, access road, traffic control, etc.—no on site temporary stock piles will be allowed;
- Placing Geotextile at the fill bottom—this is made if required for future reconstruction of the fill depth only;
- Case of pellets—Delivery and placing artificial Feldspars in lifts of 8" to 12" at 85-87% MDD at OMC—continuous density control—radio frequency density gauges or proof rolling test, avoid use of nuclear gauges, except in "back scattering mode." Each following lift is transferring to the previous one—to avoid formation of vertical "cold joints" after earth quake as way for vertical infiltration—this will be establish in design vertical fill cross profile. The top grading of each lift should be close to the design of the final fill grading—this prevents any possible soil cavitations in case of large volume surface water flow (such as nearby reservoir failure, rivers flooding, excessive rain as hurricane or climate change, etc.). Case of solid blocks—Placed as dry masonry without joints. Seal the joints with high density clay sludge (clay coagulation);

Final lift—requires minimum 90% MDD at OMC;

Final fill grading—designed to prevent surface water paddling, or rapid surface water flow as a result of excessive slope grading;

Placing minimum 3 ft of high plastic index clay at OMC near or above ½ of Plastic Index water content;

Placing Geotextile attached with long double "I" non-corrosive landscaping clips;

Placing minimum 2 ft of medium to large size crushed rock rejects from the nearby quarry, construction material production site or asphalt plant;

Rolling the final rock fill to interlock the aggregates;

Building peripheral berms from cobble or boulder size rocks;

Decorative surfacing—if required by the State, Local or Municipal Authority, such as placing top soil, planting permanent vegetations and i.e.

It should be noted that the initial design water deficiency in the quasi-natural or artificial Feldspar would prevent, for very long geologic time (10K to 100K or more), any solute transport from the Feldspar to the host. The other expected possibility is transport from the host to the artificial Feldspars until mass balance equilibrium is reached. Such burials are very low cost and easy to deploy almost everywhere, except areas with running surface water (rivers and streams, swamps and marshes), and are prohibited in areas with excessive organic content such as peat or a shallow ground water table.

7. Method for industrial recycling facility of HLW/spent fuel rods, depleted uranium or other classified as HLW, with detachable interconnected mobile units temporary buried with isolation soil berms/dikes.

Reference to Enclosed Nano-Flex HLW Spent Fuel Rods Recycling and Permanent Disposal Flow Diagram—FIG. 2.

It should be noted that all existing HLW recycling facilities are built as industrial type heavy high-rise infrastructure. The reason for this is that traditionally they were designed as industrial production footprints. In general, such facilities are very expensive, take long time to build and deploy and require very heavy utility infrastructure. An additional weighing requirement is that they demand additional various purification process deployments, for cleaning the produced additional solid, liquid and gaseous HLW. This disclosure avoids or resolves completely all of the above issues, deploying new very untraditional design.

Since the entire recycling and CFR process in this disclosure was designed in modular flow schematics, it also deploys new, very low cost, easy and quick decommissioning, extremely safe in case of natural disaster or accident production process. It consists of interconnected, detachable, mobile units, buried under soil isolation/insulation dikes.

Figure 9:
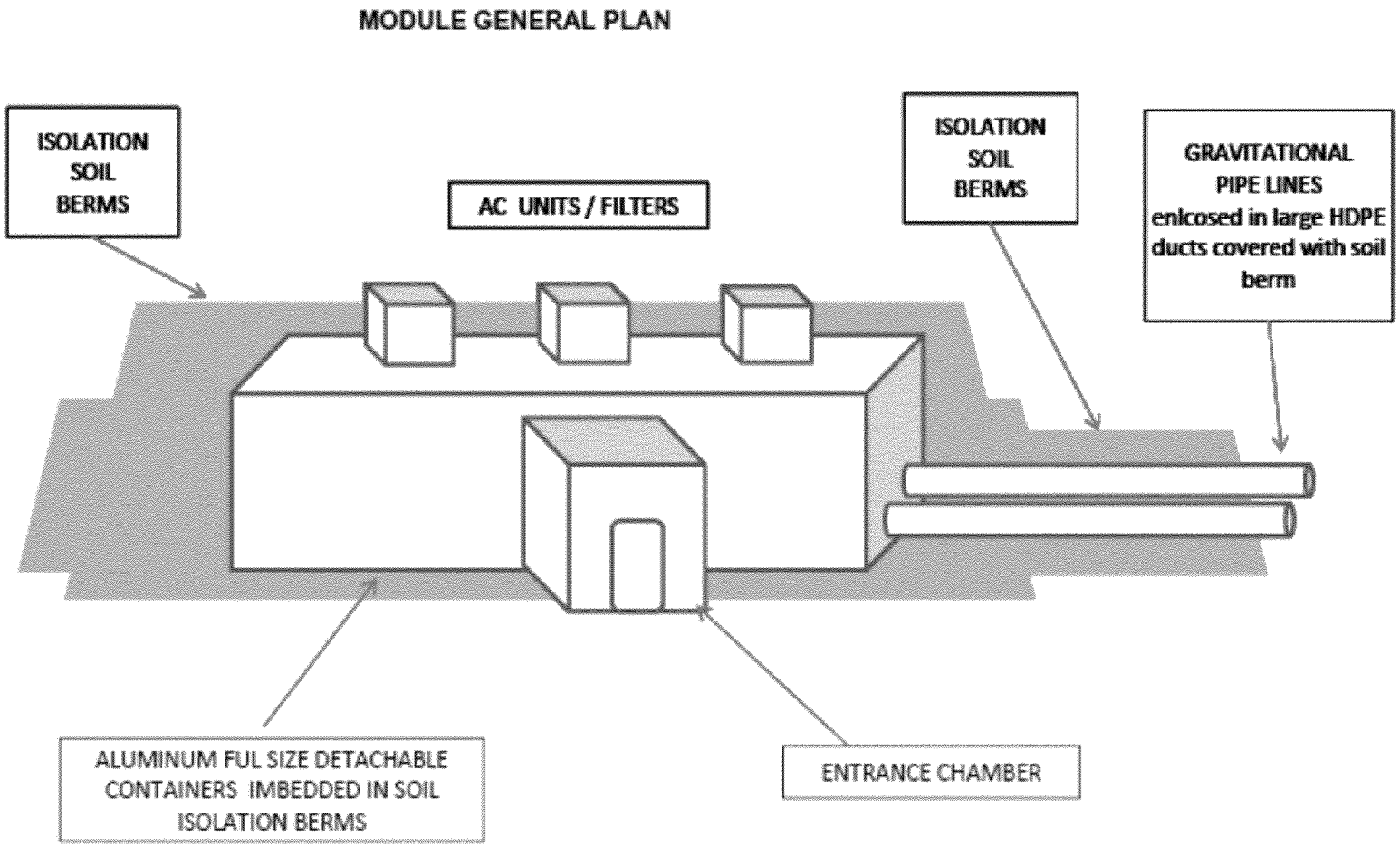
FIG. 9 is a schematic representation of a facility for recycling nuclear waste and other types of toxic waste.

Each unit, an embodiment of which is shown in FIG. 9, is constructed from interconnected, large volume alumina made cargo type containers, buried under 3 to 5 ft soil dikes—except the entrance chamber and the A/C or roof filtering units, attached to metal frames matching the top of the soil dikes. All production units are interconnected with piping/ducts transporting the liquid product from one unit to other.

All piping/ducts are installed in large size HDPE pipes, buried also under 3 to 5 ft soil dikes. HDPE large size pipes serve as a passageway for surveillance/maintenance crew, additional radiation shielding and prevention of any liquid leaks, in case of failure of utility pipes. This way, there is no chance of contamination from accidental liquid leaks—the system is self-containing. Selection of production site with one plane surface grade can be used also as accommodation of gravitational liquid transport between the units—no pumps or moving parts are present, therefore not subject to maintenance. Separation of the entire process in isolation units provides inexpensive, very high level of security including the most important one (radiation protection and shielding via very low cost soil entrapments), in case of disaster or an accident (natural disaster, fire, explosion and i.e.).

The soil dikes void completely any radiation sky shine effect. The interior of the interconnected detachable alumina containers are covered with radiation protection sheeting's, which are very easy to install and remove during decommissioning. Only 9% (DOE data related to Nuclear reactor decommissioning) of the entire facility will be highly irradiated which means that after production ceases, all containers after a 3 month waiting period (except Unit 1) can be extracted from the soil dikes and moved to another site, or safely re-used.

Unit 1 will require special attention since it is expected to be highly irradiated. After shielding removal, the remaining irradiation level areas need to be determined. In case the unit is moved to another site or re-used, additional protection measures will be required during transportation (DOE/DOT requirements). In case of scrapping, two option exists: a) Chopping and heating/melting to 3340 C to remove all isotopes and re-use the metal; b) chopping, dissolving, converting to very low radiation level quasi-natural or artificial Feldspar and quasi-permanently disposal or storage as described in this disclosure.

Alternatively, during the final ceasing phase of all activity (last production site), and removal of all disposable equipment, and shielding, the bear wall containers and HDPE ducts could remain under the soil dikes, and be filled with fine size sand using an air jet. Once filled, the sand will be soaked with water to consolidate. All openings will be sealed and buried with same 3 to 5 ft soil. The top of the site will be graded to prevent surface erosion and covered with 1 ft of crushed rock fractions rejected from a nearby quarry, crushing plant for production of road fractions, asphalt plant, or other installation for production of construction rock materials. Such simple schematics prevent the possibility of human intrusion, exhumation, or radiation pollution. The remained radiation level in unit 1 will drop below the hazard threshold within a 3 years period.

8. Apparatus design, for self powered, self controlling, gravitational separation of Uranium and Plutonium (organic phase) from the fission products (aqueous phase), and separation of all un dissolved metal particles in the liquid Reference to Enclosed Schematics of Gravity Separator/Solids Filtration Apparatus—FIG. 4.

The apparatus consists of 4 inter connected chambers representing 5 different operations. Each chamber is equipped with an independent lid/seal type of access for inspections, observations, cleanup and maintenance (if required).

Swirl Chamber (1)

Cylindrical geometry (easy for criticality control) with seal type lid on the top and conical bottom for collecting all undissolved (in liquid), particles. At the low ¼ of the cylinder height, an inlet pile for delivering the solution is located as a tangent. Since the solution is entering under very low pressure, it will naturally form a vortex, serving two purposes: a) by nature, gravity centrically forces will split the phases in the solution, and b) the same forces will pull all undissolved metal particles toward the cylinder periphery, and bring them down at the low point of the conical bottom. The Vortex at the bottom will aggregate the particles at the lowest point of the cone, into a cap-type little chamber, from where they will exit the apparatus. Since the solution is split quickly by the Vortex into two phases, the solution slowly will rise to the point of a high flow control window and overflow into the second chamber. Attached outside the wall a piezometer will serve as an automatic measuring gauge for the solution level in the cylinder. Once all chambers are filled to the High flow control, the process of phase separation/solid filtration will continue automatically (self-controlled) without outside interruption. The inflow from the inlet pipe is under automatic overflow controls, installed at the top of each piezometer.

NOTE: For first time use, the apparatus must be filled with a solution not less than 75% of the volume. This is required to avoid any organic phase passage at designated for aqueous (low windows).

Gravity Separation Chamber (2)

Around the overflowing High flow control window, circular segment geometry screen shell will help: a) downgrade the flow of the solution after entering the chamber b) separation of the phases, and c) preventing direct solution flowing toward chamber #3. Since the solution is overflowing slowly (total time of approximately 45 minutes), the phases entering the chamber will continue gravity separation at 100% proficiency. The separation process is accelerating via chamber width reduction to 50% of the width of the swirl chamber, preventing any turbulent motions in the solution (the increased liquid friction along the apparatus walls will form centric velocity flow toward chamber #2 of both organic and liquid phases). The wall connecting chamber #3 has two windows (openings), a lower one—below the bottom elevation of inlet pipe (chamber #1) for transfer of TRU aqueous solution (as flow table wall), and an upper one matching the High Flow control elevation—for transferring the Uranium & Plutonium organic phase. All openings have a ratio (length to width) of 6—little bit greater than the horizontal static liquid flow diagram—voids formation of liquid turbulence, after the liquid passes the window).

Screen Chamber (3 and 4)

Chambers 3 and 4 are identical with only one difference—chamber #3 is twice as long as chamber #4. The reason for that is to achieve complete phase separation. At volume distribution of 30/70% are installed conical screens with opening at the lowest point, serving as easy downward motion of any aqueous phase from the upper section and vise versa (screen opening size should not resist organic solution passage—ratio between highest liquid viscosity and the size of single screen opening). Since the original solution design is in the ratio of 33/67%, (organic to aqueous) the chamber volume distribution serves as phase splitting point somewhere at the middle of the screens. Each phase will move to chamber #4 via; a) low opening (at the middle of the 70% volume) and b) overflowing at high flow control. The process is repeating in the smaller chamber #4 to achieve 100% phase separation. Each phase exits the apparatus via outlet pipes.

The bottoms of Chamber #2 and #3 are inter-connected into a combined cone. Chamber #4 has a separate conical bottom. Each cone ends with a pipe that reverts any solution back to the inlet pipe. Such configuration provides; a) cleaning the apparatus without any liquid leaving the system and b) preventing any possibility of overflowing the High flow controls after piezometer failure. It should be noted that gravity separation speed relates to solution temperature. The apparatus' ability to revert flow thru the bottom outlets helps in case temperature adjustment is needed. The apparatus is very simple, easy to operate, without any moving parts, power supply or process controls. Outside each chamber will be installed multiple transparent piezometer, providing automatic liquid level measurements of organic and aqueous phases (for precision one piezometer for each 20% of the volume/chamber heights). The unique design provides easy and safe operation at any conditions. Overflowing is preventing by an automatic level control, connected to a double circuit shutoff on the inlet pipe (floatable shut-off is installed inside the piezometer serving the Swirl and #4 chambers). Periodical clean up (washing the interior) will be drained from the bottom of Chamber #1, 2-3, and 4 separately. The waste will go directly to the final waste collector storage, for processing in CFR or reverting to the solution supply tank.

Each of TABLES 1-7 has been split into a number of sub-tables. Column numbers have been provided in each of these tables and their sub-tables for convenience in understanding the data that has been set forth in the tables.

TABLE 1

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

TABLE 1A

| 1 Isotopes | 2 | 3 Mass | 4 Prod. | 5 | 6 | 7 physical form | 8 |
|---|---|---|---|---|---|---|---|
| Name | index | no A | type | Gas | Metal | Oxide | Solid Sol. |
| Actinides | | | | | | | |
| Uranium | U | 233 | α | | | X | |
| | U | 234 | α | | | X | |
| | U | 235 | α | | | X | |
| | U | 236 | α | | | X | |
| | U | 238 | α | | | X | |
| Neptunium | Np | 239 | α | | | X | |
| Plutonium | Pu | 238 | α | | | X | |
| | Pu | 239 | α | | | X | |
| | Pu | 240 | α | | | X | |
| | Pu | 241 | α | | | X | |
| | Pu | 242 | α | | | X | |
| Americium | Am | 241 | α | | | X | |
| | Am | 242 | α | | | X | |
| | Am | 242m | α.IT | | | X | |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | | | |
|---|---|---|---|---|---|---|---|
| | Am | 243 | α | | | X | |
| Curium | Cm | 242 | α | | | X | |
| | Cm | 243 | EC | | | X | |
| | Cm | 244 | α | | | X | |
| | Cm | 245 | α | | | X | |
| | Cm | 246 | α | | | X | |
| Fission Products | | | | | | | |
| Tritium | H | 3 | β | X | | | |
| Selenium | Se | 74 | γ | | | | |
| Bromine | Br | 79 | α | X | | | |
| Krypton | Kr | 85 | γ | X | | | |
| Rubidium | Rb | 86 | | X | X | | |
| Strontium | Sr | 89 | γ | | X | X | |
| | Sr | 90 | β | | X | X | |
| Yttrium | Y | 90 | β | | | X | |
| | Y | 91 | γ | | | X | |
| Zirconium | Zr | 93 | | | X | X | |
| | Zr | 95 | β, γ | | X | X | |
| Niobium | Nb | 94 | γ | | X | X | |
| | Nb | 95m | | | X | X | |
| | Nb | 95 | β, γ | | X | X | |
| Molybdenum | Mo | | | | X | X | |
| Technetium | Tc | 99 | γ | | X | | |
| Ruthenium | Ru | 103 | β, γ | | X | | |
| | Ru | 106 | β, γ | | X | | |
| Rhodium | Rh | 103m | IT | | X | | |
| | Rh | 106 | β, γ | | X | | |
| Palladium | Pd | 107 | | | X | | |
| Silver | Ag | 110m | γ | | X | | |
| | Ag | 110 | γ | | X | | |
| | Ag | 111 | γ | | X | | |
| Cadmium | Cd | 113m | | | X | | |
| | Cd | 115m | | | X | | |
| Indium | In | 115 | α | | X | | |
| Tin | Sn | 117m | | | | | |
| | Sn | 119m | | | | | |
| | Sn | 123 | | | | | |
| | Sn | 125 | | | | | |
| | Sn | 126 | | | | | |
| Antimony | Sb | 124 | | | X | | |
| | Sb | 125 | | | X | | |
| | Sb | 126m | | | X | | |
| | Sb | 126 | | | X | | |
| Tellurium | Te | 123m | | X | X | X | X |
| | Te | 125m | | X | X | X | X |
| | Te | 127m | | X | X | X | X |
| | Te | 127 | | X | X | X | X |
| | Te | 129m | | X | X | X | X |
| | Te | 129 | | X | X | X | X |
| Iodine | I | 129 | γ | X | | | |
| | I | 131 | β, γ | X | | | |
| Xenon | Xe | 131m | | X | | | |
| | Xe | 133 | | X | | | |
| Cesium | Cs | 134 | γ | X | | X | |
| | Cs | 135 | γ | X | | X | |
| | Cs | 136 | γ | X | | X | |
| | Cs | 137 | β, γ | X | | X | |
| Barium | Ba | 137m | | | | X | X |
| | Ba | 140 | β, γ | | | X | X |
| Lanthanum | Ln | 140 | β, γ | | | | X |
| Cerium | Ce | 141 | β, γ | | | | X |
| | Ce | 144 | β, γ | | | | X |
| Praseodymium | Pr | 143 | γ | | | | |
| | Pr | 144 | | | | | |
| Neodymium | Nd | 147 | | | | | X |
| Promethium | Pm | 147 | α | | | | X |
| | Pm | 148m | γ | | | | X |
| | Pm | 148 | γ | | | | X |
| Samarium | Sm | 151 | γ | | | | X |
| Europium | Eu | 152 | γ | | | | X |
| | Eu | 154 | γ | | | | X |
| | Eu | 155 | γ | | | | X |
| | Eu | 156 | | | | | X |
| Gadolinium | Gd | 152 | γ | | | | |
| Terbium | Tb | 160 | γ | | | | |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | |
|---|---|---|---|---|
| Dysprosium | Dy | 156 | γ | |
| Carbon | C | 14 | | X |
| Iron | Fe | 55 | | |
| Nickel | Ni | 59 | γ, α | |
| | Ni | 63 | γ | |
| Cobalt | Co | 60 | γ | |
| Thorium | Th | 232 | α | |

| Reference | Col. # | Source Name |
|---|---|---|
| | 1, 2, 3, 4, 10, 21, 22, 23, 24 | Nuclear Chemical Engineering, Chapter 8, table 8.1 |
| | 4, 5, 6, 7, 8 | WEB - Detail property of fission products in Uranium dioxide |
| | 9, 10 | Nuclear Chemical Engineering - Appendix C - Properties of Nuclides |
| | 11, 12, 13, 14, 15, 16, | Nuclear Chemical Engineering, Table A.1; A.2 - ref to Nuclear Energy Agency, Paris, 1989, p 41, Plutonium Fuel; An Assessment - Organization for economic Development and Cooperation |
| | 17, 18, 19, 20 | Nuclear Chemical Engineering - Table 8.7, p 388, the quantities were re-calculated from g/Mg to g/Kg - The fission product activity represent uranium fuel. irradiated for 3 years in 1GWe PWR. G. V. Samsonov. Short lived radionuclide's are not listed. |
| | 25 | Nuclear Chemical Engineering, Table 9.10 |
| | 26, 27 | Nuclear Chemical Engineering, Table 11.2 - the quantities were re-calculated from g/MT uranium fuel to g/Kg |

TABLE 1B

| 1<br>Isotopes<br>Name | 3<br>Mass<br>no A | 9<br>Abundance | 10<br>Half Life<br>(yr) |
|---|---|---|---|
| Actinides | | | 1.62E5 |
| Uranium | 233 | 0.0056 | 2.47E5 |
| | 234 | 0.7205 | 7.1E8 |
| | 235 | | 2.39E7 |
| | 236 | 99.274 | 4.51E9 |
| | 238 | | (2.35 days) |
| Neptunium | 239 | | 86 |
| Plutonium | 238 | | 24 000 |
| | 239 | | 6580 |
| | 240 | | 13.2 |
| | 241 | | 3.79E5 |
| | 242 | | 458 |
| Americium | 241 | | (16 hours) |
| | 242 | | 152 |
| | 242m | | 7950 |
| | 243 | | (163 days) |
| Curium | 242 | | 32 |
| | 243 | | 17.6 |
| | 244 | | 9300 |
| | 245 | | 5500 |
| | 246 | | |
| Fission Products | | | |
| Tritium | 3 | 0.87 | 12.3 |
| Selenium | 74 | 50.6864 | n/a |
| Bromine | 79 | | n/a |
| Krypton | 85 | | 10.76 |
| Rubidium | 86 | | (18.66 days) |
| Strontium | 89 | | (52 days) |
| | 90 | | 28.1 |
| Yttrium | 90 | | (64 hours) |
| | 91 | | (58.8 days) |
| Zirconium | 93 | | 1.5E6 |
| | 95 | | (65 days) |
| Niobium | 94 | | 2E4 |
| | 95m | | (90 hours) |
| | 95 | 23.78 | (35 days) |
| Molybdenum | | | n/a |
| Technetium | 99 | | 2.12E5 |
| Ruthenium | 103 | | (39.6 days) |
| | 106 | | (367 days) |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | |
|---|---|---|---|
| Rhodium | 103m | | (57 5 min) |
| | 106 | | (30 sec) |
| Palladium | 107 | | 7E6 |
| Silver | 110m | | (253 days) |
| | 110 | | (253 days) |
| | 111 | | (74 sec)_ |
| Cadmium | 113m | | 14 |
| | 115m | 95.72 | (43 days) |
| Indium | 115 | | 6E14 |
| Tin | 117m | | (14 days) |
| | 119m | 42.75 | (250 days) |
| | 123 | | (125 days) |
| | 125 | | 2.7 |
| | 126 | | 10E5 |
| Antimony | 124 | | (60.4 days) |
| | 125 | | 2.71 |
| | 126m | | (19 min) |
| | 126 | | (12.5 days) |
| Tellurium | 123m | | (117 days) |
| | 125m | | (58 days) |
| | 127m | | (109 days) |
| | 127 | | (9.4 hours) |
| | 129m | | (34.1 days) |
| | 129 | | (68.7 min) |
| Iodine | 129 | | 1.7E7 |
| | 131 | | (8.25 days) |
| Xenon | 131m | | (11.8 days) |
| | 133 | | (5.27 days) |
| Cesium | 134 | | 2.046 |
| | 135 | | 3E6 |
| | 136 | | (13.7 days) |
| | 137 | | 30 |
| Barium | 137m | | (2.554 min) |
| | 140 | | (12.80 days) |
| Lanthanum | 140 | | (40.22 hours) |
| Cerium | 141 | | (32.5 days) |
| | 144 | | (284 days) |
| Praseodymium | 143 | | (13.59 days) |
| | 144 | | (17.27 days) |
| Neodymium | 147 | | (11.06 dasy) |
| Promethium | 147 | | 4.4 |
| | 148m | | (41.8 days) |
| | 148 | | (5.4 days) |
| Samarium | 151 | | 87 |
| Europium | 152 | | 12.7 |
| | 154 | | 16 |
| | 155 | | 2 |
| | 156 | 0.2 | (15.4 days) |
| Gadolinium | 152 | | 1.1E14 |
| Terbium | 160 | 0.0524 | (72.1 days) |
| Dysprosium | 156 | 1.107 | 0 |
| Carbon | 14 | | 5730 |
| Iron | 55 | | 2.6 |
| Nickel | 59 | 26.23 | 8E4 |
| | 63 | | 0 |
| Cobalt | 60 | 100 | 5.26 |
| Thorium | 232 | | 1.41E10 |

TABLE 1C

| 1 | | 11 | 12 | 13 | 14 | 15 | 16 |
|---|---|---|---|---|---|---|---|
| Isotopes | 3 | | | Fuel Isotopic | | | |
| Name | Mass | | | composition - % | | | |
| Actinides | no A | 33 MWd/kg HM | | 43 MWd/kg HM | | 53 MWd/kg HM | |
| Uranium | 233 | Fresh | Spent | Fresh | Spent | Fresh | Spent |
| | 234 | | Trace | | Trace | | Trace |
| | 235 | | Trace | | Trace | | Trace |
| | 236 | 3.25 | 0.884 | 3.7 | 0.76 | 4.4 | 0.768 |
| Neptunium | 238 | | 0.391 | | 0.481 | | 0.594 |
| Plutonium | 239 | 96.75 | 94.372 | 96.3 | 93.25 | 95.6 | 91.983 |
| | 238 | | Trace | | Trace | | Trace |
| | 239 | | 0.012 | | 0.021 | | 0.033 |
| | 240 | | 0.54 | | 0.572 | | 0.607 |
| | 241 | | 0.221 | | 0.262 | | 0.291 |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | | | |
|---|---|---|---|---|---|---|---|
| Americium | 242 | | 0.132 | | 0.16 | | 0.183 |
| | 241 | | 0.045 | | 0.068 | | 0.085 |
| | 242 | | 0.003 | | 0.005 | | 0.006 |
| | 242m | | Trace | | Trace | | Trace |
| Curium | 243 | | Trace | | Trace | | Trace |
| | 242 | | Trace | | Trace | | Trace |
| | 243 | | Trace | | Trace | | Trace |
| | 244 | | Trace | | Trace | | Trace |
| | 245 | | Trace | | Trace | | Trace |
| | 246 | | Trace | | Trace | | Trace |
| | | | Trace | | Trace | | Trace |
| | | 100 | 96.6 | 100 | 95.579 | 100 | 94.55 |
| TOTALS | | | 3.4 | | 4.421 | | 5.45 |

TABLE 1D

| 1<br>Isotopes<br>Name | 3<br>Mass<br>no A | 17<br>g/Mg<br>150-day decay | 18<br>g/kg<br>150-day decay | 19<br>Ci/Mg<br>150-day decay | 20<br>W/Mg<br>heat emission |
|---|---|---|---|---|---|
| Actinides | | | | | |
| Uranium | 233 | \| | \| | \| | \| |
| | 234 | \| | \| | \| | \| |
| | 235 | \| | \| | \| | \| |
| | 236 | \| | \| | \| | \| |
| | 238 | ↓ | ↓ | ↓ | ↓ |
| Neptunium | 239 | 9.54E5 | 954 | 4.05 | 4.18E−2 |
| Plutonium | 238 | 7.49E2 | 0.749 | 1.81E1 | 5.20E−2 |
| | 239 | \| | \| | \| | \| |
| | 240 | \| | \| | \| | \| |
| | 241 | \| | \| | \| | \| |
| | 242 | ↓ | ↓ | ↓ | ↓ |
| Americium | 241 | 9.03E3 | 9.03 | 1.08E5 | 1.52E2 |
| | 242 | \| | \| | \| | \| |
| | 242m | \| | \| | \| | \| |
| | 243 | ↓ | ↓ | ↓ | ↓ |
| Curium | 242 | 1.40E2 | 0.14 | 1.88E2 | 6.11E4 |
| | 243 | \| | \| | \| | \| |
| | 244 | \| | \| | \| | \| |
| | 245 | \| | \| | \| | \| |
| | 246 | ↓ | ↓ | ↓ | ↓ |
| TOTALS | | 4.70E1 | 0.047 | 1.89E1 | 6.90E1 |
| | | 9.64E5 | 963.966<br>36.034 | 1.082E5 | 6.1321E4 |
| Fission Products | | | | | |
| Tritium | 3 | 7.17E−2 | 0.717 | 6.90E2 | 2.45E−2 |
| Selenium | 74 | 4.87E1 | 0.048 | 3.96E−1 | 1.50E−4 |
| Bromine | 79 | 1.38E1 | 0.0138 | 0 | 0 |
| Krypton | 85 | 3.60E2 | 0.36 | 1.10E4 | 6.85E1 |
| Rubidium | 86 | 3.23E2 | 0.323 | 1.90E2 | 0 |
| Strontium | 89 | | | | |
| | 90 | 8.68E2 | 0.686 | 1.74E5 | 4.50E2 |
| Yttrium | 90 | | | | |
| | 91 | 4.53E2 | 0.453 | 2.38E5 | 1.05E3 |
| Zirconium | 93 | | | | |
| | 95 | 3.42E3 | 3.42 | 2.77E5 | 1.45E3 |
| Niobium | 94 | | | | |
| | 95m | | | | |
| | 95 | 1.16E1 | 0.0116 | 5.21E5 | 2.50E3 |
| Molybdenum | | 3.09E3 | 3.09 | 0 | 0 |
| Technetium | 99 | 7.52E2 | 0.752 | 1.43E1 | 9.67E−3 |
| Ruthenium | 103 | | | | |
| | 106 | 1.90E3 | 1.9 | 4.99E5 | 3.13E2 |
| Rhodium | 103m | | | | |
| | 106 | 3.19E2 | 0.319 | 4.99E5 | 3.99E3 |
| Palladium | 107 | 8.49E2 | 0.849 | 0 | 0 |
| Silver | 110m | | | | |
| | 110 | | | | |
| | 111 | 4.21E1 | 0.0421 | 2.75E3 | 4.16E1 |
| Cadmium | 113m | | | | |
| | 115m | 4.75E1 | 0.0475 | 5.95E1 | 2.13E−2 |
| Indium | 115 | 1.09 | 0.00109 | 3.57E−1 | 1.04E−3 |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | |
|---|---|---|---|---|---|
| Tin | 117m | | | | |
| | 119m | | | | |
| | 123 | | | | |
| | 125 | | | | |
| | 126 | 3.28E1 | 0.0328 | 3.85E4 | 1.56E2 |
| Antimony | 124 | | | | |
| | 125 | | | | |
| | 126m | | | | |
| | 126 | 1.36E1 | 0.0136 | 7.96E3 | 2.74E1 |
| Tellurium | 123m | | | | |
| | 125m | | | | |
| | 127m | | | | |
| | 127 | | | | |
| | 129m | | | | |
| | 129 | 4.85E2 | 0.485 | 1.34E4 | 1.66E1 |
| Iodine | 129 | | | | |
| | 131 | 2.12.E2 | 0.212 | 2.22 | 8.98E−1 |
| Xenon | 131m | | | | |
| | 133 | 4.87E3 | 4.87 | 3.12 | 3.04E−3 |
| Cesium | 134 | | | | |
| | 135 | | | | |
| | 136 | | | | |
| | 137 | 2.40E3 | 2.4 | 3.21E5 | 2.42E3 |
| Barium | 137m | | | | |
| | 140 | 1.20E3 | 1.2 | 1E3 | 3.93E2 |
| Lanthanum | 140 | 1.14E3 | 1.14 | 4.92E2 | 8.16 |
| Cerium | 141 | | | | |
| | 144 | 2.47E3 | 2.47 | 8.27E5 | 7.87E2 |
| Praseodymium | 143 | | | | |
| | 144 | 1.09E3 | 1.09 | 7.71E5 | 5.73E3 |
| Neodymium | 147 | 3.51E3 | 3.51 | 9.47E1 | 2.65E−1 |
| Promethium | 147 | | | | |
| | 148m | | | | |
| | 148 | 1.10E2 | 0.11 | 1E5 | 9.17E1 |
| Samarium | 151 | 6.96E2 | 0.696 | 1.125E3 | 2.18 |
| Europium | 152 | | | | |
| | 154 | | | | |
| | 155 | | | | |
| | 156 | 1.26E2 | 0.126 | 1.35E4 | 7.19E1 |
| Gadolinium | 152 | 6.29E1 | 0.0629 | 2.32.E1 | 3.34E−2 |
| Terbium | 160 | 1.15 | 0.00115 | 3.02E2 | 2.54 |
| Dysprosium | 156 | 6.28E−1 | 0.628 | 0 | 0 |
| Carbon | 14 | | | | |
| Iron | 55 | | | | |
| Nickel | 59 | | | | |
| | 63 | | | | |
| Cobalt | 60 | | | | |
| Thorium | 232 | | | | |
| TOTALS | | 3.09189E4 | 32.08054 | 1.149502E5 | 1.95708E4 |
| | | 9.949189E5 | −3.95346 | 2.231502E5 | 8.08918E4 |

TABLE 1E

| 1<br>Isotopes<br>Name | 3<br>Mass<br>no A | 21<br>at discharge | 22<br>Activity Ci/yr<br>150-day decay | 23<br>10-yr decay | 24<br>Element<br>Boil T © |
|---|---|---|---|---|---|
| Actinides | | | | | |
| Uranium | 233 | \| | \| | \| | |
| | 234 | \| | \| | \| | |
| | 235 | \| | \| | \| | |
| | 236 | \| | \| | \| | |
| | 238 | ↓ | ↓ | ↓ | |
| Neptunium | 239 | | | | |
| Plutonium | 238 | 4.05 | 4.05 | 4.05 | 4135 C. |
| | 239 | 1.81E1 | 1.81E1 | 0 | |
| | 240 | \| | \| | \| | |
| | 241 | \| | \| | \| | |
| | 242 | ↓ | ↓ | ↓ | |
| Americium | 241 | | | | |
| | 242 | 1.08E5 | 1.08E5 | 1.08E5 | 3508 C. |
| | 242m | | | | |
| | 243 | | | | |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | |
|---|---|---|---|---|---|
| Curium | 242 | | | | |
| | 243 | 1.88E2 | 1.88E2 | 1.88E2 | 2880 C. |
| | 244 | \| | \| | \| | |
| | 245 | \| | \| | \| | |
| | 246 | ↓ | ↓ | ↓ | |
| TOTALS | | 1.89E1 | 1.89E1 | 1.89E1 | |
| | | 1.082E5 | 1.082E5 | 1.082E5 | |
| Fission Products | | | | | |
| Tritium | 3 | 1.93E−2 | 1.88E−2 | 1.09E−2 | 100 C. |
| Selenium | 74 | 0 | 0 | 0 | 657 C. |
| Bromine | 79 | 0 | 0 | 0 | |
| Krypton | 85 | 0.308 | 0.3 | 0.162 | −153.4 |
| Rubidium | 86 | 1.34E−2 | 5.18E−3 | 0 | 705 C. |
| Strontium | 89 | 19.6 | 2.65 | 0 | |
| | 90 | 2.11 | 2.09 | 1.65 | 1357 C. |
| Yttrium | 90 | 2.2 | 2.09 | 1.65 | |
| | 91 | 25.5 | 4.39 | 0 | 3337 C. |
| Zirconium | 93 | 5.15E−5 | 5.15E−5 | 5.15E−5 | |
| | 95 | 37.3 | 7.54 | 0 | 4325 C. |
| Niobium | 94 | 3.95E−6 | 4.89E−6 | 2.3E−5 | |
| | 95m | 0.762 | 0.16 | 0 | |
| | 95 | 37.6 | 14.2 | 0 | 4842 C. |
| Molybdenum | | 0 | 0 | 0 | |
| Technetium | 99 | 3.90E−4 | 3.90E−4 | 3.90E−4 | 3927 C. |
| Ruthenium | 103 | 33.2 | 2.41 | 0 | |
| | 106 | 14.8 | 11.2 | 1.50E−2 | 4227 C. |
| Rhodium | 103m | 33.2 | 2.41 | 0 | |
| | 106 | 20.2 | 11.2 | 1.50E−2 | 3667 C. |
| Palladium | 107 | 3.00E−6 | 3.00E−6 | 3.00E−6 | 3112 C. |
| Silver | 110m | 0.1 | 6.64E−2 | 4.52E−6 | |
| | 110 | 4.33 | 8.65E−3 | 5.88E−7 | |
| | 111 | 1.08 | 1.03E−6 | 0 | 2163 C. |
| Cadmium | 113m | 2.86E−4 | 2.86E−4 | 1.74E−4 | |
| | 115m | 0.015 | 1.34E−3 | 0 | 770 C. |
| Indium | 115 | 0 | 0 | 0 | |
| Tin | 117m | 1.62E−3 | 9.65E−7 | 0 | |
| | 119m | 4.47E−4 | 2.95E−4 | 1.79E−8 | |
| | 123 | 0.242 | 1.05 | 3.87E−10 | |
| | 125 | 0.368 | 5.81E−6 | 0 | |
| | 126 | 72.2 | 1.05 | 1.49E−5 | 2722 C. |
| Antimony | 124 | 1.11E−2 | 1.95E−3 | 0 | |
| | 125 | 0.237 | 0.215 | 1.85E−2 | |
| | 126m | 6.13E−4 | 1.49E−5 | 1.49E−5 | |
| | 126 | 1.55E−3 | 1.50E−5 | 1.47E−5 | 1625 C. |
| Tellurium | 123m | 1.66E−5 | 6.82E−6 | 0 | |
| | 125m | 8.47E−2 | 8.69E−2 | 7.66E−3 | |
| | 127m | 0.42 | 0.167 | 0 | |
| | 127 | 1.96 | 0.62 | 0 | |
| | 129m | 1.56 | 7.38E−2 | 0 | 1012 C. |
| | 129 | 9.18 | 3.87E−2 | 0 | |
| Iodine | 129 | 1.01E−16 | 1.02E−6 | 1.2E−6 | |
| | 131 | 23.5 | 5.94E−5 | 0 | 183 C. |
| Xenon | 131m | 0.174 | 8.50E−5 | 0 | |
| | 133 | 43.9 | 1.46E−7 | 0 | −108.2 |
| Cesium | 134 | 6.7 | 5.83 | 0.228 | |
| | 135 | 7.79E−6 | 7.79E−6 | 7.79E−6 | |
| | 136 | 1.66 | 5.42E−4 | 0 | |
| | 137 | 2.94 | 2.92 | 2.33 | 686 C. |
| Barium | 137m | 2.75 | 2.72 | 2.18 | |
| | 140 | 39.5 | 1.18E−2 | 0 | 1634 C. |
| Lanthanum | 140 | 40.9 | 1.34E−2 | 0 | 3370 C. |
| Cerium | 141 | 37.9 | 1.53 | 0 | |
| | 144 | 30.2 | 21 | 4.11E−3 | 3470 C. |
| Praseodymium | 143 | 32.7 | 1.85E−2 | 0 | |
| | 144 | 30.5 | 21 | 4.11E−3 | 3017 C. |
| Neodymium | 147 | 16 | 2.58E−3 | 0 | 3111 C. |
| Promethium | 147 | 2.78 | 2.65 | 0.211 | |
| | 148m | 1.06 | 8.91E−2 | 0 | |
| | 148 | 5.42 | 7.08E−3 | 0 | 3200 C. |
| Samarium | 151 | 3.41E−2 | 3.41E−2 | 3.16E−2 | 1670 C. |
| Europium | 152 | 3.41E−4 | 3.32E−4 | 1.91E−4 | |
| | 154 | 0.191 | 0.197 | 0.123 | |
| | 155 | 0.204 | 0.174 | 4.44E−3 | |
| | 156 | 6.16 | 5.94E−3 | 0 | 1430E |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | |
|---|---|---|---|---|---|
| Gadolinium | 152 | | | 0 | |
| Terbium | 160 | 3.49E−2 | 8.23E−3 | 0 | 2470 C. |
| Dysprosium | 156 | | | | |
| Carbon | 14 | | | | |
| Iron | 55 | | | | |
| Nickel | 59 | | | | |
| | 63 | | | | |
| Cobalt | 60 | | | | |
| Thorium | 232 | | | | |
| TOTALS | | 325.20835 | 122.257523 | 8.646201 | |
| | | 1.085252E5 | 1.083223E5 | 1.082086E5 | |

TABLE 1F

| 1 Isotopes Name | 3 Mass no A | 25 West Valley HLW canister Ci | 26 US HLW sludge 150-days decay g/kg | 27 US HLW sludge 6 years decay g/kg | 28 FRANCE AREVA sludge g/L |
|---|---|---|---|---|---|
| Actinides | | | | | |
| Uranium | 233 | 3.55E−1 | | | |
| | 234 | 1.47E−2 | | | |
| | 235 | 3.72E−4 | | | |
| | 236 | 1.09E−3 | | | |
| | 238 | 3.13E−3 | 4.79 | 4.79 | 2.06 |
| Neptunium | 239 | 1.36 | 0.419 | 0.419 | 0.66 |
| Plutonium | 238 | 3.02E1 | | | |
| | 239 | 6.39 | | | |
| | 240 | 4.2 | | | |
| | 241 | 1.96E2 | | | |
| | 242 | 6.38E−3 | 0.0442 | 0.0528 | 0.05 |
| Americium | 241 | 2.11E2 | | | |
| | 242 | 1.11 | | | |
| | 242m | 1.11 | | | |
| | 243 | 1.36 | 0.129 | 0.13 | 0.56 |
| Curium | 242 | 0.92 | | | |
| | 243 | 0.413 | | | |
| | 244 | 20.5 | | | |
| | 245 | 3.46E−3 | | | |
| | 246 | 3.96E−4 | 0.0319 | 0.0218 | 0.04 |
| TOTALS | | 474.98752 | 5.4141 | 5.4136 | 3.37 |
| Fission Products | | | | | |
| Tritium | 3 | 0 | | | |
| Selenium | 74 | 1.38E−2 | 0.0471 | 0.0471 | 0.08 |
| Bromine | 79 | | | | |
| Krypton | 85 | | 0.336 | 0.328 | |
| Rubidium | 86 | | 0.3 | 0.308 | 0.53 |
| Strontium | 89 | | | | |
| | 90 | 2.07E4 | 0.804 | 0.734 | 1.26 |
| Yttrium | 90 | | | | |
| | 91 | 2.08E4 | 0.422 | 0.419 | 0.7 |
| Zirconium | 93 | | | | |
| | 95 | 1.07 | 3.31 | 3.37 | 6.95 |
| Niobium | 94 | | | | |
| | 95m | | | | |
| | 95 | 8.37E1 | | | |
| Molybdenum | | | 3.13 | 3.15 | 5.04 |
| Technetium | 99 | 0.428 | 0.768 | 0.768 | 0.85 |
| Ruthenium | 103 | | | | |
| | 106 | 5.79E−5 | 2.09 | 1.97 | 1.58 |
| Rhodium | 103m | | | | |
| | 106 | 5.81E−5 | 0.363 | 0.366 | 0.44 |
| Palladium | 107 | 4.33E−2 | 1.2 | 1.2 | 1.19 |
| Silver | 110m | | | | |
| | 110 | | | | |
| | 111 | | 0.0579 | 0.0574 | 0.12 |
| Cadmium | 113m | | | | |
| | 115m | | 0.0772 | 0.0776 | 0.12 |
| Indium | 115 | | | | |

TABLE 1-continued

Isotope constituents in Uranium fuel discharged from PWR
Quantities are expressed per metric ton of uranium in the fresh fuel charged to the reactor
Average fuel exposure = 33 MWd/kg. Average specific power = 30 MW/Mg

| | | | | | |
|---|---|---|---|---|---|
| Tin | 117m | | | | |
| | 119m | | | | |
| | 123 | | | | |
| | 125 | | | | |
| | 126 | 2.34 | 0.0478 | 0.0474 | 0.06 |
| Antimony | 124 | | | | |
| | 125 | | | | |
| | 126m | | | | |
| | 126 | 5.73E−2 | | | 0.01 |
| Tellurium | 123m | | | | |
| | 125m | | | | |
| | 127m | | | | |
| | 127 | | | | |
| | 129m | | | | |
| | 129 | 0.573 | 0.517 | 0.522 | 0.71 |
| Iodine | 129 | | | | |
| | 131 | 0 | 0.248 | 0.248 | |
| Xenon | 131m | | | | |
| | 133 | | 4.94 | 4.94 | |
| Cesium | 134 | | | | |
| | 135 | | | | |
| | 136 | | | | |
| | 137 | 7.03E−1 | 2.5 | 2.23 | 5.43 |
| Barium | 137m | | | | |
| | 140 | | 1.26 | 1.53 | 2.42 |
| Lanthanum | 140 | | 1.15 | 1.15 | |
| Cerium | 141 | | | | |
| | 144 | 3.48E−7 | 2.47 | 2.25 | 3.56 |
| Praseodymium | 143 | | | | |
| | 144 | 3.49E−7 | 1.09 | 1.09 | 1.68 |
| Neodymium | 147 | | 3.52 | 3.72 | 6.07 |
| Promethium | 147 | | | | |
| | 148m | | | | |
| | 148 | 2.42E1 | 0.01 | 0.0205 | 0.1 |
| Samarium | 151 | 3.07E2 | 0.74 | 0.817 | 1.21 |
| Europium | 152 | | | | |
| | 154 | | | | |
| | 155 | | | | |
| | 156 | 8.62E−1 | 0.166 | 0.155 | 0.2 |
| Gadolinium | 152 | | 0.0908 | 0.0105 | 0.12 |
| Terbium | 160 | | | | |
| Dysprosium | 156 | | | | |
| Carbon | 14 | 0 | | | |
| Iron | 55 | 0.192 | | | 9.08 |
| Nickel | 59 | 0.416 | | | |
| | 63 | 28 | | | 1.45 |
| Cobalt | 60 | 0.814 | | | |
| Thorium | 232 | 6.45EE−3 | | | |
| TOTALS | | 30.28045 | 31.6548 | 31.5255 | 50.96 |
| | | 502.27797 | 37.0689 | 36.9391 | 54.33 |

TABLE 2

Isotope constituents in HLW after reprocessing of Uranium fuel discharged from PWR - all isotopes with zero activity at 10 years decays were excluded

TABLE 2A

| 1 | | 3 | 4 | 5 | 6 | 7 | 8 |
|---|---|---|---|---|---|---|---|
| Isotopes | 2 | Mass | Prod. | physical form | | | |
| Name | index | no A | type | Gas | Metal | Oxide | Solid Sol. |
| Actinides | | | | | | | |
| Uranium | U | 233 | α | | | X | |
| | U | 234 | α | | | X | |
| | U | 235 | α | | | X | |
| | U | 236 | α | | | X | |
| | U | 238 | α | | | X | |
| Neptunium | Np | 239 | α | | | X | |

TABLE 2-continued

| Isotope constituents in HLW after reprocessing of Uranium fuel discharged from PWR - all isotopes with zero activity at 10 years decays were excluded | | | | | | | |
|---|---|---|---|---|---|---|---|
| Plutonium | Pu | 238 | α | | | X | |
| | Pu | 239 | α | | | X | |
| | Pu | 240 | α | | | X | |
| | Pu | 241 | α | | | X | |
| | Pu | 242 | α | | | X | |
| Americium | Am | 241 | α | | | X | |
| | Am | 242 | α | | | X | |
| | Am | 242m | α.IT | | | X | |
| | Am | 243 | α | | | X | |
| Curium | Cm | 242 | α | | | X | |
| | Cm | 243 | EC | | | X | |
| | Cm | 244 | α | | | X | |
| | Cm | 245 | α | | | X | |
| | Cm | 246 | α | | | X | |
| TOTAL | | | | | | | |
| Fission Products | | | | | | | |
| Tritium | H | 3 | β | X | | | |
| Krypton | Kr | 85 | γ | X | | | |
| Strontium | Sr | 90 | β | | X | X | |
| Yttrium | Y | 90 | β | | | X | |
| Zirconium | Zr | 93 | | | X | X | |
| Niobium | Nb | 94 | γ | | X | X | |
| Technetium | Tc | 99 | γ | | X | | |
| Ruthenium | Ru | 106 | β, γ | | X | | |
| Rhodium | Rh | 106 | β, γ | | X | | |
| Palladium | Pd | 107 | | | X | | |
| Silver | Ag | 110m | γ | | X | | |
| | Ag | 110 | γ | | X | | |
| Cadmium | Cd | 113m | | | X | | |
| Tin | Sn | 119m | | | | | |
| | Sn | 123 | | | | | |
| | Sn | 126 | | | | | |
| Antimony | Sb | 125 | | | X | | |
| | Sb | 126m | | | X | | |
| | Sb | 126 | | | X | | |
| Tellurium | Te | 125m | | X | X | X | X |
| Iodine | I | 129 | γ | X | | | |
| Cesium | Cs | 134 | γ | X | | X | |
| | Cs | 135 | γ | X | | X | |
| | Cs | 137 | β, γ | X | | X | |
| Barium | Ba | 137m | | | | X | X |
| Cerium | Ce | 144 | β, γ | | | | X |
| Praseodymium | Pr | 144 | | | | | |
| Promethium | Pm | 147 | α | | | | X |
| Samarium | Sm | 151 | γ | | | | X |
| Europium | Eu | 152 | γ | | | | X |
| | Eu | 154 | γ | | | | X |
| | Eu | 155 | γ | | | | X |
| TOTAL | | | | | | | |

TABLE 2B

| 1<br>Isotopes<br>Name | 3<br>Mass<br>no A | 9<br>Abundance | 10<br>Half Life<br>(yr) |
|---|---|---|---|
| Actinides | | | |
| Uranium | 233 | | 1.62E5 |
| | 234 | 0.0056 | 2.47E5 |
| | 235 | 0.7205 | 7.1E8 |
| | 236 | | 2.39E7 |
| | 238 | 99.274 | 4.51E9 |
| Neptunium | 239 | | (2.35 days) |
| Plutonium | 238 | | 86 |
| | 239 | | 24 000 |
| | 240 | | 6580 |
| | 241 | | 13.2 |
| | 242 | | 3.79E5 |
| Americium | 241 | | 458 |
| | 242 | | (16 hours) |
| | 242m | | 152 |
| | 243 | | 7950 |
| Curium | 242 | | (163 days) |
| | 243 | | 32 |

TABLE 2-continued

| Isotope constituents in HLW after reprocessing of Uranium fuel discharged from PWR - all isotopes with zero activity at 10 years decays were excluded | | | |
|---|---|---|---|
| | 244 | | 17.6 |
| | 245 | | 9300 |
| | 246 | | 5500 |
| TOTAL | | | |
| Fission Products | | | |
| Tritium | 3 | | 12.3 |
| Krypton | 85 | | 10.76 |
| Strontium | 90 | | 28.1 |
| Yttrium | 90 | | (64 hours) |
| Zirconium | 93 | | 1.5E6 |
| Niobium | 94 | | 2E4 |
| Technetium | 99 | | 2.12E5 |
| Ruthenium | 106 | | (367 days) |
| Rhodium | 106 | | (30 sec) |
| Palladium | 107 | | 7E6 |
| Silver | 110m | | (253 days) |
| | 110 | | (253 days) |
| Cadmium | 113m | | 14 |
| Tin | 119m | | (250 days) |
| | 123 | 42.75 | (125 days) |
| | 126 | | 10E5 |
| Antimony | 125 | | 2.71 |
| | 126m | | (19 min) |
| | 126 | | (12.5 days) |
| Tellurium | 125m | | (58 days) |
| Iodine | 129 | | 1.7E7 |
| Cesium | 134 | | 2.046 |
| | 135 | | 3E6 |
| | 137 | | 30 |
| Barium | 137m | | (2.554 min) |
| Cerium | 144 | | (284 days) |
| Praseodymium | 144 | | (17.27 days) |
| Promethium | 147 | | 4.4 |
| Samarium | 151 | | 87 |
| Europium | 152 | | 12.7 |
| | 154 | | 16 |
| | 155 | | 2 |
| TOTAL | 3 | | |

TABLE 2C

| | | 11 | 12 | 13 | 14 | 15 | 16 |
|---|---|---|---|---|---|---|---|
| | | Fuel Isotopic composition - % | | | | | |
| 1 Isotopes | 3 Mass | 33 MWd/kg HM | | 43 MWd/kg HM | | 53 MWd/kg HM | |
| Name | no A | Fresh | Spent | Fresh | Spent | Fresh | Spent |
| Actinides | | | | | | | |
| Uranium | 233 | | Trace | | Trace | | Trace |
| | 234 | | Trace | | Trace | | Trace |
| | 235 | 3.25 | 0.884 | 3.7 | 0.76 | 4.4 | 0.768 |
| | 236 | | 0.391 | | 0.481 | | 0.594 |
| | 238 | 96.75 | 94.372 | 96.3 | 93.25 | 95.6 | 91.983 |
| Neptunium | 239 | | Trace | | Trace | | Trace |
| Plutonium | 238 | | 0.012 | | 0.021 | | 0.033 |
| | 239 | | 0.54 | | 0.572 | | 0.607 |
| | 240 | | 0.221 | | 0.262 | | 0.291 |
| | 241 | | 0.132 | | 0.16 | | 0.183 |
| | 242 | | 0.045 | | 0.068 | | 0.085 |
| Americium | 241 | | 0.003 | | 0.005 | | 0.006 |
| | 242 | | Trace | | Trace | | Trace |
| | 242m | | Trace | | Trace | | Trace |
| | 243 | | Trace | | Trace | | Trace |
| Curium | 242 | | Trace | | Trace | | Trace |
| | 243 | | Trace | | Trace | | Trace |
| | 244 | | Trace | | Trace | | Trace |
| | 245 | | Trace | | Trace | | Trace |
| | 246 | | Trace | | Trace | | Trace |
| TOTAL | | 100 | 96.6 | 100 | 95.579 | 100 | 94.55 |

TABLE 2-continued

Isotope constituents in HLW after reprocessing of Uranium fuel discharged from PWR - all isotopes with zero activity at 10 years decays were excluded

TABLE 2D

| 1<br>Isotopes<br>Name | 3<br>Mass<br>no A | 17<br>g/Mg<br>150-day decay | 18<br>g/kg<br>150-day decay | 19<br>Ci/Mg<br>150-day decay | 20<br>W/Mg<br>heat emission |
|---|---|---|---|---|---|
| Actinides | | | | | |
| Uranium | 233 | \| | \| | \| | \| |
| | 234 | \| | \| | \| | \| |
| | 235 | \| | \| | \| | \| |
| | 236 | ↓ | ↓ | ↓ | ↓ |
| | 238 | 9.54E5 | 954 | 4.05 | 4.18E−2 |
| Neptunium | 239 | 7.49E2 | 0.749 | 1.81E1 | 5.20E−2 |
| Plutonium | 238 | \| | \| | \| | \| |
| | 239 | \| | \| | \| | \| |
| | 240 | \| | \| | \| | \| |
| | 241 | ↓ | ↓ | ↓ | ↓ |
| | 242 | 9.03E3 | 9.03 | 1.08E5 | 1.52E2 |
| Americium | 241 | \| | \| | \| | \| |
| | 242 | \| | \| | \| | \| |
| | 242m | ↓ | ↓ | ↓ | ↓ |
| | 243 | 1.40E2 | 0.14 | 1.88E2 | 6.11E4 |
| Curium | 242 | \| | \| | \| | \| |
| | 243 | \| | \| | \| | \| |
| | 244 | \| | \| | \| | \| |
| | 245 | ↓ | ↓ | ↓ | ↓ |
| | 246 | 4.70E1 | 0.047 | 1.89E1 | 6.90E1 |
| TOTAL | | 9.64E5 | 963.966 | 1.082E5 | 8.48E2 |
| Fission Products | | | 36.034 | | |
| Tritium | 3 | 7.17E−2 | 0.717 | 6.90E2 | 2.45E−2 |
| Krypton | 85 | 3.60E2 | 0.36 | 1.10E4 | 6.85E1 |
| Strontium | 90 | 8.68E2 | 0.686 | 1.74E5 | 4.50E2 |
| Yttrium | 90 | | | | |
| Zirconium | 93 | | | | |
| Niobium | 94 | | | | |
| Technetium | 99 | 7.52E2 | 0.752 | 1.43E1 | 9.67E−3 |
| Ruthenium | 106 | 1.90E3 | 1.9 | 4.99E5 | 3.13E2 |
| Rhodium | 106 | 3.19E2 | 0.319 | 4.99E5 | 3.99E3 |
| Palladium | 107 | 8.49E2 | 0.849 | 0 | 0 |
| Silver | 110m | | | | |
| | 110 | | | | |
| Cadmium | 113m | | | | |
| Tin | 119m | | | | |
| | 123 | | | | |
| | 126 | 3.28E1 | 0.0328 | 3.85E4 | 1.56E2 |
| Antimony | 125 | | | | |
| | 126m | | | | |
| | 126 | 1.36E1 | 0.0136 | 7.96E3 | 2.74E1 |
| Tellurium | 125m | | | | |
| Iodine | 129 | | | | |
| Cesium | 134 | | | | |
| | 135 | | | | |
| | 137 | 2.40E3 | 2.4 | 3.21E5 | 2.42E3 |
| Barium | 137m | | | | |
| Cerium | 144 | 2.47E3 | 2.47 | 8.27E5 | 7.87E2 |
| Praseodymium | 144 | 1.09E3 | 1.09 | 7.71E5 | 5.73E3 |
| Promethium | 147 | | | | |
| Samarium | 151 | 6.96E2 | 0.696 | 1.125E3 | 2.18 |
| Europium | 152 | | | | |
| | 154 | | | | |
| | 155 | | | | |
| TOTAL | 3 | 1.1750E4 | 12.2854 | 3.150289E6 | 9.963E3 |
| 1 | | 9.75750E5 | 23.7486 | 3.258489E6 | 10.811E3 |

TABLE 2E

| 1<br>Isotopes<br>Name | 3<br>Mass<br>no A | 21<br>Activity Ci/yr<br>at discharge | 22<br>Activity Ci/yr<br>150-day decay | 23<br>Activity Ci/yr<br>10-yr decay | 24<br>Element<br>Boil T © |
|---|---|---|---|---|---|
| Actinides | | | | | |
| Uranium | 233 | \| | \| | \| | |
| | 234 | \| | \| | \| | |

TABLE 2-continued

| Isotope constituents in HLW after reprocessing of Uranium fuel discharged from PWR - all isotopes with zero activity at 10 years decays were excluded | | | | | |
|---|---|---|---|---|---|
| | 235 | \| | \| | \| | |
| | 236 | ↓ | ↓ | ↓ | |
| | 238 | 4.05 | 4.05 | 4.05 | 4135 C. |
| Neptunium | 239 | 1.81E1 | 1.81E1 | 1.81E1 | |
| Plutonium | 238 | \| | \| | \| | |
| | 239 | \| | \| | \| | |
| | 240 | \| | \| | \| | |
| | 241 | ↓ | ↓ | ↓ | |
| | 242 | 1.08E5 | 1.08E5 | 1.08E5 | 3508 C. |
| Americium | 241 | \| | \| | \| | |
| | 242 | \| | \| | \| | |
| | 242m | ↓ | ↓ | ↓ | |
| | 243 | 1.88E2 | 1.88E2 | 1.88E2 | 2880 C. |
| Curium | 242 | \| | \| | \| | |
| | 243 | \| | \| | \| | |
| | 244 | \| | \| | \| | |
| | 245 | ↓ | ↓ | ↓ | |
| | 246 | 1.89E1 | 1.89E1 | 1.89E1 | |
| TOTAL | | 1.082E5 | 1.082E5 | 1.082E5 | |
| Fission Products | | | | | |
| Tritium | 3 | 1.93E−2 | 1.88E−2 | 1.09E−2 | 100 C. |
| Krypton | 85 | 0.308 | 0.3 | 0.162 | −153.4 |
| Strontium | 90 | 2.11 | 2.09 | 1.65 | 1357 C. |
| Yttrium | 90 | 2.2 | 2.09 | 1.65 | |
| Zirconium | 93 | 5.15E−5 | 5.15E−5 | 5.15E−5 | |
| Niobium | 94 | 3.95E−6 | 4.89E−6 | 2.3E−5 | |
| Technetium | 99 | 3.90E−4 | 3.90E−4 | 3.90E−4 | 3927 C. |
| Ruthenium | 106 | 14.8 | 11.2 | 1.50E−2 | 4227 C. |
| Rhodium | 106 | 20.2 | 11.2 | 1.50E−2 | 3667 C. |
| Palladium | 107 | 3.00E−6 | 3.00E−6 | 3.00E−6 | 3112 C. |
| Silver | 110m | 0.1 | 6.64E−2 | 4.52E−6 | |
| | 110 | 4.33 | 8.65E−3 | 5.88E−7 | |
| Cadmium | 113m | 2.86E−4 | 2.86E−4 | 1.74E−4 | |
| Tin | 119m | 4.47E−4 | 2.95E−4 | 1.79E−8 | |
| | 123 | 0.242 | 1.05 | 3.87E−10 | |
| | 126 | 72.2 | 1.05 | 1.49E−5 | 2722 C. |
| Antimony | 125 | 0.237 | 0.215 | 1.85E−2 | |
| | 126m | 6.13E−4 | 1.49E−5 | 1.49E−5 | |
| | 126 | 1.55E−3 | 1.50E−5 | 1.47E−5 | 1625 C. |
| Tellurium | 125m | 8.47E−2 | 8.69E−2 | 7.66E−3 | |
| Iodine | 129 | 1.01E−16 | 1.02E−6 | 1.2E−6 | |
| Cesium | 134 | 6.7 | 5.83 | 0.228 | |
| | 135 | 7.79E−6 | 7.79E−6 | 7.79E−6 | |
| | 137 | 2.94 | 2.92 | 2.33 | 686 C. |
| Barium | 137m | 2.75 | 2.72 | 2.18 | |
| Cerium | 144 | 30.2 | 21 | 4.11E−3 | 3470 C. |
| Praseodymium | 144 | 30.5 | 21 | 4.11E−3 | 3017 C. |
| Promethium | 147 | 2.78 | 2.65 | 0.211 | |
| Samarium | 151 | 3.41E−2 | 3.41E−2 | 3.16E−2 | 1670 C. |
| Europium | 152 | 3.41E−4 | 3.32E−4 | 1.91E−4 | |
| | 154 | 0.191 | 0.197 | 0.123 | |
| | 155 | 0.204 | 0.174 | 4.44E−3 | |
| TOTAL | 3 | 193.13379 | 85.90225 | 8.22968 | |
| | | 1.08393E5 | 1.08286E5 | 1.08208E5 | |

TABLE 2F

| 1<br>Isotopes<br>Name | 3<br>Mass<br>no A | 25<br>West Valley<br>HLW canister<br>Ci | 26<br>US HLW sludge<br>150-days decay<br>g/kg | 27<br>US HLW sludge<br>6 years decay<br>g/kg | 28<br>FRANCE<br>AREVA sludge<br>g/L |
|---|---|---|---|---|---|
| Actinides | | | | | |
| Uranium | 233 | 3.55E−1 | \| | \| | \| |
| | 234 | 1.47E−2 | \| | \| | \| |
| | 235 | 3.72E−4 | \| | \| | \| |
| | 236 | 1.09E−3 | ↓ | ↓ | ↓ |
| | 238 | 3.13E−3 | 4.79 | 4.79 | 2.06 |
| Neptunium | 239 | 1.36 | 0.419 | 0.419 | 0.66 |
| Plutonium | 238 | 3.02E1 | \| | \| | \| |
| | 239 | 6.39 | \| | \| | \| |
| | 240 | 4.2 | \| | \| | \| |
| | 241 | 1.96E2 | ↓ | ↓ | ↓ |
| | 242 | 6.38E−3 | 0.0442 | 0.0528 | 0.05 |

TABLE 2-continued

| Isotope constituents in HLW after reprocessing of Uranium fuel discharged from PWR - all isotopes with zero activity at 10 years decays were excluded | | | | | |
|---|---|---|---|---|---|
| Americium | 241 | 2.11E2 | \| | \| | \| |
| | 242 | 1.11 | \| | \| | \| |
| | 242m | 1.11 | ↓ | ↓ | ↓ |
| | 243 | 1.36 | 0.129 | 0.13 | 0.56 |
| Curium | 242 | 0.92 | \| | \| | \| |
| | 243 | 0.413 | \| | \| | \| |
| | 244 | 20.5 | \| | \| | \| |
| | 245 | 3.46E−3 | ↓ | ↓ | ↓ |
| | 246 | 3.96E−4 | 0.0319 | 0.0218 | 0.04 |
| TOTAL | | 44.4964 | 4.9951 | 4.9946 | 3.37 |
| Fission Products | | | | | |
| Tritium | 3 | 0 | | | |
| Krypton | 85 | | 0.336 | 0.328 | |
| Strontium | 90 | 2.07E4 | 0.804 | 0.734 | 1.26 |
| Yttrium | 90 | | | | |
| Zirconium | 93 | | | | |
| Niobium | 94 | | | | |
| Technetium | 99 | 0.428 | 0.768 | 0.768 | 0.85 |
| Ruthenium | 106 | 5.79E−5 | 2.09 | 1.97 | 1.58 |
| Rhodium | 106 | 5.81E−5 | 0.363 | 0.366 | 0.44 |
| Palladium | 107 | 4.33E−2 | 1.2 | 1.2 | 1.19 |
| Silver | 110m | | | | |
| | 110 | | | | |
| Cadmium | 113m | | | | |
| Tin | 119m | | | | |
| | 123 | | | | |
| | 126 | 2.34 | 0.0478 | 0.0474 | 0.06 |
| Antimony | 125 | | | | |
| | 126m | | | | |
| | 126 | 5.73E−2 | | | 0.01 |
| Tellurium | 125m | | | | |
| Iodine | 129 | | | | |
| Cesium | 134 | | | | |
| | 135 | | | | |
| | 137 | 7.03E−1 | 2.5 | 2.23 | 5.43 |
| Barium | 137m | | | | |
| Cerium | 144 | 3.48E−7 | 2.47 | 2.25 | 3.56 |
| Praseodymium | 144 | 3.49E−7 | 1.09 | 1.09 | 1.68 |
| Promethium | 147 | | | | |
| Samarium | 151 | 3.07E2 | 0.74 | 0.817 | 1.21 |
| Europium | 152 | | | | |
| | 154 | | | | |
| | 155 | | | | |
| TOTAL | 3 | 2.101056E4 | 12.4088 | 11.8004 | 16.01 |
| | | 2.0105506E4 | 17.4039 | 16.795 | 19.38 |

TABLE 3

Long - lived Isotope constituents in HLW after reprocessing of Uranium fuel discharged from PWR

TABLE 3A

| 1 | | 3 | 4 | 5 | 6 | 7 | 8 |
|---|---|---|---|---|---|---|---|
| | | | | physical form | | | |
| Isotopes Name | 2 index | Mass no A | Prod. type | Gas | Metal | Oxide | Solid Sol. |
| Actinides | | | | | | | |
| Uranium | U | | α | | | X | |
| Plutonium | Pu | | α | | | X | |
| Americium | Am | 241 | α | | | X | |
| | Am | 242m | α.IT | | | X | |
| | Am | 243 | A | | | X | |
| Curium | Cm | 243 | EC | | | X | |
| | Cm | 244 | A | | | X | |

TABLE 3-continued

Long - lived Isotope constituents in HLW after reprocessing of Uranium fuel discharged from PWR

| | | | | | | | |
|---|---|---|---|---|---|---|---|
| | Cm | 245 | A | | | X | |
| | Cm | 246 | α | | | X | |
| TOTAL | | | | | | | |
| Fission Products | | | | | | | |
| Tritium | H | 3 | β | X | | | |
| Krypton | Kr | 85 | γ | X | | | |
| Strontium | Sr | 90 | β | | X | X | |
| Zirconium | Zr | 93 | | | X | X | |
| Niobium | Nb | 94 | γ | | X | X | |
| Technetium | Tc | 99 | γ | | X | | |
| Palladium | Pd | 107 | | | X | | |
| Cadmium | Cd | 113m | | | X | | |
| Tin | Sn | 126 | | | | | |
| Antimony | Sb | 125 | | | X | | |
| Iodine | I | 129 | γ | X | | | |
| Cesium | Cs | 135 | γ | X | | X | |
| Cesium | Cs | 137 | β, γ | X | | X | |
| Samarium | Sm | 151 | γ | | | | X |
| Europium | Eu | 152 | γ | | | | X |
| Europium | Eu | 154 | γ | | | | X |
| TOTAL | | | | | | | |

TABLE 3B

| 1 | 3 | 10 | 19 | 20 | 21 | 22 | 23 |
|---|---|---|---|---|---|---|---|
| | | | | | Activity Ci/yr | | |
| Isotopes Name | Mass no A | Half Life (yr) | Ci/Mg 150-day decay | W/Mg heat emission | at discharge | 150-day decay | 10-yr decay |
| Actinides | | | | | | | |
| Uranium | | 4.51E9 | 4.05 | 4.18E−2 | | | |
| Plutonium | | 3.79E5 | 1.08E5 | 1.52E2 | | | |
| Americium | 241 | 458 | | | | | |
| | 242m | 152 | | | | | |
| | 243 | 7950 | 1.88E2 | 6.11E4 | | | |
| Curium | 243 | 32 | \| | \| | | | |
| | 244 | 17.6 | \| | \| | | | |
| | 245 | 9300 | ↓ | ↓ | | | |
| | 246 | 5500 | 1.89E1 | 6.90E1 | | | |
| TOTAL | | | 1.082E5 | 8.48E2 | | | |
| Fission Products | | | | | | | |
| Tritium | 3 | 12.3 | 6.90E2 | 2.45E−2 | 1.93E−2 | 1.88E−2 | 1.09E−2 |
| Krypton | 85 | 10.76 | 1.10E4 | 6.85E1 | 0.308 | 0.3 | 0.162 |
| Strontium | 90 | 28.1 | 1.74E5 | 4.50E2 | 2.11 | 2.09 | 1.65 |
| Zirconium | 93 | 1.5E6 | | | 5.15E−5 | 5.15E−5 | 5.15E−5 |
| Niobium | 94 | 2E4 | | | 3.95E−6 | 4.89E−6 | 2.3E−5 |
| Technetium | 99 | 2.12E5 | 1.43E1 | 9.67E−3 | 3.90E−4 | 3.90E−4 | 3.90E−4 |
| Palladium | 107 | 7E6 | 0 | 0 | 3.00E−6 | 3.00E−6 | 3.00E−6 |
| Cadmium | 113m | 14 | | | 2.86E−4 | 2.86E−4 | 1.74E−4 |
| Tin | 126 | 10E5 | 3.85E4 | 1.56E2 | 72.2 | 1.05 | 1.49E−5 |
| Antimony | 125 | 2.71 | | | 0.237 | 0.215 | 1.85E−2 |
| Iodine | 129 | 1.7E7 | | | 1.01E−16 | 1.02E−6 | 1.2E−6 |
| Cesium | 135 | 3E6 | | | 7.79E−6 | 7.79E−6 | 7.79E−6 |
| Cesium | 137 | 30 | 3.21E5 | 2.42E3 | 2.94 | 2.92 | 2.33 |
| Samarium | 151 | 87 | 1.125E3 | 2.18 | 3.41E−2 | 3.41E−2 | 3.16E−2 |
| Europium | 152 | 12.7 | | | 3.41E−4 | 3.32E−4 | 1.91E−4 |
| Europium | 154 | 16 | | | 0.191 | 0.197 | 0.123 |
| TOTAL | | | | | 3.76E3 | 1.14E2 | 8.66 |

TABLE 3C

| 1 | 3 | 25 | 26 | 27 | 28 |
|---|---|---|---|---|---|
| Isotopes Name | Mass no A | West Valley HLW canister Ci | US HLW sludge 150-days decay g/kg | US HLW sludge 6 years decay g/kg | FRANCE AREVA sludge g/L |
| Actinides | | | | | |
| Uranium | | 3.13E−3 | 4.79 | 4.79 | 2.06 |
| Plutonium | | 6.38E−3 | 0.0442 | 0.0528 | 0.05 |

TABLE 3-continued

| Long - lived Isotope constituents in HLW after reprocessing of Uranium fuel discharged from PWR | | | | | |
|---|---|---|---|---|---|
| Americium | 241 | 2.11E2 | | | |
| | 242m | 1.11 | | | |
| | 243 | 1.36 | 0.129 | 0.13 | 0.56 |
| Curium | 243 | 0.413 | | | |
| | 244 | 20.5 | | | |
| | 245 | 3.46E−3 | | | |
| | 246 | 3.96E−4 | 0.0319 | 0.0218 | 0.04 |
| TOTAL | | 474.98752 | 4.9951 | 4.9946 | 3.37 |
| Fission Products | | | | | |
| Tritium | 3 | 0 | | | |
| Krypton | 85 | | 0.336 | 0.328 | |
| Strontium | 90 | 2.07E4 | 0.804 | 0.734 | 1.26 |
| Zirconium | 93 | 1.07 | 3.31 | 3.37 | 6.95 |
| Niobium | 94 | 8.37E1 | | | |
| Technetium | 99 | 0.428 | 0.768 | 0.768 | 0.85 |
| Palladium | 107 | 4.33E−2 | 1.2 | 1.2 | 1.19 |
| Cadmium | 113m | | | | |
| Tin | 126 | 2.34 | 0.0478 | 0.0474 | 0.06 |
| Antimony | 125 | | | | |
| Iodine | 129 | | | | |
| Cesium | 135 | | | | |
| Cesium | 137 | 7.03E−1 | 2.5 | 2.23 | 5.43 |
| Samarium | 151 | 3.07E2 | 0.74 | 0.817 | 1.21 |
| Europium | 152 | | | | |
| Europium | 154 | 8.62E−1 | 0.166 | 0.155 | 0.2 |
| TOTAL | | | 9.8718 | 9.6494 | |

TABLE 4

Calculated isotope amount and radiation for quasi-natural or artificial very low radiation level Feldspar for 5 kg-10 kg-50 kg and 100 kg mix

TABLE 4A

| 1 | | 3 | 4 | 5 | 6 physical form | 7 | 8 |
|---|---|---|---|---|---|---|---|
| Isotopes Name | 2 index | Mass no A | Prod. type | Gas | Metal | Oxide | Solid Sol. |
| Actinides | | | | | | | |
| Uranium | U | | α | | | X | |
| Plutonium | Pu | | α | | | X | |
| Americium | Am | 241 | α | | | X | |
| | Am | 242m | α.IT | | | X | |
| | Am | 243 | α | | | X | |
| Curium | Cm | 243 | EC | | | X | |
| | Cm | 244 | α | | | X | |
| | Cm | 245 | α | | | X | |
| | Cm | 246 | α | | | X | |
| TOTAL | | | | | | | |
| Fission Products | | | | | | | |
| Tritium | H | 3 | β | X | | | |
| Krypton | Kr | 85 | γ | X | | | |
| Strontium | Sr | 90 | β | | X | X | |
| Zirconium | Zr | 93 | | | X | X | |
| Niobium | Nb | 94 | γ | | X | X | |
| Technetium | Tc | 99 | γ | | X | | |
| Palladium | Pd | 107 | | | X | | |
| Cadmium | Cd | 113m | | | X | | |
| Tin | Sn | 126 | | | | | |
| Antimony | Sb | 125 | | | X | | |
| Iodine | I | 129 | γ | X | | | |
| Cesium | Cs | 135 | γ | X | | X | |
| Cesium | Cs | 137 | β, γ | X | | X | |
| Samarium | Sm | 151 | γ | | | | X |

TABLE 4-continued

| Calculated isotope amount and radiation for quasi-natural or artificial very low radiation level Feldspar for 5 kg-10 kg-50 kg and 100 kg mix | | | | |
|---|---|---|---|---|
| Europium | Eu | 152 | γ | X |
| Europium | Eu | 154 | γ | X |
| TOTAL | | | | |

TABLE 4B

| 1<br>Isotopes<br>Name | 3<br>Mass<br>no A | 10<br>Half Life<br>(yr) | 20<br>W/Mg<br>heat emission | 23<br>Ci/Mg<br>10-yr decay |
|---|---|---|---|---|
| Actinides | | | | |
| Uranium | | 4.51E9 | 4.18E−2 | 4.05 |
| Plutonium | | 3.79E5 | 1.52E2 | 1.08E5 |
| Americium | 241 | 458 | | |
| | 242m | 152 | | |
| | 243 | 7950 | 6.11E4 | 1.88E2 |
| Curium | 243 | 32 | | |
| | 244 | 17.6 | | |
| | 245 | 9300 | ↓ | |
| | 246 | 5500 | 6.90E1 | 1.89E1 |
| TOTAL | | | 6.231E4 | 1.082E5 |
| Fission Products | | | | |
| Tritium | 3 | 12.3 | 2.45E−2 | 1.09E−2 |
| Krypton | 85 | 10.76 | 6.85E1 | 0.162 |
| Strontium | 90 | 28.1 | 4.50E2 | 1.65 |
| Zirconium | 93 | 1.5E6 | | 5.15E−5 |
| Niobium | 94 | 2E4 | | 2.3E−5 |
| Technetium | 99 | 2.12E5 | 9.67E−3 | 3.90E−4 |
| Palladium | 107 | 7E6 | 0 | 3.00E−6 |
| Cadmium | 113m | 14 | | 1.74E−4 |
| Tin | 126 | 10E5 | 1.56E2 | 1.49E−5 |
| Antimony | 125 | 2.71 | | 1.85E−2 |
| Iodine | 129 | 1.7E7 | | 1.2E−6 |
| Cesium | 135 | 3E6 | | 7.79E−6 |
| Cesium | 137 | 30 | 2.42E3 | 2.33 |
| Samarium | 151 | 87 | 2.18 | 3.16E−2 |
| Europium | 152 | 12.7 | | 1.91E−4 |
| Europium | 154 | 16 | | 0.123 |
| TOTAL | | | | 8.66 |

TABLE 4C

| 1<br>Isotopes<br>Name | 3<br>Mass<br>no A | 27<br>US HLW<br>sludge<br>6 years decay<br>g/kg | 29<br>a/o<br>natural<br>variation | 30<br>mg |
|---|---|---|---|---|
| Actinides | | | | |
| Uranium | | | 0.0056 | |
| | | | 0.7205 | |
| | | 4.79 | 99.274 | 4790 |
| Plutonium | | 0.0528 | trace in U | 52.8 |
| Americium | 241 | | | |
| | 242m | | | |
| | 243 | 0.13 | trace in U | 130 |
| Curium | 243 | | 0.185-0.251 | |
| | 244 | | 88.45 | |
| | 245 | | 11.114 | |
| | 246 | 0.0218 | ave 0.0046 | 28.1 |
| TOTAL | | 4.9946 | | 5000.9 |
| Fission Products | | | | |
| Tritium | 3 | | | 0 |
| Krypton | 85 | 0.328 | 0.00014 | 328 |
| Strontium | 90 | 0.734 | | 734 |
| Zirconium | 93 | 3.37 | 0.37 | 3370 |
| Niobium | 94 | trace | | |
| Technetium | 99 | 0.768 | 1E−9 g to 0.2 ng/kg | 768 |
| Palladium | 107 | 1.2 | 35.9 | 1200 |

TABLE 4-continued

Calculated isotope amount and radiation for quasi-natural or artificial very low radiation level Feldspar for 5 kg-10 kg-50 kg and 100 kg mix

| | | | | |
|---|---|---|---|---|
| Cadmium | 113m | 0.0776 | 4 PPM | 77.6 |
| Tin | 126 | 0.0474 | | 47.4 |
| Antimony | 125 | 0.01 | | 10 |
| Iodine | 129 | 0.248 | 0.04 PPM | 248 |
| Cesium | 135 | trace | 20% | |
| Cesium | 137 | 2.23 | | 2230 |
| Samarium | 151 | 0.817 | 1.6 | 817 |
| Europium | 152 | trace | rear earth | |
| Europium | 154 | 0.155 | rear earth | 155 |
| TOTAL | | 9.985 | | 9985 |
| | | 14.9796 | | 14985.90 |

TABLE 4D

| 1 Isotopes Name | 3 Mass no A | 31 in 5 kg Art.Feldsp | 32 Ci | 33 in 10 kg Art.Feldsp | 34 Ci |
|---|---|---|---|---|---|
| Actinides | | | | | |
| Uranium | | 0.958 | 3.8E−6 | 0.479 | 1.9E−6 |
| Plutonium | | 0.01056 | 0.0011404 | 0.00528 | 0.0005702 |
| Americium | 241 | | | | |
| | 242m | | | | |
| | 243 | 0.026 | 4.8E−6 | 0.013 | 2.4E−6 |
| Curium | 243 | | | | |
| | 244 | | | | |
| | 245 | | | | |
| | 246 | 0.00562 | 1.06E−7 | 0.00281 | 5.3109E−8 |
| TOTAL | | 1.00018 | 0.0011491 | 0.50009 | 0.0005746 |
| 1 | 3 | 32 | | 32 | |
| Fission Products | | | | | |
| Tritium | 3 | | | 0 | |
| Krypton | 85 | 0.0656 | 1.06272E−8 | 0.0328 | 5.3136E−9 |
| Strontium | 90 | 0.1468 | 2.4222E−7 | 0.0734 | 1.2111E−7 |
| Zirconium | 93 | 0.674 | 3.4711E−11 | 0.337 | 1.73555E−11 |
| Niobium | 94 | | | | |
| Technetium | 99 | 0.1536 | 5.9904E−11 | 0.0768 | 2.9952E−11 |
| Palladium | 107 | 0.24 | 7.2E−13 | 0.12 | 3.6E−13 |
| Cadmium | 113m | 0.01552 | 2.70048E−12 | 0.00776 | 1.35024E−12 |
| Tin | 126 | 0.00948 | 1.41252E−13 | 0.00474 | 7.0626E−14 |
| Antimony | 125 | 0.002 | 3.7E−11 | 0.001 | 1.85E−11 |
| Iodine | 129 | 0.0496 | 5.952E−14 | 0.0248 | 2.976E−14 |
| Cesium | 135 | | | | |
| Cesium | 137 | 0.446 | 1.03918E−6 | 0.223 | 5.1959E−7 |
| Samarium | 151 | 0.1634 | 5.16355E−9 | 0.0817 | 2.58172E−9 |
| Europium | 152 | | | | |
| Europium | 154 | 0.031 | 3.813E−9 | 0.0155 | 1.9065E−9 |
| TOTAL | | 1.997 | 3.011187E−7 | 0.9985 | 6.505693E−7 |
| | | 2.99718 | 0.001149112 | 1.49859 | 0.0005752 |

TABLE 4E

| 1 Isotopes Name | 3 Mass no A | 35 in 50 kg Art.Feldsp | 36 Ci | 37 in 100 kg Art.Feldsp | 38 Ci |
|---|---|---|---|---|---|
| Actinides | | | | | |
| Uranium | | 0.0958 | 3.0E−7 | 0.0479 | 1.0E−7 |
| Plutonium | | 0.001056 | 0.000114 | 0.000528 | 0.000057 |
| Americium | 241 | | | | |
| | 242m | | | | |
| | 243 | 0.0026 | 4.0E−7 | 0.0013 | 2.0E−7 |
| Curium | 243 | | | | |
| | 244 | | | | |

TABLE 4-continued

| Calculated isotope amount and radiation for quasi-natural or artificial very low radiation level Feldspar for 5 kg-10 kg-50 kg and 100 kg mix | | | | | |
|---|---|---|---|---|---|
| | 245 | | | | |
| | 246 | 0.000562 | 1.06218E−8 | 0.000281 | 5.5109E−9 |
| TOTAL | | 0.100018 | 0.0001147 | 0.050009 | 0.0000573 |
| 1 | 3 | 32 | | 32 | |
| Fission Products | | | | | |
| Tritium | 3 | 0 | | 0 | |
| Krypton | 85 | 0.00656 | 1.06272E−9 | 0.00328 | 5.3136E−10 |
| Strontium | 90 | 0.01468 | 2.4222E−8 | 0.00734 | 1.2111E−8 |
| Zirconium | 93 | 0.0674 | 3.4711E−11 | 0.0337 | 1.73555E−12 |
| Niobium | 94 | | | | |
| Technetium | 99 | 0.01536 | 5.9904E−12 | 0.00768 | 2.9952E−12 |
| Palladium | 107 | 0.024 | 7.2E−14 | 0.012 | 3.63E−14 |
| Cadmium | 113m | 0.001552 | 2.70048E−13 | 0.000776 | 1.35024E−13 |
| Tin | 126 | 0.000948 | 1.41252E−14 | 0.000474 | 7.0626E−15 |
| Antimony | 125 | 0.0002 | 3.7E−12 | 0.0001 | 1.85E−12 |
| Iodine | 129 | 0.00496 | 5.952E−15 | 0.00248 | 2.976E−15 |
| Cesium | 135 | | | | |
| Cesium | 137 | 0.0446 | 1.03918E−7 | 0.0223 | 5.1959E−8 |
| Samarium | 151 | 0.01634 | 5.16355E−10 | 0.00817 | 2.58172E−10 |
| Europium | 152 | | | | |
| Europium | 154 | 0.0031 | 3.813E−10 | 0.00155 | 1.9065E−10 |
| TOTAL | | 0.1997 | 3.011187E−8 | 0.09985 | 6.505693E−8 |
| | | 0.299718 | 0.00011491 | 0.149859 | 0.00005752 |

TABLE 6

Nano-Flex Experimental Protocol for Disposal after 10 Years Decay

TABLE 6A

| 1 Component | 2 Focus Element | 3 Index | 4 Isotopes | 5 Reprocesses Chemical Form | 6 Compound Form Fly Ash (%) |
|---|---|---|---|---|---|
| Fly Ash | SiO2 | n/a | n/a | S.Solution | 52.59 |
| | Al2O3 | \| | \| | S.Solution | 19.98 |
| | CaO | \| | \| | S.Solution | 15.49 |
| | Fe2O3 | \| | \| | S.Solution | 7.39 |
| | MgO | \| | \| | S.Solution | 3.43 |
| | SO3 | ↓ | ↓ | S.Solution | 0.85 |
| | Other | | | S.Solution | 0.27 |
| | | | | | 100 |
| Actinides | Uranium | U | | Oxide | |
| | | | | Oxide | |
| | | | | Oxide | trace |
| | Plutonium | Pu | | Oxide | |
| | Americium | Am | 241 | Oxide | |
| | | Am | 242m | Oxide | |
| | | Am | 243 | Oxide | |
| | Curium | Cm | 243 | Oxide | |
| | | Cm | 244 | Oxide | |
| | | Cm | 245 | Oxide | |
| | | Cm | 246 | Oxide | |
| Fission Products | Tritium | H | 3 | Gas | |
| | Krypton | Kr | 85 | Gas | |
| | Strontium | Sr | 90 | Oxy/S.Sol | trace |
| | Zirconium | Zr | 93 | Oxy/S.Sol | trace |
| | Niobium | Nb | 94 | Oxide | |
| | Technetium | Tc | 99 | Metal | |
| | Palladium | Pd | 107 | Metal | trace |
| | Cadmium | Cd | 113m | Metal | trace |
| | Tin | Sn | 126 | G/M/Oxy/S.S | |
| | Antimony | Sb | 125 | Metal | trace |
| | Iodine | I | 129 | Gas | |
| | Cesium | Cs | 135 | Gas/Oxide | trace |
| | Cesium | Cs | 137 | Gas/Oxide | trace |
| | Samarium | Sm | 151 | S.Solution | |

TABLE 6-continued

| | | | | | |
|---|---|---|---|---|---|
| | Europium | Eu | 152 | S.Solution | |
| | Europium | Eu | 154 | S.Solution | |
| Fission | Yttrium | Y | 90 | S.Solution | |
| Products | Ruthenium | Ru | 106 | Metal | |
| to | Rhodium | Rh | 106 | Metal | |
| be | Cesium | Cs | 134 | Gas/Oxide | |
| consider | Barium | Ba | 137m | Oxy/S.Sol. | trace |
| | Cerium | Ce | 144 | S.Solution | |
| | Praseodymium | Pr | 144 | S.Solution | |
| Activated | Carbon | C | 14 | S.Solution | proportion |
| Products | Tritium | H | 3 | Gas | |
| | Cobalt | Co | 60 | Metal | Trace |
| | Nickel | Ni | 59 | Metal | Trace |
| | | Ni | 63 | Metal | Trace |

NOTE
Experimental laboratory test to be perform with benign non radioactive metal ions
Isotope ions have similar chemical properties as non radioactive
Column 20 - NCRP report No. 161, Vol I
Human body contain 4500 Bq of potassium-40, 3700 Bq of carbon-14 and 13 Bq of radium 226 - essentially imported form food - Ref to NCRP - regulatory dose limits
Column 18 - NCRP has limits for individual and occupational exposure. No isotope limits exist under the umbrella of NCRP, because the radiation exposure is ration from the source density, distance and particular organ of interest.

TABLE 6B

| 1 Component | 2 Focus Element | 7 Half Life (yr) | 8 Isotope Concentration in Feldspar (g) | 9 Isotope Concentration in Feldspar (ppm) | 10 Isotope radiation (Ci) | 11 Thermal Emission (W/g) |
|---|---|---|---|---|---|---|
| Fly Ash | SiO2 | n/a | n/a | n/a | n/a | n/a |
| | Al2O3 | \| | \| | \| | \| | \| |
| | CaO | \| | \| | \| | \| | \| |
| | Fe2O3 | \| | \| | \| | \| | \| |
| | MgO | \| | \| | \| | \| | \| |
| | SO3 | ↓ | ↓ | ↓ | ↓ | ↓ |
| | Other | | | | | |
| Actinides | Uranium | 4.51E9 | 0.958 | 958 | 3.8E−6 | 4.18E−08 |
| | Plutonium | 3.79E5 | 0.01056 | 10.5 | 0.0011404 | 1.52E−4 |
| | Americium | 458 | | | | |
| | | 152 | | | | |
| | | 7950 | 0.026 | 26 | 4.8E−6 | 6.11E−2 |
| | Curium | 32 | | | | \| |
| | | 17.6 | | | | ↓ |
| | | 9300 | | | | |
| | | 5500 | 0.00562 | 5.62 | 1.06E−7 | 6.90E−5 |
| | | | 1.00018 | 1000.12 | 1.15E−03 | 6.13E−02 |
| Fission | Tritium | 12.3 | | | | 2.45E−8 |
| Products | Krypton | 10.76 | 0.0656 | 65.6 | 1.06272E−8 | 6.85E−5 |
| | Strontium | 28.1 | 0.1468 | 146.8 | 2.4222E−7 | 4.50E−4 |
| | Zirconium | 1.5E6 | 0.674 | 674 | 3.4711E−11 | |
| | Niobium | 2E4 | | | | |
| | Technetium | 2.12E5 | 0.1536 | 153.6 | 5.9904E−11 | 9.67E−9 |
| | Palladium | 7E6 | 0.24 | 240 | 7.2E−13 | 0 |
| | Cadmium | 14 | 0.01552 | 15.52 | 2.70048E−12 | |
| | Tin | 10E5 | 0.00948 | 9.48 | 1.41252E−13 | 1.56E−4 |
| | Antimony | 2.71 | 0.002 | 2 | 3.7E−11 | |
| | Iodine | 1.7E7 | 0.0496 | 49.6 | 5.952E−14 | |
| | Cesium | 3E6 | | | | |
| | Cesium | 30 | 0.446 | 448 | 1.03918E−6 | 2.42E−3 |
| | Samarium | 87 | 0.1634 | 163.4 | 5.16355E−9 | 2.18E−6 |
| | Europium | 12.7 | | | | |
| | Europium | 16 | 0.031 | 31 | 3.813E−9 | |
| | | | 1.997 | 1999 | 3.011187E−7 | 3.0967E−3 |
| Fission | Yttrium | (64 hours) | 0.422 | Immeasurable trace | | |
| Products | Ruthenium | (367 days) | 2.09 | | | |
| to | Rhodium | (30 sec) | 0.363 | | | |
| be | Cesium | 2.046 | n/a | | | |
| consider | Barium | (2.554 min) | 1.26 | | | |
| | Cerium | (284 days) | 2.47 | | | |
| | Praseodymium | (17.27 months) | 1.09 | | | |
| Activated | Carbon | 5730 | | | | |
| Products | Tritium | 12.3 | | | | |
| | Cobalt | 5.26 | | trace | | |
| | Nickel | 8E4 | | trace | | |
| | | 92 | 1.45 | trace | | |

TABLE 6-continued

TABLE 6C

| 1 Component | 2 Focus Element | 11 Thermal Emission (W/g) | 12 Artificial Feldspar Mix Proportions % | 13 Rate constant | 14 thermal (ΔC.) | 15 Water cont (%) | 16 pressure (Δbars) |
|---|---|---|---|---|---|---|---|
| Fly Ash | SiO2 | n/a | 52.59 | to | 1400 C. | less | to |
| | Al2O3 | \| | 19.98 | be | to | than | be |
| | CaO | \| | 15.49 | select | 800 C. | 50 | select |
| | Fe2O3 | \| | 7.39 | (relates | for | (relates | (for |
| | MgO | \| | 3.43 | to | Calcium | to | dropping |
| | SO3 | ↓ | 0.85 | rector | Feldspar | actual | process |
| | Other | | 0.27 | type) | | Fly | ΔT) |
| | | | 100 | | | | |
| Actinides | Uranium | 4.18E−08 | 0.001916 | | For | ash | |
| | Plutonium | 1.52E−4 | 0.000021 | | other | property) | |
| | Americium | 6.11E−2 | 0.000052 | | Feldspar | | |
| | | | | | types | | |
| | Curium | 6.90E−5 | 0.000011 | | (N, K, | | |
| | | \| | | | Ba) | | |
| | | ↓ | | | refer | | |
| | | | | | to | | |
| | | | | | Bowen | | |
| | | | | | Rection | | |
| | | | | | Series | | |
| | | 6.13E−02 | | | | | |
| Fission Products | Tritium | 2.45E−8 | | | | | |
| | Krypton | 6.85E−5 | | | | | |
| | Strontium | 4.50E−4 | 0.000293 | | | | |
| | Zirconium | | 0.001348 | | | | |
| | Niobium | | | | | | |
| | Technetium | 9.67E−9 | | | | | |
| | Palladium | 0 | 0.00048 | | | | |
| | Cadmium | | 0.000031 | | | | |
| | Tin | 1.56E−4 | 0.000018 | | | | |
| | Antimony | | 0.000004 | | | | |
| | Iodine | | 0.000099 | | | | |
| | Cesium | | | | | | |
| | Cesium | 2.42E−3 | 0.0892 | | | | |
| | Samarium | 2.18E−6 | | | | | |
| | Europium | | | | | | |
| | Europium | | 0.000005 | | | | |
| | | 3.0967E−3 | | | | | |
| Fission Products to be consider | Yttrium | | | | | | |
| | Ruthenium | | | | | | |
| | Rhodium | | | | | | |
| | Cesium | | | | | | |
| | Barium | | | | | | |
| | Cerium | | | | | | |
| | Praseodymium | | | | | | |
| Activated Products | Carbon | | | | | | |
| | Tritium | | | | | | |
| | Cobalt | | | | | | |
| | Nickel | | | | | | |

The data in column 13, 14, 15, 16 to be finalized-relates to CFR thermodynamics selection

TABLE 6D

| 1 Component | 2 Focus Element | 17 Solubility Leaching | 18 ICRP LIMITS pCi/(ml-g) | 19 Natural Occurrence a/o | 20 Dominant Health Hazard |
|---|---|---|---|---|---|
| Fly Ash | SiO2 | | | 100 | n/a |
| | Al2O3 | | | 100 | \| |
| | CaO | | | 100 | \| |
| | Fe2O3 | | | 100 | \| |
| | MgO | | | 100 | \| |
| | SO3 | | | 100 | ↓ |
| | Other | | | 100 | |
| Actinides | Uranium | Negligible in trace amount | No limits for soil-relates to natural occurrence | 0.0056<br>0.7205<br>99.274 | 15 days - ingestion |
| | Plutonium | | | trace in U | 73,000 days - inhal-limit abspt |

TABLE 6-continued

| | | | | | |
|---|---|---|---|---|---|
| | Americium | | | trace in U | 73,000 days - skin/ ingestion |
| | Curium | | | 0.185-0.251<br>88.45<br>11.114<br>ave 0.0046 | |
| Fission Products | Tritium | Negligible in trace amount | No limits for soil-relates to natural occurrence | | |
| | Krypton | | | 0.00014 | |
| | Strontium | | | | 18,000 days - inhal/ingest |
| | Zirconium | | | 0.37 | |
| | Niobium | | | | |
| | Technetium | | | 1E−9 g to 0.2 ng/kg | 6.02 hours |
| | Palladium | | | 35.9 | |
| | Cadmium | | | 4 PPM | |
| | Tin | | | | |
| | Antimony | | | | |
| | Iodine | | | 0.04 PPM | 138 days - skin/inhale./ing |
| | Cesium | | | 20% | |
| | Cesium | | | | 70 days - inhal./ingestion |
| | Samarium | | | 1.6 | |
| | Europium | | | rear earth | |
| | Europium | | | rear earth | |
| Fission Products to be consider | Yttrium | | | | 64 hours - inhal/ingest |
| | Ruthenium | | | | |
| | Rhodium | | | | |
| | Cesium | | | | |
| | Barium | | | | Ingestion (200 yr) |
| | Cerium | | | | |
| | Praseodymium | | | | |
| Activated Products | Carbon | | | ALI- | Naturally occurring |
| | Tritium | | | 2000 mCi(EPA) | 12 days - skin/inhal./ ingest |
| | Cobalt | | | | 9.5 days - inhal/ingestion |
| | Nickel | | | | |

ALI—Annual Limit on Intake

HLW/Spent Fuel Recycling and Permanent Disposal ("Technical Report")

Part 1

Isotope Inventory in Produced from Recycling HLW

Figure 10:
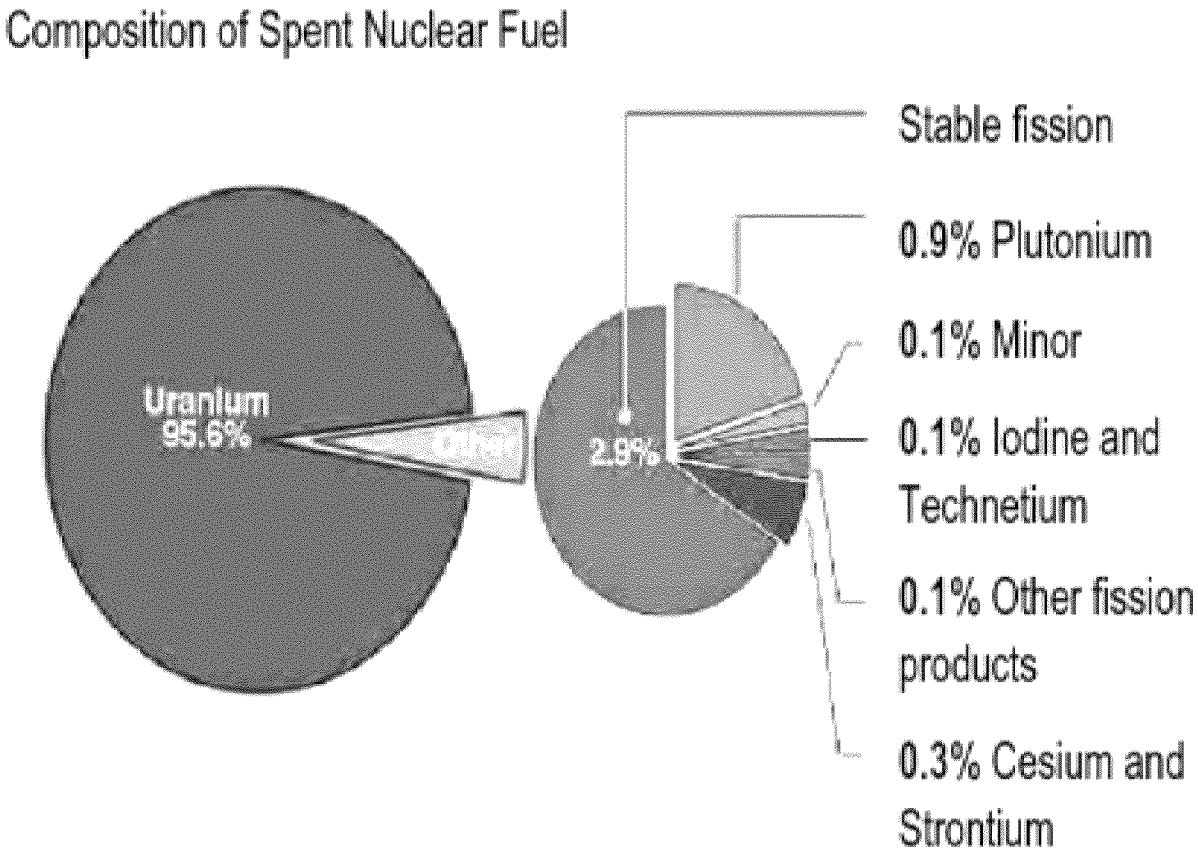
FIG. 10 is a chart showing the typical composition of spent nuclear fuel.
Figure 11:
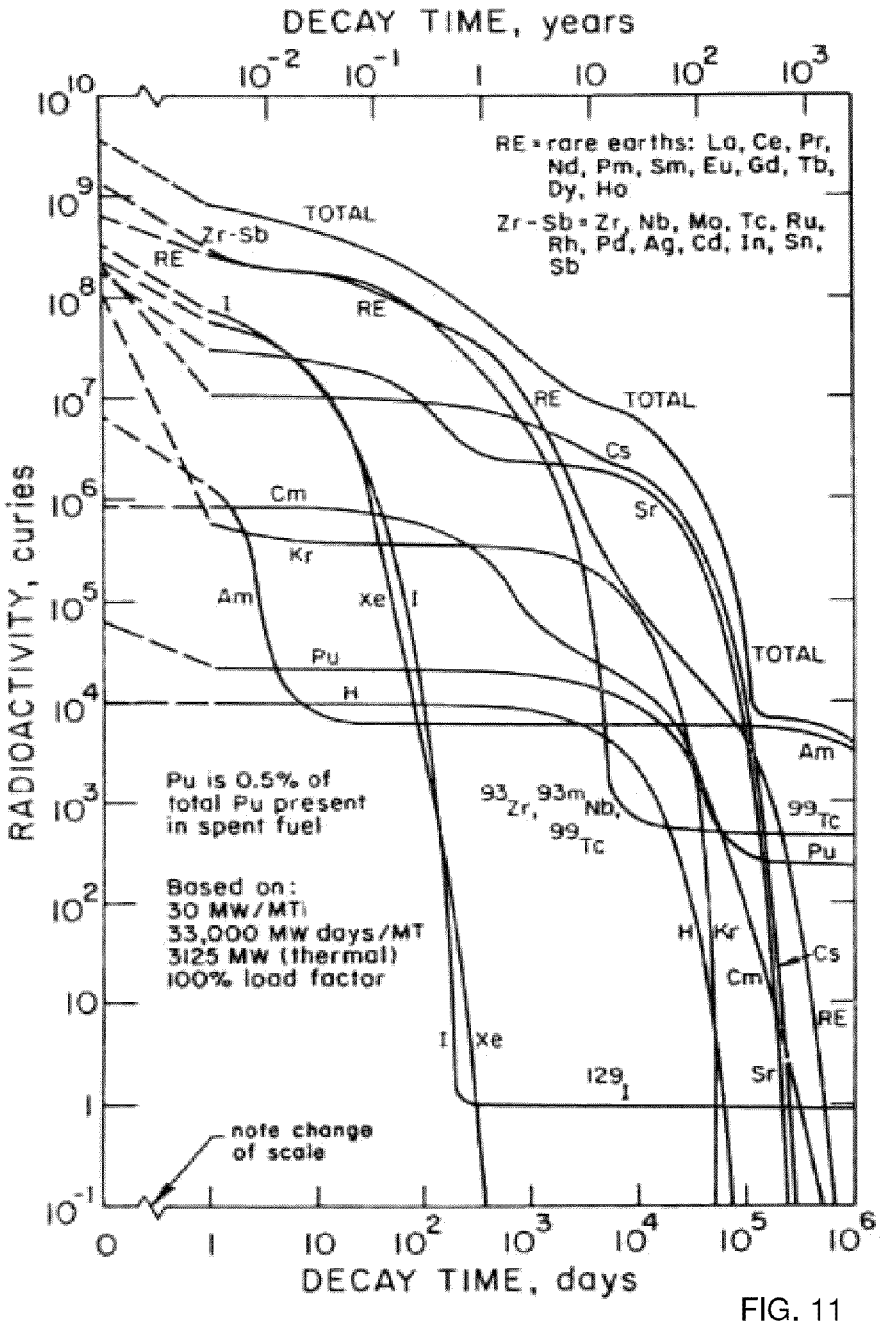
FIG. 11 is a chart depicting the decay times of various radioactive elements.

The general isotope composition of spent fuel rods is shown in FIG. 10.

Table A.1 shows the proportional fission levels in the HLW fuel at various burn-up rates:

TABLE A.1

Isotopic composition of fresh and spent LEU (kilograms per kilogram initial heavy metal), for design and discharge burn-ups of 33, 43, and 53 $MW_td/kgHM$.

| | Fresh LEU | | | Spent LEU | | |
|---|---|---|---|---|---|---|
| Isotope | 33 | 43 | 53 | 33 | 43 | 53 |
| U-235 | 0.03250 | 0.03700 | 0.04400 | 0.00884 | 0.00760 | 0.00768 |
| U-236 | | | | 0.00391 | 0.00481 | 0.00594 |
| U-238 | 0.96750 | 0.96300 | 0.95600 | 0.94372 | 0.93250 | 0.91983 |
| Pu-238 | | | | 0.00012 | 0.00021 | 0.00033 |
| Pu-239 | | | | 0.00540 | 0.00572 | 0.00607 |
| Pu-240 | | | | 0.00221 | 0.00262 | 0.00291 |
| Pu-241 | | | | 0.00132 | 0.00160 | 0.00183 |
| Pu-242 | | | | 0.00045 | 0.00068 | 0.00085 |
| Am-241 | | | | 0.00003 | 0.00005 | 0.00006 |
| Total | 1.00000 | 1.00000 | 1.00000 | 0.96600 | 0.95579 | 0.94550 |

Source:
Nuclear Energy Agency, *Plutonium Fuel: An Assessment* (Paris: Organization for Economic Development and Cooperation, 1989), p. 41.

Table A.2 shows the Isotope composition in fresh MOX fuel produced from LEU (provided as a reference in evaluating by-product MOX fuel production):

TABLE A.2

Isotopic composition of fresh MOX fuel with design burn-ups of 33, 43, and 53 $MW_td/kgHM$ produced with plutonium recovered from LEU with discharge burn-up of 33 and 43 $MW_td/kgHM$.

| | 33 $MW_td$/ kgHM LEU Pu | | | 43 $MW_td$/ kgHM LEU Pu | |
|---|---|---|---|---|---|
| | Design Burnup (MWtd/kgHM) | | | | |
| Isotope | 33 | 43 | 53 | 43 | 53 |
| U-235 | 0.00213 | 0.00212 | 0.00209 | 0.00210 | 0.00207 |
| U-238 | 0.94632 | 0.93871 | 0.92667 | 0.93053 | 0.91631 |
| Pu-238 | 0.00070 | 0.00080 | 0.00096 | 0.00129 | 0.00156 |
| Pu-239 | 0.03019 | 0.03465 | 0.04172 | 0.03678 | 0.04457 |
| Pu-240 | 0.01215 | 0.01394 | 0.01679 | 0.01659 | 0.02010 |
| Pu-241 | 0.00550 | 0.00631 | 0.00760 | 0.00768 | 0.00931 |
| Pu-242 | 0.00248 | 0.00285 | 0.00343 | 0.00428 | 0.00519 |
| Am-241 | 0.00054 | 0.00062 | 0.00074 | 0.00075 | 0.00091 |
| Total | 1.00000 | 1.00000 | 1.00000 | 1.00000 | 1.00000 |

Source: Nuclear Energy Agency, *Plutonium Fuel: An Assessment* (Paris: Organization for Economic Development and Cooperation, 1989), pp. 50-51.

Discussion of the Isotopes Properties in Spent Nuclear Fuel

The entire process in the nuclear fuel cycle is subject to the following simple rule: The sum of the atomic weight of the two atoms produced by the fission of one atom is always less than the atomic weight of the original atom. This is because some of the mass is lost as free neutrons and large amounts of energy.

Since the nuclei that can readily undergo fission are particularly neutron-rich (e.g. 61% of the nucleons in uranium-235 are neutrons), the initial fission products are almost always more neutron-rich than stable nuclei of the same mass as the fission product (e.g. stable ruthenium-100 is 56% neutrons; stable xenon-134 is 60%). The initial fission products therefore may be unstable and typically undergo beta decay towards stable nuclei, converting a neutron to a proton with each beta emission. (Fission products do not emit alpha particles.).

Approximately 3.0% of the isotope mass consists of the fission products of $^{235}U$ and $^{239}Pu$ (also indirect products in the decay chain) which are considered radioactive waste.

The fission products include every element in the periodic table from zinc through to the lanthanides; much of the fission yield is concentrated in two peaks, one in the second transition row (Zr, Mo, Tc, Ru, Rh, Pd, Ag) and the other later in the periodic table (I, Xe, Cs, Ba, La, Ce, Nd).

Many of the fission products are either non-radioactive or short-lived radioisotopes, but, a considerable number are medium to long-lived radioisotopes such as $^{90}Sr$, $^{137}Cs$, $^{99}Tc$ and $^{129}I$. Research has been conducted by several different countries into segregating the rare isotopes in fission waste including the "fission platinoids" (Ru, Rh, Pd) and silver (Ag) as a way of offsetting the cost of reprocessing.

The fission products can modify the thermal properties of the uranium dioxide; the lanthanide oxides tend to lower the thermal conductivity of the fuel, while the metallic nanoparticles slightly increase the thermal conductivity of the fuel.

Traces of the minor actinides are also present in spent reactor fuel. These are actinides other than uranium and plutonium and include neptunium, americium and curium. The amount formed depends greatly upon the nature of the fuel used and the conditions under which it was used. For instance, the use of MOX fuel ($^{239}Pu$ in a $^{238}U$ matrix) is likely to lead to the production of more $^{241}Am$ and heavier nuclides than a uranium/thorium based fuel ($^{233}U$ in a $^{232}Th$ matrix).

For natural uranium fuel: Fissile component starts at 0.71% $^{235}U$ concentration in natural uranium. At discharge, total fissile component is still 0.50% (0.23% $^{235}U$, 0.27% fissile $^{239}Pu$, $^{241}Pu$). Fuel is discharged not because fissile material is fully used-up, but because the neutron-absorbing fission products have built up and the fuel become significantly less able to sustain a nuclear reaction.

Some natural uranium fuels use chemically active cladding, such as Magnox, and need to be reprocessed because long-term storage and disposal is difficult.

For highly-enriched fuels used in marine reactors and research reactors, the isotope inventory will vary based on in-core fuel management and reactor operating conditions.

The first beta decays are rapid and may release high energy beta particles or gamma radiation. However, as the fission products approach stable nuclear conditions, the last one or two decays may have a long half-life and release less energy. There are a few exceptions with relatively long half-lives and high decay energy, such as:

Strontium-90 (high energy beta, half-life 30 years);

Caesium-137 (high energy gamma, half-life 30 years);

Tin-126 (even higher energy gamma, but long half-life of 230,000 years means a slow rate of radiation release, and the yield of this nuclide per fission is very low).

Fission products have half-lives of 90 years (Samarium-151) or less, except for seven long-lived fission products with half-lives of 211,100 years (Technetium-99) and more. Therefore, the total radioactivity of fission products decreases rapidly for the first several hundred years before stabilizing at a low level, that then degrades very slowly over hundreds of thousands of years. This contrasts with actinides produced in the open (no nuclear reprocessing) nuclear fuel cycle, a number of which have half-lives in the intermediate range of about 100 to 200,000 years.

Proponents of nuclear fuel cycles which aim to consume all their actinides by fission, such as the Integral Fast Reactor and Molten Reactor, claim that within 200 years, their wastes are no more radioactive than the original uranium ore. Unfortunately these claims need to be proven practically, requiring evaluation over an extended timeframe.

| Actinides | | | | Half-life | Fission products | | | |
|---|---|---|---|---|---|---|---|---|
| $^{244}Cm$ | $^{241}Pu^f$ | $^{250}Cf$ | $^{243}Cm^f$ | 10-30 y | $^{137}Cs$ | $^{90}Sr$ | $^{85}Kr$ | |
| $^{232}U^f$ | | $^{238}Pu$ | f is for | 69-90 y | | | $^{151}Sm$ nc→ | |
| 4n | $^{249}Cf^f$ | $^{242}Am^f$ | fissile | 141-351 | No fission product | | | |
| | $^{241}Am$ | | $^{251}Cf^f$ | 431-898 | has half-life $10^2$ | | | |
| $^{240}Pu$ | $^{229}Th$ | $^{246}Cm$ | $^{243}Am$ | 5-7 ky | to $2 \times 10^5$ years | | | |
| 4n | $^{245}Cm^f$ | $^{250}Cm$ | $^{239}Pu^f$ | 8-24 ky | | | | |
| | $^{233}U^f$ | $^{230}Th$ | $^{231}Pa$ | 32-160 | | | | |
| | 4n + 1 | $^{234}U$ | 4n + 3 | 211-290 | $^{99}Tc$ | | $^{126}Sn$ | $^{79}Se$ |
| $^{248}Cm$ | | $^{242}Pu$ | | 340-373 | Long-lived fission products | | | |
| | $^{237}Np$ | 4n + 2 | | 1-2 My | $^{93}Zr$ | $^{135}Cs$ nc→ | | |
| $^{236}U$ | 4n + 1 | | $^{247}Cm^f$ | 6-23 My | | $^{107}Pd$ | $^{129}I$ | |
| $^{244}Pu$ | | | | 80 My | >7% | >5% | >1% | >.1% |
| $^{232}Th$ | | $^{238}U$ | $^{235}U^f$ | 0.7-12 Ty | fission product yield | | | |

Fission products emit beta radiation, while actinides primarily emit alpha radiation. Many of each also emits gamma radiation. Some fission products decay with the release of a neutron.

Some of the fission products, such as xenon-135 and samarium-149, have a high neutron absorption capacity.

Nuclear weapons use fission as either the partial or the main energy source. Depending on the weapon design and where it is exploded, the relative importance of the fission product radioactivity will vary compared to the activation product radioactivity in the total fallout radioactivity.

The immediate fission products from nuclear weapon fission are essentially the same as those from any other fission source, depending slightly on the particular nuclide that is fissioning. However, the very short time scale for the reaction makes a difference in the particular mix of isotopes produced from an atomic bomb. The $^{134}Cs/^{137}Cs$ ratio provides an easy method of distinguishing between fallout from a bomb and the fission products from a power reactor. Almost no Cs-134 is formed by nuclear fission (because xenon-134 is stable). The $^{134}Cs$ is formed by the neutron activation of the stable $^{133}Cs$ which is formed by the decay of isotopes in the isobar (A=133). So in a momentary criticality by the time that the neutron flux becomes zero too little time will have passed for any $^{133}Cs$ to be present. While in a power reactor plenty of time exists for the decay of the isotopes in the isobar to form $^{133}Cs$, the $^{133}Cs$ thus formed can then be activated to form $^{134}Cs$ only if the time between the start and the end of the criticality is long.

The radioactivity in the fission product mixture in an atom bomb is mostly caused by short-lived isotopes such as I-131 and Ba-140. After about four months Ce-141, Zr-95/Nb-95, and Sr-89 represent the largest share of radioactive material. After two to three years, Ce-144/Pr-144, Ru-106/Rh-106, and Promethium-147 are the bulk of the radioactivity. After a few years, the radiation is dominated by Strontium-90 and Caesium-137, whereas in the period between 10,000 and a million years it is Technetium-99 that dominates.

For fission of uranium-235, the predominant radioactive fission products include isotopes of iodine, caesium, strontium, xenon and barium. The threat becomes smaller with the passage of time. Many of the fission products decay through very short-lived isotopes to form stable isotopes, but a considerable number of the radioisotopes have half-lives longer than a day.

The radioactivity in the fission product mixture is mostly caused by short lived isotopes such as Iodine-131 and $^{140}$Ba, after about four months $^{141}$Ce, $^{95}$Zr/$^{95}$Nb and $^{89}$Sr take the largest share, while after about two or three years the largest share is taken by $^{144}$Ce/$^{144}$Pr, $^{106}$Ru/$^{106}$Rh and $^{147}$Pm. Later $^{90}$Sr and $^{137}$Cs are the main radioisotopes, being succeeded by $^{99}$Tc. In the case of a release of radioactivity from a power reactor or used fuel, only some elements are released; as a result, the isotopic signature of the radioactivity is very different from an open air nuclear detonation, where all the fission products are dispersed. At least three isotopes of iodine are important. $^{129}$I, $^{131}$I (radioiodine) and $^{132}$I. The short-lived isotopes of iodine are particularly harmful because the thyroid collects and concentrates iodide—radioactive as well as stable.

$^{137}$Cs is an isotope which is of long term concern as it remains in the top layers of soil. Plants with shallow root systems tend to absorb it for many years. Hence grass and mushrooms can carry a considerable amount of $^{137}$Cs which can be transferred to humans through the food chain.

Other concern is the effect of Strontium—in soils poor in calcium is the uptake of strontium by plants.

These facts were taken into account in the design of this disclosure, in order all issues to be resolve permanently. This was achieved by copying the model in nature, where the isotopes are found in safe natural mineral matrices which are able to sustain the long geologic metamorphosis, without affecting the biosphere.

In order to produce a sustainable testing program, the first step will be to list all the isotopes produced in a nuclear reactor s—all long lived isotope of interest are marked with circles (Ref.—Nuclear Chemical Engineering).

TABLE 8.2

Nuclide composition, Elemental composition and neutron absorption of fission products in discharge uranium fuel †

| Nuclide | Half-life (S = stable) | Atoms per fission-product pair‡ | Effective thermal cross sections,§b | Neutron absorption, barns per fission-product pair |
|---|---|---|---|---|
| PROPERTIES OF IRRADIATED FUEL AND OTHER REACTOR MATERIALS 359 | | | | |
| ●$^{3}$H | 12.3 yr | $1.26 \times 10^{-4}$ | — | — |
| $^{73}$Ge | S | $1.38 \times 10^{-6}$ | 11.5 | $1.59 \times 10^{-5}$ |
| $^{74}$Ge | S | $4.94 \times 10^{-6}$ | 0.369 | $1.83 \times 10^{-6}$ |
| $^{76}$Ge | S | $2.61 \times 10^{-5}$ | 0.295 | $7.70 \times 10^{-6}$ |
| Total | | $3.29 \times 10^{-5}$ | | $2.54 \times 10^{-5}$ |
| $^{75}$As | S | $7.98 \times 10^{-6}$ | 14.5 | $1.16 \times 10^{-4}$ |
| Total | | $7.98 \times 10^{-6}$ | | $1.16 \times 10^{-4}$ |
| $^{77}$Se | S | $8.06 \times 10^{-5}$ | 42.7 | $3.44 \times 10^{-3}$ |
| $^{78}$Se | S | $2.16 \times 10^{-4}$ | 0.352 | $7.60 \times 10^{-5}$ |

TABLE 8.2-continued

Nuclide composition, Elemental composition and neutron absorption of fission products in discharge uranium fuel †

| Nuclide | Half-life (S = stable) | Atoms per fission-product pair‡ | Effective thermal cross sections,§b | Neutron absorption, barns per fission-product pair |
|---|---|---|---|---|
| ●$^{79}$Se | $<6.5 \times 10^{4}$ yr | $5.00 \times 10^{-4}$ | 3.74 | $1.87 \times 10^{-4}$ |
| $^{80}$Se | S | $9.05 \times 10^{-4}$ | 0.737 | $6.67 \times 10^{-4}$ |
| $^{82}$Se | S | $2.87 \times 10^{-3}$ | 1.638 | $4.70 \times 10^{-3}$ |
| Total | | $4.58 \times 10^{-3}$ | | $1.08 \times 10^{-2}$ |
| $^{83}$Br | S | $1.29 \times 10^{-3}$ | 20.0 | $2.58 \times 10^{-2}$ |
| Total | | $1.29 \times 10^{-3}$ | | $2.58 \times 10^{-2}$ |
| $^{83}$Kr | S | $2.75 \times 10^{-5}$ | 93.0 | $2.56 \times 10^{-3}$ |
| $^{83}$Kr | S | $3.51 \times 10^{-3}$ | 222 | $7.79 \times 10^{-1}$ |
| $^{84}$Kr | S | $9.73 \times 10^{-3}$ | 1.47 | $1.43 \times 10^{-2}$ |
| ●$^{85}$Kr | 10.76 yr | $2.48 \times 10^{-3}$ | 9.89 | $2.45 \times 10^{-3}$ |
| $^{86}$Kr | S | $1.65 \times 10^{-3}$ | 0.065 | $1.07 \times 10^{-3}$ |
| Total | | $3.22 \times 10^{-2}$ | | $8.22 \times 10^{-1}$ |
| $^{85}$Rb | S | $8.14 \times 10^{-3}$ | 0.937 | $7.63 \times 10^{-3}$ |
| ●$^{87}$Rb | $4.7 \times 10^{10}$ yr | $2.03 \times 10^{-2}$ | 0.147 | $2.98 \times 10^{-3}$ |
| Total | | $2.84 \times 10^{-2}$ | | $1.06 \times 10^{-2}$ |
| $^{88}$Sr | S | $2.94 \times 10^{-2}$ | 0.005 | $1.47 \times 10^{-4}$ |
| $^{89}$Sr | 52 days | $2.82 \times 10^{-4}$ | 0.466 | $1.31 \times 10^{-4}$ |
| ●$^{90}$Sr | 28.1 yr | $4.43 \times 10^{-2}$ | 1.34 | $5.94 \times 10^{-3}$ |
| Total | | $7.40 \times 10^{-2}$ | | $5.96 \times 10^{-2}$ |
| $^{89}$Y | S | $3.82 \times 10^{-2}$ | 1.29 | $4.93 \times 10^{-2}$ |
| $^{90}$Y | 64 h | $1.16 \times 10^{-4}$ | 3.27 | $3.79 \times 10^{-4}$ |
| $^{91}$Y | 58.8 days | $1.06 \times 10^{-3}$ | 0.996 | $1.06 \times 10^{-3}$ |
| Total | | $3.87 \times 10^{-2}$ | | $5.07 \times 10^{-3}$ |
| $^{90}$Zr | S | $2.05 \times 10^{-3}$ | 0.093 | $1.91 \times 10^{-4}$ |
| $^{91}$Zr | S | $4.81 \times 10^{-3}$ | 3.81 | $1.83 \times 10^{-1}$ |
| $^{92}$Zr | S | $5.19 \times 10^{-2}$ | 0.363 | $1.88 \times 10^{-2}$ |
| ●$^{93}$Zr | $1.5 \times 10^{6}$ yr | $5.65 \times 10^{-2}$ | 8.93 | $5.05 \times 10^{-1}$ |
| $^{94}$Zr | S | $5.92 \times 10^{-2}$ | 0.118 | $6.99 \times 10^{-3}$ |
| $^{95}$Zr | 65 days | $9.20 \times 10^{-4}$ | ~0 | — |
| ●$^{96}$Zr | $>3.6 \times 10^{12}$ yr | $6.00 \times 10^{-3}$ | 0.063 | $3.78 \times 10^{-3}$ |
| Total | | $2.78 \times 10^{-1}$ | | $7.18 \times 10^{-1}$ |
| $^{95}$Nb | 35.0 days | $9.28 \times 10^{-4}$ | 4.10 | $3.80 \times 10^{-3}$ |
| Total | | $9.35 \times 10^{-4}$ | | $3.80 \times 10^{-3}$ |
| 360 PROPERTIES OF IRRADIATED FUEL AND OTHER REACTION MATERIALS | | | | |
| $^{95}$Mo | S | $5.47 \times 10^{-2}$ | 40.8 | 2.23 |
| $^{96}$Mo | S | $2.50 \times 10^{-3}$ | 8.44 | $2.11 \times 10^{-2}$ |
| $^{97}$Mo | S | $5.93 \times 10^{-2}$ | 6.39 | $3.79 \times 10^{-1}$ |
| $^{98}$Mo | S | $5.88 \times 10^{-2}$ | 2.04 | $1.20 \times 10^{-1}$ |
| ●$^{100}$Mo | $>3 \times 10^{17}$ yr | $6.52 \times 10^{-2}$ | 1.60 | $1.04 \times 10^{-1}$ |
| Total | | $2.40 \times 10^{-1}$ | | 2.86 |
| ●$^{99}$TC | $2.12 \times 10^{5}$ yr | $5.77 \times 10^{-2}$ | 44.4 | 2.36 |
| Total | | $5.77 \times 10^{-2}$ | | 2.56 |
| $^{100}$Ru | S | $2.89 \times 10^{-3}$ | 10.9 | $3.15 \times 10^{-2}$ |
| $^{101}$Ru | S | $5.19 \times 10^{-2}$ | 25.1 | 1.30 |
| $^{102}$Ru | S | $4.90 \times 10^{-2}$ | 4.33 | $2.12 \times 10^{-1}$ |
| $^{103}$Ru | 39.6 days | $1.66 \times 10^{-4}$ | ~0 | — |
| $^{104}$Ru | S | $3.10 \times 10^{-2}$ | 1.70 | $5.20 \times 10^{-2}$ |
| $^{106}$Ru | 367 days | $6.28 \times 10^{-3}$ | 0.693 | $4.35 \times 10^{-2}$ |
| Total | | $1.41 \times 10^{-1}$ | | 1.60 |
| $^{103}$Rh | S | $2.36 \times 10^{-2}$ | 426 | $1.01 \times 10^{-1}$ |
| Total | | $2.36 \times 10^{-2}$ | | $1.01 \times 10^{-1}$ |
| $^{104}$Pd | S | $9.43 \times 10^{-3}$ | 10.4 | $9.81 \times 10^{-2}$ |
| $^{105}$Pd | S | $1.67 \times 10^{-2}$ | 30.8 | $8.14 \times 10^{-1}$ |
| $^{106}$Pd | S | $1.42 \times 10^{-2}$ | 1.95 | $2.77 \times 10^{-1}$ |
| ●$^{107}$Pd | $\approx 7 \times 10^{6}$ yr | $1.16 \times 10^{-2}$ | 19.6 | $2.27 \times 10^{-1}$ |
| $^{108}$Pd | S | $7.35 \times 10^{-3}$ | 54.2 | $3.98 \times 10^{-1}$ |
| $^{110}$Pd | S | $1.56 \times 10^{-3}$ | 3.06 | $4.77 \times 10^{-3}$ |
| Total | | $6.71 \times 10^{-3}$ | | 1.27 |
| $^{109}$Ag | S | $2.94 \times 10^{-3}$ | 487 | 1.43 |
| Total | | $2.94 \times 10^{-3}$ | | 1.43 |
| $^{110}$Cd | S | $1.14 \times 10^{-3}$ | 8.76 | $9.99 \times 10^{-3}$ |
| $^{111}$Cd | S | $5.06 \times 10^{-4}$ | 16.54 | $1.33 \times 10^{-3}$ |
| $^{112}$Cd | S | $4.30 \times 10^{-4}$ | 3.75 | $1.61 \times 10^{-1}$ |
| $^{113}$Cd | S | $9.35 \times 10^{-6}$ | $1.66 \times 10^{4}$ | $1.55 \times 10^{-1}$ |
| $^{114}$Cd | S | $6.50 \times 10^{-4}$ | 6.78 | $4.41 \times 10^{-2}$ |
| $^{116}$Cd | S | $1.95 \times 10^{-4}$ | 1.06 | $4.02 \times 10^{-4}$ |
| Total | | $3.23 \times 10^{-3}$ | | $1.85 \times 10^{-1}$ |
| ●$^{115}$In | $6 \times 10^{14}$ yr | $7.24 \times 10^{-5}$ | $1.14 \times 10^{3}$ | $8.25 \times 10^{-2}$ |
| Total | | $7.24 \times 10^{-5}$ | | $8.25 \times 10^{-2}$ |

TABLE 8.2-continued

Nuclide composition, Elemental composition and neutron absorption of fission products in discharge uranium fuel †

| Nuclide | Half-life (S = stable) | Atoms per fission-product pair‡ | Effective thermal cross sections,§b | Neutron absorption, barns per fission-product pair |
|---|---|---|---|---|
| $^{116}$Sn | S | $1.06 \times 10^{-4}$ | 4.02 | $4.26 \times 10^{-4}$ |
| $^{117}$Sn | S | $2.02 \times 10^{-4}$ | 6.80 | $1.37 \times 10^{-3}$ |
| $^{118}$Sn | S | $2.05 \times 10^{-4}$ | ~0 | — |
| $^{119}$Sn | S | $2.11 \times 10^{-4}$ | 3.94 | $8.31 \times 10^{-4}$ |
| $^{120}$Sn | S | $2.21 \times 10^{-4}$ | 0.347 | $7.67 \times 10^{-5}$ |
| $^{122}$Sn | S | $2.56 \times 10^{-4}$ | 0.147 | $3.76 \times 10^{-5}$ |
| $^{124}$Sn | S | $3.39 \times 10^{-4}$ | 0.115 | $4.24 \times 10^{-5}$ |
| PROPERTIES OF IRRADIATED FUEL AND OTHER REACTOR MATERIALS 361 | | | | |
| ●Sn | $\approx 10^{5}$ yr | $4.71 \times 10^{-4}$ | 0.280 | $1.32 \times 10^{-4}$ |
| Total | | $2.05 \times 10^{-3}$ | | $2.92 \times 10^{-3}$ |
| $^{121}$Sb | S | $2.32 \times 10^{-4}$ | 46.3 | $1.07 \times 10^{-2}$ |
| ●Sb | $>1.3 \times 10^{16}$ yr | $2.72 \times 10^{-4}$ | 54.6 | $1.49 \times 10^{-2}$ |
| $^{122}$Sb | 2.71 yr | $3.36 \times 10^{-4}$ | 1.46 | $4.91 \times 10^{-4}$ |
| Total | | $8.44 \times 10^{-4}$ | | $2.61 \times 10^{-3}$ |
| $^{123m}$Te | 58 days | $7.98 \times 10^{-6}$ | — | — |
| $^{125}$Te | S | $1.59 \times 10^{-4}$ | 8.16 | $1.30 \times 10^{-3}$ |
| $^{126}$Te | S | $4.50 \times 10^{-4}$ | 3.32 | $1.49 \times 10^{-3}$ |
| $^{127m}$Te | 109 days | $2.98 \times 10^{-5}$ | — | — |
| $^{128}$Te | S | $6.21 \times 10^{-3}$ | 3.00 | $1.86 \times 10^{-2}$ |
| $^{129m}$Te | 34 days | $1.03 \times 10^{-5}$ | — | — |
| ●Te | $8 \times 10^{20}$ yr | $2.16 \times 10^{-2}$ | 0.270 | $5.83 \times 10^{-3}$ |
| Total | | $2.85 \times 10^{-3}$ | | $2.73 \times 10^{-2}$ |
| $^{127}$I | S | $1.79 \times 10^{-3}$ | 55.87 | $9.99 \times 10^{-2}$ |
| ●I | $1.7 \times 10^{7}$ yr | $1.07 \times 10^{-2}$ | 37.4 | $4.00 \times 10^{-1}$ |
| Total | | $1.25 \times 10^{-2}$ | | $9.00 \times 10^{-1}$ |
| $^{130}$Xe | S | $3.95 \times 10^{-4}$ | 2.46 | $9.72 \times 10^{-4}$ |
| $^{131}$Xe | S | $2.18 \times 10^{-2}$ | 322 | 7.02 |
| $^{132}$Xe | S | $5.68 \times 10^{-2}$ | 0.869 | $4.94 \times 10^{-2}$ |
| $^{134}$Xe | S | $7.83 \times 10^{-2}$ | 0.689 | $5.39 \times 10^{-2}$ |
| $^{136}$Xe | S | $1.19 \times 10^{-1}$ | 0.230 | $2.74 \times 10^{-2}$ |
| Total | | $2.76 \times 10^{-1}$ | | 7.15 |
| $^{133}$Cs | S | $5.37 \times 10^{-2}$ | 158 | 8.48 |
| $^{134}$Cs | 2.046 yr | $6.94 \times 10^{-3}$ | 129 | $8.95 \times 10^{-1}$ |
| ●Cs | $3.0 \times 10^{6}$ yr | $1.42 \times 10^{-2}$ | 30.2 | $4.29 \times 10^{-1}$ |
| $^{137}$Cs | 30.0 yr | $6.02 \times 10^{-2}$ | 0.176 | $1.06 \times 10^{-2}$ |
| Total | | $1.35 \times 10^{-1}$ | | 9.82 |
| $^{134}$Ba | S | $3.91 \times 10^{-3}$ | 0.819 | $3.20 \times 10^{-3}$ |
| $^{136}$Ba | S | $9.20 \times 10^{-4}$ | 4.05 | $3.23 \times 10^{-3}$ |
| $^{137}$Ba | S | $2.37 \times 10^{-3}$ | 4.75 | $1.13 \times 10^{-2}$ |
| $^{138}$Ba | S | $5.91 \times 10^{-2}$ | 0.574 | $3.30 \times 10^{-2}$ |
| Total | | $6.63 \times 10^{-2}$ | | $5.21 \times 10^{-1}$ |
| $^{239}$La | S | $6.25 \times 10^{-2}$ | 9.87 | $6.17 \times 10^{-1}$ |
| Total | | $6.25 \times 10^{-3}$ | | $6.17 \times 10^{-1}$ |
| $^{140}$Ce | S | $6.37 \times 10^{-2}$ | 0.631 | $4.02 \times 10^{-2}$ |
| $^{141}$Ce | 33 days | $9.66 \times 10^{-5}$ | 23.7 | $2.29 \times 10^{-3}$ |
| ●Ce | $>5 \times 10^{16}$ yr | $5.73 \times 10^{-2}$ | 1.15 | $6.59 \times 10^{-2}$ |
| $^{144}$Ce | 284 days | $1.16 \times 10^{-2}$ | 1.57 | $1.82 \times 10^{-2}$ |
| Total | | $1.33 \times 10^{-1}$ | | $1.27 \times 10^{-1}$ |
| 362 PROPERTIES OF IRRADIATED FUEL AND OTHER REACTION MATERIALS | | | | |
| ●Pr | $>2 \times 10^{16}$ yr | $5.90 \times 10^{-2}$ | 6.40 | $3.78 \times 10^{-1}$ |
| Total | | $5.90 \times 10^{-2}$ | | $3.78 \times 10^{-3}$ |
| $^{142}$Nd | S | $8.75 \times 10^{-4}$ | 16.8 | $1.47 \times 10^{-3}$ |
| $^{143}$Nd | S | $3.69 \times 10^{-2}$ | 288 | $1.06 \times 10^{-3}$ |
| ●Nd | $2.4 \times 10^{15}$ yr | $5.23 \times 10^{-2}$ | 7.54 | $3.94 \times 10^{-1}$ |
| ●Nd | $>6 \times 10^{-16}$ yr | $3.43 \times 10^{-2}$ | 86.7 | 2.97 |
| $^{146}$Nd | S | $3.37 \times 10^{-3}$ | 15.4 | $5.19 \times 10^{-1}$ |
| $^{148}$Nd | S | $1.75 \times 10^{-3}$ | 7.74 | $1.35 \times 10^{-1}$ |
| ●Nd | $>10^{16}$ yr | $8.37 \times 10^{-3}$ | 6.47 | $5.42 \times 10^{-2}$ |
| Total | | $1.84 \times 10^{-1}$ | | $1.47 \times 10^{1}$ |
| $^{147}$Pm | 2.62 yr | $5.70 \times 10^{-3}$ | $1.11 \times 10^{3}$ | 6.33 |
| Total | | $5.70 \times 10^{-3}$ | | 6.33 |
| ●Sm | $1.05 \times 10^{11}$ yr | $3.67 \times 10^{-3}$ | 274 | 1.01 |
| ●$^{148}$Sm | $>2 \times 10^{14}$ yr | $1.04 \times 10^{-2}$ | 21.7 | $2.26 \times 10^{-1}$ |
| ●Sm | $>1 \times 10^{15}$ yr | $2.19 \times 10^{-4}$ | $3.52 \times 10^{-4}$ | 7.71 |
| $^{150}$Sm | S | $1.35 \times 10^{-2}$ | 149 | 2.01 |
| ●Sm | ≈87 yr | $1.70 \times 10^{-3}$ | $2.17 \times 10^{3}$ | 3.88 |
| $^{152}$Sm | S | $4.46 \times 10^{-3}$ | $1.03 \times 10^{3}$ | 4.59 |

TABLE 8.2-continued

Nuclide composition, Elemental composition and neutron absorption of fission products in discharge uranium fuel †

| Nuclide | Half-life (S = stable) | Atoms per fission-product pair‡ | Effective thermal cross sections,§b | Neutron absorption, barns per fission-product pair |
|---|---|---|---|---|
| $^{154}$Sm | S | $1.43 \times 10^{-3}$ | 11.7 | $1.67 \times 10^{-3}$ |
| Total | | $3.54 \times 10^{-2}$ | | $1.94 \times 10^{3}$ |
| $^{153}$Eu | S | $4.70 \times 10^{-3}$ | 629 | 2.96 |
| ●Eu | 16 yr | $1.39 \times 10^{-3}$ | $1.32 \times 10^{3}$ | 1.83 |
| $^{154}$Eu | 1.811 yr | $1.56 \times 10^{-4}$ | $1.22 \times 10^{4}$ | 1.90 |
| Total | | $6.26 \times 10^{-3}$ | | 6.69 |
| $^{155}$Gd | S | $2.84 \times 10^{-5}$ | $4.51 \times 10^{4}$ | 1.28 |
| $^{156}$Gd | S | $2.49 \times 10^{-3}$ | 16.0 | $3.98 \times 10^{-2}$ |
| $^{157}$Gd | S | $1.20 \times 10^{-6}$ | $2.08 \times 10^{5}$ | $2.50 \times 10^{-5}$ |
| $^{158}$Gd | S | $4.33 \times 10^{-4}$ | 11.18 | $4.84 \times 10^{-5}$ |
| $^{160}$Gd | S | $3.06 \times 10^{-5}$ | 0.655 | $2.06 \times 10^{-1}$ |
| Total | | $3.06 \times 10^{-3}$ | | 1.58 |
| $^{159}$Tb | S | $5.90 \times 10^{-8}$ | 218 | $1.28 \times 10^{-2}$ |
| Total | | $5.90 \times 10^{-8}$ | | $1.28 \times 10^{-2}$ |
| $^{160}$Dy | S | $1.06 \times 10^{-5}$ | 377 | $4.00 \times 10^{-3}$ |
| $^{161}$Dy | S | $6.96 \times 10^{-6}$ | 970 | $6.75 \times 10^{-3}$ |
| $^{162}$Dy | S | $6.01 \times 10^{-6}$ | $1.08 \times 10^{-3}$ | $6.50 \times 10^{-3}$ |
| $^{163}$Dy | S | $4.92 \times 10^{-6}$ | 664 | $3.27 \times 10^{-3}$ |
| $^{164}$Dy | S | $1.16 \times 10^{-6}$ | $2.32 \times 10^{3}$ | $2.69 \times 10^{-3}$ |
| Total | | $2.96 \times 10^{-5}$ | | $2.32 \times 10^{-2}$ |
| Total, all fission products | | 2.00 | | 89.2 |

†One hundred fifty days after discharge from uranium-fueled PWR.
‡Some elemental totals include minor contributions for nuclides not shown in table.
§Effective thermal cross sections for a typical neutron spectrum of a PWR.
●Long lived isotopes.

| Element | Gas | Metal | Oxide | Solid solution |
|---|---|---|---|---|
| Br Kr | Yes | — | — | — |
| Rb | Yes | — | Yes | — |
| Sr | — | — | Yes | Yes |
| Y | — | — | — | Yes |
| Zr | — | — | Yes | Yes |
| Nb | — | — | Yes | — |
| Mo | — | Yes | Yes | — |
| Tc Ru Rh Pd Ag Cd In Sb | — | Yes | — | — |
| Te | Yes | Yes | Yes | Yes |
| I Xe | Yes | — | — | — |
| Cs | Yes | — | Yes | — |
| Ba | — | — | Yes | Yes |
| La Ce Pr Nd Pm Sm Eu | — | — | — | Yes |

The above data was taken into account in the decision of deploying in this disclosure the process of Volatilization in Isolation, before the dissolution of the spent fuel. Separation of all gas components prior the fuel recycling provide several benefits that are important for the entire process s, including production of much less radiation and 50% less heat during reprocessing. Additional benefits are gained in transferring some of the isotopes captured in the gas filters for direct disposal via conversion to artificial Feldspars. Captured gas components (Br, Te, I, Ce) are converted in the filters to stable/semi stable oxide salts, very suitable for trace elements during thermal conversion to the artificial Feldspars. All other gas components are treated in a conventional way—Krypton and Xenon—are control released in the upper atmosphere, or liquefied and reused in the industry. Tritium will be treated separately via an unconventional method of pumping into multi chamber bore holes, where the radioactive hydrogen will be successfully absorbed by the surrounding rock massive (drilling of such absorptive bore holes requires geotechnical investigation to assure proper selection of absorptive soil horizons outside the water exchange aquifer strata). Specific attention will be given to Iodine. From well-known iodine salts (Ag and K), the silver one is preferred: a) for the low solubility, and b) much stable chemically.

As illustrated by The quantity and level of decay of the remaining solid isotopes were estimated for a time frame of 10 years. The 10 year time frame was selected based on a) the recommendation of the reviewing expert—Dr. Gary Sandquist, and b) the recognition that most of the spent fuel in storage in the US is more than 10 years old. In the future event that spent fuel of lesser age is selected, it will be necessary to complete additional estimates of the quantity/decay matrix. It is recognized that the quantities of isotopes and delay will be different for each spent fuel, based on the type of fuel, reactor power, and irradiation time. In order to avoid any question of data credibility, for this particular matrix estimate were selected from well-known published data resources such as Nuclear Chemical Engineering.

For better understanding, the schematics of isotope selection and elimination, 4 flow tables (i.e., TABLES 1 through 4 above) were prepared representing:

TABLE 1 summary flow table of all isotopes of interest—fission products and actinides.

TABLE 2 summary flow table of all long lived isotopes—all stable isotopes were excluded.

TABLE 3 isotopes remaining after 10 years decay time, which will be included in the artificial production of Feldspars.

TABLE 4 isotopes remaining after 10 years decay time, combined with natural occurrence (a/o) and 4 mixes of Artificial Feldspars (5 kg, 10 kg, 50 kg and 100 kg). The mixes contain estimates of actual isotope quantity in grams and activity in Curies. The mix proportions were provisionally elected for purpose to provide data how low the initial radiation after Artificial Feldspar production is. Need to be consider that these proportions will be elected to match the natural occurrence isotope levels at any selected side in the world.

Extensive research was done for all EPA, OSHA, and NIOSH regulations for permissible concentrations. Most of above documents represent only selective permissible concentrations in water and air, which cannot be used as guideline for permissible value in soil.

This disclosure targets production of artificial Feldspars with isotope concentrations that will match the concentrations in natural soil/rocks. Therefore a non-traditional approach was needed to identify concentrations as "occurrences" in existing minerals and rock (see, e.g., FIG. 12). TABLE 5 below is an extraction from World Rock & Minerals database. The information was selected not to try to match particular minerals, rather to indicate the breadth of the mineral family and how easy it will be to attach the residual isotopes in the waste as trace elements in artificial Feldspars.

The final stage was the selection of particular isotope concentration. The residual isotopes will be in combined liquid form, very suitable for the thermal equilibrium processing of artificial Feldspar, Therefore, instead of trying to match any particular mineral "natural occurrence" of the combined isotopes, the matrix selection was determined using the average natural occurrence of the greatest single element. This approach provide the security that the most concentrated isotope will be in the range of the natural element occurrence and the all of the other isotopes will be in much lesser concentration than the natural occurrence—TABLE 5 (below).

This paper and planned test work focus solely on the reprocessing and disposal of spent nuclear fuels. The fission products from nuclear weapon fission are essentially the same as those from any other fission source, depending slightly on the particular nuclide that is fissioning. Therefore, it is expected that the disclosed teachings could also be applied to the clean-up of contamination from an atomic bomb, and final reprocessing/disposal of any HLW liquid or already solidified in various forms and stored for the uncertainties of existing approach "for better time". The presented fuel reprocessing is the simplest one, with only one intention—to avoid extensive expense for required in all existing technologies purification. This will provide the freedom in future deployment to apply separation of selected isotopes for additional cost cut off or market needs.

During the practical deployment of this disclosure, it will be necessary to make "in situ" adjustment of the isotope concentrations to match existing local natural occurrence levels. This means that at some particular locations, the existing natural levels will be much higher than used in this test estimate.

Adjusting the process to such local mineral occurrence levels will result in a higher profit margin, keeping the radiation levels as the natural or less.

The provisional minimum occurrence levels provided in Table 5 (Addendum A) is for the purpose of the lab preparation period. The inventor is reviewing an extensive data base, in order to obtain world wide range of "natural occurrence element levels" as reference.

Part 2

Selecting Media for Hosting Produced Radioactive Waste

Target

The key element of this disclosure is to select a permanent form of the remaining waste.

Taking into account historical data for existing technology of "separation and storage for a better time" that in reality will never come up, a new, unconventional design approach is needed.

The theory of nontraditional modeling suggests so called backwards modeling in order to determine the existing natural restrictions first. Once determined, these natural restrictions will direct the target (this that we wish to accomplish) to the matrix existing in nature that is able to carry the isotopes in the safest way without impacting the biosphere. The first given restriction was that the planet is a closed system—since creation during 5.5 billion years nothing comes in and nothings goes out; the system orderly transition from one form to other.

Figure 13:
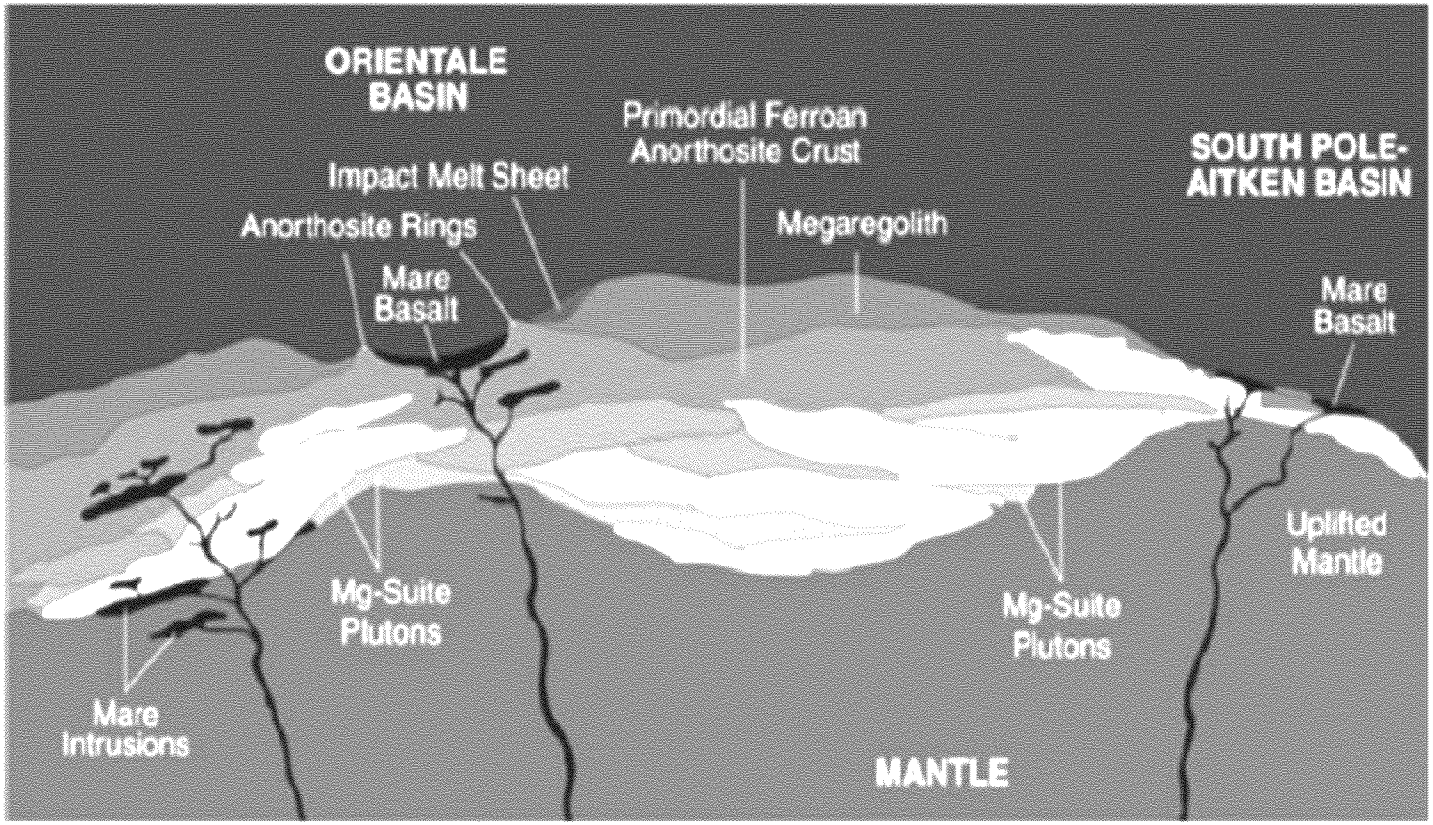
FIG. 13 is an illustration of various parts of Earth's geology.

The following natural restrictions that need to be met were determined using continuous linking models (see, e.g., FIG. 13):

a) The matrix needs to be as close as possible to the most abundant mineral group on the planet;

b) Once produced, the mineral matrix needs to meet all requirements for known natural geological metamorphosis over an extensive period of geologic time (100 K years or more) based on exposure to any Earth crust conditions;

c) The radioactivity level of the produced mineral matrix needs to fall within the natural radioactivity levels at any chosen location in order to fulfill the biohazard safety requirements.

d) The stability of the produced mineral matrix must meet the requirements of proliferation, intrusion, exhumation and dry or wet thermodynamic dissolution and transport.

Decision

Based on General Mineralogy, the most abundant mineral group in the upper level of Earth crust is the "Feldspar's Group" (including the mixed and Feldspathoid group and the well defined 22 members of the Zeolite group)—constituting more than 50% of the Earth crust and Lunar rocks, and also found in meteorites.

The composition of the Feldspar's is basically determined by the component ratio in a terminal system, applying the following formula:

NaAlSi2O8-KAlSi3O8-CaAl2Si2O8

Figure 14:
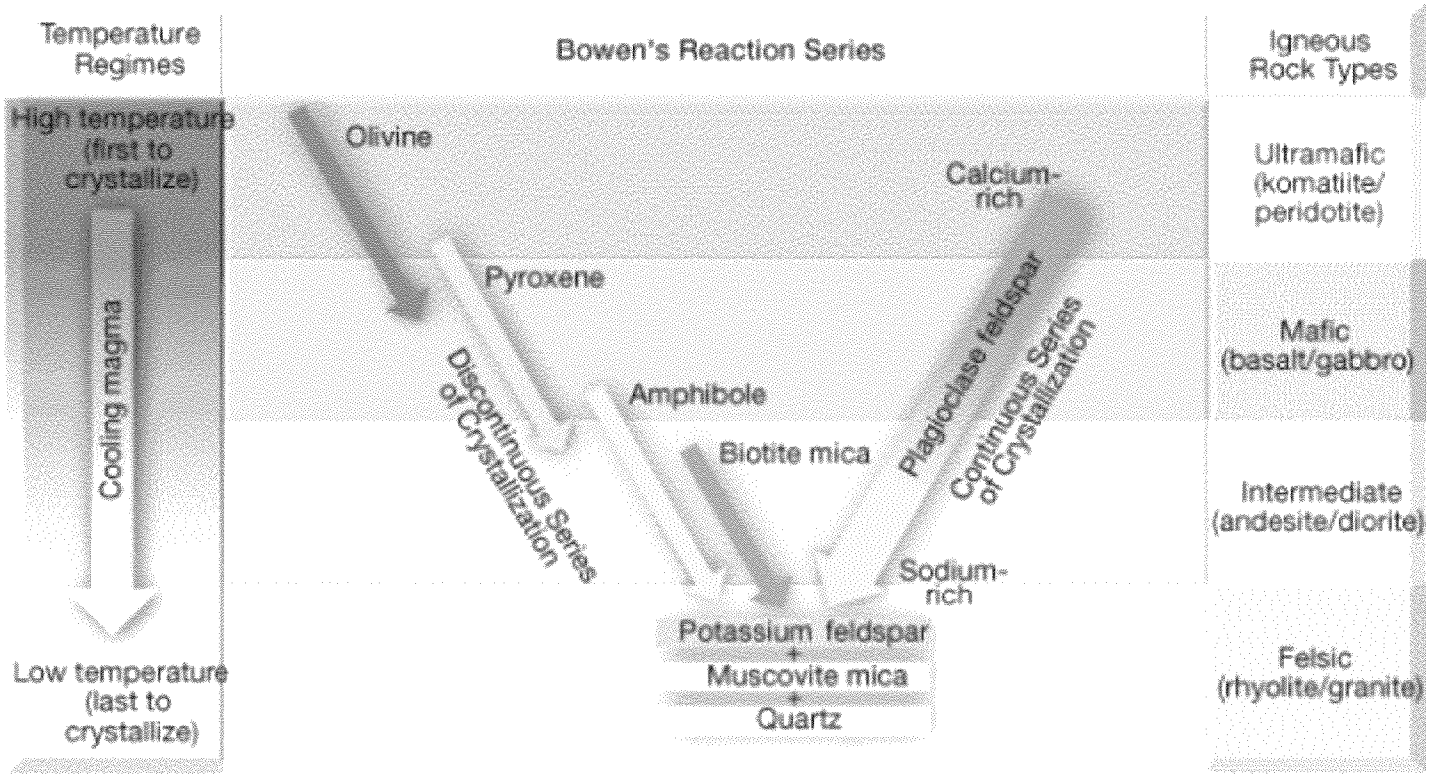
FIGS. 14-17, 20, 21 and 35 are various Bowen's Reaction Series diagrams.
Figure 15:
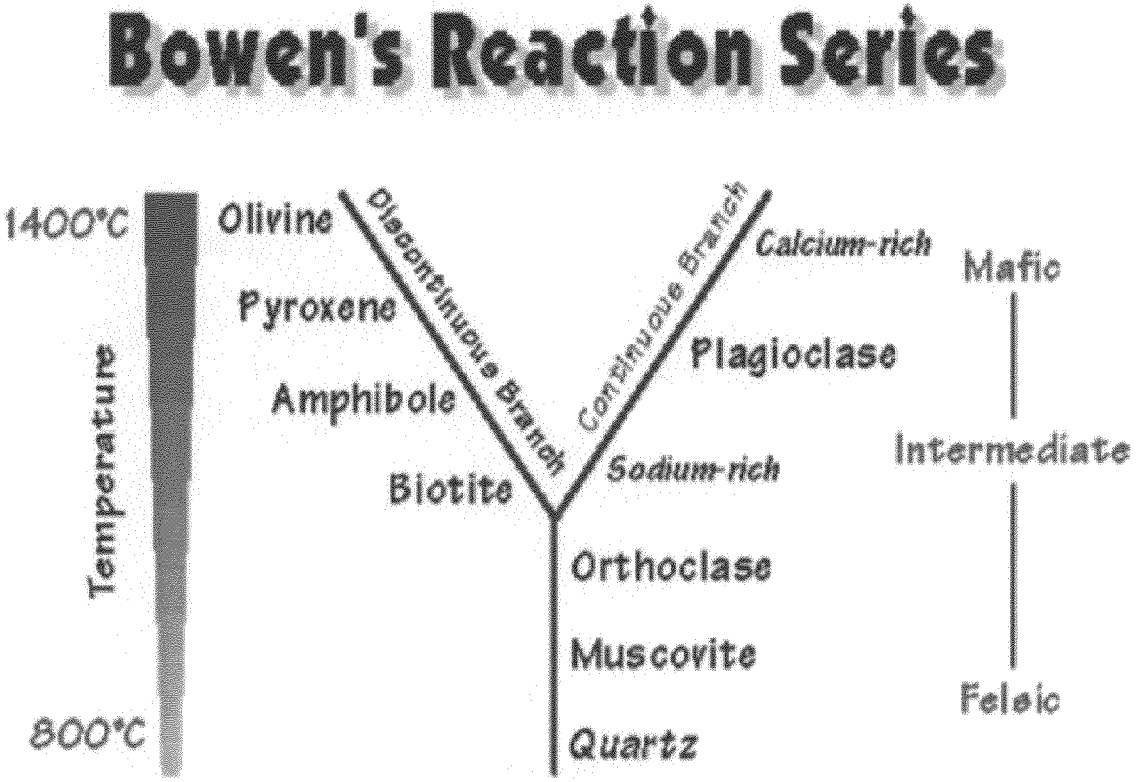
Figure 16:
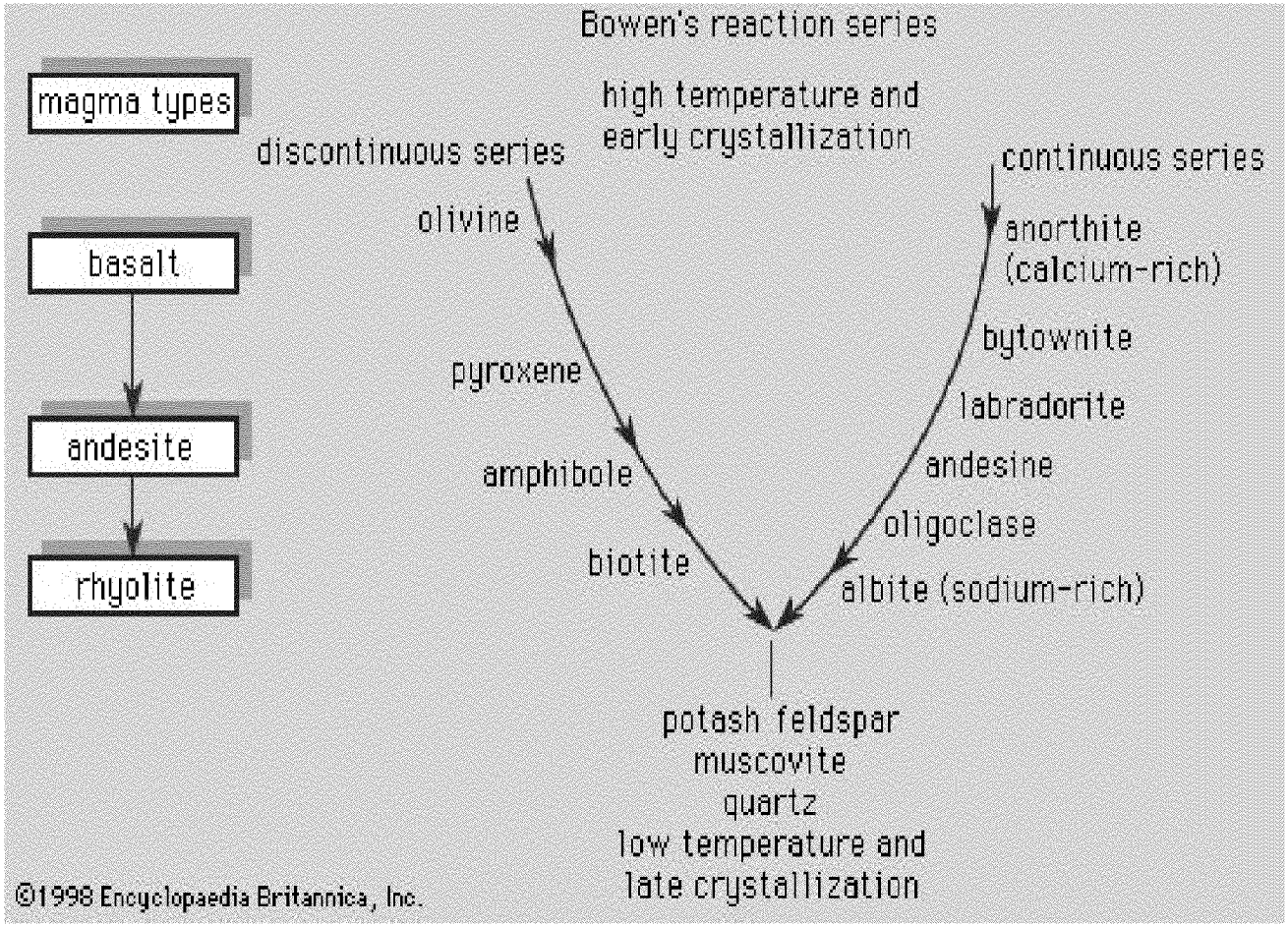

The Feldspars formation genesis was well defined in Mineralogy science by Bowen Reaction series (see FIGS. 14-16). This means the Feldspar's are aluminosilicates of Na, K and Ca with very wide range of admixtures of Ba, Sr, Pb, Fe, Rb, Cs, Eu, Ce, Mn, Co, Ni, Cu, Zn, Pd, Ag, Cd, Pt, Au, Hg, Sb, Bi, U, Zr and non-metals such as S, Se and semimetals such as As and Te. Explained another other way: in order to be thermodynamically stable and electrically neutral in the upper Earth crust, Feldspar's minerals are in general oxygen tetrahedrons with Al (+3) or Si (+4) electrons (as most abundant). Because the K(+1), Na(+1) and Ca(+2) are also abundant and can fit into the intersilical positions, the feldspars—KAlSi3O8, NaALSi3O8 and CaAl2Si2O8 and solid solutions of these—are the most abundant mineral group, making up about one half the Earth's crust. Since the bond characteristics are metallic, ionic, covalent or mixed, the above mentioned atoms will have stronger magnetic bonds toward oxygen along any of the mineral axis (X, Y, Z)—one of the reason of forming polysynthetic twinning crystal formations. Following the limits of solid solution with temperature increase in the range of 11 to 93 Angstrom (1 A=1/100 millionth cm), they are able to attract a wide range of metal ions in stable or semi stable conditions.

All actinides (rare earths) and lanthanides are chemically stable with metallic bonding, which make them excellent candidates to host trace attached atoms—something very common in the Feldspar's group.

These and other trace metals, by their type and origin, indicate that at some point of the early Earth crust geologic transition, the Feldspar's were one of the major carriers of the radioactive isotopes in the upper crust. This given restriction in the model pinpoints the Feldspar's as prime future media to host the waste remaining after recycling TRU, actinides and lanthanides.

Figure 17:
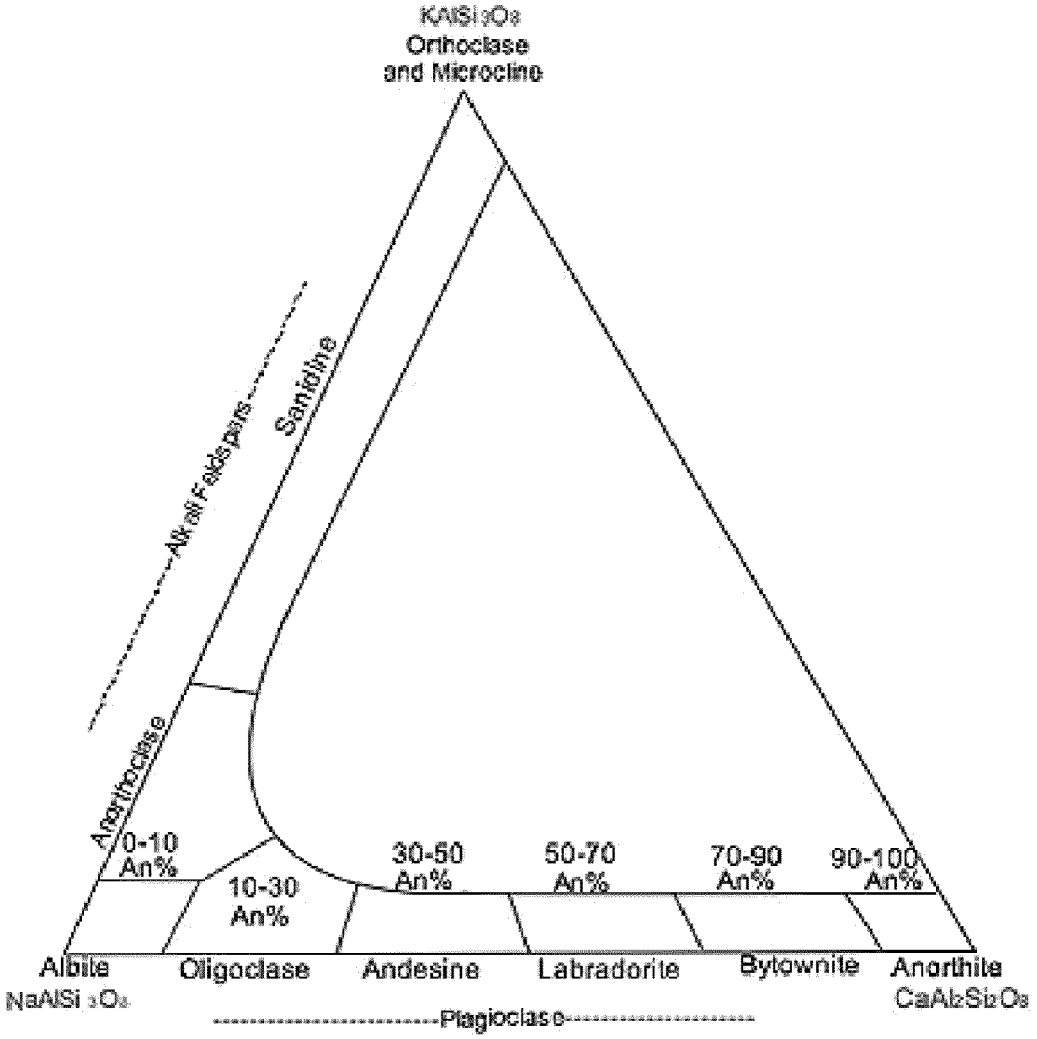

As shown in FIG. 17, all Feldspar's have a basic three dimensional framework composed of tetrahedral (Al, Si) O4 groups in which one-third to one-half of the Si atoms are replaced by Al. Univalent K+ and Na+ cations, with Al/Si ratio of 1:3 or bivalent Ca2 and Ba2 cations, with Al/Si ration of 1:2 are arranged in the large vacancies with this framework.

Two series of solid solutions are differentiated in the Feldspars group: anothoclases, or alkali feldspar's (KAlSi2O8-NaAlSi3O8) and plagioclases (NaAlSi3O8-CaAl2Si2O8). The barium feldspar BaAl2Si2O8 known as Ceisian, is rare, and is a solid solution with compositions between KAlSi3O8 and BaAl2Si2O8 known as Hyalophane and containing up to 10-30 percent Ba.

Figure 18:
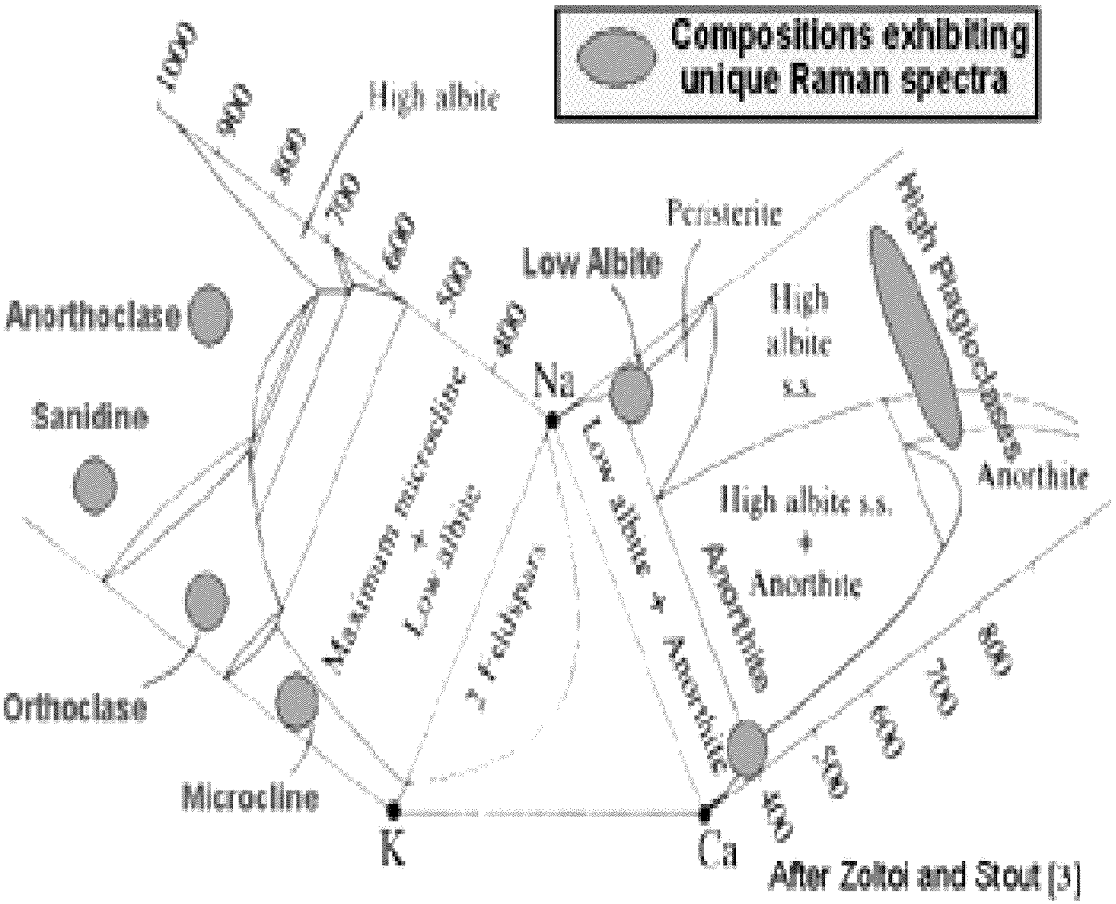
FIGS. 18 and 19 are diagrams depicting various properties and characteristics of feldspar minerals.

Many varieties of Feldspar's result from complex variation in composition, with the ordering of Al and Si distribution according to structural position, the decomposition of solid solutions, and submicroscopic twinning. The following are examples of potassium Feldspars (see FIG. 18): (1) sanidine, with monoclinic symmetry and disordered Si and Al distribution; (2) maximum microcline (triclinic), with fully ordered Si and Al distribution; (3) intermediate microclines, and (4) Orthoclase (assumed to be pseudomonoclinic) composed of submicroscopic twinned triclinic domains.

Figure 19:
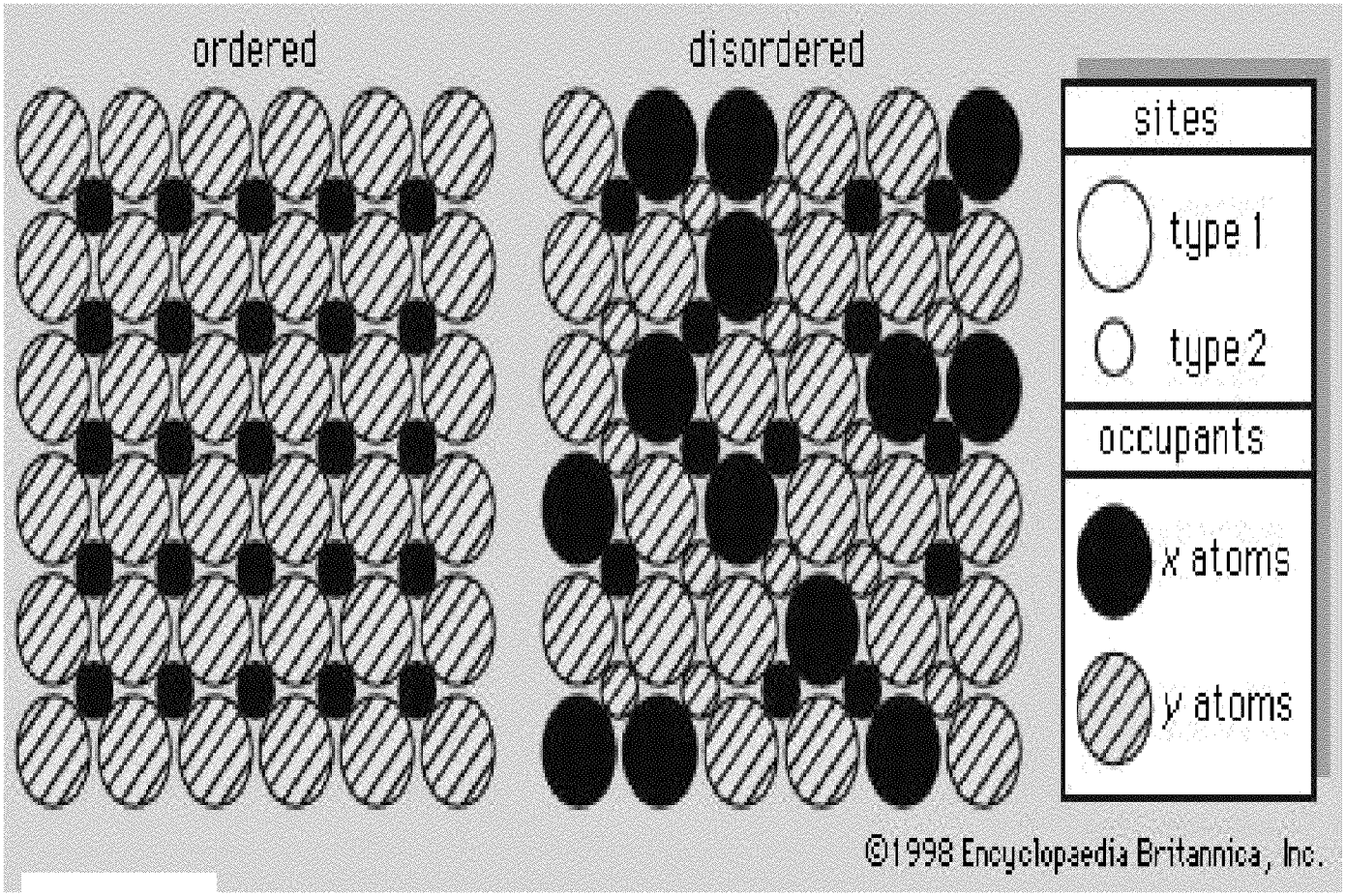

High-temperature anothoclases are disordered and form a continuous series of solid solutions. Low-temperature anothoclases decompose to yield perthites—regular intergrowths of microcline or orthoclase—and sodium feldspars, or albite. All plagioclase varieties are high-temperature (disordered with respect to Al and SI distribution), low-temperature (ordered), or intermediate (see FIG. 19). Changes in the degree of ordering, and the composition of the plagioclases occur with the retention of triclinic symmetry with extremely complex structural changes and the formation of two unmixed regions, which in many oligoclases and labradorites is accompanied by iridescence.

Precise determination of the composition and the structural state (ordering) of Feldspar's is carried out by means of optical orientation diagrams and diagrams of optical axial angles measured by universal, stage, and by X-ray methods (difractometry).

Plagioclases and microclines are nearly always polysyntetically twinned, because they form microscopic intergrowths of several elements in accordance with various characteristic laws of twinning.

The tabular or prismatic habit of Feldspar's in rocks is determined by well-developed {010} and {001} faces, along with perfect cleavage is formed at a right or nearly right angle, as well as {by 110} faces. Feldspar's have a hardness of 6-6.5 on Mohs' scale and a density of 2500-2800 kg/m3. They have no color of their own; the varied coloration (gray, pink, red, green, black and i.e.) is due to the presence of very fine inclusions of hematite, iron, hydroxides, homblende, pyroxene, and other minerals; the bluish green color of amazonite and the green color of microcline are associated with the electrons of Pb, substituting for K. Bands of Pb2+, Fe3+, Ce3+ and Eu2+ are distinguished in the luminescence spectra of Feldspar's. Electron paramagnetic resonance spectra of Feldspar's are used to determine the electron centers of Ti3+ and the hole centers Al—O—Al, formed through the entrapment of electron or hole, respectively, by lattice defects.

Figure 20:
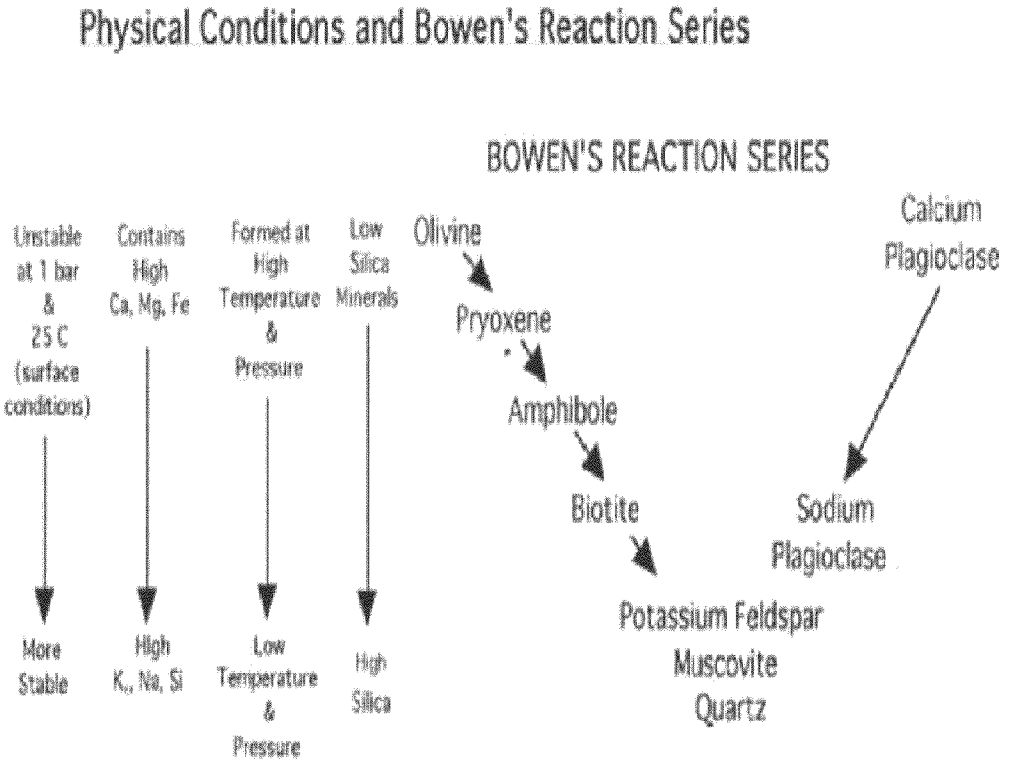
Figure 21:
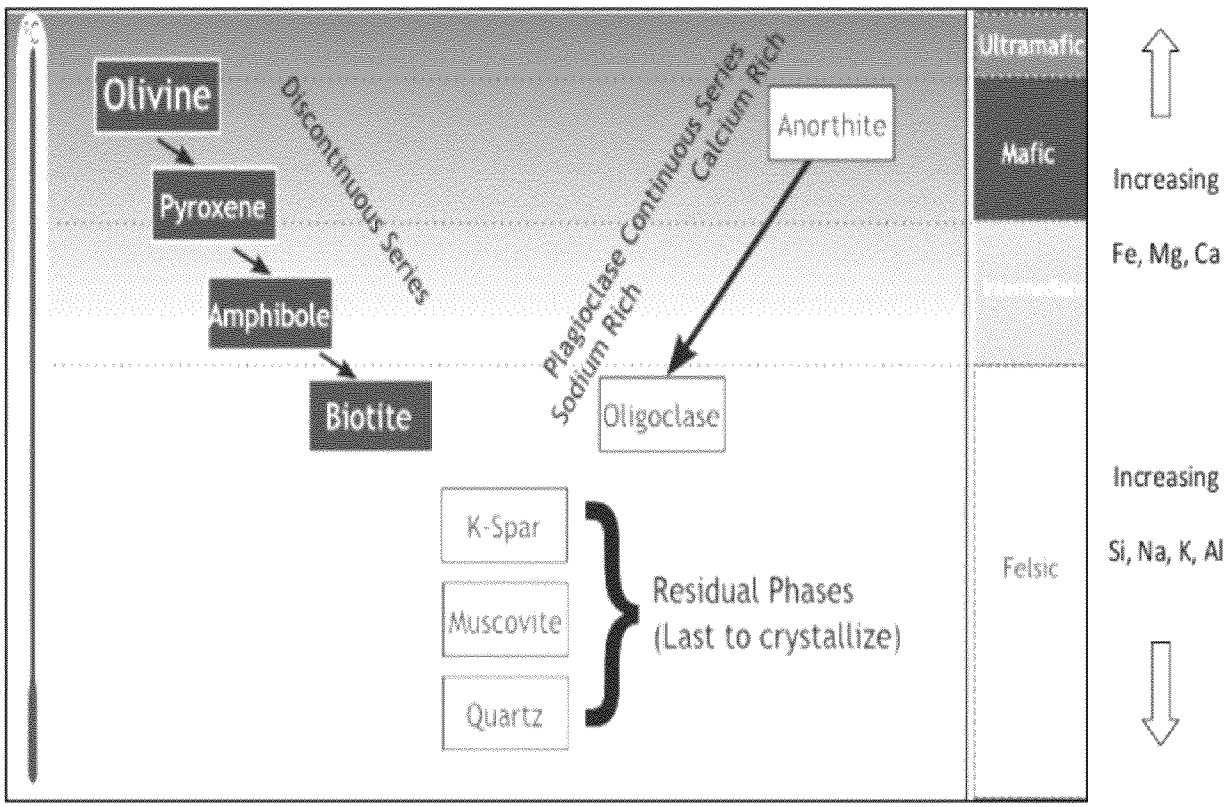

The data provided in TABLES 9.3 and 9.4 below will be used to distinguish the findings and classify the artificial product as a member of the Feldspar's mineral group (see FIGS. 20 and 21). Since the isotopes will be entirely in the group of trace elements, the particular chemical affinity needs to be taken into account.

TABLE 9.3

Metallic and ionic radii of the actinides and the interatomic distances in the actinyl (V and VI) ions (Å)

| Element | Atomic number | $M^0$ | $M^{3+}$ | $M^{4+}$ | $M^{5+}$ | $M^{6+}$ | V M—O | VI M—O |
|---|---|---|---|---|---|---|---|---|
| Actinium | 89 | 1.88 | 1.076 | | | | | |
| Thorium | 90 | 1.80 | | 0.984 | | | | |
| Protactinium | 91 | 1.63 | | 0.944 | 0.90 | | | |
| Uranium | 92 | 1.56 | 1.005 | 0.929 | 0.88 | 0.83 | | 1.71 |
| Neptunium | 93 | 1.55 | 0.986 | 0.913 | 0.87 | 0.82 | 1.98 | |
| Plutonium | 94 | 1.60 | 0.974 | 0.896 | 0.87 | 0.81 | 1.94 | |
| Americium | 95 | 1.74 | 0.962 | 0.888 | 0.86 | 0.80 | 1.92 | |
| Curium | 96 | 1.75 | 0.946 | 0.886 | | | | |
| Berkelium | 97 | | 0.935 | 0.870 | | | | |

Source: S. Ahrjand et al., "Solution Chemistry," in *Comprehensive Inorganic Chemistry*, vol. 5, J. C. Bailar, Jr., et al. (eds.), Pergamon, Oxford, 1973.

TABLE 9.4

Oxidation states of lanthanide and actinide elements[†,‡]

Lanthanides

| | Atomic number | | | | | | | | | | | | | | |
|---|---|---|---|---|---|---|---|---|---|---|---|---|---|---|---|
| | 57 | 58 | 59 | 60 | 61 | 62 | 63 | 64 | 65 | 66 | 67 | 68 | 69 | 70 | 71 |
| Element | La | Ce | Pt | Nd | Pm | Sm | Cu | Gd | Tb | Dy | He | Er | Tm | Yb | Lu |
| Oxidation states | 3 | 3<br>4 | 3<br>(4) | (2)<br>3 | 3 | 2<br>3 | 2<br>3 | 3 | 3<br>(4) | 3 | 3 | 3 | (2)<br>3 | 2<br>3 | 3 |

Actinides (+transactinides)

| | Atomic number | | | | | | | | | | | | | | | | |
|---|---|---|---|---|---|---|---|---|---|---|---|---|---|---|---|---|---|
| | 89 | 90 | 91 | 92 | 93 | 94 | 95 | 96 | 97 | 98 | 99 | 100 | 101 | 102 | 103 | 104 | 105 |
| Element | Ac | Th | Pa | U | Np | Pu | Am | Cm | Bk | Cf | Es | Fm | Md | No | Lr | Ku<br>(Rf) | Hs |
| Oxidation states | 3 | (3)<br>4 | (3)<br>4<br>5 | 3<br>4<br>5<br>6 | 3<br>4<br>5<br>6<br>7 | 3<br>4<br>5<br>6<br>7 | (2)<br>3<br>4<br>5<br>6 | 3<br>4 | (2)<br>3<br>4 | 3 | 3 | 3 | 2<br>3 | 2<br>3 | 3 | 4 | (5) |

[†]The most stable oxidation states are italicized. Those not known in solution are within parantheses.
[‡]Data through atomic number 103 are from Abrland et al.[Al]. Data for atomic numbers 104 and 105 are from Keller [K2].

The total amount of isotopes remaining in the liquid waste will be calculated from Part 1—TABLES 1-3. The minimum concentration of each particular Isotope (element) (TABLE 4; "Job Mix Formula"; and TABLE 6—Experimental Protocol).

The final isotope amounts are provided in Table 4 (column 31 to 37) with reference amount of radiation in Ci (column 32 to 38). The range (JMF for 5 kg, 10 kg, 50 kg and 100 kg) was provisionally selected to indicate the actual radioactivity level decrease related to isotopes content. In future applications of this disclosure the actual isotope content will be selected as reference to natural occurrence levels at any particular location on the Earth—means that at some location the actual JMF will be below or greater than in the 5000 g composition.

Figure 12:
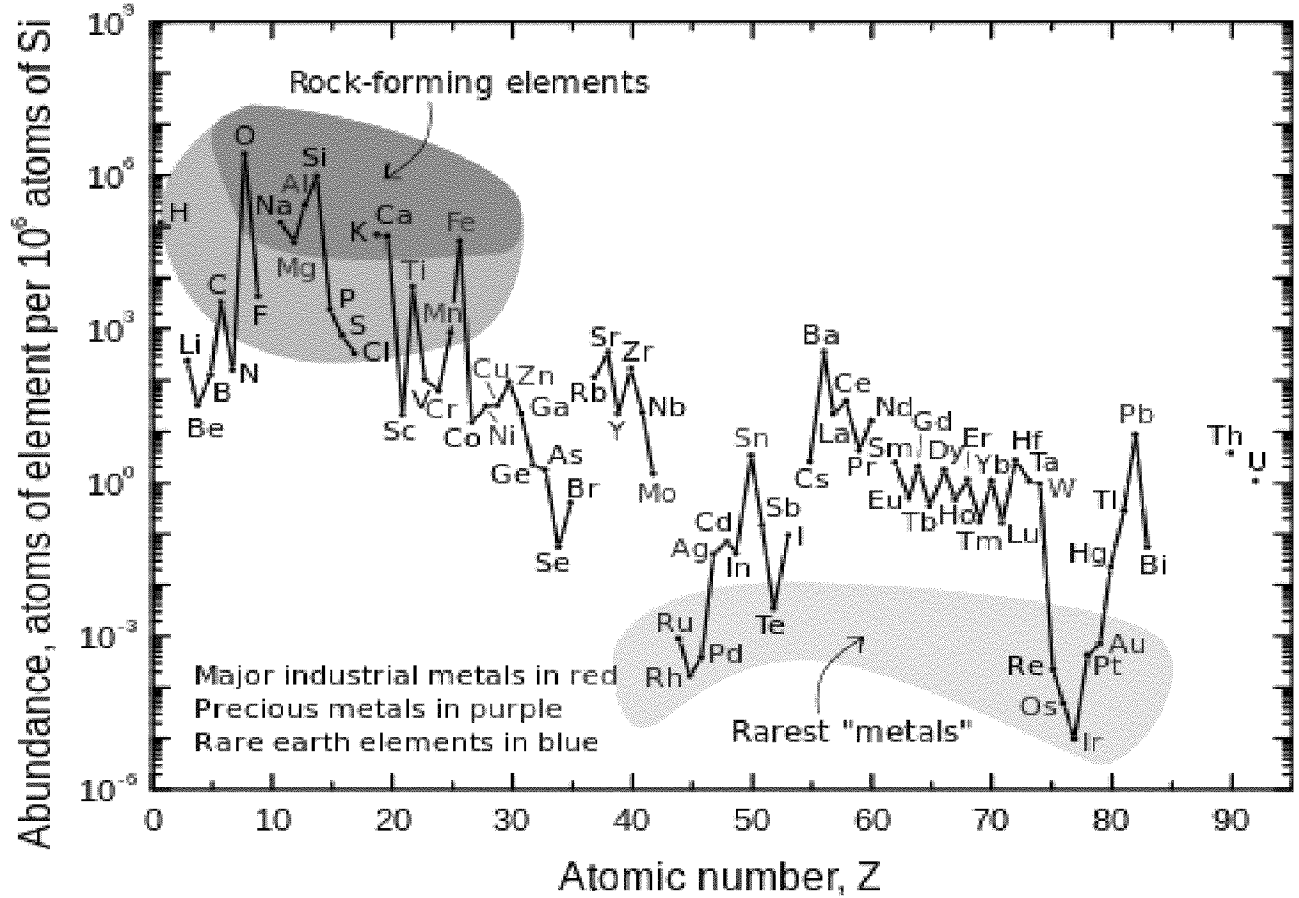
FIG. 12 is a chart illustrating the abundance of various elements on Earth.

The graph of FIG. 12 provides the relationship between the Silicon abundance to any other rock forming elements or rare earth metals in natural mineral occurrence. From mineralogical point of view need to be consider that in upper Earth crust the Silicon and Oxygen atoms occupied total of 75% of all mineral forming elements—major reason for wide spread abundance of Feldspars.

Part 3

Selecting Industrial Byproduct as Mineral Precursor for Production of Artificial Feldspars Solutions:

The selection of a low cost and suitable (in chemical composition, granular size and crystalline structure) industrial byproduct, to be used as advance mixed media to produce the desire Feldspar's is an important advance design criteria.

Also, it is well known within the disciplines of Mineral Crystallography and the artificial crystal industry that for formation of any crystalline stable structure requires:

a) In equilibrium natural or artificial media at high temperature and pressure, to facilitate formation of the desired single crystalline structure. Once formed, this structure will continue growing until the media falls below the thermodynamic equilibrium; or.

b) Using crystalline precursors (already formed as single crystals at significantly lower temperature and pressure) to continue crystallization via control of the thermodynamic equilibrium (concentration).

Since the second approach is technically very easy and low cost, a wide array of possible industrial byproducts was examined. The key issues, such as abundance, availability, chemical composition, initial crystal size were taken into account. The final selection was in favor of Fly Ash (other options include blended slag, clay chewing's, etc.). Need to be stated that the actual crystalline precursor selection relates to Feldspar type production choice. This also will determine the process production temperature (dT). In part two presented Bowen reaction series details rule, that these production temperatures should be at the range of material melting temperatures, in order to achieve early crystallization. This particular detail will be used for very efficient pellets production (provided in the disclosure above).

The annual production of Fly Ash in the US is 44 million tons, while only 7 million tons are consumed. The US Government in collaboration with cement and coal fired power industry has established a system of subsidies for anyone uses fly ash—something that will increase the profit margin of the disclosed technology (similar subsidies exist in other parts of the world—in case the technology is deployed overseas).

In nature, ideal crystallization conditions are very rare. The general solid solution tends to order in 50-50. This means that ordered crystals have compound properties and disordered solid solutions have intermediate properties between those of the end elements. These natural restrictions make Feldspar's production easy, allowing a very wide (almost open end) range of chemical composition (like in nature, the family of Feldspar minerals continues to grow).

Properties of Fly Ash

Fly Ash is an industrial byproduct commonly produced through coal combustion> it has the following relevant properties:

Particle size 1,875 μm to 118 μm;

Chemical composition—$SiO_2$ (β and glass), $Al_2O_3$, $SiO_2/Al_2O_3$ (crystal), $SiO_2+Al_2O_3$, $Na_2O$, $K_2O$, CaO, MgO, $SO_3$, $P_2O_4$, $TiO_2$;

Trace elements—Antimony, Arsenic, Barium, Beryllium, Boron, Cadmium, Chromium, Chloride, Cobalt, Led, Manganese, Mercury, Molybdenum, Nickel, Selenium, Thallium, Vanadium, Zink, Uranium, Strontium and i.e.;

Dissolution—above pH 9.0;

High durability when exposed to sulfate water, sea water and acids;

Crystalline Morphology—well rounded, solid spheres, well rounded hollow spheres with thin walls, quartz—angular or sub angular form (produces alumosilicate phases when mixed with calcium) termed cenospheres, plerospheres which are cenospheres containing numerous smaller spheres within their hollow cavity;

Active surface—similar to cement—over 6000 sq. meters per cubic centimeter;

When mixed with water, produces initial range of pH 10.5 to 11.5. Kinetic models for 100 years indicate final pH above 7.7;

Free crystalline energy—governed by the molar ration (α) of the major constituents SiO2 and Al2O3;

Leaching requirements—520 to 850 mV at pH from 3.2 to 5.2;

X-ray diffraction identifies the following minerals—quartz, hematite, anhydrite, periclase, magnetite, portlandite, gehlenite, magnesioferrite, lime, sylvite, rutite;

Compressive Strength vs. Sio2/Al2O3—at 1.9 ratio equal to 5,000 psiI; at 2.90 ratio equal to 7,700 psi;

Reference Fly Ash data:

C6—represent wood chips C1—Lignite

F6 wood chips; F1—lignite

Fly ashes are classified as Class C (ASTM), except for sample C1 (lignite) which is associated with Class F. Ref. 2007 World of Coal Ash (WOCA)—May 7-10, 2007, N. Kentucky, USA (www.Flyash.info)

| | F1 | F2 | F3 | F4 | F5 | F6 | C1 | C2 | C3 | C4 | C5 | C6 |
|---|---|---|---|---|---|---|---|---|---|---|---|---|
| $SiO_2$ | 40.33 | 36.58 | 32.96 | 23.35 | 22.81 | 13.30 | 47.80 | 28.05 | 29.20 | 14.57 | 18.72 | 20.07 |
| $Fe_2O_3$ | 8.11 | 6.53 | 6.01 | 6.34 | 4.59 | 2.46 | 9.06 | 7.70 | 8.89 | 4.74 | 5.53 | 2.36 |
| $Al_2O_3$ | 21.59 | 19.54 | 17.88 | 15.42 | 14.07 | 2.61 | 24.12 | 15.11 | 14.63 | 6.45 | 6.97 | 9.26 |
| $TiO_2$ | 1.34 | 1.06 | 0.90 | 0.77 | 0.69 | 0.03 | 0.98 | 0.48 | 0.39 | 0.29 | 0.27 | 0.05 |
| CaO | 12.53 | 12.68 | 15.04 | 8.67 | 18.13 | 41.70 | 5.73 | 14.19 | 19.59 | 9.58 | 13.76 | 41.16 |
| MgO | 4.10 | 3.58 | 4.18 | 4.71 | 6.81 | 8.10 | 3.64 | 5.00 | 5.70 | 2.99 | 3.89 | 4.47 |
| $SO_3$ | 8.09 | 7.51 | 8.98 | 3.37 | 5.86 | 10.08 | 3.80 | 9.65 | 13.23 | 3.82 | 4.81 | 4.02 |
| $P_2O_3$ | 0.71 | 0.92 | 1.37 | 0.87 | 2.55 | 4.67 | 0.50 | 0.73 | 1.03 | 0.31 | 0.78 | 2.34 |
| $Na_2O$ | 0.30 | 0.63 | 1.23 | 2.17 | 0.88 | 2.75 | 0.28 | 1.46 | 1.95 | 1.10 | 1.82 | 0.63 |
| $K_2O$ | 2.25 | 2.05 | 2.26 | 1.65 | 6.41 | 12.08 | 3.13 | 2.23 | 2.96 | 0.91 | 3.07 | 5.57 |
| LOI | 1.10 | 9.34 | 9.51 | 32.93 | 18.15 | 2.17 | 1.19 | 16.24 | 2.64 | 53.68 | 33.36 | 10.51 |
| Total | 100.35 | 100.42 | 100.32 | 100.25 | 100.05 | 100.04 | 100.23 | 100.84 | 100.24 | 100.44 | 99.98 | 100.44 |

FLY ASH COMPOSITION

| | BOYCE LA | MT. PLEASANT TX | MANSFIELD LA | TATUM TX |
|---|---|---|---|---|
| SiO2 | 37.77 | 55.61 | 58.52 | 48.7 |
| Al2O3 | 19.13 | 19.87 | 20.61 | 16.6 |
| SiO2/Al2O3 | 1.97 | 2.80 | 2.84 | 2.93 |
| SiO2 + Al2O3 | 56.90 | 75.48 | 79.13 | 65.3 |
| CaO | 22.45 | 12.93 | 5 | 18.72 |
| Fe2O3 | 7.33 | 4.52 | 9.43 | 6.93 |
| MgO | 4.81 | 2.49 | 1.86 | 3.91 |
| SO3 | 1.56 | 0.49 | 0.49 | 0.85 |
| Moist. Content | 0.12 | 0.02 | 0.14 | 0.12 |
| LOI | 0.17 | 0.22 | 0.05 | 0.49 |
| Finess (% passing 325) | 99.2 | 77.30 | 82.05 | 97.4 |

Ref. Trenchless Technology Center - Louisiana Tech University

NOTE: The presented data does not include the volume of Carbon in the Fly Ash. The amount of Carbon relates to the actual burned material. In the cement industry, the Fly Ash is blended to remove the Carbon—relates to the specific hydrophobic property of Carbon. Fly Ash that contains Carbon separate the cement in concrete mix.

In finalizing the design of artificial Feldspar production, should be consider whether or not to use blended Fly Ash, because some amount of carbon in the row mix may benefit the bonding with metal traces of heavy elements. This relates also to the selected temperature dT/pressure dP in the reactor equilibrium. The presented data relates to production of Calcium Feldspar—formed at high temperature and early crystallization. All other Feldspar types are applicable as isotope hosts matrix. Particular selection will be guided by the Feldspar type availability at the selected for disposal location.

Part 4

Geochemical Evaluation of Artificial Feldspars—Solubility Test

Modeling solubility is a matter of choosing the right test model, in order to duplicate the natural matrix avoiding any assumptions. Several key elements need to be taken into account. Since we are permanently disposing the produced Artificial Feldspars in the surface or upper medium depth strata, we need to determine the matrix properties that support solute transport.

Figure 22:
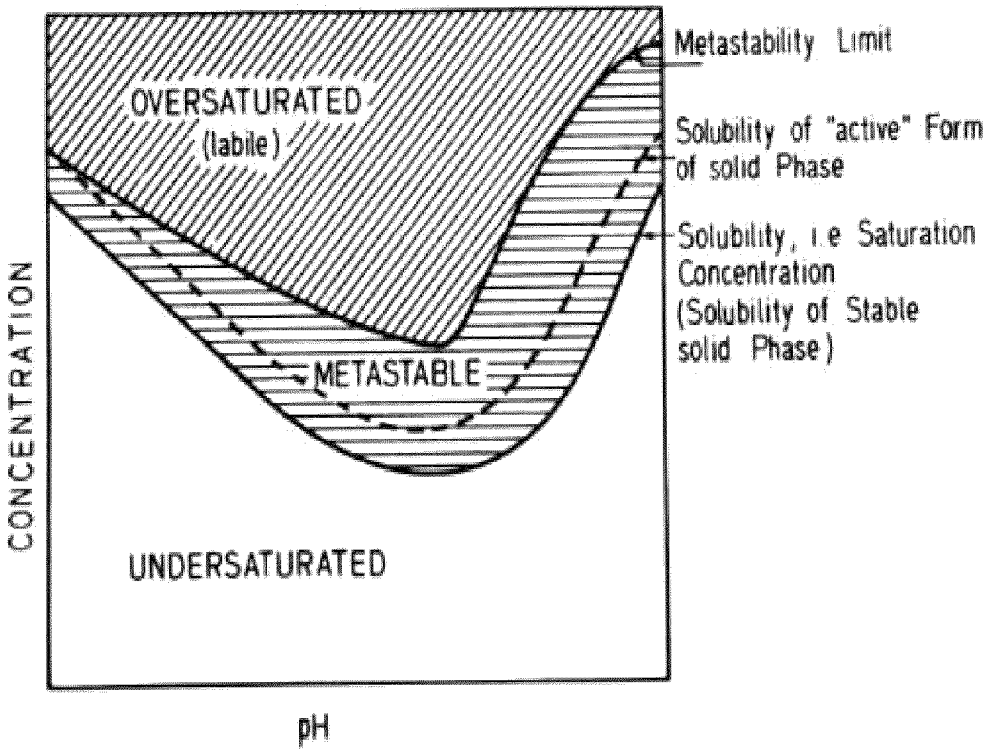

The first question that needs to be answered is how the solute transport works in nature (ref. FIG. 5.2-FIG. 22). The fundamental determinant is the relation between solubility and saturation of any element that is subject to solute transport, related to the pH of the medium (host rock formation).

Since we are dealing with possible solute transport of metal ions of heavy metals—in conditions of absence of running water/washout—the only possible solute transport will be hydrolysis. The major determinant of solubility is the level of saturation:

Solute transport is highly likely in a supersaturated matrix, and

Significantly lower/negligible in an under saturated matrix/trace value.

Figure 23:
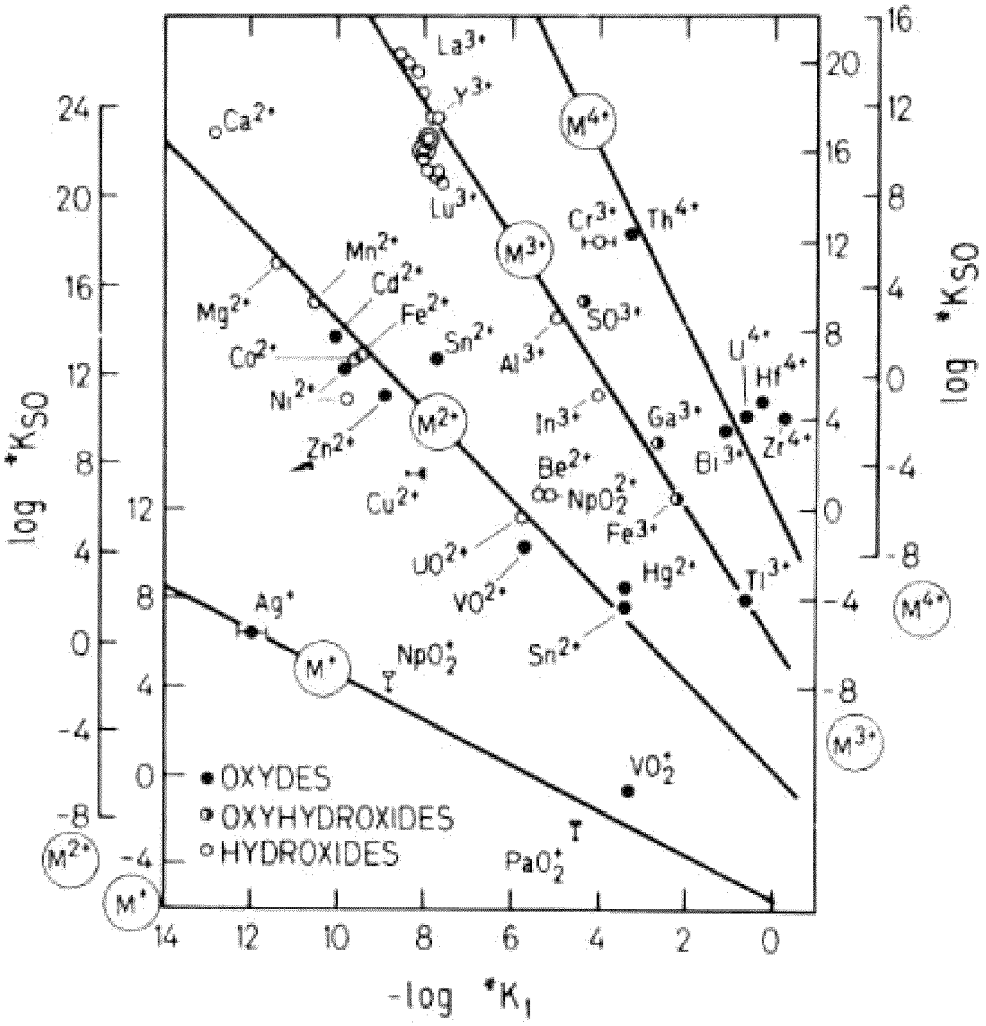
FIG. 23 is a chart showing the solubility of various elements in combination with potassium feldspar.

FIG. 23 (ref FIG. 6.6) indicates the correlation of the solubility various chemical elements, including the heavy ones, in combination with Potassium.

Figure 24:
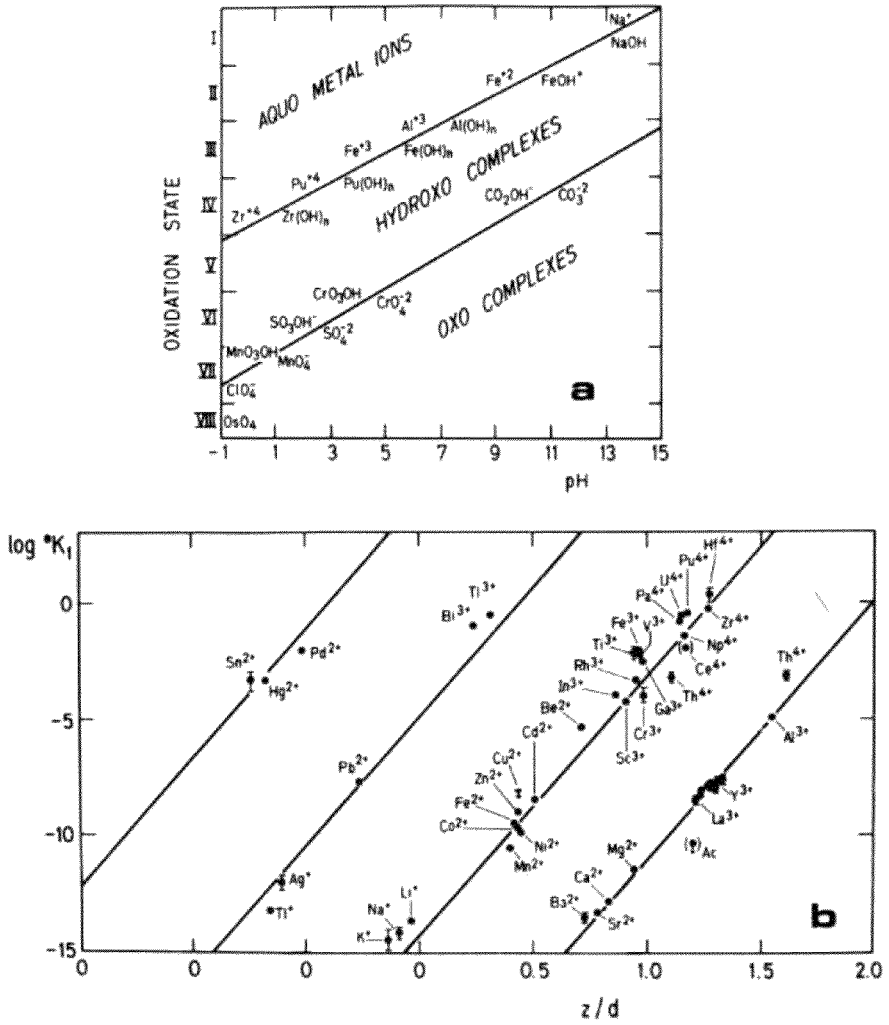
FIG. 24 is a chart showing the hydrolysis of metal ions.

In FIG. 24 below (ref FIG. 6.4), the first diagram shows the particular solubility of Metal Ions—high theoretical possibility, since our isotope trace elements partially fulfill this requirement for metal ions. The applied matrix model is for metal ions in trace quantities. The first diagram indicates that the hydrolysis range for Zirconium-Uranium-Plutonium ions is possible only at very high acid pH range (from pH 1 to pH 4.5) and oxidation state of III to little bit over IV. It should be recognized that such conditions are extremely rare in nature and the possibility of depositing Artificial Feldspars at such pH conditions is negligible.

The second diagram represents the correlation between the size (diameter) of the metal ion and the distance from the Oxygen atom. The diagram indicates that oxidation of very heavy atoms will be possible at hydrolysis constant at level (−lg 15) i.e. this means that the required distance from the metal ion should be in the range of 3 times the metal ion diameter. Considering very strong ion gravitational forces, such conditions are also very rare. It needs to be noted that during the decay, a significant volume of energy is released in the form of heat. This consequently conditions the host matrix into expansion mode. (This rule applies for very concentrated levels of HLW—"the existing conditions of separation, concentration and storage for better future". Such expansion is not possible in the case of this disclosure, because all isotopes will be in trace concentrations, matching the level of the host media (ref. TABLE 4 above—the total emitted heat is in the range of 0.193069 W per 5 kg Feldspar). The minor level of heat that will be released during decay will contribute only to the natural process of mineral metamorphosis.

Figure 25:
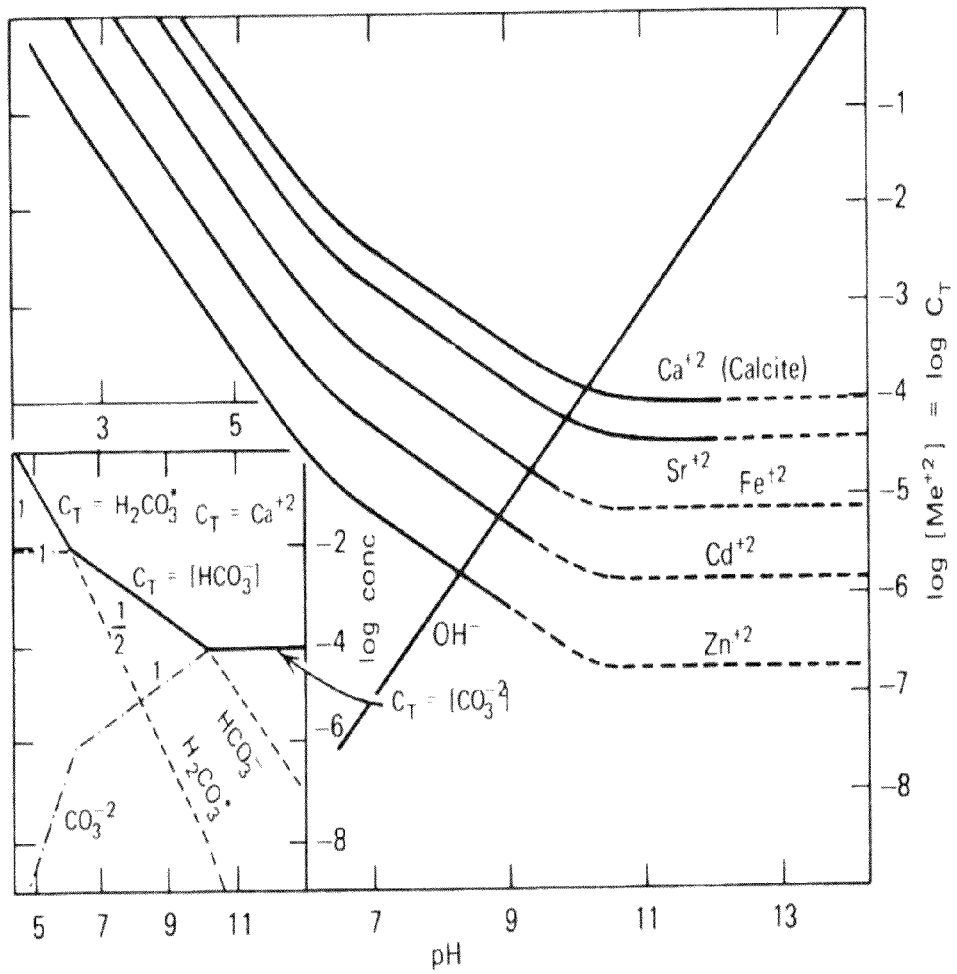
FIG. 25 is a chart showing the solubility of metal carbonates.

The next issue is hydrolysis of metal carbonates. (Ref. FIG. 5.6-FIG. 25). Here the conditions are much wider in the range of pH 7 to pH 9 (for Strontium ion).

Even greater this possibility also is limited, due to the fact that formation of free carbonates will be possible only at ground water level exceeding, the Plastic Limit. Taking into consideration that placing Artificial Feldspars will be subject to regulatory restrictions including absence of running water, formation of free carbonates from Fly Ash will requires pH above 10 (cross reference to the dotted line in the diagram, where the possible solubility is flat).

The other option that also will be restricted is solubility from formed in the atmosphere conditions hydro carbonates (ref. FIG. 5.7) from the CO2 in the air. The rain water will affect the Feldspars. Need to be noted that in nature this is the only model for active solute transport of Feldspars, in one and only condition—when exposed on surface. Such condition is impossible, since the Artificial Feldspars will be protected with a top dual matrix of drain material and a hydrophobic clay curtain.

Figure 26:
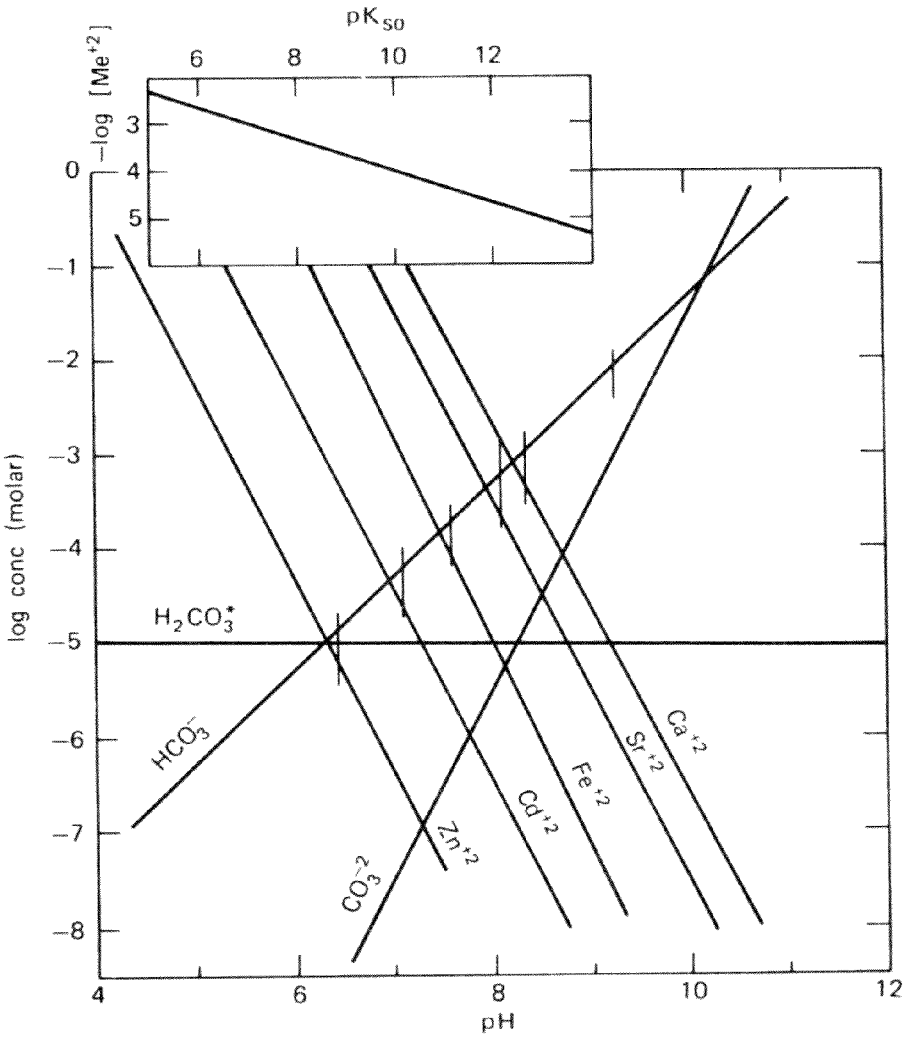
FIG. 26 is a chart showing the solubility of $MeCO_3(s)$.

The graph below (Ref. FIG. 5.7-FIG. 26) indicates that for Strontium, the pH is in the normal range for exposure to rain water (HCO3), but only when the molar concentration much higher than trace levels.

Figure 27:
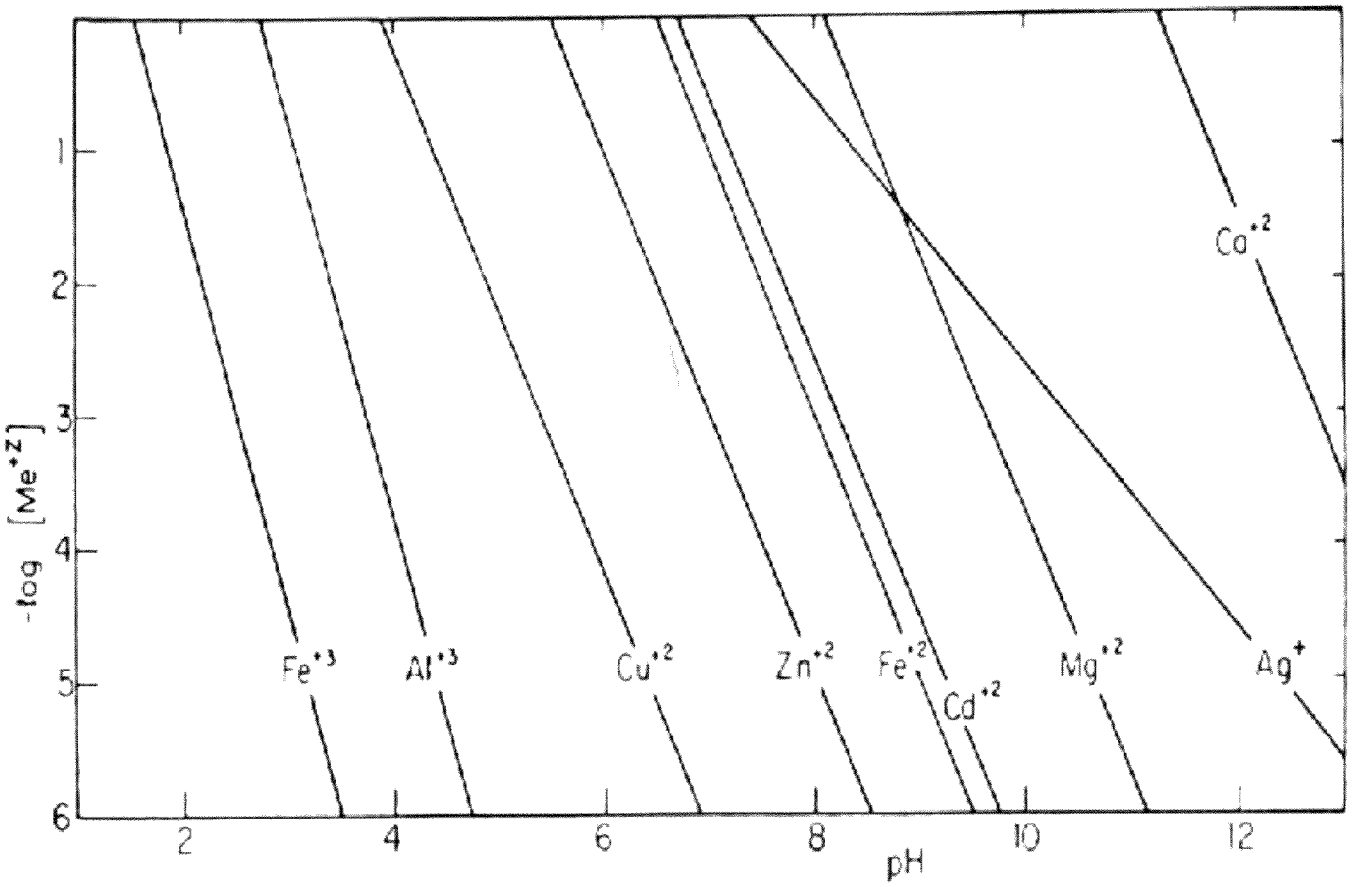
FIG. 27 is a chart showing the solubilities of various oxides and hydroxides.

The next issue is the solubility of oxides and hydroxides (ref. FIG. 5.3-FIG. 27). The graph does not show oxides of heavy metals. From table 5 Part 1 of this Technical report it is clear that formation of oxides and hydroxides of heavy metals is extremely rare in nature. The existing research indicates that such conditions are common for lighter metal ions (as presented in the graph), where the inter-molar relationships are dictated by the natural chemical behavior of the ion.

Figure 28:
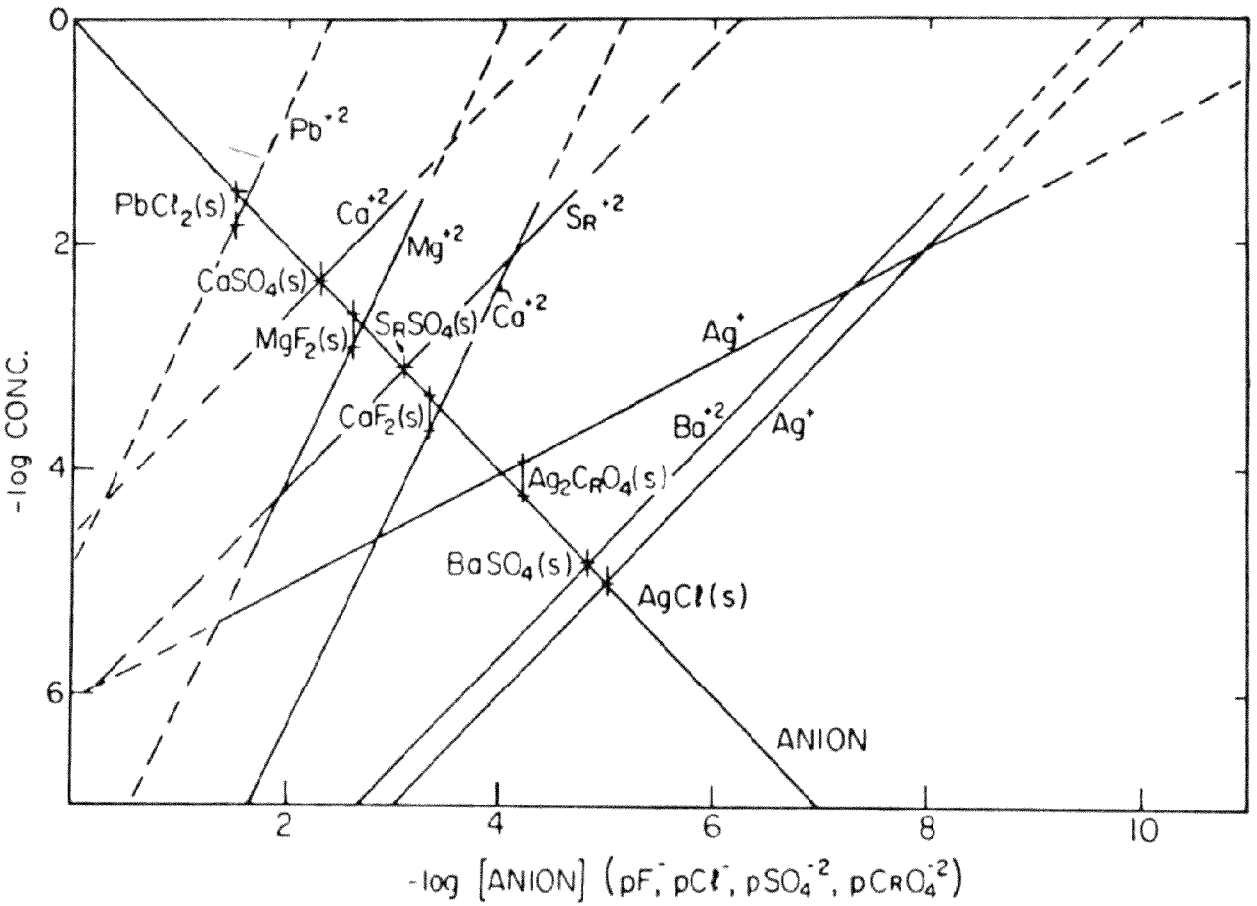
FIG. 28 is a chart showing the solubilities of various simple salts.

The final issue that will be considered is the ratio of solubility of simple salts as a function of common anion concentration (Ref FIG. 5.1-FIG. 28). The rule here is simple—at higher anion or cation concentration, the complex formation or ion pair-binding become possible. Since we are dealing with concentrations at trace levels, the likelihood of such model of solute transport will be negligible. The solute transport is in right relation to the natural circulation of fresh water—evaporation, condensation in air, rainfall, solubility of the surface soil matrix into rainfall at moment of contact, surface flow solute transport, water percolation into the soil strata, transport into ground water aquifer, and from there the effect to the biosphere (Ref. FIG. 9.1-FIG. 29).

Figure 29:
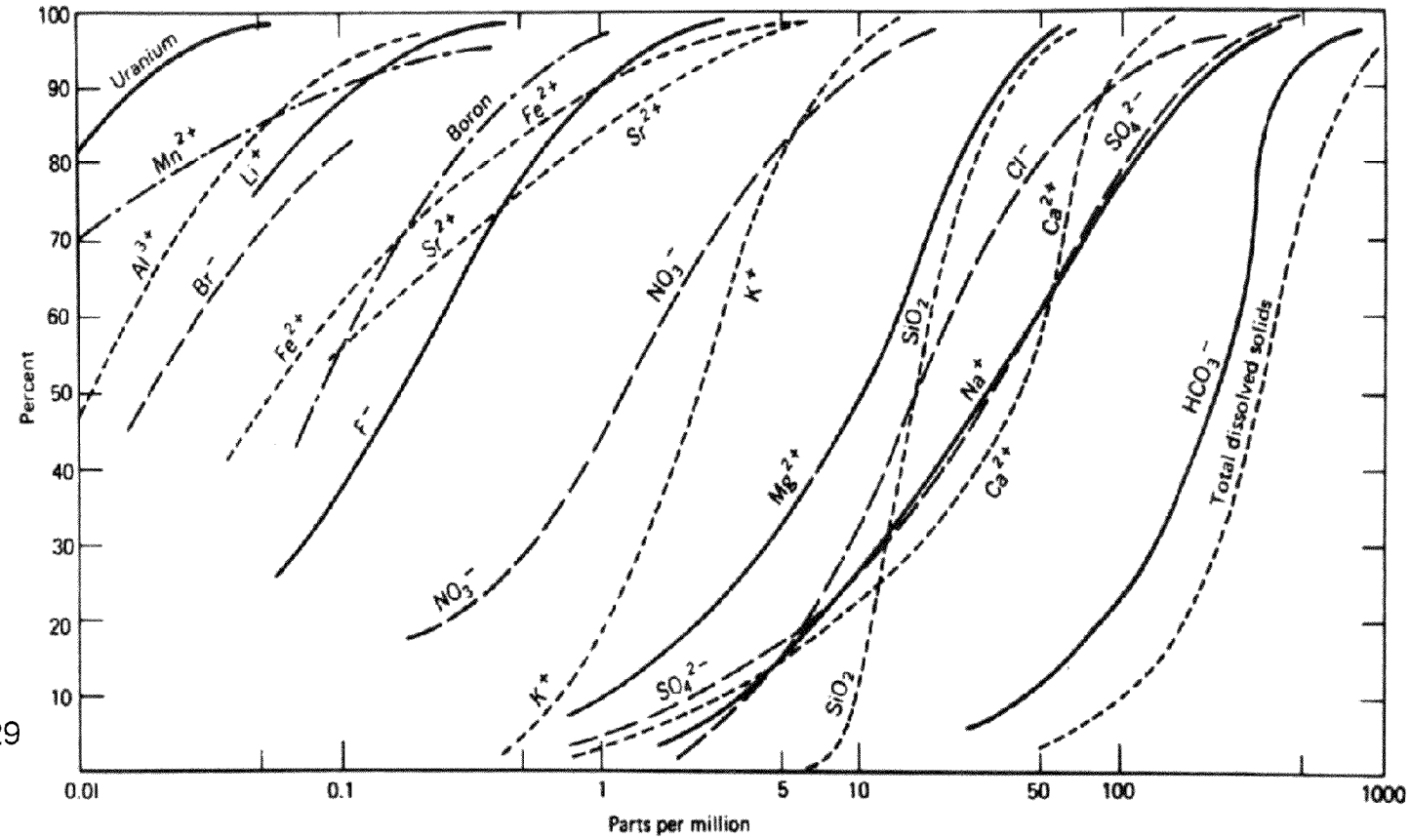

The graph of FIG. 29 represents also other information, not described in the title. This is the relationship between the cumulative distribution of chemical elements in terrestrial water, and the cumulative distribution of chemical elements in soils. This is represent by the next dashed line (Example—for Uranium the solid line represent the distribution in terrestrial water. The cumulative distribution in soil is represent by the next dashed line to the left (the beginning of the dashed line should be ahead of the end of Uranium solid line)—this is the dashed line of Potassium ion (from 0.4% to almost 10%—this fact was proven by various natural occurrence variation worldwide).

The solute transport in ground water aquifer is the most complicated for modeling. The geochemical thermodynamics in this matrix is not possible to be modeled completely, because it is not impossible to incorporate all known and unknown variables. General mistake in such modeling is the approach of many ungrounded assumption, which at the end provide very inconsistent conclusions. From other hand the modern geochemical science until this moment was not able to understand and predict how the interaction between fresh water aquifers and the under laying meteoric saline aquifers interact. The law of mass equilibrium has not yet been scientifically proven. This same generalization contradicts the fact that natural springs coming from deep underground strata have in most cases less solute transport than the surface ones. In the end, such inconsistency is generally used for politically motivated needs only.

In order to avoid as much as possible assumptions we have to establish first the conditions where the artificial Feldspars will be deposited:

A) One of the possible options will be excluded for any possible solute transport immediately, since in this option the natural equilibrium of the host rock excludes any possibility of solute transport—The Fumaroles. The Fumaroles are natural phenomenon of transporting terrestrial hot gases from the under laying deep solidified magma. As very hot, several miles long, reach in minerals and radioactivity, these vents never appear on the surface. The surrounding host rock is heated extensively, preventing formation of any perched aquifer, as a source of potential solute transport. The crystallization and the following natural metamorphosis follow the well-established Bowen's reaction series. This option has very high potential, since the (the inventor already located one Fumaroles) the entire world HLW production for over 50 years could be placed at a single location.

B) The second option is depositing into underground closed for operation mining facility, such as old uranium, coal, copper, zinc, cadmium or rare earth, or open pit facilities for similar types of minerals. In general, such mine facilities already have natural elevated contamination from heavy metals and in many cases some isotopes. For right prediction of possible solute transport, water samples will require solute test from the selected facility. Considering the very low level of isotope inventory in the Artificial Feldspars, the likelihood of significant solute transport toward the aquifer with elevated levels of heavy metal contamination, is negligible due to the rule of mass equilibrium. The mass equilibrium of the natural aquifer will exceed the mass equilibrium of the Artificial Feldspars, which generally will prevent solute transport from the Feldspars to the aquifer. On the contrary, the opposite is much more likely to occur—namely, solute transport from the surrounding aquifer into the Feldspars in order to balance the masses. This is the most observed scenario in nature during the natural metamorphosis of Feldspars. The process is very slow (many hundreds of thousands of years) which will provide the required timeframe for natural stabilization of the long lived isotopes. The process will match the actual process in nature, without human interference in any form such as isolation, multiple engineering barriers, etc.

C) The third option is the most probable one—depositing the Artificial Feldspars in surface burials in the form of Low Level Waste (LLW). Such LLW burials are already being explored by Energy Solutions and the Department of Energy (DOE) here in the USA and in other countries around the world. The burials are licensed only in selected climate and geographic conditions, predominantly with very low annual rainfall and humidity-related to the composition of LLW, hospital by products, tailings, accidental contaminations, etc.

The existing burials are organized and entrapped within multiple engineering barriers, with very uncertain future. From the soil dynamic it is very well known that no perfect engineering barrier exists. Most engineering barriers fail during first several decades, contradicting the requirement for safeguarding during minimum period of 1,000 years. Considering that the burials often contain concentrated chemical compositions which are unfriendly to the surround host massive, such composition often exceeds the mass equilibrium of the host. In such circumstances it is only a matter of time before the engineering barriers fail, and solute transport from the burial to the host soil commences.

The situation is completely different for burial of Artificial Feldspars. The difference in the chemical composition of the Feldspars and the host soil will not contribute to solute transport into the host soil. The opposite is most likely—transport from the host soil to the Feldspars. Feldspars generally contain at least 8 molecules of water. Since the Artificial Feldspars are produced under moderate temperature and pressure, they will have a lower volume of water as compared with natural Feldspars (data provided in Part 2, page 2). Therefore, when deposited into host soil with elevated water content, solute transport will tend to be from the host soil to the Feldspars in order to balance the masses (water migration following the difference in the pore pressure). This is dictated by the specific property of Al: unlike other elements which tend to have no more than 3 water shells, Al usually holds up to 8 in stable state. When water comes in contact with Al, it triggers the formation of additional Calcium-Alumo silicates with extreme cementation properties (from 5000 psi to 7700 psi compressive strength). Such reaction will increase the density of the Feldspars, preventing solute transport—Calcium-Alumo silicates are leachable only exposed to running water, which will never occur, even in near surface burials.

In order to prove the case, several sample set ups will be required. First sample set up is to determine the general solubility of the Artificial Feldspars. This will be done by soaking a sample in rain water, during period of up to 5 days. The sample will be tested for change in pH and eH in logarithmic timetable—1 m, 2 m, 5 m, 10 m, 15 m, 30 m, 1 h, 2 h, 3 h, 6 h, 12 h, 24 h, 2 days, 3 days, 5 days. At the end of $5^{th}$ day the type and amount of any isotope in the water will be measured. This can be done via different ways—from titration to spectroscopic, at the discretion of the performing laboratory. Once determined/if any, this will provide the ability to calculate, based on logarithmic testing of change in pH and eH, the value and level of dilution over any given time frame.

Figure 30:
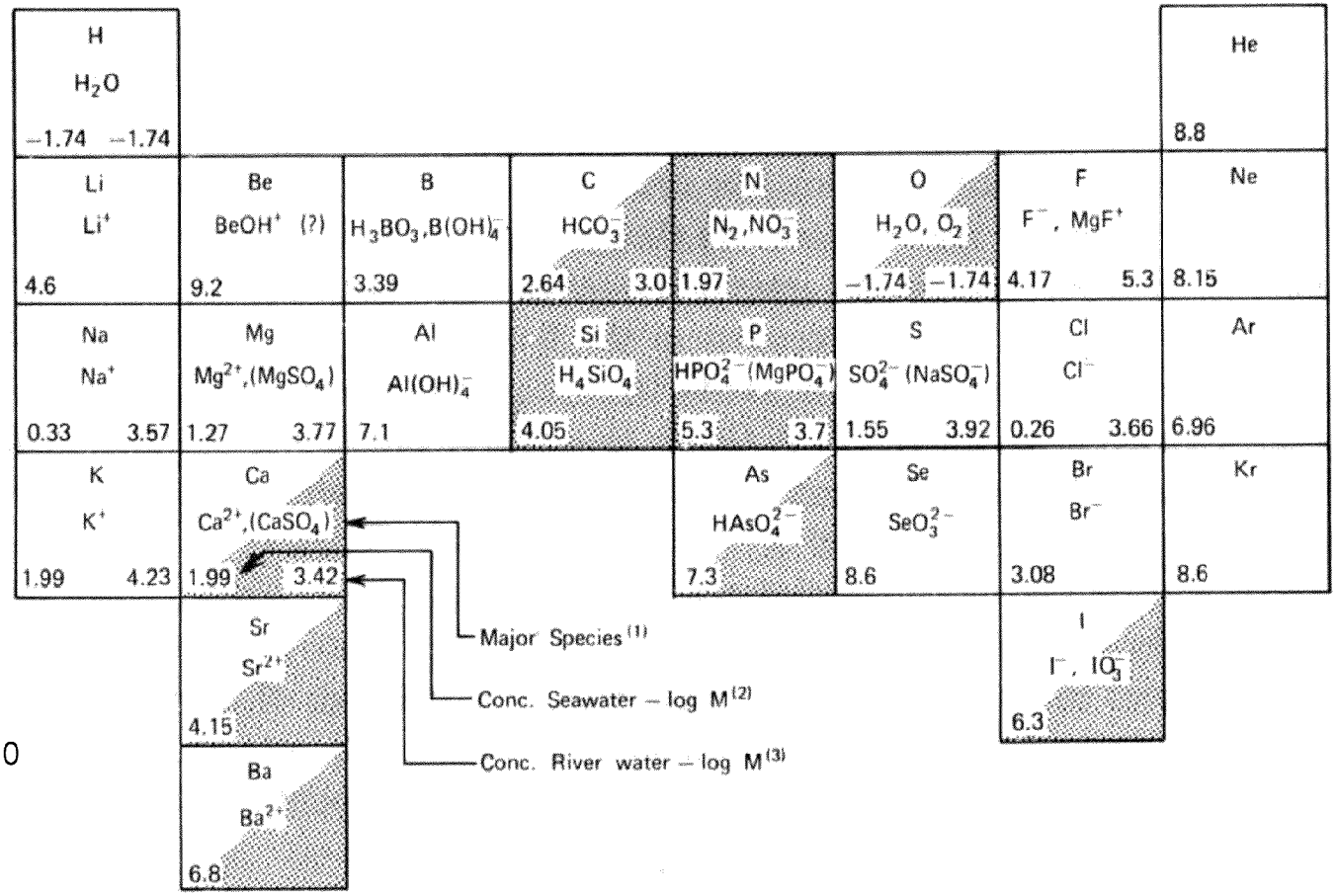

The composition of the rain water for the test is enclosed (FIGS. 30 and 31). Testing in distilled water is not a correct approach since such conditions do not exist in nature. The model of the rain water was designed to contain trace quantities of each solute potential to operate. The surface area will be estimated in the range of "3/rρ", where the "r" is the radius of the particle and the "ρ" is the density of the solid phase.

Testing with multiple so called "wet-dry-wet" cycles is not appropriate for this case—all isotopes will be in trace amounts, and such schematics will be useless. Deployment of multiple wet-dry-wet cycles testing procedure is also not applicable for disposal site in areas with subtropical climate (which I do not anticipate at all)—selection of such site would be a fundamental mistake of scientific misunderstanding.

Second, sample setup will test for formation of low temperature calcite and calcium-alumo silicates (general schematics is to mix solid sample with small amount of rain water as preliminary state of natural metamorphosis). The right amount of water for the testing will be determined as ½ of the value of the Plastic limit of the solid sample. This will duplicate the actual natural process in soil—the natural moisture content of any soil on the planet in near surface crust in continental climate is in the range of zero to one/half of the Plastic limit of the solid at density approximately 75 to 85% of MDD (Maximum Dry Density). The choice of instrumentation testing for formation of calcite or calcium-alumo silicates will be at the discretion of the testing laboratory (preferably will be the microscopic, which will provide photo slides of the crystalline structure of the Feldspars).

Note:

Composition of rain water at 25 C, pH5.5, eH0.57 Volts—Al+3=0.01 mg/L, Ca+2=0.1 mg/L, Cl—1.0 mg/L, Fe+2=0.04 mg/L, K+=0.001 mg/L, HCO3-=swapped with CO2, HS-=0.0001 mg/L, Na+=0.6 mg/L, Mg+2=0.1 mg/L, SiO2=0.3 mg/L, SO4=0.3 mg/L.

Part 5

Special Properties of Isotopes—Cryogenic Cooling Effect to Atomic Nucleus

The Nature of Matter

Subatomic physics is the study of the most fundamental constituents of matter of everything we see around us. Early research into the atom revealed its central nucleus (comprising neutrons and protons) and orbiting electrons. These elementary particles are the building blocks of nature, and they act on the universe through simple physical laws. They are ordered in the Standard Model, a theoretical framework developed by experimental high-energy-physics research (example Fermi lab). Matter, in its most basic forms exists as quarks and leptons. The particles are progressively heavier from one generation to the next. The single undiscovered element in the Standard Model is the top quark, a particle so massive that the only accelerator in the world capable of producing it is the Tevatron—the world highest-energy accelerator down.

| | ELECTRIC CHARGE (Proton is +1) | M = MASS IN ENERGY UNITS | | |
|---|---|---|---|---|
| The Quarks | +⅔ | M = 5 MeV | M = 1500 MeV | M > 91,000 MeV |
| | | u | c | t |

-continued

| | ELECTRIC CHARGE (Proton is +1) | M = MASS IN ENERGY UNITS | | |
|---|---|---|---|---|
| | | up | charm | top<br>NOT YET DISCOVERED |
| | −⅓ | M = 10 MeV<br>d<br>down | M = 150 MeV<br>s<br>strange | M > 5000 MeV<br>b<br>bottom<br>DISCOVERED<br>at FERMILAB |
| The Leptons | 0<br>(neutral) | M = 0 or almost Ø<br>$\nu_e$<br>electron neutrino | M = 0 or almost Ø<br>$\nu_\mu$<br>muon neutrino | M = 0 or almost Ø<br>$\nu_\tau$<br>Tau neutrino<br>NOT YET<br>OBSERVED DIRECTLY |
| | −1 | M = 0.511 MeV<br>e<br>electron | M = 105 MeV<br>μ<br>muon | M = 1784 MeV<br>τ<br>Tau |

The Standard Model of particles and forces

We understand their behavior down to a scale of about E-18 meters, and that investigations at that length scale are relevant to conditions in the Universe just a fraction of a second after the Big Bang.

However, the Standard Model contains many apparently arbitrary physical parameters. The observation of neutrino oscillations by the Sudbury Neutrino Observatory (SNO) indicates non-zero neutrino masses that are much smaller than the other particles, possibly hinting at physics beyond the Standard Model. In addition, there is mounting evidence that dark matter is formed of particles not found in the Standard Model. Hence, it is anticipated that nature is represented by a more general "beyond the Standard Model" theory which overcomes the Standard Model' shortcomings.

In the Standard Model, the W and Z particles acquire mass through a process of symmetry breaking. The simplest implementation of this symmetry breaking requires the existence of a currently unobserved particle called the Higgs boson. The data obtained to date favor a low mass Higgs which should be observable at the Large Hadron Collider (LHC). However, there are theoretical inconsistencies in this simplest of descriptions of mass generation and if a light Higgs is observed it is expected to be part of a more complete theory such as super symmetry. If super symmetry exists, many additional particles should be discovered by the LHC. If the Higgs is not observed, some other chanism beyond the physics of the Standard Model must be responsible for symmetry breaking, which would also lead to new dynamics at energies accessible to the LHC. Either case is expected to reveal new physics beyond the Standard Model.

Nuclear physics experiments at low and intermediate energies also have a role to play in the search for physics beyond the Standard Model. Carefully selected nuclei provide a "quantum laboratory" for very high precision measurements of Standard Model observables, and for searches for phenomena forbidden or suppressed by the Standard Model.

In the Standard Model, the interactions between quarks (which have mass) and gluons (which are mass less) are described by a theory called Quantum Chromo dynamics (QCD). Quarks and gluons combine to form the familiar protons and neutrons as well as other hadrons, but the details of QCD remain poorly understood.

To illustrate why the solution of this problem is important, consider the mass of regular matter. The mass of atoms is concentrated in their nuclei; the surrounding electrons are crucial for determining how atoms interact with each other, but they provide less than a part in a thousand of the mass. The nuclei are assembled from protons and neutrons which in turn are made from quarks and gluons. Thus, most of the mass of matter can ultimately be traced back to the quarks and gluons described by QCD. However, a realistic estimate of the contribution of the quark masses to the mass of the nucleus is small: just a few percent of the total proton mass. Hence, 95% of the proton (or neutron) mass, and thus 95% of the mass of ordinary matter, emerges from the interactions of quarks with mass less gluons. There is, as yet, no detailed explanation for this phenomenon.

While QCD is now firmly established as the fundamental theory of the strong interactions between quarks and gluons, our understanding is lacking on several critical fronts. In short distance (high energy) interactions, the interaction is relatively feeble, so mathematical methods can be used to solve a subset of the theory. In contrast, in lower-energy (long distance) interactions, quarks and gluons are found to interact with one another exceedingly strongly, leading to their confinement to form the building blocks of conventional matter: protons and neutrons. Quantitative QCD calculations in this regime remain one of the greatest intellectual challenges in physics.

The nucleus contains over 99.9% of the mass of the atom and, hence, of ordinary matter in the Universe. The properties of atomic nuclei are essential in determining the structure and evolution of the cosmos. Only the lightest elements (hydrogen, helium, and lithium) were created in the Big Bang; all of the heavier elements have been synthesized through nuclear reactions in normal stars, novae, X-ray bursts, supernovae and other astrophysical environments. The reactions in the synthesis of the elements involve many unstable exotic nuclei that exist only under the extremes of temperature and pressure found in stars and supernovae.

Fundamentals of Nuclear Reactions

Nuclear reactions at low and intermediate energies provide several fundamental rules that are part in this disclosure. One of them is the Displacement Law. The original of displacement law simply stated that any element which is a product of an alpha-disintegration is found in the Mendeleev periodic table two columns to the left of the parent radioactive element, while product of a beta-ray disintegration is found one column to the right of its parent. (Soddy's law) (Ref to Table 5.1 and 5.2 from Rapid Decay in Single Radionuclide for Atomic Nucleus).

TABLE 5.1

| | | | | | |
|---|---|---|---|---|---|
| Alpha decay | Parent | Z | Daughter | Z − 2 | α |
| Positron beta decay | | Z | | Z − 1 | β+ |
| Electron Capture | | Z | | Z − 1 | EC |
| Gamma Decay | | Z | | Z | γ |
| Internal conversion | | Z | | Z | e− |
| Isometric transition | | Z | | Z | IT |
| Neutron emission | | Z | | Z | n |
| Negatron beta decay | | Z | | Z + 1 | β− |

TABLE 5.2

| Nuclear reaction type | | | |
|---|---|---|---|
| (α,n) | | Daughter | Z + 2 |
| (α.p) | (d,n) | | Z + 2 |
| (d.p) | (n,γ) | | Z |
| (d,α) | (n,p) | | Z − 1 |
| (n,α) | | | Z − 2 |

Atom Thermodynamics

The most basic expression of matter is that it is the ration of the energy of the particle to the energy of the field.

Translational motion in solids however, takes the form of phonons. Phonons are constrained, quantized wave packets traveling at the speed of sound for a given substance. The manner in which phonons interact within a solid determines a variety of its properties, including its thermal conductivity. In electrically insulating solids, phonon-based heat conduction is usually inefficient and such solids are considered thermal insulators (such as glass, plastic, rubber, ceramic, and rock). This is because in solids, atoms and molecules are locked into place relative to their neighbors and are not free to roam.

Metals however, are not restricted to only phonon-based heat conduction. Heat energy conducts through metals extraordinarily quickly because instead of direct molecule-to-molecule collisions, the vast majority of heat energy is mediated via very light, mobile conduction electrons. This is why there is a near-perfect correlation between metals' thermal conductivity and their electrical conductivity. Conduction electrons imbue metals with their extraordinary conductivity because they are delocalized (i.e., not tied to a specific atom) and behave rather like a sort of quantum gas due to the effects of zero-point energy. Furthermore, electrons are relatively light with a rest mass only 1/1836th that of a proton.

Figure 32:
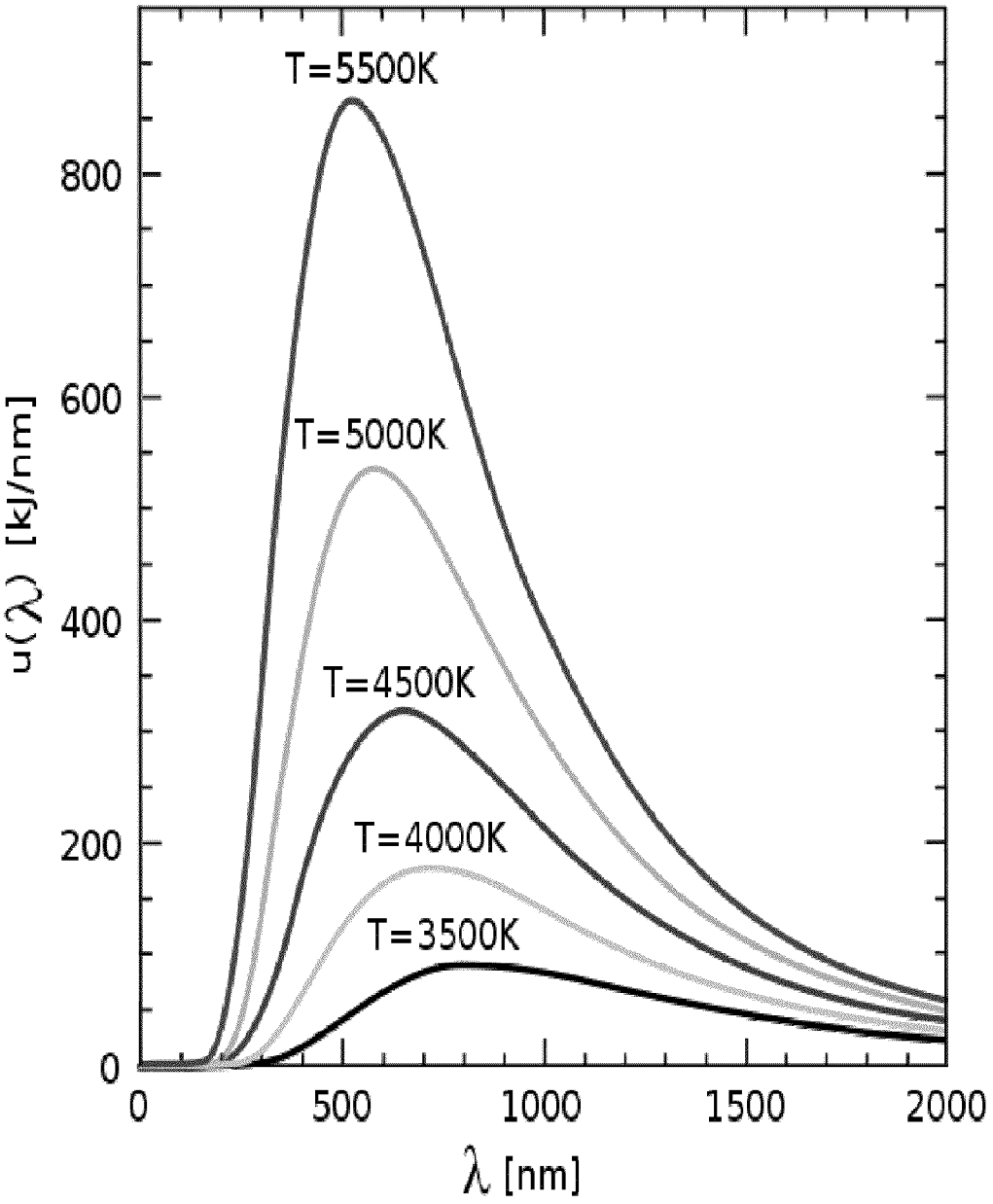
FIG. 32 is a graph showing the diffusion of heat energy.

FIG. 32 is a graph showing the diffusion of heat energy: Black-body radiation—The spectrum of black-body radiation has the form of a Planck curve. A 5500 K black-body has a peak emittance wavelength of 527 nm. Compare the shape of this curve to that of a Maxwell distribution.

Thermal radiation is a byproduct of the collisions arising from various vibrational motions of atoms. These collisions cause the electrons of the atoms to emit thermal photons (known as black-body radiation). Photons are emitted anytime an electric charge is accelerated (as happens when electron clouds of two atoms collide). Even individual molecules with internal temperatures greater than absolute zero also emit black-body radiation from their atoms. In any bulk quantity of a substance at equilibrium, black-body photons are emitted across a range of wavelengths in a spectrum that has a bell curve-like shape called a Planck curve. The top of a Planck curve (the peak emittance wavelength) is located in a particular part of the electromagnetic spectrum depending on the temperature of the black-body. Substances at extreme cryogenic temperatures emit at long radio wavelengths whereas extremely hot temperatures produce short gamma rays (see Table below of common temperatures).

Black-body radiation diffuses heat energy throughout a substance as the photons are absorbed by neighboring atoms, transferring momentum in the process. Black-body photons also easily escape from a substance and can be absorbed by the ambient environment; kinetic energy is lost in the process.

As established by the Stefan-Boltzmann law, the intensity of black-body radiation increases as the fourth power of absolute temperature. Thus, a black-body at 824 K (just short of glowing dull red) emits 60 times the radiant power as it does at 296 K (room temperature). This is why one can so easily feel the radiant heat from hot objects at a distance. At higher temperatures, such as those found in an incandescent lamp, black-body radiation can be the principal mechanism by which heat energy escapes a system. The full range of the thermodynamic temperature scale, from absolute zero to absolute hot, and some notable points between them are shown in the table below.

| | Kelvin | Peak emittance wavelength of black-body photons |
|---|---|---|
| Absolute zero (precisely by definition | 0 K | ∞[3] |
| Coldest measured temperature | 450 pK | 6,400 kilometers |
| One millikelvin (precisely by definition) | 0.001 K | 2.897 77 meters (Radio, FM band) |
| Water's triple point (precisely by definition) | 273.16 K | 10,608.3 nm (Long wavelength I.R.) |
| Incandescent lamp | 2500 K | 1160 nm (Near infrared)[C] |
| Sun's visible surface | 5778 K | 501.5 nm (Green light) |
| Lightning bolt's channel | 28,000 K | 100 nm (Far Ultraviolet light) |
| Sun's core | 16 MK | 0.18 nm (X-rays) |
| Thermonuclear weapon (peak temperature) | 350 MK | $8.3 \times 10^{-3}$ nm (Gamma rays) |
| Sandia National Labs' Z machine | 2 GK | $1.4 \times 10^{-3}$ nm (Gamma rays) |
| Core of a high-mass star on its last day | 3 GK | $1 \times 10^{-3}$ nm (Gamma rays) |
| Merging binary neutron star system | 350 GK | $8 \times 10^{-6}$ nm (Gamma rays) |
| Gama-ray burst progenitors | 1 TK | $3 \times 10^{-6}$ nm (Gamma rays) |
| Relativistic Heavy Ion Collider | 1 TK | $3 \times 10^{-6}$ nm (Gamma rays) |
| CERN's proton vs. nucleus collisions | 10 TK | $3 \times 10^{-7}$ nm (Gamma rays) |
| Universe $5.391 \times 10^{-44}$ s after the Big Bang | $1.417 \times 10^{32}$ K | $1.616 \times 10^{-26}$ nm Planck frequency |

The 2500 K value is approximate.

For a true blackbody (which tungsten filaments are not). Tungsten filaments' emissivity is greater at shorter wavelengths, which makes them appear whiter. Effective photosphere temperature.

For a true blackbody (which the plasma was not). The Z machine's dominant emission originated from 40 MK electrons (soft x-ray emissions) within the plasma.

The kinetic energy of particle motion is just one contributor to the total heat energy in a substance; another is phase transitions, which are the potential energy of molecular bonds that can form in a substance as it cools (such as during condensing and freezing).

Internal Energy

The total kinetic energy of all particle motion, including that of conduction electrons, plus the potential energy of phase changes, plus zero-point energy comprise the internal energy of a substance, which is its total heat energy. The term internal energy must not be confused with internal degrees of freedom. Whereas the internal degrees of freedom of molecules refer to one particular place where kinetic energy is bound, the internal energy of a substance comprises all forms of heat energy.

Figure 33:
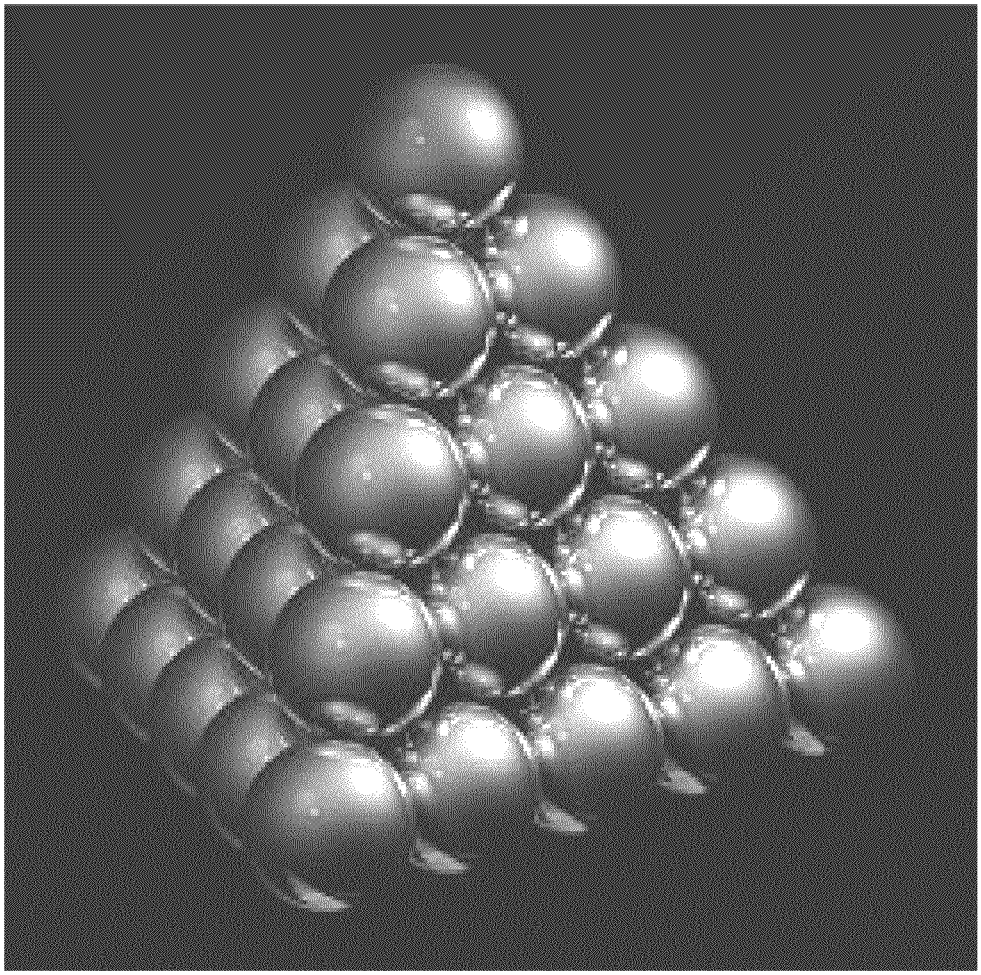
FIG. 33 is an image of a crystal structure.

When many of the chemical elements, such as the noble gases and platinum-group metals, freeze to a solid—the most ordered state of matter—their crystal structures (see, e.g., FIG. 33) have a closest-packed arrangement. This yields the greatest possible packing density and the lowest energy state.

Heat Energy at Absolute Zero

As a substance cools, different forms of heat energy and their related effects simultaneously decrease in magnitude: the latent heat of available phase transitions are liberated as a substance changes from a less ordered state to a more ordered state; the translational motions of atoms and molecules diminish (their kinetic temperature decreases); the internal motions of molecules diminish (their internal temperature decreases); conduction electrons (if the substance is an electrical conductor) travel somewhat slower; and black-body radiation's peak emittance wavelength increases (the photons' energy decreases). When the particles of a substance are as close as possible to complete rest and retain only ZPE-induced quantum mechanical motion, the substance is at the temperature of absolute zero (T=0).

Note that whereas absolute zero is the point of zero thermodynamic temperature and is also the point at which the particle constituents of matter have minimal motion, absolute zero is not necessarily the point at which a substance contains zero heat energy; one must be very precise with what one means by heat energy. Often, all the phase changes that can occur in a substance, will have occurred by the time it reaches absolute zero. However, this is not always the case. Notably, T=0 helium remains liquid at room pressure and must be under a pressure of at least 25 bar (2.5 MPa) to crystallize. This is because helium's heat of fusion (the energy required to melt helium ice) is so low (only 21 joules per mole) that the motion-inducing affect of zero-point energy is sufficient to prevent it from freezing at lower pressures. Only if under at least 25 bar (2.5 MPa) of pressure will this latent heat energy be liberated as helium freezes while approaching absolute zero. A further complication is that many solids change their crystal structure to more compact arrangements at extremely high pressures (up to millions of bars, or hundreds of gigapascals). These are known as solid-solid phase transitions wherein latent heat is liberated as a crystal lattice changes to a more thermodynamically favorable, compact one.

The above complexities make for rather cumbersome blanket statements regarding the internal energy in T=0 substances. Regardless of pressure though, what can be said is that at absolute zero, all solids with a lowest-energy crystal lattice such those with a closest-packed arrangement contain minimal internal energy, retaining only that due to the ever-present background of zero-point energy. One can also say that for a given substance at constant pressure, absolute zero is the point of lowest enthalpy (a measure of work potential that takes internal energy, pressure, and volume into consideration). Lastly, it is always true to say that all T=0 substances contain zero kinetic heat energy.

Definition of Thermodynamic Temperature

Figure 34:
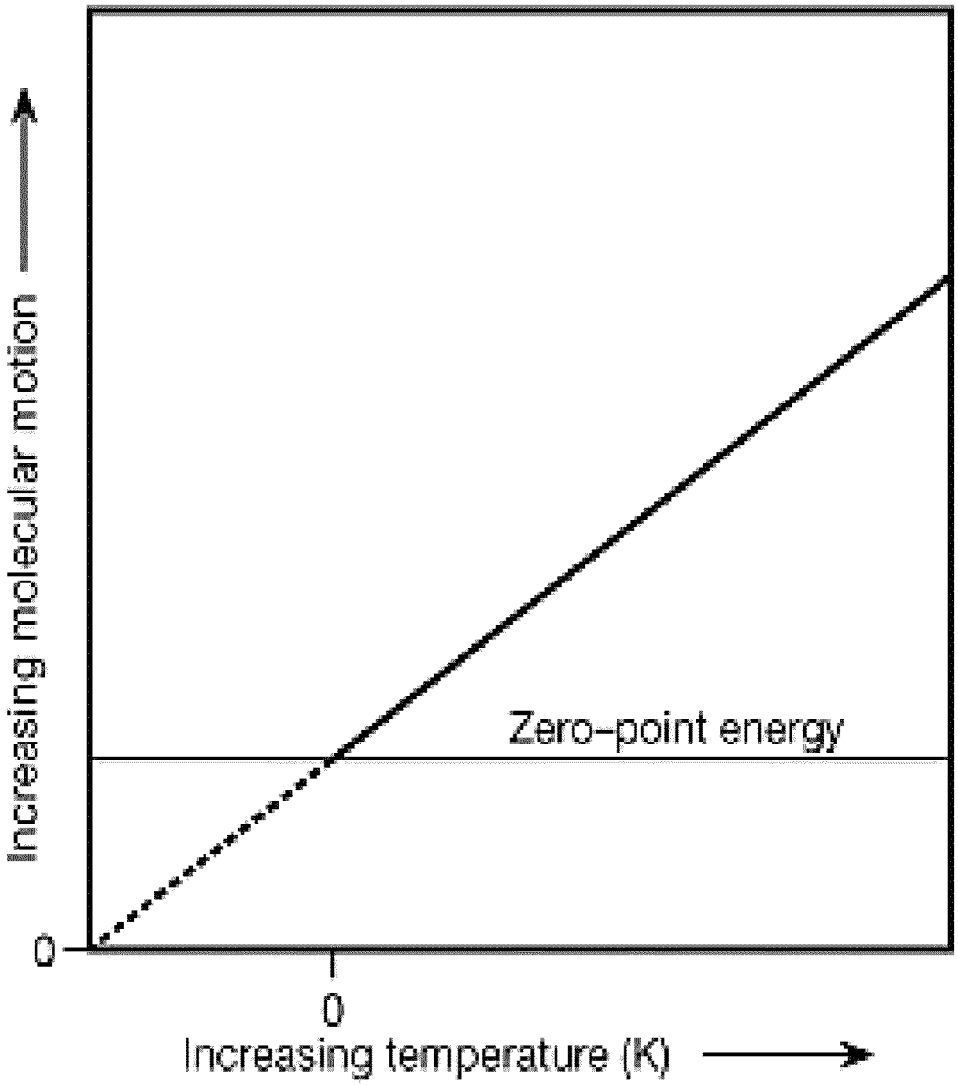
FIG. 34 is a graph illustrating the relationship between absolute zero (temperature) and zero-point energy.

Strictly speaking, the temperature of a system is well-defined only if its particles (atoms, molecules, electrons, photons) are at equilibrium, so that their energies obey a Boltzmann distribution (or its quantum mechanical counterpart). FIG. 34 illustrates absolute zero's relationship to zero-point energy.

While scientists are achieving temperatures ever closer to absolute zero, they cannot fully achieve a state of zero temperature. However, even if scientists could remove all kinetic heat energy from matter, quantum mechanical zero-point energy (ZPE) causes particle motion that can never be eliminated. Encyclopedia Britannica Online defines zero-point energy as the "vibrational energy that molecules retain even at the absolute zero of temperature". ZPE is the result of all-pervasive energy fields in the vacuum between the fundamental particles of nature; it is responsible for the Casimir effect and other phenomena.

Although absolute zero (T=0) is not a state of zero molecular motion, it is the point of zero temperature and, in accordance with the Boltzmann constant, is also the point of zero particle kinetic energy and zero kinetic velocity.

The Boltzmann constant and its related formulas describe the realm of particle kinetics and velocity vectors whereas ZPE is an energy field that jostles particles in ways described by the mathematics of quantum mechanics. However, in T=0 condensed matter; e.g., solids and liquids, ZPE causes interatomic jostling where atoms would otherwise be perfectly stationary. In as much as the real-world effects that ZPE has on substances can vary as one alters a thermodynamic system (for example, due to ZPE, helium won't freeze unless under a pressure of at least 25 bar or 2.5 MPa). ZPE is very much a form of heat energy and may properly be included when tallying a substance's internal energy.

Note too that absolute zero serves as the baseline atop which thermodynamics and its equations are founded because they deal with the exchange of heat energy between "systems" (a plurality of particles and fields modeled as an average). Accordingly, one may examine ZPE-induced particle motion within a system that is at absolute zero but there can never be a net outflow of heat energy from such a system. Also, the peak emittance wavelength of black-body radiation shifts to infinity at absolute zero; indeed, a peak no longer exists and black-body photons can no longer escape. Because of ZPE, however, virtual photons are still emitted at T=0. Such photons are called "virtual" because they can't be intercepted and observed. Furthermore, this zero-point radiation has a unique zero-point spectrum. However, even though a T=0 system emits zero-point radiation, no net heat flow Q out of such a system can occur because if the surrounding environment is at a temperature greater than T=0, heat will flow inward, and if the surrounding environment is at T=0, there will be an equal flux of ZP radiation both inward and outward (known as self shielding). It is the vibrational energy matter retains at the zero Kelvin point. Derivation of the classical electromagnetic zero-point radiation spectrum via a classical thermodynamic operation involving van der Waals forces, Daniel C. Cole, Physical Review A, 42 (1990) 1847.

At non-relativistic temperatures of less than about 30 GK, classical mechanics are sufficient to calculate the velocity of particles. At 30 GK, individual neutrons (the constituent of neutron stars and one of the few materials in the universe with temperatures in this range) have a 1.0042 $\gamma$ (gamma or Lorentz factor). Thus, the classic Newtonian formula for kinetic energy is in error less than half a percent for temperatures less than 30 GK.

Cryogenic Cooling Effect to Subatomic Particles

Cryogenics is that branch of engineering which deals with temperatures lower than −150 C. There are many areas of interest where we need cryogenic temperatures such as storage of large volumes of gases in small space in the liquefied form, preservation of insemination, very high vacuum applications and fundamental research in understanding more deeply about entropy and sub-atomic structure of matter as the motion of protons, electrons reduces at cryogenic temperatures

| Gas | N.B.P. ° C. | Freezing Point ° C. | Critical Temperature ° C. | Maximum inversion Temp. ° C. |
|---|---|---|---|---|
| Air | −191 | −212.3 | −140.2 | 330 |
| $O_2$ | −183 | −218.8 | −118.8 | 620 |
| $N_2$ | −196 | −210 | −147.0 | 347.8 |
| $H_2$ | −252.8 | −259.2 | −239.9 | −77.8 |
| He | −268.9 | −269.7 | −267.9 | −250.0 |
| $CO_2$ | −78.3 | — | 31.1 | 1230 |

The above table provides Important Properties of gases.

Cryogenic Cooling Effect to Nuclides

In order to describe the effect in the nucleus, need to be review the relation between the peak emittance wavelength of black-body photons and the cryogenic cooling.

The first reference is that the nuclei with even Z and even A have total zero angular momentum. From there is follows:

$$Tf = \frac{\ln 2}{\lambda} = \frac{0.693}{\lambda} \tag{1}$$

where λ is a radioactive constant since $$\lambda = \lambda 0 \cdot E - \gamma \tag{2}$$

and $$\lambda 0 = (01 \text{ to } 1) \times \frac{V}{R} = 10\ E\ 21 \text{ sec } -1 \tag{3}$$

Where the Coulomb Barrier transmission is = (4)

$$\frac{V \text{ (inside nucleus velocity)}}{R \text{ (nucleus electromagnetic radius)}}$$

Follows, that the variables in radioactive constant are the inside nucleus velocity and the nucleus electromagnetic radius. Bought they can be effected from the T=0 temperature It was already established that a 10% change in the nucleus radius R produces 40-fold change in the decay constant λ and half-period Tf. Temperature T=0 produce significant velocity delay in the building particles of the nucleus—as change of the emitted wavelength (ref. below table)

The Quantum mechanics already established the following relationship:

A) Increase in Z result in less emission from the nucleus

B) Increase in R result in more transmission from the nucleus

C) Increase in V,M,T result in more transmission from the nucleus

| | Kelvin | Peak emittance wavelength of black-body photons |
|---|---|---|
| Absolute zero (precisely by definition) | 0 K | ∞[3] |
| Coldest measured temperature | 450 pK | 6,400 kilometers |
| One millikelvin (precisely by definition) | 0.001 K | 2.897 77 meters (Radio, FM band) |
| Water's triple point (precisely by definition) | 273.16 K | 10,608.3 nm (Long wavelength I.R.) |
| Incandescent lamp | 2500 K | 1160 nm (Near infrared) |
| Sun's visible surface | 5778 K | 501.5 nm (Green light) |
| Lightning bolt's channel | 28,000 K | 100 nm (Far Ultraviolet light) |
| Sun's core | 16 MK | 0.18 nm (X-rays) |
| Thermonuclear weapon (peak tempreature) | 350 MK | $8.3 \times 10^{-3}$ nm (Gamma rays) |
| Sandia National Labs' Z machine | 2 GK | $1.4 \times 10^{-3}$ nm (Gamma rays) |
| Core of a high-mass star on its last day | 3 GK | $1 \times 10^{-3}$ nm (Gamma rays) |
| Merging binary neutron star system | 350 GK | $8 \times 10^{-6}$ nm (Gamma rays) |
| Gamma-ray burst progenitors[21] | 1 TK | $3 \times 10^{-6}$ nm (Gamma rays) |
| Relativistic Heavy Ion Collider | 1 TK | $3 \times 10^{-6}$ nm (Gamma rays) |
| CERN's proton vs. nucleus collisions | 10 TK | $3 \times 10^{-7}$ nm (Gamma rays) |
| Universe $5.391 \times 10^{-44}$ s after the Big Bang | $1.417 \times 10^{32}$ K | $1.616 \times 10^{-26}$ nm (Planck frequency)[24] |

The enclosed table provides the relationship between emission wavelength from the nucleus to the cryogenic temperature, which completely overlaps the provided in equation 1 to 4 relationships (Ref. to Gamov, Gutneg and Godon—Rapid Decay of a Single Radionuclide for the Atomic Nucleus).

The conclusion is that cryogenic cooling is affecting the kinetic energy of entire atom (electrons, protons and neutrons). This means that with temperature dropping to near "zero" the wavelength of emission from the nucleus reaches close to infinity, resulting in nucleus energy emission level drops down.

As result at temperature near "zero" the isotope radiation energy emission level from the nucleus (in MeV) (not the type of radiation) also drops down (ref. to relationship C)—decrease of nuclei particles velocity V and electromagnetic radius R, at T=0).

This cryogenic cooling phenomenon is known as nuclei self-shielding.

Need to be pointed that this affects only α, β and γ rays, but not the neutron rays (or for now is not possible to be measured). This effect of cryogenic cooling provide safer radiation environment and is very useful when handling spent fuel or other HLW with high energy emission levels.

Part 6

Nano-Flex Draft Testing Protocol

Experimental Protocol for Evaluating the Retention of Selected Radioactive Nucleotides in Spent Nuclear Fuel (10 Years Decay) Sequestered in a Feldspar Matrix Background This testing protocol is designed to investigate experimentally the following physical and chemical conditions that may be needed to support Claims for the NANO-FLEX patent disclosure:

A) Production of Artificial Feldspar Sequester Matrix using selected fly ash combined with selected HLW elements as surrogates for radioisotopes in the HLW.

B) Demonstrate that surrogate elements for the associated radioisotopes in Feldspar matrix are satisfactorily retained under anticipated ambient conditions of leaching and weathering.

C) Confirm that Artificial Feldspar is a stable media over extensive time under natural mineral metamorphosis and radioisotope mutation.

Draft—Testing Protocol

A. Production of Artificial Feldspar Matrix

Since radioactive isotopes have similar chemical properties as their stable specie, this test(s) will be done with selected stable elements (with the exception of natural uranium) as follows:

| HLW Components | Elements | Weight % | Comments |
|---|---|---|---|
| Actinides | Uranium | 0.00191% | |
| Fission Products | Strontium | 0.000293% | |
| | Cesium | 0.000892% | |
| | Iodine | 0.000099% | as silver iodine |
| | Barium | 0.00002% | (trace) |

| Feld Spar | Compounds | Weight % |
|---|---|---|
| Fly Ash composition: | SiO2 | 52.59% |
| | Al2O3 | 19.98% |
| | CaO | 15.49% |
| | Fe2O3 | 7.39% |
| | MgO | 3.43% |
| | SO3 | 0.85% |
| | Other | 0.27% |

Possible Test Parameters

Temperature ranges ΔT (1400 C to 800 C)—Reference to Bowen Reaction Series. Since the Fly ash formation temperature is around 1100 C, anticipated melting temperature will be above 1150 C Pressure ranges ΔP (to be determined)

Water exposure ΔW (0 to 50%)

Testing times Δt (to be determined—achieve stable state with approximately 4 molecules of H2O per Feldspar unit. Once the mix is homogenized in CFR/batch reactor, quick crystallization will be triggered with a) pressure dropping, or b) quick cooling. Option (b) is very useful for technically easy and low cost pellet production via droplets formation of the melted Feldspar over high revolution rotating "hedgehog" surface cylinder (well known German technology for production of artificial light weight concrete aggregates "klingerit". The process is exact duplication of magma cooling in the oceans, except that no material moving—the cooling time is sufficient for achieving quick crystallization (Bowen Reaction series—forming polysynthetic twinning crystal formations) with additional benefit of perfect glacial surface (for further absorption reduction). The process also provides the accommodation for required initial 4 molecules of water (per Feldspar unit).

NOTE: For the significant radionuclide's inventory resulting from HLW and spent fuel reprocessing, a small, representative set of nuclides will be tested with this protocol (ref. Table 6). Proposed are 4 fission products (I, Sr, Cs, and) and 1 actinide (natural U) to be tested.

It is proposed that the Fly ash composition used to produce the Artificial Feldspar Matrix will be Calcium Feldspar type.

FINAL TEST: Microscopic or, difractometry (with possible slides) or spectroscopy B. Solubility Testing Soaking in rainwater for period of 5 days. Continuous testing of pH and eH at logarithmic times intervals—1 m, 2 m, 5 m, 10 m, 15 m, 30 m, 1 h, 2 h, 3 h, 6 h, (12 h—can be skipped), 24 h, 2 days, 3 days, 5 days. Initial (pretest) and final (post-test completion) spectroscopy of rainwater for any diluted amount of actinides and fission products as provided in section A).

Testing surface area (ratio between Feldspar and water) to be estimated in the range of 3/R·D—where R is the radius of Feldspar particle (Fly ash) and D is the density of Feldspar (2,500 to 2,800 kg/m3).

Composition of rain water at 25 C, pH=5.5, eH=0.57 Volts, Al+3=0.01 mg/L, Ca+2=0.1 mg/L, Cl=1.0 mg/L, Fe+2=0.04 mg/L, K+=0.001 mg/L, HCO3-=swapped with CO2, HS-=0.0001 mg/L, Na+=0.6 mg/L, Mg+2=0.1 mg/L, SiO2=0.3 mg/L, SO4=0.3 mg/L.

Testing for formation of calcite and calcium alumina silicate at time of contact with additional amount of water. Such natural metamorphosis is expected any time after permanent disposal, when the Feldspar will increase the interstitial water content from 4 to 8 molecules of water per Feldspar unit. The model is reverse engineering approach to duplicate process of "quick crystallization"—Reference to Bowen reaction series, where the freshly formed Feldspar luck up to 4 molecules of water.

Testing follows the general rule—moisture content of any soil in earth's upper crust/near surface, range from zero to 0.5 of soil Plastic limit at approximate density 75 to 85% of MDD (Max Dry Density).

Testing for determination of Plastic Limit—Reference to ASTM—D4318-10, AASHTO T90 or BS-1377 standard procedure.

Mixing selected amount of Artificial Feldspar with rainwater. Amount of water—less than PL. Pouring the sample in closed glass container, to prevent air oxidation for at least 3 days. This will allow completion of initial and final setting time of calcite and calcium alumina silicate. Testing the sample for change in temperature with thermo couple thermometer (electronic) or laser thermo meter at 0 min, 15 min, 30 min, 1 hour, 3 hours, 6 hours, (12 hours—this reading can be skipped), 24 hours, 2 days, 3 days.

Performing microscopic, difractometry, with possible slides or spectroscopy, or other chemical analysis for formation (quantity/quality) of calcite or alumina silicate.

C. Calcification in Continue Flow & Batch Reactor to Produce Quasi-Natural or Artificial Very Low Radiation Level Feldspar.

The term—very low radiation level is used in this disclosure following the adopted fundamental rule to match the radiation level of the product to, or at least 5% below the radiation level of the host (Earth crust). The isotope concentration will be tune up to any selected for disposal location.

All CFR parameters are provided in "Part 7—JMF Protocol."

Testing times Δt (to be determined—achieve stable state equilibrium of Liquid>Gas>Solid with approximately 4 molecules of H2O per Feldspar unit.

Temperature (dT) and pressure (dP) relates to type of crystalline precursor. Process temperature (dT) relates to temperature formation of fly ash 1100 C (or any other industrial crystalline precursor). In this case reactor equilibrium temperature will be in the range of 1150 C or above (at no pressure). Application of pressure will accommodate the process of melting at significant low temperature range (as more economically feasible). These parameters are calculated using well known reactor chemical kinetics equations (Reference to Chemical Reactor kinetics).

For achieving proper reaction time between Fly ash and the liquid waste, need to be considering the following:

The fly ash need to be at the end of the Setting time of formation of Try Calcium Alumina Silicate packets, before introduction into the reactor. The process starts (Initial Setting Time) approximately 90 minutes after introduction of water. Indication of the process initiation is slide increase of the temperature, resulting formation of Try Calcium Alumina Silicate. As per literature data the Final Setting time for Fly Ash is in the range of 4 hours or more after liquid introduction. The process continues for approximately 16 hours, when the formation of Calcium Alumina Silicate is complete (packets formation—after this moment the mix start to gain compressive strength). Temperature reverse is indication for the completion of the Final Setting time (Other indicator is the process of coagulation that can visible be observe. After the 16 hour threshold the process continues with formation of Calcite (using any available in the mix access water), which is simple low temperature hydratation process of soft unstable Calcite. This means that the mixture in form of dense gel, need to be introduce into the reactor at approximately Final Setting time, when the of formation of Try Calcium Alumina Silicates crystalline packets containing attached trace elements of Actinides and Fission products is completed. The formed at this time small amount of unstable Calcite will be completely dissolve during thermal application in the reactor the water amount per unit Feldspar will be reduce to approximately 4 molecules per unit (Bowen reaction series of natural Feldspar formation). Reactor time need to be selected in such way to promote formation of twinning crystalline cluster (very common for Feldspar's), in order to obtain the required for Feldspar density structure. Tuning the reactor time ($\Delta t$) towards temperature ($\Delta T$) and pressure ($\Delta P$) is mater of practical justification instate of kinetic calculation (to many variables to assume—reference to Chemical Reactor kinetics).

Part 7

Nano-Flex Production Job Mix Formula Protocol

JMF Protocol for Production of Quasi-Natural or Artificial Very Low Radiation Level Feldspar Method and Process for JMF Adjustments Background This disclosure is applicable for any type of HLW, such as spent fuel, Depleted uranium, liquid or solid HLW in storage or coming from production (including but not limited to classified, medical, encapsulated in boric silicate HLW and etc), uranium mine tailings, nuclear accident spills, post nuclear detonation cleanups and toxic chemical or reactive HLW.

This protocol is based on radioactive nuclides inventory in spent LWR fuel sludge after 10 years decay (Ref. to Nuclear Chemical Engineering), but the structure is applicable to any one HLW type.

Selection of this decay time was based on the recommendation (Dr. Gary Sandquist PhD), that spent fuel age in storage in US is 10 years or older.

This disclosure provides methodology for future JMF adjustment, based on the type of spent fuel, reactor irradiation time, decay time and also for all other HLW types. Reference to these 3 key factors will be require determination of actual isotope inventory in the spent fuel, or other HLW in order to adjust the production JMF for production of quasi-natural or artificial very low radiation level Feldspar.

Recitals

This section represents practical steps for production JMF Protocol For future reference quasi-natural or artificial very low radiation level Feldspar will be referred as "the Product". The production protocol is in the following steps:

1. Selection of prospective site for quasi-permanent disposal or long term storage of the Product. As provided in this disclosure, the selection is based on economical factors rather than radiation restrictions—reference to Fumaroles, close for operations underground or open pit mine facilities, surface berms, dikes, trenches or other burials. Site selection in organic reach formations (peat), swamps, running surface water, or shallow ground water level is restricted.
2. Determination of natural isotopes inventory in selected for disposal prospective site. Need to be noted that post operations sample collection and testing is less reliable when compared to report-assembling from pre-operation or during operation sampling and testing. Such data is available when related to mine exploration in the mine record (requires for mine profit randeman tracking). Post operations sampling and testing is not reliable source, because the existing grade was exposed to long time surface deterioration and erosion transport. Use of such data usually resulting in wrong and misleading modeling. Taking new shallow bore hole sampling is expensive method, that cannot replace the data rich pre-operation and during operation sampling and testing record. At the end this issue will be left to the discretion of prospective facility owner. From mineralogical view need to be pointed that except the surface, Earth crust matrix since creation (5.5. billion years ago) is in continuous very slow metamorphosis transition, which is not effected in any meaning by the time frame of average human life length. Specifically Feldspars after starting with Bowen reaction series, and reaching equilibrium level of 8 molecules of water per unit, and not exposed to surface temperature gradient, UV, and erosion degradation, are and will be in stable equilibrium for very long geologic time. FIG. 12 indicates the relationship between Si atom and other metals and elements.
3. Determination of isotope inventory of the spent fuel, Depleted uranium, liquid or solid waste in storage or coming from the industry, nuclear accidents or post nuclear detonation cleanups, and at the end any toxic chemical and reactive HLW. This is requires from the basic emphasis in this disclosure, that the radiation level of the Product should match or be at least 5% below the natural radiation level of the host.
4. Preparation of combined isotope chart—natural versus activated. The biggest challenge is how to approach the issue with all "artificially" created isotopes, their daughters and all other activated products. Here need to be explained one fundamental misunderstanding in the nuclear science. In present time most of the nuclear scientists believed that two basic isotopes groups exist—natural and not natural. This question cannot stand and fell apart when the analysis spectrum is extended in the field of modern mineralogy, crystallography, sedimentology, and metamorphology and geo chemistry. Was already proven that in natural uranium were found traces from Plutonium and Americium, believed to be only artificially created. It is matter of time when traces of Curium also will be found. The situation with Fission product is much more complicated, where the daughter isotopes are mix crossing with other activated products such as Cobalt, Iron and etc. The assumption there, that most of them are only artificially created is also falling apart when we look into the natural reactor in Oklo-Gabon. First need to be noted that it is matter of time when other such natural phenomena will be discovered. Second, based on the chemical elements spectrum, that exist there, were also created Spectrum of natural Fission products—The natural reactor in Oklo was operating for period of 100 million years and created over 10 tons of Plutonium in the core. This Plutonium carries also certain amount of Americium and Curium. The conclusion is that there is no limitation in the list of natural Actinides and Fission products. The second issues, that remain unnoticed is the ration between the amounts of these Actinides and Fission products. It is known that all products based on the type of nuclear chain reaction (controlled in reactor core or un controlled after nuclear detonation) are in quantities equilibrium. In other words, the ration amount of these products remains in approximation equilibrium (very narrow variation). This fact was proven by available in the literature data for various spent fuel types. (In this disclosure were provided examples for spent fuel from West Valley—US and Areava—France). This discovered by the inventor rule was used as base for development of the JMF Protocol. Explained in other words means that taking certain amount of Uranium from spent fuel type in HLW, provide list and expected quantities of the rest of the Actinides and Fission products. Such simplified approach provide easy for practical purpose, ability for practical adjustment of the production JMF Protocol.

5. Once the inventory list of available in HLW Actinides and Fission products is completed, the next step is the determination of the isotopes amount and total activity in the Product. As was mentioned in paragraph 3 the product isotopes content should be equal or at least 5% below the isotopes content in the disposal host matrix.
6. For purpose of example this disclosure provide in Table 4 the quantities/activity of Actinides and Fission products for 5 kg, 10 kg, 50 kg and 100 kg of quasi-natural or artificial very low radiation level Feldspar for spent fuel of LWR after 10 years decay time. The method of calculations is applicable to any type and decay time of spent fuel, liquid or solid LHW in storage or in production, Depleted uranium, nuclear accident or after nuclear detonation cleanups and any toxic chemical or reactive HLW.
7. Mixing the liquid HLW sludge with predetermined quantity as directed in paragraph 5 and 6 of crystalline precursor (selected industrial by product to achieve formation of desire type of Feldspar—Sodium, Potassium, Calcium or Barium). Calculated for the Product very low radiation level indicate that no criticality issue exist, but for safety is recommended in case procedural mixing mistake is done. In this particular case as crystalline precursor was selected, available very wide and cheep Fly ash, to form Calcium Feldspar (no additional pre-process blending is requires).

| | Compounds | Weight % (average) |
|---|---|---|
| Fly Ash composition: | SiO2 | 52.59% |
| | Al2O3 | 19.98% |
| | CaO | 15.49% |
| | Fe2O3 | 7.39% |
| | MgO | 3.43% |
| | SO3 | 0.85% |
| | Other | 0.27% |

Technical report recommends other industrial by products, but some requires pre-process blending. The disclosure is open for selection of any other available industrial by product, matching the crystalline precursor properties (formation of crystalline Feldspar clusters).

Figure 35:
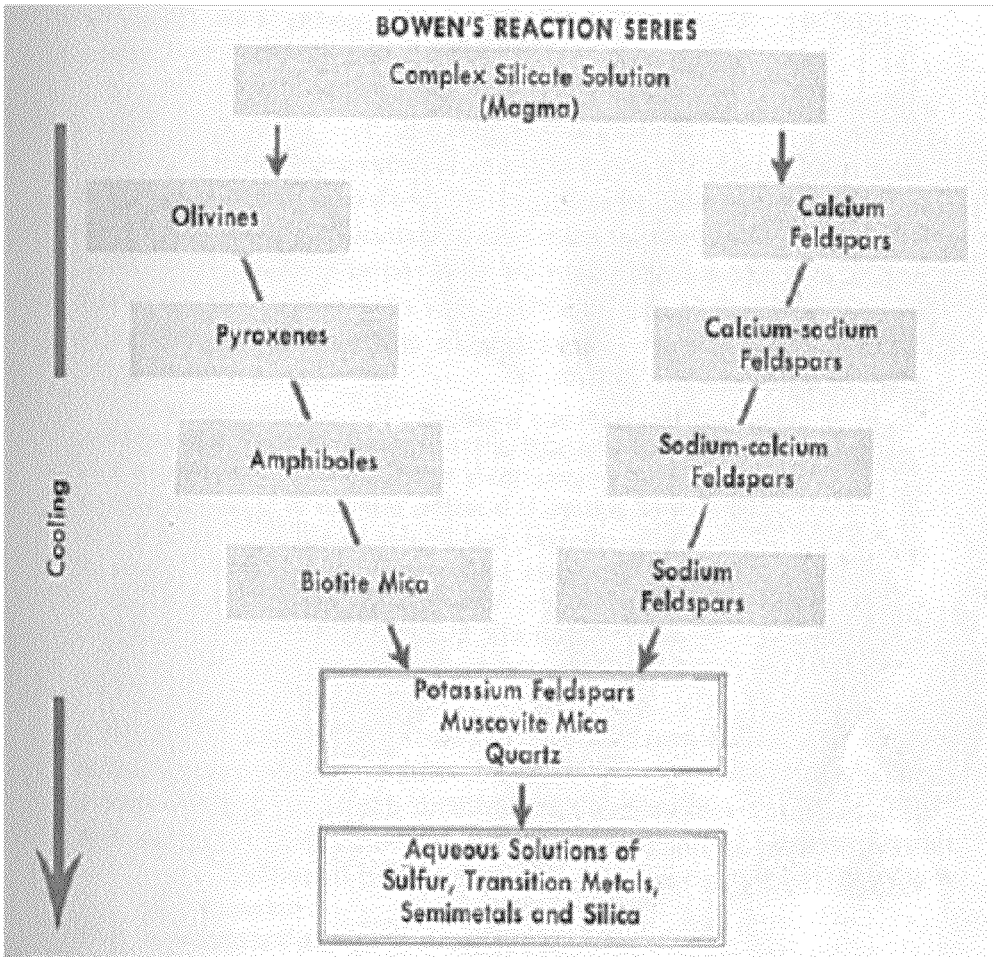

8. Observing Setting time for formation of Alumina Silicate clusters. In this particular case is Try Calcium Alumina Silicates. The actual Setting time for each Feldspar type requires laboratory determination. For this particular case of Calcium Feldspar this Setting time is 16 hours after liquid introduction. Oxidation prevention needs to be observed in case of Sodium and Potassium Feldspar. In the case of Calcium Feldspar, this issue is negligible.
9. Quantity controlled introduction in the Continue Flow Reactor (CFR) to achieve desire liquid>gas>solid equilibrium. Since the Bowen Reaction series determined that the temperature range for formation of Feldspars starts from and below 1400 C, selection of operating temperature is required. This process relates to production quantity and pre-determined reactor property. In general Feldspar solidification (calcification) relates to decision of using additional pressure to speed the process (reactor (dn,R) at (dP,dT) for period of dt) or process without pressure (reactor (dn,R) at dT for period of dt). Since both reactor equilibriums theoretically are very well established in the chemical engineering, this will be left to the production facility owner discretion. It is inventor's recommendation that for the case of Calcium Feldspar which stays at the top of the Bowen Reaction Series (FIG. 35), the production temperature should be in the range of 1150 C to 1200 C C but not less than 1100 C (Fly ash original formation temperature). Such temperature will assure Feldspar formation with reduced water content in the molecule—in nature after initial formation the water content in the Feldspar is around 4 atoms water per unit. This amount during extensive geologic time (over 100K years) of cooling via natural metamorphosis transition increases to 8 water atoms per unit—as all Feldspars found near Crust surface. Formation of the Product with such reduced water content will assure for very long period of geologic time (10,000 to over 100,000 years), that no solid or liquid transport will occur from the Product to the host. Following mass equilibrium law, a reverse transport from the host to the Product is anticipated. Such scheme was never practically achieved in all existing Technologies for HLW disposal.
10. This disclosure provides two theoretically identical, but practically very different types of CFR production facility—Fumaroles and Industrial CFR/batch reactors. Each facility is detail explained in patent application claims and drawings, including all post production and permanent disposal steps and methods. Fumaroles as very large natural phenomena has unlimited production and storage capacity—usually several miles length. The design there is limited to determination of convenient for remote assembly single production segment length (3 to 5 meters length). Different is the situation with industrial CFR type—requires pre determination of production capacity and owner willingness for size investment. Chemical engineering already develops very wide range of CFR type and technological complexity. Determination of this will be left to the discretion of facility owner.

TABLE 5

Natural Isotope Minerals

TABLE 5A

| Isotope Name | Mineral Name | Mineral Chemical Formula | Crystalin Structure |
|---|---|---|---|
| | | Fission products | |
| Kripton | gas | Gas | none |
| Strontium | Acuminite | SrAlF4OH•(H2O) | dipyramidal/mono |
| | Alsakharovite - | NaSrKZn(Ti,Nb)4(Si4O12)2(O,OH)4•7H2O | clinic |

TABLE 5-continued

| Natural Isotope Minerals | | | |
|---|---|---|---|
| | Zn | Sr(Ce,La)(CO3)2(OH)•(H2O) SrSO4 | cyclosilicates |
| | Ancylite | (PbSr)(U4+,U6+))Fe2+,Zn)(Ti,Fe2+,Fe3+)28(O,OH)38 | distorted cryctal |
| | Celestine | (Ca,Sr,Ce,Na)5(PO4)3 | orthohombic |
| | Cleusonite | Sr2Fe2+(Fe2+,Mg)2Al4(PO4)4(OH)10 SrCO3 | trygonal |
| | Fluorcaphite | SrAl3(PO4)(SO4)(OH)6 | hexagonal |
| | Lulzacite | Sr2B11O16(OH)5•H2O | Triclinic |
| | Strontianite | Na2(Sr,Ca)3Zr(CO3)6•3H2O | (pinacoidal) |
| | Svanbergite | K4(Ca,Na)14Sr2Mn(Ti,Nb)4(O,OH)4(Si6O17)2(Si2O7)3(H2O,OH)3 | Prismatic/ |
| | Veatchite | | hexagonal |
| | Weloganite | | Polymorphs |
| | Yuksporite | | hexagonal |
| | | | monoclinic |
| Zirconium | Zircon | ZrSiO4 Na2(Sr,Ca)3Zr(CO3)6•3H2O | hexagonal |
| | Baddelevite | | hexagonal |
| | Kosnarite | | |
| | total of 140 minerals | | |
| Techtenium | In Uranium ore; 1 kg Uranium contains 1 nanogram (E−9 g) as red grains known as techtenium stars | centrosymentric structure | Trygonal |
| Paladium | Braggite | (Pt,Pd,Ni)S PtS | Tetragonal |
| | Cooperite | (Pd,Pt)(Te,Bi)2 Pd2Sb | no description |
| | Merenskyite | Pd(Bi,Pb) PdCu | found trigonal |
| | Naldrettite | Pd5Sb2 Pd8As3 | Orthohombic |
| | Polarite | | Orthohombic |
| | Skaergaardite | | cubic grain |
| | Stibiopalladinite | | hexagonal |
| | Stillwaterite | | hexagonal |
| Tin | Abhurite, | Sn3O(OH)2Cl2, Ag8SnS6, | no description |
| | Canfieldite, | Sn02, Pb3Sn4FeSb2S14, | found cubic/ |
| | Cassiterite, | Pb5Sn3Sb2S14, | othohombic |
| | Cylindrite, | Cu2(Zn,Fe)SnS4 CaSnO(SiO4) | crystal twinn near |
| | Franckeite, | Cu2SnS3 Ba(SnTi)Si3O9 | 60 deg triclinic |
| | Kesternite | Cu2FeSnS4 PbSnS2 | pinacoidal |
| | Malayaite, | MnSn(BO3)12 (PtPd)NI)S | spherical |
| | Mohite | | no desctirption |
| | Pabsite | | found |
| | Stannite | | monoclinic |
| | Teallite | | prismatic |
| | Tusionite | | triclininc pedial |
| | Braggite | | hexagonal |
| | | | tetragonal |
| | | | orthohombic |
| | | | trygonal |
| | | | tetragonal |
| Cadmium | Greenockite | CdS | hexagonal |
| | Zink ore | up to 1.4% cadmium | dipyramidal |
| Iodine | Caliche | not available | trace element |
| Cesium | Avogardite, | (K,Cs)BF4 (Cs,KH3O)2(UO2)2V2O8 | orthohombic |
| | Galkhaite, | (Cs,TI)(Hg,Cu,Zn)6(As,Sb)4S12 | system, |
| | Margaritasite, | (Cs,Na)2Al2Si14,O12.2H2O Cs(Si2Al)O6•nH2O | monolcininc |
| | Pollucite | | isometric |
| | Zeolite | | |
| Samarium | Monacite, | inlcuded in rear earth | trigonal, |
| | Bastnasite, | | halides, monolcininc, |
| | Cerite, | | at 731 C. |
| | Gadolinite, | | changes to |
| | Samrskite | | hexagonal close |
| | | | packed; 922 C. - |
| | | | bodi centered |
| | | | cubic; 40 kbar - |
| | | | double hexagonal |
| | | | close packed; 900 kbar - |
| | | | teragonal; |
| | | | rapid change 400-700 C. - |
| | | | transient |
| | | | behaviour |
| Europium | rear earth | inlcuded in rare earth incorporated in plagioclase; when magma crystalize Eu will incorporate in mineral causing with higher concentartion and transmuted to non radioactive gadolinium | following plagioclase; with positive anomaly (when plagioclase |

TABLE 5-continued

| Natural Isotope Minerals | | | |
|---|---|---|---|
| | | | is missed) or negative anomaly - when plagiocalse is present in the rocks |
| Uranium | uranninite<br>billietite<br>soddyite<br>saleeite<br>coffinite<br>Davidite<br>Brannerite<br>Ganotite<br>Tyuyaminite<br>Autunite<br>Torbernite<br>Uranophane | UO2 Ba(UO2)6O4(OH)6•8(H2O)<br>(UO2)2SiO4•2(H2O) Mg(UO2)2(PO4)2•10(H2O)<br>U(Si)4)1−x(OH)4x<br>(Fe,Ce,La,Y,U,Ca,Zr,Th)(Ti,Fe,Cr,V)3(O,OH)<br>(U,Ca,Fe,Th,Y)3Ti5O16 K2(UO2)2(VO4)2•3H2O<br>Ca(UO2)2(VO4)2•5-8 H2O Ca(UO2)2(PO4)2•10-12 H2O<br>Cu(UO2)2(PO4)2•8-12 H2O Ca(UO2)2<br>SiO3(OH02•5H2O | isometric<br>orthohobic<br>no data<br>monoclinic<br>tetragonal |
| Actinides | | | |
| Plutonium | trinitite | melting feldspar and quartz | no data |
| Cerium | allanite<br>monacite<br>bastnasite<br>h-bastanite<br>rhabdophane<br>synchysite | (Ca,Ce,LaY)2(Al,Fe)3)SiO4)3(OH)<br>(Ce,La,Th,Nd,Y)PO4 (Cw,La,Y)CO3F<br>(Ce,La,Nd)CO3(OH,F) (Ce,La,Nd)PO4•H2O<br>Ca(Ce,La,Nd,Y)(CO3)2F | face centered cubic |
| Americium | none | traces found in uranium - neutron capture | |

TABLE 5B

| Isotope Name | Natural a/o | Density g/kg | Special Property | Toxicity |
|---|---|---|---|---|
| Fission products | | | | |
| Kripton | 0.00014 | 3.64 | | none |
| Strontium | worldwide<br>370 PPM/weight<br>87 PPM by moles | 3.295<br>3.95<br>3.97<br>4.74<br>3.55<br>3.74<br>3.78<br>3.2 | Fluorcaphite is naturaly radioactive.<br>Strontianite is member of aragonite group (Ca mineral group).<br>Svanbergite occurs in high Al grade media | |
| Zirconium | 130 mg/kg - crust 0.026 mg/l - sea | 3.2 | | human body - ev 1 mg. Daily intake 50 mg/day. In blood only 10 PPB. Aquatic plants intake Zirconium. Land plants - no (ave content of 5 PPB). Zirconium is used in sand paper or abrasive weels |
| Techtenium | 1E−9 g,<br>0.2 ng/kg<br>Belgian Congo (1962), Oklo phenomena - Gabon | | at 400-450 C. oxidizes to form pale - yellow heptoxide 2Tc2O7 and with hidrogen reduction will convert to black dioxide TcO2 | Forming numerous organic complexes - used in nuclear medicine, but have very low toxicity |
| Paladium | 35.9 -West Transvaal<br>S. Africa<br>Greenland<br>Canada<br>Finland | 9.83<br>no data<br>8.547<br>10.694<br>12.51<br>10.64 | | |
| Tin | | 4.3<br>5.4<br>6.28<br>6.4 | Cassiterit - associated with quartz veins with tourmaline, topaz, fluorite, apatite, molybdenite, arsenopyrite; Kesterite - associate with arsenopyrite, stannoidite, | |

TABLE 5-continued

| Natural Isotope Minerals | | | | |
|---|---|---|---|---|
| | | | chalcopyrite, chalcocite, spahlerite, tennantite | |
| Cadmium | 0.1 to 0.5 PPM - crust; 0.11 PPM - ocean; natural source are forest fires and vulcano; soil - 4 PPM | | | inhalation of cadmium fumes is toxic OSHA - 0.05 mg/m3; NIOSH - 9 mg/m3 |
| Iodine | 0.05 PPM - sea; 0.04 PPM in rocks | | very poor water solubility 1 g per 3450 ml at 20 C. - hydroiodic acid, potasium iodine and etc. | very high oxidiser; 2-3 g intake is letal. Permissible air concentration 1 mg/m3 |
| Cesium | 20% at Bernic Lake-Manitoba | 2.9<br>3.0 | Pollucite-zeolite mineral - associates with quartz, spodumene, petalite, amblygonite, lepidolite, elbaite, cassiterit, columbite, apatite, eucryptite, muscovite, albite and microcline | |
| Samarium | 25.75, natural concentration varies from 2 PPM to 23 PPM, ave 8 PPM; in oceans from 0.5PPT to 0.8 PPT, in sandy soils 200 times higher, in clays can ecced 1000 times, in monacite up to 2.8% | | at 150 C. - spotaneous ignitin, when stored at room temperature gradualy oxidizes. Naturaly occuring samrium has radiaoactivity of 128 Bq/g | Total normal content in adults - 50 mcg - in liver and kidney, 8 mcg in the blood, not absorbed in plants. When ingested only 0.05% is absorbed in blood, the rest is escreted. From the blood 45% stay in the liver and 45% in boon surface and stay there for 10 years, the rest 10% is excreted |
| Europium | | | | level of toxicity over 550 mg/kg acute dose at 3000 mg/kg, Rapid disolution in sulfuric acid |
| Uranium | | 10.63<br>3.27<br>5.1 | | |
| Actinides | | | | |
| Plutonium | artificial | | Oklo - Gabon - 10 tons | toxic if ingested |
| Cerium | 136 Ce - 0.185%<br>138 Ce - 0.251%<br>140 Ce - 88.45% 142 Ce - 11.114% ave 0.0046% | | at −16 C. γ-cerium changes to β-cerium; at −172 C. γ-cerium changes to α-cerium; at −269 C. α-cerium transformation is completed. Burn at +150 C. | |
| Americium | n/a | | | Am243- radiation emitter can cause cancer |

TABLE B.1

| Typical Uranium Concentrations | |
|---|---|
| Medium | Average Concentration (ppm U) |
| High-grade ore | 20,000 |
| Low-grade ore | 1,000 |
| Granite | 4 |
| Sedimentary rock | 2 |
| Earth's continental crust | 2.8 |
| Seawater | 0.003 |

TABLE 7

Chemical Properties of Isotopes

TABLE 7A

| Name | Atomic Number | Atomic Mass g · mol−1 | Electro negativity | Density g · cm−3 | Melting point C. | Boiling point C. |
|---|---|---|---|---|---|---|
| Nitrogen | 7 | 14.0067 | 3 | 1.25E−03 | −210 C. | −198.8 C. |
| Actinides | | | | | | |
| Uranium | 92 | 238 | 1.38 | 19.1 | 1132.2 C. | 4131 C. |
| Plutonium | 94 | 244 | unknown | 19.84 | 641 C. | 3232 C. |
| Americium | 95 | 243 | unknown | 13.67 | 994 C. | 2607 C. |
| Curium | 96 | 247 | unknown | 13.51 | 1340 C. | unknown |
| Fission products | | | | | | |
| Tritium | 1 | 1.00783 | 2.1 | 8.99E−05 | −259.2 C. | −252.8 C. |
| Krypton | 36 | 83.8 | n/a | 3.73 | −157 C. | −153 C. |
| Strontium | 38 | 87.62 | 1 | 2.6 | 769 C. | 1384 C. |
| Zirconium | | | | | | |
| Niobium | 41 | 92.91 | unknown | 8.4 | 2410 C. | 5100 C. |
| Technetium | 43 | 99 | 1.9 | 11.5 | 2200 C. | 4877 C. |
| Palladium | 46 | 106.42 | 2.2 | 11.9 | 1560 C. | 2927 C. |
| Cadmium | 48 | 112.4 | 1.7 | 8.7 | 321 C. | 767 C. |
| Tin | 50 | 118.69 | 1.8 | 5.77 (alpha) 7.3 (beta) | 232 C. | 2270 C. |
| Antimony | 51 | 121.75 | 1.9 | 6.685 | 631 C. | 1380 |
| Iodine | 53 | 126.905 | 2.5 | 4.93 | 114 C. | 184 C. |
| Cesium | 55 | 132.905 | 0.7 | 1.9 | 28.4 C. | 669 C. |
| Samarium | 62 | 150.35 | 1.2 | 6.9 | 1072 C. | 1790 C. |
| Europium | 63 | 167.26 | 1.2 | 9.2 | 1522 C. | 2510 C. |

TABLE 7B

| Name | Radi nm | Ionic radius nm | Isotopes | Rays | Electron shell | Natural occurrence |
|---|---|---|---|---|---|---|
| Nitrogen | 0.092 | 0.171 (−3) 0.011 (+5) 0.016 (+3) | 4 | | [He]2se32pe3 | 78% |
| Actinides | | | | | | |
| Uranium | 156 pm | | 6 | α | [Rn]5f3 6d1 7s2 | 238 > 99,2752% 235 > 0.7202% 234 > 0.0059% 51 st most abundant element |
| Plutonium | unknown | unknown | 11 | α | [Rn]5f67s2 | trace in U 238 |
| Americium | unknown | unknown | 8 | α | [Rn]5f77s2 | trace in U 238 |
| Curium | unknown | unknown | 10 | α | [Rn]5f76d17s2 | trace in U238 |
| Fission products | | | | | | |
| Tritium | 0.12 | 0.208 (−1) | 3 | | | 0.15% of earth crust, in water 0.5 ppm.14% of any biomass |
| Krypton | 0.197 | | 15 | | [Ar]3d104s24p6 | 1 ppm in air |
| Strontium | 0.215 | 0.113 | 14 | | [Kr]5s2 | 0.03% |
| Zirconium | | | | | | |
| Niobium | 0.143 | 0.070 (+5) 0.069 (+4) | 14 | | | 0.45 to 1 ppm |
| Technetium | 0.128 | | 9 | γ | [Kr]4d65s1 | trace in Uranium 238 |
| Palladium | 0.137 | 0.065 (+2) | 9 | | [Kr]4d105s0 | specimet found in Brazil also with nickel, copper, platinum |
| Cadmium | 0.154 | 0.097 (+2) | 15 | | [Kr]4d105s2 | in crust with zink, lead and copper |
| Tin | 0.162 | 0.112 (+2) 0.070 (+4) | 20 | | [Kr]4d105s25p2 | 1-4 ppm in soil 300 ppm in peats cassiterite |
| Antimony | 0.159 | 0.245 (−3) 0.062 (+5) 0.076 (+3) | 12 | | [Kr]4d105s25p3 | total 0.00002% of eart crust |
| Iodine | 0.177 | 0.216 (−1) 0.05 (+7) | 15 | | [Kr]4d105s25p5 | found in air, water and soil sea releases 400,000 tons per year into the air later deposited in soil |

TABLE 7-continued

| Chemical Properties of Isotopes | | | | | |
|---|---|---|---|---|---|
| | | | | | iodine mineral-iodargyte |
| | | | | | in nature up to 100 ppm |
| Cesium | 0.267 | 0.167 | 12 | [Xe]6s1 | occur naturaly (from errosion) |
| | | | | | released in air, soil and water |
| Samarium | unknown | unknown | 11 | [Xe]4f66s2 | 5th most abandone rare element |
| | | | | | monazite, bastnasite, samarskite |
| | | | | | ignites when heated above 150 C. |
| Europium | unknown | unknown | 9 | [Xe]4f126s2 | less abandone rare element (as tin) |

TABLE 7C

| Name | Health effect | Environmental effect |
|---|---|---|
| Nitrogen | as Nitrates negative<br>NO - positive<br>N gas - sification | very weak α emitter |
| Actinides | | |
| Uranium | DU - poisoning form U oxyde<br>in soil - 0.7 to 11 (15)PPM<br>in plants 5-60 PPM<br>Atabasca - Canada in ore 23% | poison if inhaled/ingested<br>effecting birth edfects, imune system<br>Radon (daughter) major health risk<br>Uranium is fire hazard |
| Plutonium | very low toxic<br>natural Ra - x200 more toxic<br>α - skin irritation,<br>ingestion - lung cancer | very slow moving downwards<br>plants absorb Pu, but no<br>significant effect to food<br>chain |
| Americium | moves rapidly in the body<br>concentrated in bones for<br>long time<br>cause genetic mutation | release in air in 1963<br>will remain long in the air<br>in plants - small amout and animals<br>that are not consume |
| Curium | after ingestion only 0.05%<br>retain in the body - bloodstream<br>45% in the liver, and bones<br>toxic only ingested/inhalation | soil concentration - 4000 time higher<br>than water, in clays can reach 18,000<br>after 1960 in air tests remain in air |
| Fission products | | |
| Tritium | extremely flamable. High<br>concentration<br>cause oxygen deficiency-headache,<br>ringing<br>ears, unconsciousness, vomiting<br>effect to aquatic life - no evidence | most flamable.slightly more soluble in<br>organic than in water. |
| Krypton | inhaled - cause dizziness, nausea<br>vomitin, at concentration of 33%<br>cause asphyxia. | no loong term ecology effect<br>disposal - very slowly<br>stable at low T only |
| Strontium | mineral celestite, strontianite<br>food contain - corn0.4 ppm<br>orange 0.5 ppm, cabbage 45 ppm<br>onion 50 ppm, lattuce 74 ppm<br>only danger is strontium chromate -<br>cause lung cancer, alergy, bone<br>growth<br>skin rishes | water soluble, exposure from dust<br>food, water or contact.<br>mostly in soil, and less in water<br>can end in fish, vegetables, livestock<br>decay to stable zirconium |
| Zirconium | | |
| Niobium | skin irritation, no reprot of poisoning<br>when inhaled retain in lungs and<br>bones<br>interferes with calcium as activator<br>of enzime system<br>at 40 mg/m3 scarring the lungs | no negative effect |
| Technetium | at 55 ppm protect steel form corrosion<br>99T is contamination hazard<br>use widely in medica isotope testing | little Technetium escapes in<br>environment<br>via its use in medical diagnosis<br>superconductor at 11K |
| Palladium | cause skin and eye irritation<br>as liquid burn skin<br>Palladium chloride is toxic when<br>inhaled, ingestedor skin contact<br>use as pills for tuberculosis at<br>rate 0.065 g/day (1 mg/kg) | absorb Hydrogen - 900 times its volume<br>Palladium is "white gold" in juwelry<br>catalic converters |
| Cadmium | cause Diarrhoea, stomach pain,<br>vomiting<br>bone fracture, reproduction failure<br>damage central nervous system | Mainly in waste stream - industrial and<br>household, from fuel combustion,<br>fertilizers<br>Plants uptake cadmium |

TABLE 7-continued

| Chemical Properties of Isotopes | | |
|---|---|---|
| | damage immune system, phychological disorders, DNA and cancer accumulates in kidney, effect high bloodpressure, liver, nervebrain damage | Deadly to eartwarms & microorganisms accumulates in mussels, oysters, shrims, lobsters and fish |
| Tin | Accute - eye, skin irritation, headache stomachache, sickness, dizziness sevear sweling, breathlessness, urination Long term - depression, liver damage, imune system, chromosom damage shortage of red blood cells, brain damage | insoluble, as single atom is not very toxic In organic form - very toxic great harm to ecosystem, toxic to fungi and phytoplankton Organic tin disturb growth, reproduction, enzimatic system and feeding paterns main exposure in top water layer |
| Antimony | inhalation of 9 mg/m3 for long time cause irritaion of eyes, skin and lungs cause lung disease, heart problems diarrhea, sevear vomiting and ulcers unknown to cause cancer, or reporduction use in medicine - parasital infection | found in soil, water, air in small amounts travel great distance in water toxic and deadly to animals |
| Iodine | promote thyroid, nervous system and metabolism, Elemental iodine is toxic air concentration - up to 1 mg/m−3 Access intake is toxic 131 I - cause thyroid cancer | in organic form remain for long time - plants from there is entering food chain Only one isotope is long lived and of environmental consern |
| Cesium | high dose - toxic to animals radiactive cesium detected in food and top soil - released from accidents cell damage, nausea, vomiting, diarrhoea bleeding. Long exposure - lose of consciousness or coma | in air travel long distance easy water solluble, but remain in soil-no trasfer |
| Samarium | has no biological role stimulate metabolism ingestion - mildle toxicity cause skin and eye irritation | do not poses any treat to plants or anymals |
| Europium | has no biological role ingestion - mildle toxicity, but not investigated | do not poses any treat to plants or anymals metal dust present fire and explosion hazard |

The invention claimed is:

1. A method for processing toxic material, comprising:

forming quasi-natural feldspar or artificial feldspar having a chemical formula of $Ca(Al,Si)O_2$ with a toxic material, the quasi-natural or the artificial feldspar having a toxicity level equal or below an average toxicity level in a natural feldspar material present at a host site where the quasi-natural feldspar or the artificial feldspar will be permanently stored.

2. The method of claim 1, wherein forming comprises forming the quasi-natural feldspar or the artificial feldspar with the toxic material comprising a radioactive material.

3. The method of claim 2, wherein forming comprises forming the quasi-natural feldspar or the artificial feldspar with the radioactive material in liquid form or solid form.

4. The method of claim 2, wherein forming comprises forming the quasi-natural feldspar or the artificial feldspar with the radioactive material comprising depleted uranium.

5. The method of claim 2, wherein forming comprises forming the quasi-natural feldspar or the artificial feldspar with the radioactive material comprising medical radioactive material or other classified radioactive material.

6. The method of claim 2, wherein forming comprises forming the quasi-natural or the artificial feldspar with radioactive material comprising radioactive materials from a nuclear incident.

7. The method of claim 2, wherein forming comprises forming the quasi-natural or the artificial feldspar with the radioactive material comprising radioactive materials resulting from a nuclear detonation.

8. The method of claim 1, wherein forming comprises forming the quasi-natural feldspar or the artificial feldspar with the toxic materials comprising a toxic chemical or a reactive material.

9. The method of claim 1, wherein forming comprises forming the quasi-natural feldspar or the artificial feldspar with the toxic material comprising mine tailing material.

10. The method of claim 1, wherein forming the quasi-natural feldspar or the artificial feldspar comprises subjecting a job mix formula, including precursors for the quasi-natural feldspar or the artificial feldspar and the toxic material, to a temperature of at least about 1,100° C.

11. The method of claim 10, wherein forming the quasi-natural feldspar or the artificial feldspar comprises subjecting the job mix formula to the temperature of at least about 1,100° C. for about four hours or more.

12. The method of claim 11, wherein subjecting the job mix formula to the temperature of at least about 1,100° C. for about four hours or more comprises introducing the job mix formula into a continuous flow reactor.

13. The method of claim 1, wherein forming the quasi-natural feldspar or the artificial feldspar comprises subjecting the job mix formula to a temperature of about 800° C. to about 1,400° C.

14. The method of claim 13, wherein forming the quasi-natural feldspar or the artificial feldspar comprises subjecting the job mix formula to the temperature of about 800° C. to about 1,400° C. for about four hours or more.

15. The method of claim 14, wherein subjecting the job mix formula to the temperature of about 800° C. to about 1,400° C. for about four hours or more comprises introducing the job mix formula into a continuous flow reactor.

16. A method for processing toxic material, comprising:

designing a job mix formula, including fly ash, for making an artificial feldspar having a chemical formula of $Ca(Al,Si)O_2$;

mixing the job mix formula with a toxic material to provide a mixture having a toxicity level equal to or below an average toxicity level in a natural feldspar material present at a host site where the artificial feldspar will be permanently stored;

introducing the mixture into a continuous flow reactor to form the artificial feldspar.

17. The method of claim 16, wherein introducing the mixture into the continuous flow reactor comprises exposing the mixture to a temperature of about 800° C. to about 1,400° C.

18. The method of claim 17, wherein introducing the mixture into the continuous flow reactor comprises exposing the mixture to a temperature of at least about 1,100° C.

19. The method of claim 16, further comprising:

leaving the mixture in the continuous flow reactor for about four hours or more.

20. A method for processing toxic material, comprising:

designing a job mix formula, including fly ash, for making an artificial feldspar having a chemical formula of $Ca(Al,Si)O_2$;

mixing the fly ash and other components of the job mix formula with a toxic material to provide a mixture having a toxicity level equal to or below an average toxicity level in a natural feldspar material present at a host site where the artificial feldspar will be permanently stored;

introducing the mixture into a continuous flow reactor to heat the job mix formula and the toxic material to a temperature of at least about 1,100° C. to form the artificial feldspar; and rapidly cooling the artificial feldspar, with a coating of silicon dioxide forming on each particle or piece of the artificial feldspar while rapidly cooling the artificial feldspar.

* * * * *